US006917774B2

(12) United States Patent
Terada et al.

(10) Patent No.: US 6,917,774 B2
(45) Date of Patent: Jul. 12, 2005

(54) PROCESS CARTRIDGE MOUNTING AND DEMOUNTING MECHANISM INCLUDING A GUIDE TO BE POSITIONED, A PROCESS CARTRIDGE DETACHABLY MOUNTABLE TO ELECTROPHOTOGRAPHIC IMAGE FORMING APPARATUS INCLUDING A GUIDE TO BE POSITIONED OR A CARTRIDGE POSITIONING PORTION, AND THE ELECTROPHOTOGRAPHIC IMAGE FORMING APPARATUS

(75) Inventors: Ichiro Terada, Nabari (JP); Shinya Noda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/098,289

(22) Filed: Mar. 18, 2002

(65) Prior Publication Data

US 2002/0181969 A1 Dec. 5, 2002

(30) Foreign Application Priority Data

Mar. 16, 2001 (JP) ..... 2001-075842

(51) Int. Cl.[7] ..... G03G 15/00
(52) U.S. Cl. ..... 399/111
(58) Field of Search ..... 399/107, 109–114

(56) References Cited

U.S. PATENT DOCUMENTS

| | | | | |
|---|---|---|---|---|
| 5,331,372 A | | 7/1994 | Tsuda et al. | 355/200 |
| 5,404,198 A | | 4/1995 | Noda et al. | 355/200 |
| 5,463,446 A | | 10/1995 | Watanabe et al. | 355/200 |
| 5,470,635 A | | 11/1995 | Shirai et al. | 428/131 |
| 5,475,470 A | | 12/1995 | Sasago et al. | 355/210 |
| 5,488,459 A | | 1/1996 | Tsuda et al. | 355/211 |
| 5,510,878 A | | 4/1996 | Noda et al. | 355/211 |
| 5,579,098 A | * | 11/1996 | Noguchi et al. | 399/122 |
| 5,583,613 A | | 12/1996 | Kobayashi et al. | 355/200 |
| 5,602,623 A | | 2/1997 | Nishibata et al. | 399/111 |
| 5,608,509 A | | 3/1997 | Shirai et al. | 399/351 |
| 5,614,996 A | * | 3/1997 | Tanda | 399/120 |
| 5,623,328 A | | 4/1997 | Tsuda et al. | 399/111 |
| 5,640,650 A | | 6/1997 | Watanabe et al. | 399/117 |
| 5,669,042 A | | 9/1997 | Kobayashi et al. | 399/111 |
| 5,749,027 A | | 5/1998 | Ikemoto et al. | 399/113 |
| 5,774,766 A | | 6/1998 | Karakama et al. | 399/111 |
| 5,828,928 A | | 10/1998 | Sasago et al. | 399/111 |
| 5,842,093 A | * | 11/1998 | Tanda | 399/263 |
| 5,878,310 A | | 3/1999 | Noda et al. | 399/117 |
| 5,890,036 A | | 3/1999 | Karakama et al. | 399/119 |

(Continued)

FOREIGN PATENT DOCUMENTS

| | | | |
|---|---|---|---|
| EP | 0 854 393 | * | 7/1998 |
| JP | 4-333066 | | 11/1992 |
| JP | 6-43702 | | 2/1994 |
| JP | 7-199568 | | 8/1995 |
| JP | 10-240103 | | 9/1998 |
| JP | 2875203 | | 1/1999 |

*Primary Examiner*—Quana Grainger
(74) *Attorney, Agent, or Firm*—Fitzpatrick, Cella, Harper & Scinto

(57) ABSTRACT

A process cartridge mounting and demounting mechanism detachably mounts a process cartridge to a main assembly of an electrophotographic image forming apparatus. The mechanism includes an opening through which the process cartridge is mounted and demounted; an opening and closing member for opening and closing the opening; a cartridge mounting member for demountably mounting the process cartridge; and a mounting member holder for movably holding the cartridge mounting member in interrelation with an operation of the opening and closing member at a first position in which the process cartridge is detachably mountable with the opening and closing member being in an open state and at a second position in which the process cartridge is capable of operation for image formation with the opening and closing member being in a closing state.

31 Claims, 67 Drawing Sheets

U.S. PATENT DOCUMENTS

| | | | | |
|---|---|---|---|---|
| 5,899,602 | A | 5/1999 | Noda et al. | 399/111 |
| 5,920,752 | A | 7/1999 | Karakama et al. | 399/111 |
| 5,930,562 | A | 7/1999 | Noda et al. | 399/114 |
| 5,943,528 | A | 8/1999 | Akutsu et al. | 399/110 |
| 6,115,565 | A | 9/2000 | Noda | 399/102 |
| 6,185,390 | B1 | 2/2001 | Higeta et al. | 399/90 |
| 6,201,935 | B1 | 3/2001 | Terada et al. | 399/13 |
| 6,208,818 | B1 | 3/2001 | Noda | 399/111 |
| 6,229,974 | B1 | 5/2001 | Noda | 399/111 |

* cited by examiner (A)

(B)

(C)

PROCESS CARTRIDGE MOUNTING AND DEMOUNTING MECHANISM INCLUDING A GUIDE TO BE POSITIONED, A PROCESS CARTRIDGE DETACHABLY MOUNTABLE TO ELECTROPHOTOGRAPHIC IMAGE FORMING APPARATUS INCLUDING A GUIDE TO BE POSITIONED OR A CARTRIDGE POSITIONING PORTION, AND THE ELECTROPHOTOGRAPHIC IMAGE FORMING APPARATUS

FIELD OF THE INVENTION AND RELATED ART

The present invention relates to an electrophotographic image forming apparatus, a process cartridge removably mountable in an electrophotographic apparatus, and a process cartridge mounting/dismounting mechanism.

Here, the electrophotographic image forming apparatus forms an image on a recording material through an electrophotographic image formation type process. Examples of the electrophotographic image forming apparatus include an electrophotographic copying machine, an electrophotographic printer (laser beam printer, LED printer or the like), the facsimile machine, a word processor or a complex machine (multi function printer or the like) or the like.

The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Or, it may be a cartridge containing integrally at least developing means and an electrophotographic photosensitive member, the cartridge being detachably mountable to a main assembly of an image forming apparatus.

In an electrophotographic image forming apparatus using the electrophotographic image forming process, use has been made of the process cartridge type in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type, the maintenance operation can be carried out in effect by the users without the necessity of relying on serviceman, and therefore, the operability is improved. Therefore, the process cartridge type machines are widely used in the field of the image forming apparatus.

In order to provide satisfactory images by the electrophotographic image forming apparatus using such a process cartridge, it is necessary that the process cartridge is mounted at a predetermined position in the main assembly of the electrophotographic image forming apparatus to establish a correct connection of the interface portions, such as various electrical contacts and a drive transmitting portion.

Referring first to FIG. 60 and FIG. 61, there are shown a process cartridge PC (FIG. 60) and a guide groove GL provided in the main assembly PR of the image forming apparatus (FIG. 61). FIG. 62 shows an image forming apparatus employing of such a process cartridge PC.

As shown in FIGS. 60–62, in the mounting-and-demounting of the process cartridge PC relative to the main assembly PR of the image forming apparatus, a positioning boss CB is provided on the axis of an electrophotographic photosensitive member in the form of a photosensitive drum provided in the process cartridge PC, and on the other hand, the main assembly PR of the image forming apparatus is provided with a guide groove GL for guiding and positioning the positioning boss CB of the process cartridge. When the user inserts the process cartridge PC along the guide groove GL (cartridge mounting guide) to a predetermined position, an abutting portion P provided on the main assembly PR of the image forming apparatus is abutted to the process cartridge PC to prevent rotation about the positioning boss CB. The apparatus of such a structure has been put into practice.

Further, an image forming apparatus, the main assembly PR of which is provided with springs for keeping a process cartridge PC pressured in the process cartridge mounting direction after the mounting of the process cartridge PC in the main assembly, has been devised, and has been put to practical use.

Further, referring to FIG. 62, there has been also devised an image forming apparatus, in which an under cover UC, conforming in configuration to the external form of the process cartridge PC, is secured to the inward side of the opening/closing cover C. In this case, as the opening/closing cover C is closed, the process cartridge PC is pushed into the correct position.

With the opening/closing cover closed after the mounting of a process cartridge into an image forming apparatus employing a process cartridge pressing means such as the above described one, the process cartridge remains under the pressure generated by the pressure generating means. Thus, if the pressure generated by the pressure generating means is substantial, there is a possibility that the pressure generating means, and/or the portion of the process cartridge directly subjected to the pressure from the pressure generating means, will creep.

On the contrary, unless the pressure generating means is enabled to generate a certain amount of pressure, there is a possibility that as a user closes the opening/closing cover, the process cartridge stops before it reaches the position in which the process cartridge is to be mounted.

Generally, a process cartridge comprises a cleaning unit and a development unit. The two units are connected to each other so that they can be pivoted relative to each other. Further, it is structured so that the two units are kept pressured toward each other to keep stable the positional relationship between the photoconductive drum and development roller. Thus, it is only one of the two units that is directly supported by the image forming apparatus main assembly. In most cases, it is the cleaning unit which supports the photoconductive drum, the position of which relative to the other components of an image forming apparatus must be accurately maintained. Therefore, the other unit, or the development unit, remains suspended by the directly supported unit, in the image forming apparatus main assembly.

In order to keep the process cartridge in the above described state pressured by the pressure generating means attached to the opening/closing cover, the unit to which pressure is applied by the pressure generating means must be the unit directly supported by the image forming apparatus main assembly, for the following reason. If pressure is applied to the suspended unit by the pressure generating unit, the state of the contact between the photoconductive drum in one unit, and the development roller in the other unit is affected. Thus, in order to prevent the pressure applied to the suspended unit from affecting the state of the contact between the photoconductive member and development roller, the pressure applied to the suspended unit by the pressure generating means must be restricted in terms of where on the suspended unit the pressure is applied, and also in strength.

Further, regarding the under cover UC configured to match the external form of the process cartridge and attached to the inward side of the opening/closing cover, after the completion of the mounting of the process cartridge, a certain amount of a gap has to be present between the under cover UC and process cartridge. Moreover, in consideration of the tolerances in the measurements of the process cartridge and the apparatus main assembly, there is provided a certain amount of a gap between the process cartridge and the apparatus main assembly. Therefore, there is the problem that the process cartridge fails to be pushed into the correct mounting position.

The present invention is a result of the further development of the above described prior arts regarding an image forming apparatus.

SUMMARY OF THE INVENTION

The primary object of the present invention is to provide a process cartridge, an electrophotographic image forming apparatus in which a process cartridge is removably mountable, and a process cartridge mounting/dismounting mechanism, which are superior in the operability in the mounting of a process cartridge into the image forming apparatus main assembly.

Another object of the present invention is to provide a process cartridge automatically mountable into the correct process cartridge position, an electrophotographic image forming apparatus, into the process cartridge position of which a process cartridge is removably and automatically mountable, and an automatic process cartridge mounting/dismounting mechanism.

Another object of the present invention is to provide a process cartridge, the mounting of which into the process cartridge position in the apparatus main assembly is linked to the closing movement of the opening/closing member, an electrophotographic image forming apparatus, into the process cartridge position of which a process cartridge is mounted by the closing movement of the opening/closing member, and a process cartridge mounting/dismounting mechanism, the process cartridge mounting operation of which is linked to the closing movement of the opening/closing member.

Another object of the present invention is to provide a process cartridge automatically mountable into, or dismountable from, the correct process cartridge position, an electrophotographic image forming apparatus, into which, or from which, a process cartridge is removably and automatically mountable to a process cartridge position, or dismountable from a process cartridge position, and an automatic process cartridge mounting/dismounting mechanism.

Another object of the present invention is to provide a process cartridge, an electrophotographic image forming apparatus in which a process cartridge is removably mountable, and a process cartridge mounting/dismounting mechanism, which are superior in operability in the mounting of a process cartridge into the image forming apparatus main assembly, or the dismounting of the process cartridge from the image forming apparatus main assembly.

Another object of the present invention is to provide a process cartridge mounting/dismounting mechanism, the process cartridge mounting or dismounting operation of which is linked to the closing or opening movement of the opening/closing member, a process cartridge compatible with such a process cartridge mounting/dismounting mechanism, and an electrophotographic image forming apparatus in which such a process cartridge is removably mountable.

Another object of the present invention is to provide a process cartridge mounting/dismounting mechanism, the process cartridge mounting or dismounting operation of which is linked to the closing or opening movement of the opening/closing member, and which is capable of reliably supporting a process cartridge in the image formation position, and a process cartridge compatible with such a mechanism, and an electrophotographic image forming apparatus in which such a process cartridge is removably mountable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS:

The preferred embodiments of the process cartridge mounting mechanism (process cartridge mounting-and-demounting mechanism) and the process cartridge according to the present invention will be described in conjunction with the accompanying drawings.

In the following descriptions, the longitudinal direction of a process cartridge is a direction in which a process cartridge is mounted to or dismounted from the main assembly of the apparatus (substantially perpendicular thereto), which is substantially parallel with the surface of the recording material and crossing with (substantially perpendicular to) a feeding direction of the recording material. The "left" and "right" directions are the left and right directions as the recording material is seen from the top in the feeding direction of the recording material. The top or upper surface or side of the process cartridge is the surface or side which takes an upper position when the process cartridge is mounted to the main assembly of the apparatus, and the bottom surface or side is the surface or side which takes a lower position when the process cartridge is mounted to the main assembly of the apparatus, respectively.

Figure 1:
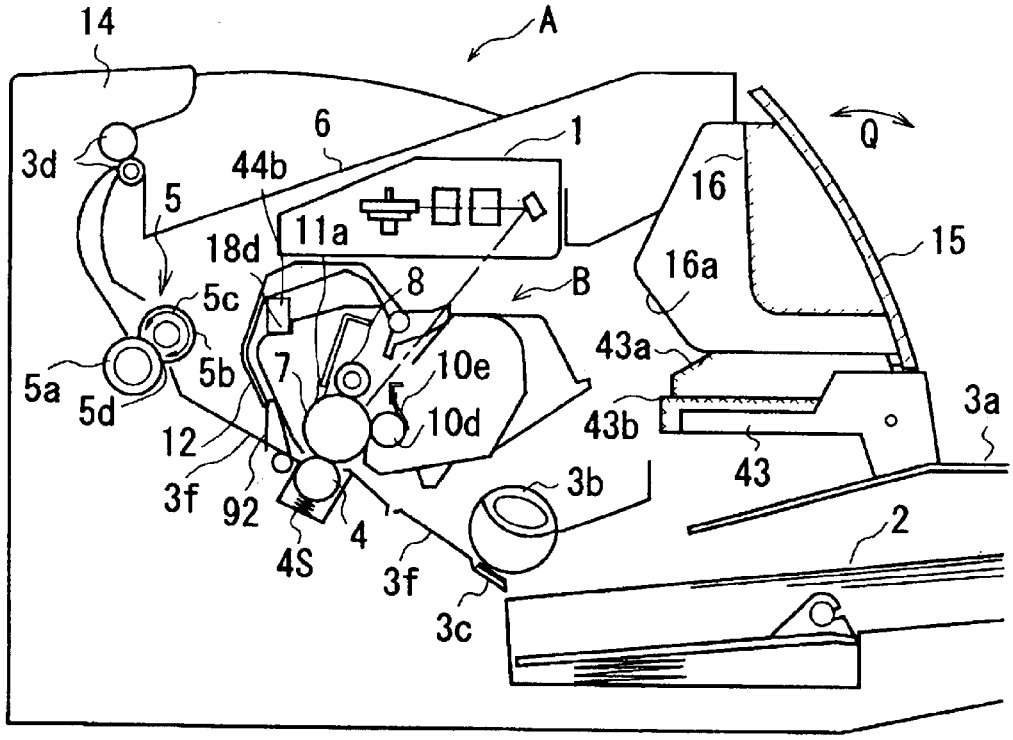
FIG. 1 is a sectional view of an electrophotographic image forming apparatus according to an embodiment of the present invention.
Figure 2:
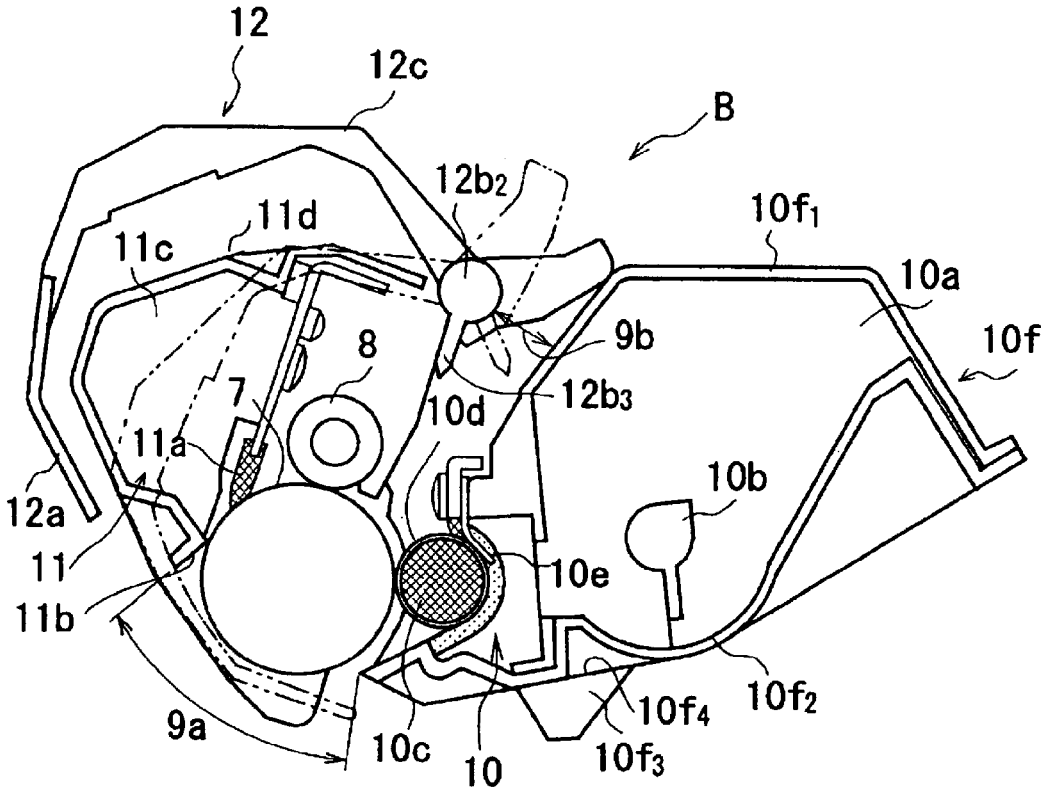
FIG. 2 is a sectional view of a process cartridge according to an embodiment of the present invention.

FIG. 1 illustrates an electrophotographic image forming apparatus according to an embodiment of the present invention. In this embodiment, a process cartridge shown in the FIG. 2 is detachably mountable to the electrophotographic image forming apparatus. FIG. 1 is a schematic illustration of the electrophotographic image forming apparatus when the process cartridge is mounted thereto, and FIG. 2 is a schematic illustration of the process cartridge.

A description will first be provided as to general arrangements of the process cartridge and the electrophotographic image forming apparatus using it, and then as to the process cartridge mounting-and-demounting mechanism.

(General Arrangement)

In this embodiment, the electrophotographic image forming apparatus A (image forming apparatus) is in the form of a laser beam printer, and as shown in FIG. 1, it comprises an electrophotographic photosensitive member 7 in the form of a drum (photosensitive drum) as an image bearing member. The photosensitive drum 7 is electrically charged to a uniform potential by charging means in the form of a charging roller 8, and then is exposed to information light on the basis of image information supplied from optical means (optical system), by which an electrostatic latent image is formed on the photosensitive drum 7. The electrostatic latent image is visualized with a developer (toner) into a toner image.

In synchronism with the formation of the toner image, the recording material (recording paper, OHP sheet, textile or the like) is fed one by one from a cassette 3*a* to an image transfer station by a pick-up roller 3*b* and a press-contact member 3*c* press-contacted thereto. The toner image formed on the photosensitive drum 7 is transferred onto the recording material 2 at the transfer station by application of a transfer of voltage to the transfer roller 4. The recording material 2 now carrying the toner image transferred thereto is fed to fixing means 5 along a feeding guide 3*f*.

In this embodiment, the fixing means 5 comprises a driving roller 5*a* and a fixing rotatable member 5*d*.

The fixing rotatable member 5*d* comprises a cylindrical sheet containing therein a heater 5*b* and rotatably supported by a supporting member 5*c*. The fixing rotatable member 5*d* applies heat and pressure to the recording material 2 passing therethrough to fix the transferred toner image. The recording material 2 now having the fixed toner image is fed by discharging rollers 3*d*, and is discharged to a discharging portion 6 through a reverse feeding path.

In this embodiment, the feeding means is constituted by the pick-up roller 3*b*, the press-contact member 3*c*, discharging rollers 3*d* and so on.

The main assembly An of the image forming apparatus contains the feeding means, the fixing means 5 and driving means for driving the process cartridge B. The driving means receives a driving force from a motor (unshown) (driving source) and functions to rotate rotatable members through a gear train (unshown).

The driving force to be supplied to the process cartridge B is transmitted to a large gear 83 (FIG. 11) through the gear train (unshown), and is transmitted to the process cartridge B by the large gear 83. The drive transmission between the large gear 83 and the process cartridge B is effected by coupling means disclosed in Japanese Patent No.02875203 and Japanese Laid-open Patent Application Hei 10-240103, for example.

Figure 11:
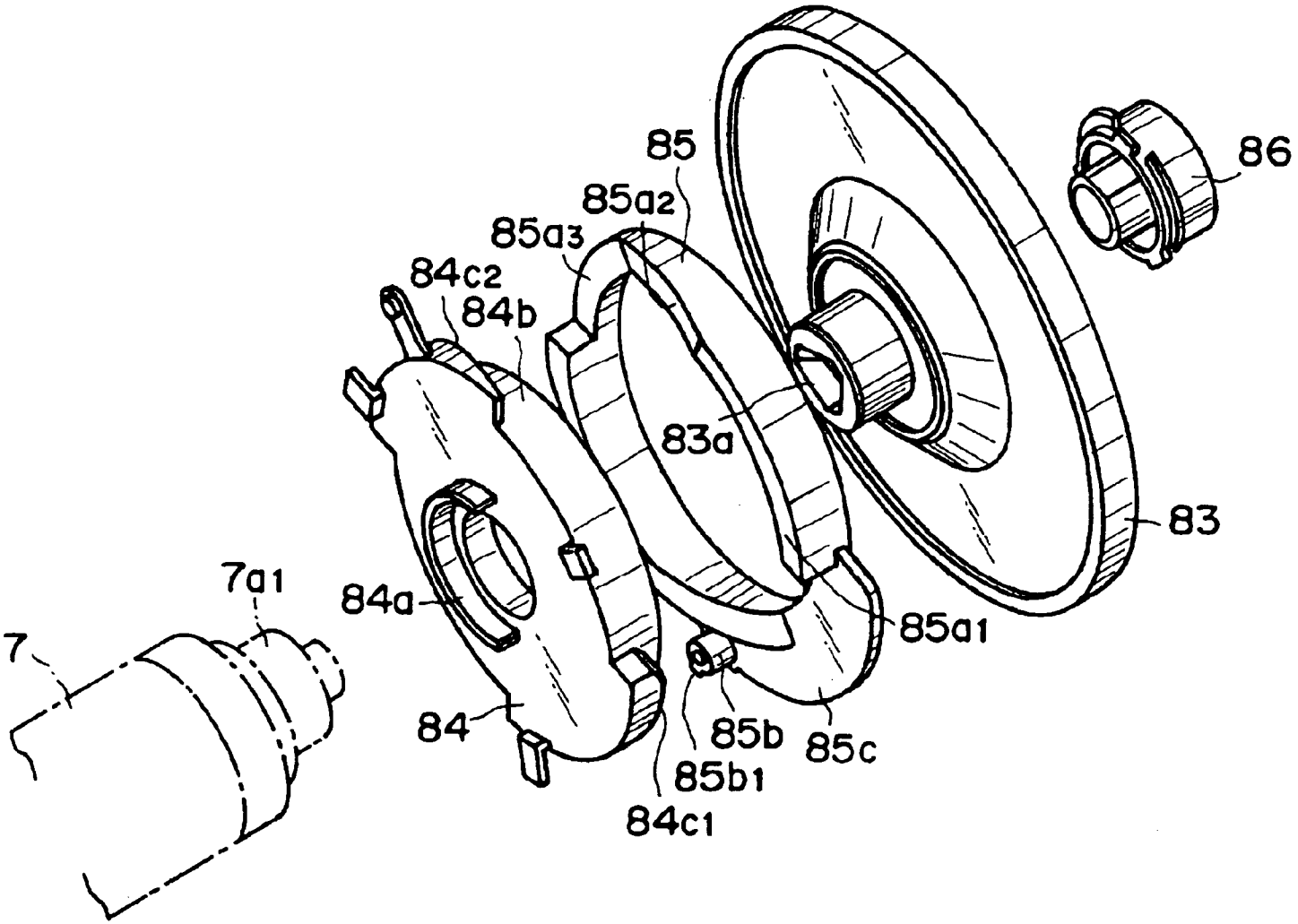
FIG. 11 is an exploded perspective view of a bearing and a large gear including a coupling cam.

As shown in FIG. 11, the coupling means comprises a large gear coupling 83*a* provided with a twisted recesses having a substantially regular triangular cross-section and having an axis coaxial with a rotational center axis of the large gear 83, and a twisted projection (driving force receiving portion 7*a*1, or drum coupling 7*a*1) having a substantially regular triangular cross-section. A detailed description will be provided hereinafter. The drum coupling 7*a*1 is formed coaxially with the rotational central axis of the photosensitive drum 7 on a gear flange (unshown) fixed to one end portion of the photosensitive drum 7. The coupling means is brought into and out of the transmitting engagement by moving the large gear coupling 83*a* in the longitudinal direction of the photosensitive drum 7.

By the engagement of the coupling, the axes of the large gear 83 and the photosensitive drum 7 are aligned, and the driving force transmission is enabled, and with the transmission of the driving force, the longitudinal position of the photosensitive drum 7 is determined. Therefore, in this embodiment, there is provided driving connection means for engagement and disengagement of the coupling means.

(Process Cartridge)

The process cartridge B contains the electrophotographic photosensitive member and at least one process means. The process means includes charging means for electrically charging the electrophotographic photosensitive member, developing means for developing an electrostatic latent image formed on the electrophotographic photosensitive member, and cleaning means for removing the residual toner remaining on the photosensitive member. The process cartridge B according to this embodiment, as shown in FIG. 2, includes a rotatable photosensitive drum 7 which is an electrophotographic photosensitive member having a photosensitive layer. The surface of the photosensitive drum 7 is electrically charged to a uniform potential by application of a voltage to charging means in the form of a charging roller 8. The photosensitive drum 7 thus electrically charged is exposed to image information (light image) supplied from an optical system 1 through an exposure opening 9*b*. By doing so, an electrostatic latent image is formed on the surface of the photosensitive drum 7. The electrostatic latent image is developed by developing means 10.

In the developing means 10, the toner is moved from a toner accommodating portion 10*a* to a developing roller 10*d* (rotatable developing member (developer carrying member)) by a rotatable feeding member 10*b* for feeding the toner. The developing roller 10*d* contains therein a stationary magnet 10*c*. By rotating the developing roller 10*d*, while keeping the magnet 10*c* stationary, and by regulating the thickness of a layer of the developer formed on the developing roller, a layer of the developer having a regulated thickness and having triboelectric charge is formed on the developing roller 10*d*. The toner on the surface of the developing roller 10*d* is transferred onto the photosensitive drum 7 in accordance with the electrostatic latent image, by which a toner (visualized) image is formed on the photosensitive drum 7.

A transfer roller 4 is supplied with a voltage of a polarity opposite from the polarity of the toner image, by which the toner image is transferred onto the orecording material 2. Thereafter, the residual toner remaining on the surface of the photosensitive drum 7 is removed by a cleaning blade 11*a* of the cleaning means. The removed toner is received by a receptor sheet 11*b*. The received toner is collected in a removed toner accommodating portion 11*c*.

The process cartridge B comprises a cleaning frame 11*d* rotatably supporting the photosensitive drum 7 and supporting the cleaning means 11 and the charging roller 8, and a toner developing frame 10*f* supporting the developing means 10, the toner accommodating portion 10*a*.

The developing frame 10*f* is rotatably supported on the cleaning frame 11*d* so that the developing roller 10*d* of the developing means 10 may be opposed to the surface of the photosensitive drum 7 with a predetermined parallel gap.

At the opposite end portions of the developing roller 10*d*, there are provided spacers (unshown) for maintaining the predetermined gap between the developing roller 10*d* and the photosensitive drum 7.

Figure 3:
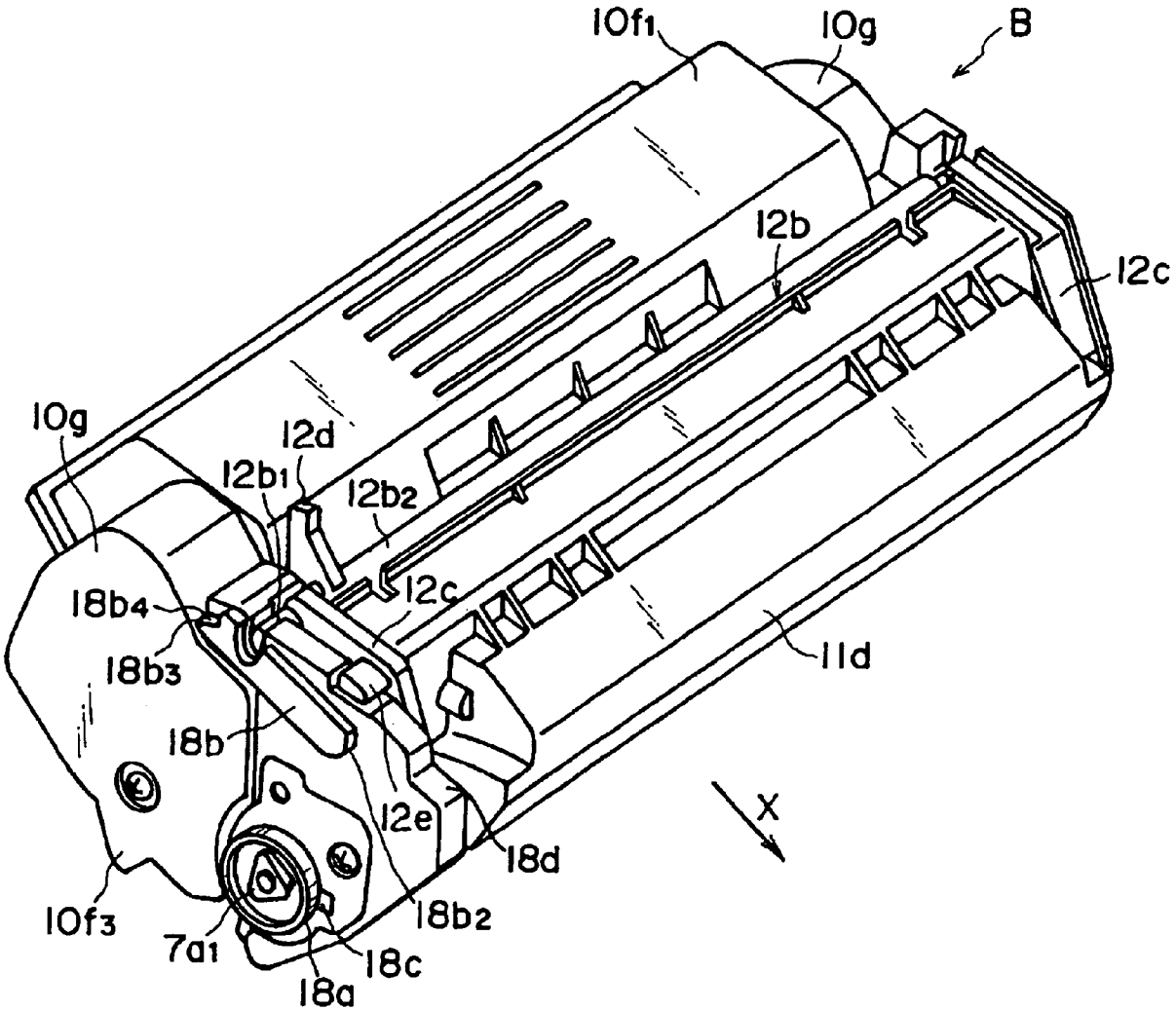
FIG. 3 is a perspective view of a process cartridge according to an embodiment of the present invention.

As shown in FIG. 3, at the sides of the toner developing device frame 10*f*, there are holder members 10*g*. Although not shown, it is provided with a hanging arm having a connecting portion for rotatably hanging the developing unit to the cleaning unit. In order to maintain the predetermined gap between the developing unit and the cleaning unit, a predetermined pressing force is applied.

The process cartridge B includes a toner developing device frame 10*f* constituted by a developing device frame 10*f*1 and a cap member 10*f*2 which are welded together, and a cleaning frame 11*d*, and these frames are coupled to constitute a cartridge frame CF.

Figure 4:
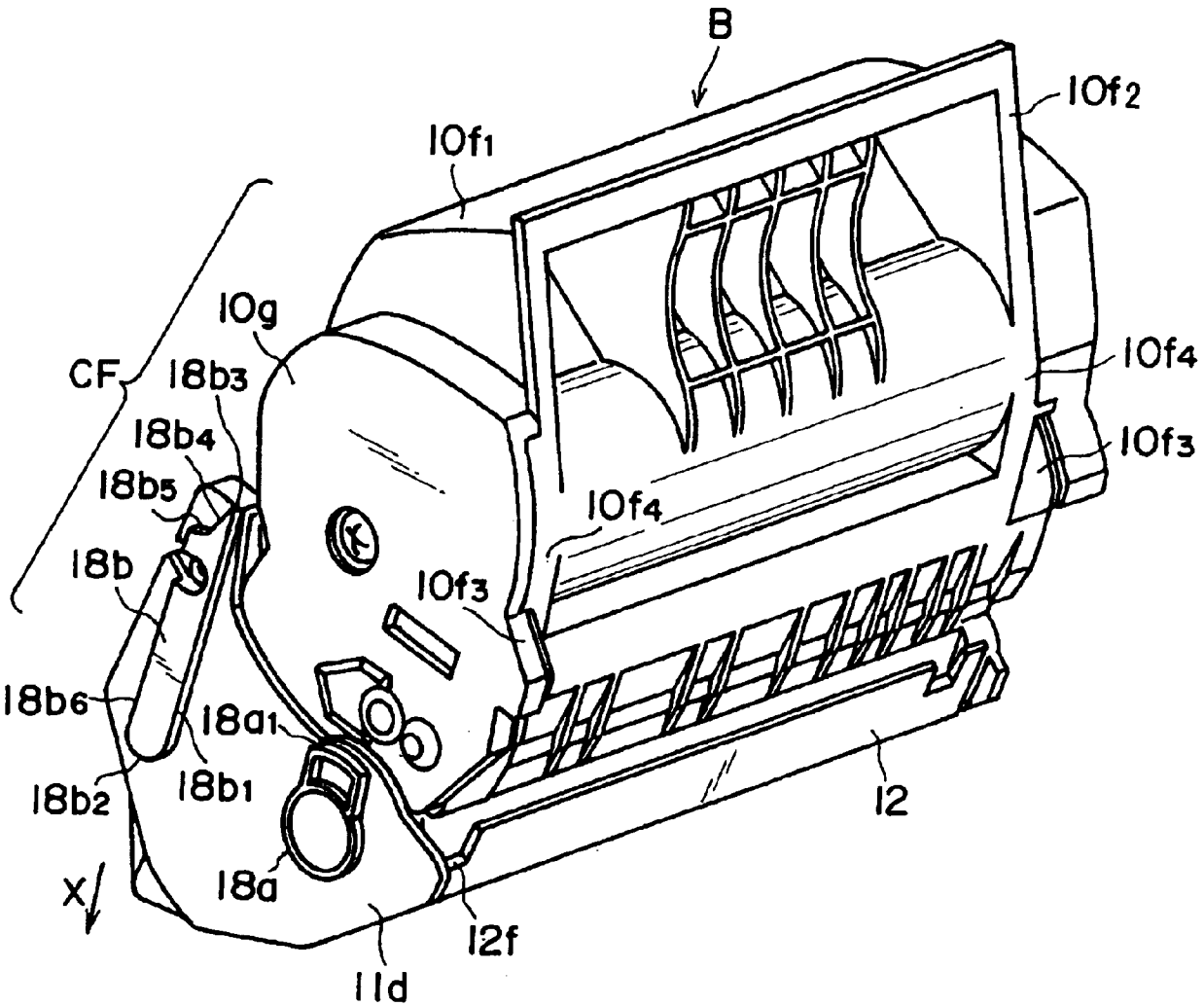
FIG. 4 is a perspective view of a process cartridge according to an embodiment of the present invention.

At the opposite longitudinal ends of the cartridge frame CF, as shown in FIGS. 3, 4, there are provided a first cartridge guide 18*b* and a second cartridge guide 18*b* (mounting guide 18*b*) for guiding mounting of the process cartridge in the direction indicated by an arrow X to the main assembly of the electrophotographic image forming apparatus (image forming apparatus) 14, and a first cartridge positioning portion 18*a* and a second cartridge positioning portion 18*a* (positioning guide 18*a*) which are coaxial with the rotational center of the photosensitive drum 7 and which are to be supported by positioning means (a first main assembly positioning portion and a second main assembly positioning portion) provided in the main assembly of the image forming apparatus.

The positioning guides 18*a* are in the form of cylindrical bosses, in which the driving side cylindrical boss has a larger diameter. The positioning guide 18*a* at the non-driving side, as shown in FIG. 4, is provided with a mounting assisting guide 18*a*1 extended rearwardly with respect to the process cartridge mounting direction. The trailing end of the mounting assisting guide 18*a*1 is formed into an outer surface 18*a*2 (FIG. 43) to be urged, and is in the form of an arcuation coaxial with the positioning guide 18*a*.

The mounting guide 18*b* to be guided has a portion to be supported 18*b*1 (lower surface 18*b*1) which is to be supported by a first main assembly side guide 41 and a second main assembly side guide 41 (movement guide 41) which will be described hereinafter, and a leading end portion 18*b*2 of the mounting guide 18*b* which takes the leading end of the process cartridge in the inserting direction. The leading end portion 18*b*2 has an arcuation connecting to the lower surface 18*b*1 and an arcuation connecting to the upper surface 18*b*6, wherein the former has a diameter larger than that of the latter. The bottom corner portion 18*b*3 of the lower surface 18*b*1 at the trailing end portion is formed into an inclined surface portion 18*b*4 constituting an acute angle with the lower surface 18*b*1. The training end portion of the upper surface includes an orthogonal surface 18*b*5 which is orthogonal with the upper surface 18*b*6.

The gravity center of the process cartridge is between the leading end and the trailing end of the mounting guide 18*b*, so that when the process cartridge B is supported at the trailing end of the mounting guide 18*b*, the process cartridge takes a front side down position at all times.

In this embodiment, the mounting guides 18*b* are provided on the end surfaces of the cleaning frame 11*d* above the positioning guides 18*a*, and the leading end portions 18*b*2 of the mounting guide are positioned downstream of a vertical plane passing through the rotational center of the photosensitive drum 7 which is coaxial with the positioning guides 18*a*, with respect to the mounting direction. However, the mounting guides 18*b* may be provided on the toner developing device frame 10*f* or on the holder members 10*g* provided at end portions of the toner developing device frame 10*f*.

In this embodiment, the process cartridge B is provided with a drum shutter 12 which is rotatably supported on the cleaning frame 11*d*, and the drum shutter 12 is capable of simultaneously covering an exposure opening 9*b* and a transfer opening 9*a* to be opposed to the transfer roller 4.

A description will be provided as to the structure of the drum shutter 12.

As shown in FIGS. 1 and 2, the drum shutter 12 has a drum protecting portion 12*a* capable of covering the transfer opening 9*a* through which the photosensitive drum 7 and the transfer roller 4 contact each other. The drum shutter 12 has a rotation shaft 12*b*, and is rotatably supported adjacent the exposure opening 9*b* of the cleaning frame 11*d*. The rotation shaft 12*b* has sliding portions 12*b*1 for sliding contact with the cleaning frame 11*d* at the opposite end portions of the rotation shaft 12*b*, respectively, a large diameter portion 12*b*2 having a diameter larger than that of the sliding portions 12*b*1 at the portion corresponding to the exposure opening 9*b* between the sliding portions 12*b*1, and an exposure shutter portion 12*b*3 closing the exposure opening 9*b* when the drum shutter 12 is closed, the exposure shutter portion 12*b*3 being provided on the large diameter portion 12*b*2.

To the outside of the large diameter portion 12*b*2 of the rotation shaft 12*b*, one end of the connecting portion 12*c* disposed at each of left and right positions is connected, and the other end is connected to the end portion of the protecting portion 12*a*.

At the righthand side of the large diameter portion 12*b*2 of the rotation shaft 12*b*, there is disposed a cam portion 12*d* (FIG. 3) projected to the top side of the process cartridge. The righthand side connecting portion 12*c* of the drum shutter 12 is provided with a rib 12*e* projected outwardly. The rib 12*e* is received by a shutter guide 44*c* of a fixed guide 44 (FIG. 7), and functions to maintain the drum shutter 12 in the open state. In this embodiment, the above-described portions of the drum shutter 12 are integrally formed with resin material. As regards the positional relation of the righthand side mounting guide 18*b*, the rib 12*e* and the cam portion 12*d* in the longitudinal direction, the mounting guide 18*b*, the rib 12*e* and the cam portion 12*d* are arranged in the order named from the longitudinally outside of the process cartridge.

The drum shutter 12 is urged in the direction of closing the photosensitive drum 7 by a coil spring (unshown).

By doing so, when the process cartridge B is out of the main assembly 14 of the apparatus, the drum shutter 12 keeps the transfer opening 9*a* closed as indicated by the chain lines in FIG. 2. On the other hand, when the process cartridge is in the main assembly 14 and is in the operative position for image forming operation, the drum shutter assumes the open position to expose the photosensitive drum 7 to permit the photosensitive drum 7 and the transfer roller 4 to contact each other through the transfer opening 9*a* as shown by solid lines in FIG. 2.

(Process Cartridge Mounting-and-demounting Mechanism)

Next, the mechanism for mounting or dismounting the process cartridge B, into or from, the image forming apparatus main assembly 14 will be described.

The process cartridge mounting/dismounting mechanism comprises:

(1) A pair of moving guides 41 which move between the optical system 1 and conveying means while holding the process cartridge B;

(2) A pair of cam plates 50, and a pair of inner plates 40 having guide rails 40*a* and 40*b*, for moving the moving guides 41, during the front half of the process for opening an opening/closing cover 15 (which hereinafter will be referred to as opening/closing cover 15) and the latter half of the process for closing the opening/closing cover 15;

(3) A pair of connecting plates 51 for transmitting the rotational movement of the opening/closing cover 15 to the pair of cam plates 50, one for one;

(4) A pair of pushing arms 52 for holding the process cartridge B to the process cartridge mounting place (which hereinafter will be referred to as "image formation enabled position" or "image formation location") after the movement of the process cartridge B; and (5) Drum shutter opening/closing means for opening or closing the drum shutter 12 of the process cartridge B.

The process cartridge mounting/dismounting mechanism in this embodiment further comprises:

(6) A connecting means for coupling or uncoupling the coupling means which transmits the driving force, from the right side of the process cartridge B with respect to its lengthwise direction, during the front half of the process for opening the opening/closing cover 15 and the latter half of the process for closing the opening/closing cover 15; and (7) An interlocking switch 54 which detects the completion of the closing of the opening/closing cover 15, and allows electrical current to flow to enable the image forming apparatus to carry out an image forming operation.

In the process for closing the opening/closing cover 15, first, the process cartridge B is conveyed by the movement of the moving guide 41 as a cartridge mounting member, and then, the coupling means is enabled to be coupled, by the connecting means, while moving the pushing arm 52. Thereafter, the interlocking switch 54 is operated. In the process for opening the opening/closing cover 15, first, the interlocking switch 54 is operated, and then, the connecting means and pushing arm 52 are disengaged, and lastly, the moving guide 41 is moved. In the following description of the process cartridge mounting/dismounting mechanism, first, the configuration of the various components of the mechanism are described, and then, the method for assembling the various components, and the method for mounting the process cartridge B into the image forming apparatus, will be described. Lastly, the movement of the process cartridge mounting/dismounting mechanism will be described following the rotational movement of the opening/closing cover 15.

(Description of Structural Components)

(Moving Guide and First and Second Guides, on Main Assembly Side)

Figure 5:
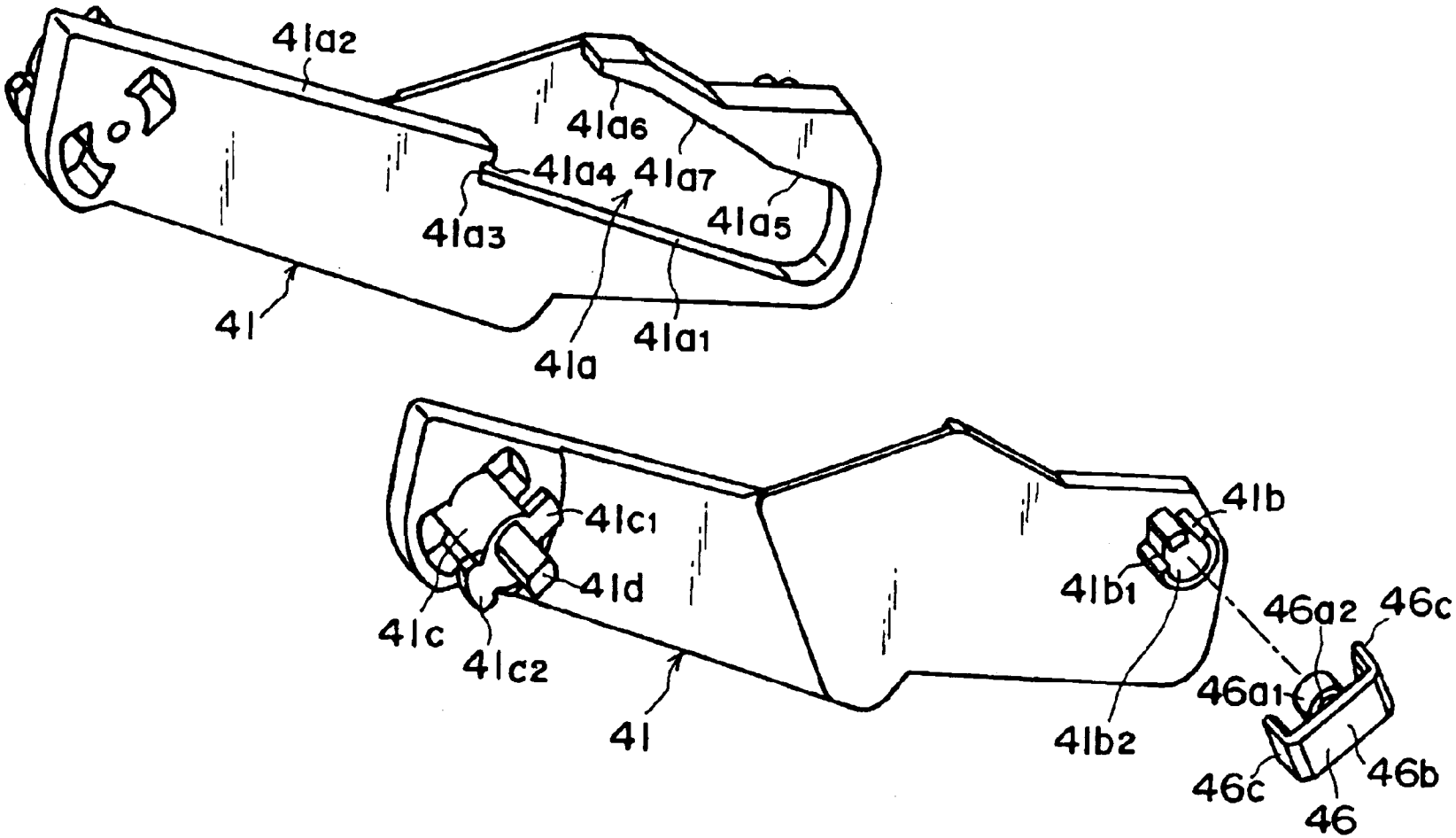
FIG. 5 shows perspective views of a movement guide and a guide stopper.

The pair of moving guides 41 are attached to the left and right inner plates 40, one for one, being approximately symmetrically positioned with respect to the plane which divides the apparatus main assembly into the left and right halves with respect to the process cartridge mounting direction. Referring to FIG. 5, each moving guide 41 is provided with a guiding groove 41*a* as a guiding portion, which is in the surface facing the process cartridge B, and in which the mounting guide 18*b* of the process cartridge B engages. Each moving guide 41 is also provided with first and second bosses 41*b* and 41*c*, which are for controlling the attitude of the process cartridge B within the apparatus main assembly, and are on the surface opposite to the surface in which the guiding groove 41*a* is located. The first and second bosses 41*b* and 41*c* are disposed on the downstream and upstream sides, respectively, of the guiding groove 41*a*, with respect to the direction X in which the process cartridge B is mounted into the apparatus main assembly.

The first boss 41*b* is provided with a through hole 41*b*2, which is coaxial with the circumferential surface of the boss 41. It is also provided with a snap fit claw 41*b*1, the end portion of which projects inward with respect to the radius direction of the through hole. The second boss 41*c* is provided with claws 41*c*1 and 41*c*2, which are on the end portion of the boss 41*c* and project outward with respect to the radius direction of the boss 41*c*. These claws 41*c*1 and 41*c*2 are extended so that the direction, in which they extend, align with the line connecting the rotational center of the second boss 41*c* and the rotational center of the cam plate, which will be described later, after the process cartridge is moved by the process cartridge mounting/dismounting mechanism to the second position at which the process cartridge B is capable of carrying out an image forming operation.

The guiding groove 41*a* has two sections, that is, downstream and upstream sections with respect to the process cartridge insertion direction, and the downstream section is slightly recessed from the upstream section, with the presence of a step between the two sections. The surface 41*a*1 of the downstream section of the guiding groove 41*a* is the retaining surface on which the mounting guide 18*b* of the process cartridge B rests while the moving guide 41 moves within the image forming apparatus, and the surface 41*a*2 of the upstream section, which is higher than the surface 41*a*1 of the downstream section, is a guiding surface which guides the process cartridge B when the process cartridge B is inserted into, or pulled out of, the apparatus main assembly. The retaining surface 41*a*1 and guiding surface 41*a*2 are downwardly inclined with respect to the process cartridge insertion direction, assuring that as a user inserts the process cartridge B into the image forming apparatus main assembly 14, the process cartridge B is guided into the retaining surface 41*a*1.

Figure 6:
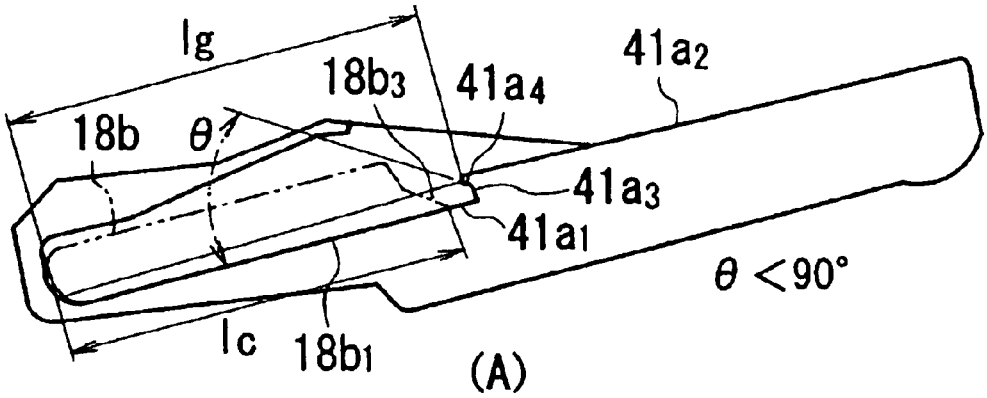
FIGS. 6(A)–6(C) are illustrations of a relationship between the movement guide and the mounting guide.
Figure 6:
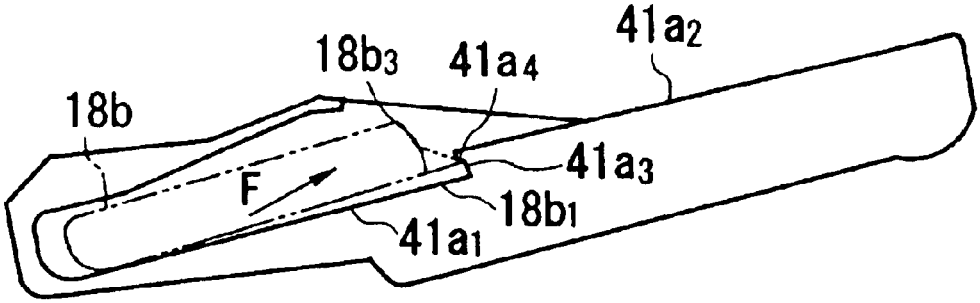
Figure 6:
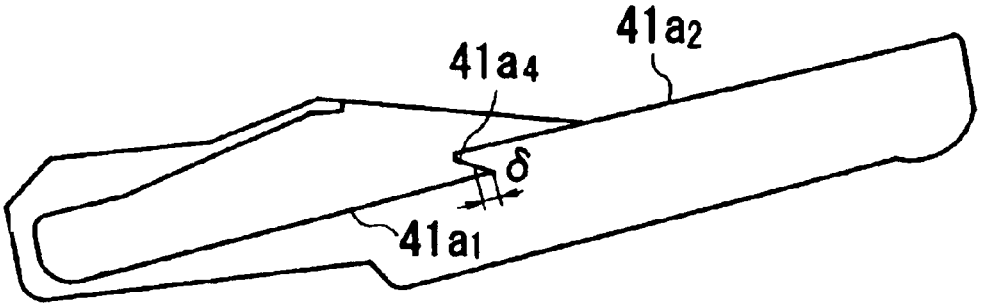

Referring to FIG. 6, the step portion between the retaining surface 41*a*1 and guiding surface 41*a*2 is given a function of pushing the trailing end 18*b*3 of the mounting guide 18*b* of the process cartridge B to assure that the process cartridge B is conveyed to a predetermined location, in spite of the conveyance load, to which the process cartridge B supported by the retaining surface 41*a*1 is subjected during the movement of the moving guide 41. The stepped portion has an inclined portion 41*a*4, the theoretical extension of which forms an acute angle relative to the retaining surface 41*a*1, and a perpendicular surface 41*a*3, which is between the inclined portion 41*a*4 and retaining surface 41*a*1 and is approximately perpendicular to the retaining surface 41*a*1. The inclined portion 41*a*4 prevents the mounting guide 18*b*, supported by the retaining surface 41*a*1, from being lifted from the retaining surface 41*a*1 by the resistance of the transfer roller 4, which acts in the direction to lift the process cartridge B (FIG. 6(B)).

Referring to FIG. 6(A), in order to guide the mounting guide 18*b* of the process cartridge B from the guiding surface 41*a*2 onto the retaining surface 41*a*1, the distance lg from the corner of the leading end of the retaining surface 41*a*1 with respect to the process cartridge insertion direction, to the intersection between the inclined portion 41*a*4 and the guiding surface 41*a*2, and the length lc of the is bottom surface 18*b*1 of the mounting guide 18*b* with respect to the process cartridge inserting direction, must satisfy the following inequality:

$$lg > lc.$$

In other words, the length of the retaining surface 41*a*1 is longer than the bottom surface 18*b*1 of the mounting guide 18*b*. Referring to FIG. 6(C), if the guiding surface 41*a*2 and retaining surface 41*a*1 are connected by the inclined surface 41*a*4 alone, the retaining surface 41*a*1 will be longer by a length of d, being unnecessarily longer than the bottom surface 18*b*1 of the mounting guide 18*b*. In such a case, the distance by which the moving guide 41 and process cartridge B slide relative to each other as the process cartridge B is subjected to the conveyance load, will be excessively long. Thus, in this embodiment, the length of the retaining surface 41*a*1 is adjusted, being reduced in length, by the addition of the perpendicular surface 41*a*3, so that the trailing end of the mounting guide 18*b* can be more quickly pushed as the process cartridge B is subjected to the conveyance resistance.

The downwardly facing surface of the top wall of the guiding groove 41*a* is approximately parallel to the retaining surface 41*a*1. It has top surfaces 41*a*5 and 41*a*6, and a gently inclined top surface 41*a*7 which connects the top surfaces 41*a*5 and 41*a*6. The top surfaces 41*a*5 and 41*a*6 are positioned so that their distance from the retaining surface 41*a*1 and guiding surface 41*a*2, with respect to the direction perpendicular to the surfaces of the retaining surface 41*a*1 and guiding surface 41*a*2, respectively, becomes slightly greater than the thickness of the mounting guide 18*b* of the process cartridge B, with respect to the direction perpendicular to the lengthwise direction of the mounting guide 18*b*.

As for the configurations of the pair of moving guides 41, which have been described up to this point, the left and right moving guides are symmetrically positioned relative to each other, with respect to the vertical plane which divides the process cartridge B into the left and right halves. However, the right moving guide is provided with a means for transmitting a driving force to the process cartridge B, and therefore, the second boss 41*c* of the right moving guide is provided with a timing boss 41*d*, which extends beyond the claws 41*c*1 and 41*c*2 in the axial direction of the second boss 41*c*.

Next, a cartridge conveying means, more specifically, the guide rails, cam plate, and connecting plate, which make up the moving guide moving means, will be described. The structure of the cartridge conveying means (moving guide moving means) does not need to be limited to the one which will be described next; it is optional.

(Guide Rails of Inner Plate)

Figure 7:
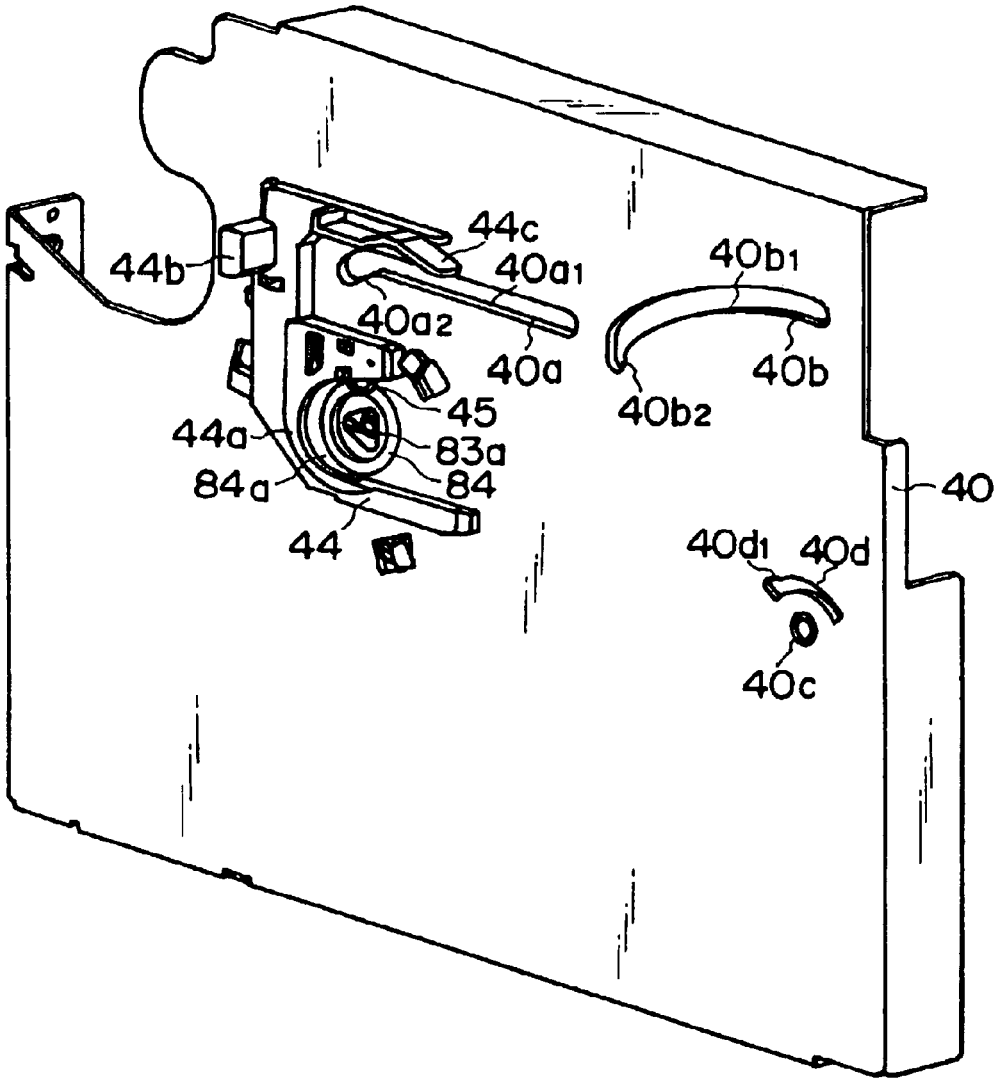
FIG. 7 is a perspective view of a fixed guide and an inner bearing provided on a right-hand inner plate.

FIG. 7 shows the right inner plate 40 of the image forming apparatus main assembly 14. The right inner plate 40 is provided with a pair of guide rails, as the cartridge conveying means (means for holding the cartridge mounting member), with which the bosses 41*b* and 41*c* slidably engage, respectively.

The widths (dimension with respect to the direction perpendicular to the direction in which the guides rails extend) of the guide rails 40*a* and 40*b* are equal to, or slightly greater than, the diameters of the bosses 41*b* and 41*c*, respectively, allowing the moving guide 41 to easily slide. In this embodiment, the inner plate 40 is formed of an approximately 1 mm thick metallic plate, and the guide rails 40*a* and 40*b* are holes, which have been formed by burring, and the lips of which protrude outward of the image forming apparatus. The reason for using burring as the method for forming the guide rails 40*a* and 40*b* is as follows. That is, if the guide rails 40*a* and 40*b* are formed simply by punching, the surfaces of the guide rails 40*a* and 40*b*, across which the bosses 41*b* and 41*c* of the moving guide 41 slide, respectively, will be rough, and also will be only as wide as the thickness of the metallic plate, increasing the contact pressure which acts on the bosses 41*c* and 41*b*. Thus, as the moving guide 41 repeatedly slides on the guide rails, the bosses 41*b* and 41*c* will be shaved across the areas in contact with the edges of the guide rails 40*a* and 40*b*, respectively, which sometimes will result in the disengagement of the moving guide 41 from its predetermined position in the apparatus main assembly. This is the reason burring is used instead of simple punching. In other words, burring is used to create the guide rails 40*a* and 40*b*, which are smoother and wider, across the surfaces across which the bosses 41*b* and 41*c* slide, in order to prevent the bosses 41*b* and 41*c* from being prematurely shaved by the guide rails 40*a* and 40*b*, respectively. In other words, the usage of burring as the method for forming the guide rails 40*a* and 40*b* is a countermeasure for the premature shaving of the bosses 41*b* and 41*c* by the guide rails 40*a* and 40*b*.

With the provision of the pair of guide rails 40*a* and 40*b*, and the pair of bosses 41*b* and 41*c* of the moving guide 41, the moving guide 41 is allowed to move between the optical system 1, and the conveyance path for the recording medium 2.

The first guide rail 40*a*, in which the first boss 41*b* engages, has a nearly horizontal portion 40*a*1, which is on the opening/closing cover 15 side, and an inclined portion 40*a*2, which is located at the deeper end of the guide rail 40*a*, and is inclined downward with respect to the process cartridge insertion direction. The two portions 40*a*1 and 40*a*2 are connected by a smoothly curved portion. The second guide rail 40*b*, in which the second boss 41*c* engages, has an arcuate portion 40*b*1, which bulges upward, and a vertical straight portion 40*b*2, which is located on the first guide rail 40*a* side. The two portions 40*b*1 and 40*b*2 are connected by a smoothly curved portion. Further, the inner plate 40 is provided with a hole 40*c*, in which the rotational shaft 50*a* of the cam plate 50, which will be described later, is borne. The axial line of the hole 40*c* coincides with the center of the curvature of the arcuate portion 40*b*1. The inner plate 40 is also provided with an arcuate hole 40*d*, which is located near the hole 40*c*, and the center of the curvature of which coincides with the axial line of the hole 40*c*.

In this embodiment, the hole 40*c* is also formed by burring. The arcuate hole 40*d* is provided with an assembly facilitation portion 40*d*1, which is the deeper end portion of the arcuate hole 40*d* with respect to the direction in which the opening/closing cover is closed, and is slightly wider with respect to the radius direction of its curvature. This assembly facilitation portion 40*d*1 is where the assembly facilitation claw 50*e* of the cam plate 50 (FIG. 8) is put through when the cam plate 50 is attached to the inner plate 40. After the assembly facilitation claw 50*e* is put through the assembly facilitation portion 40*d*1 of the arcuate hole 40*d*, the cam 50 is rotated in the direction in which the opening/closing cover is opened. As the cam 50 is rotated, the back surface of the assembly facilitation claw 50*e* comes into contact with the upper edge of the arcuate hole 40*d*, preventing the cam plate 50 from disengaging from the inner plate 40 with respect to the axial direction of the rotational shaft 50*a*.

(Cam Plate)

To the outward surface of the inner plate 40, that is, the surface opposite to where the moving guide 41 is mounted, the cam plate 50 is attached, which is provided with a rotational shaft 50*a*, the rotational axis of which coincides with the center of the curvature of the arcuate portion 40*b*1 of the second guide rail 40*b*.

Figure 8:
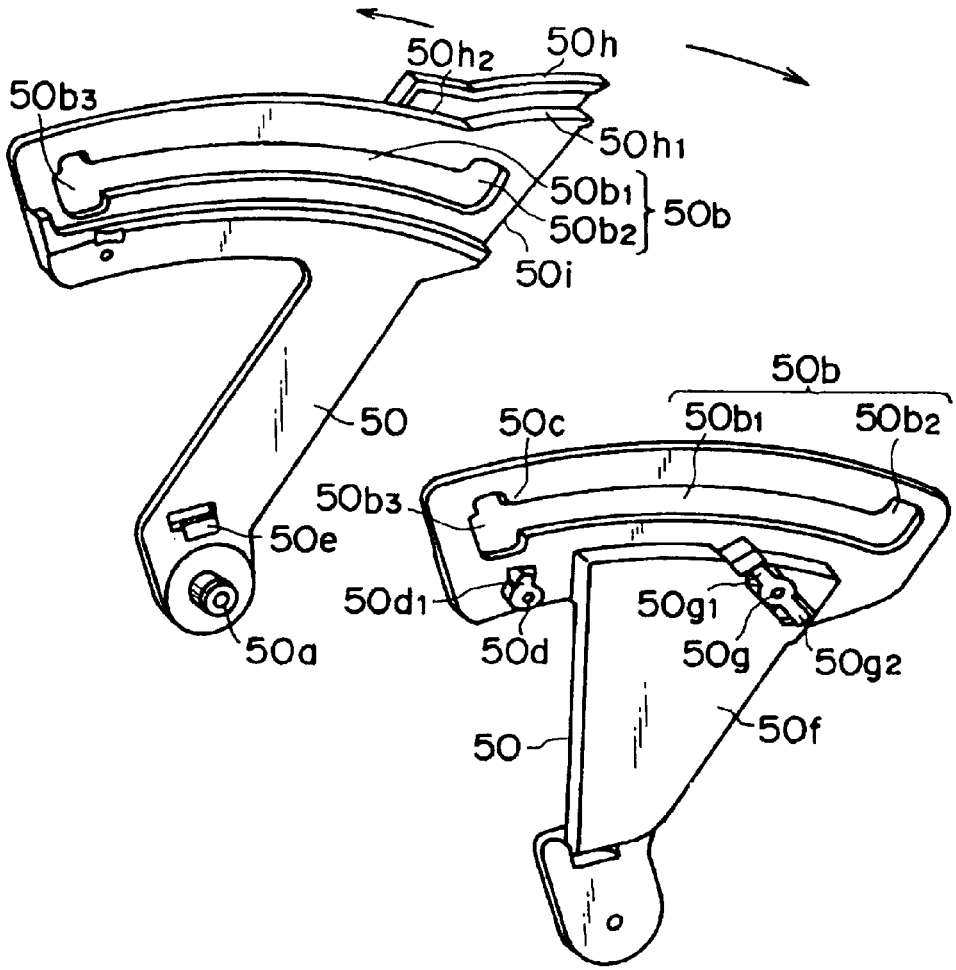
FIG. 8 is a perspective view of a cam plate.
Figure 9:
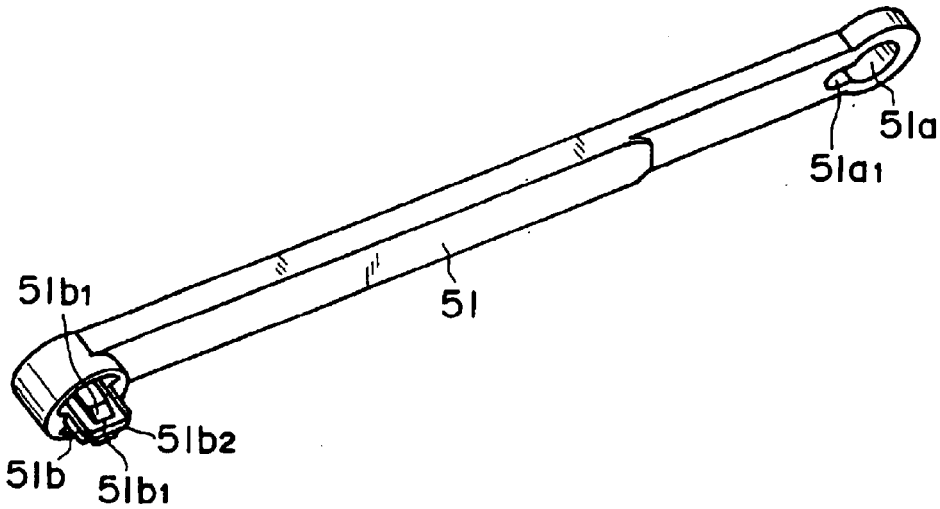
FIG. 9 is a perspective view of a connection plate.

Referring to FIG. 8, the cam plate 50 is provided with a cam hole 50*b*, which has an arcuate portion 50*b*1 (which hereinafter may be referred to as arcuate hole), and a straight portion 50*b*2 (which hereinafter may be referred to as straight groove hole). The center of the curvature of the arcuate portion 50*b*1 of the cam hole 50*b* coincides with the axial line of the rotational shaft 50*a*. The straight portion (straight groove hole) 50*b*2 of the cam hole 50*b* is continuous from the inward end of the arcuate portion 50*b*1 of the can hole 50*b*, with respect to the direction in which the opening/closing cover 15 is closed, and extends outward with respect to the radius direction of the curvature the cam hole 50*b*.

Into this cam hole 50*b*, the second boss 41*c* of the moving guide 41 engages after being put through the second guide rail 40*b* of the inner plate 40. The radius of the arcuate portion 50*b*1 of the cam hole 50*b* is smaller than that of the arcuate portion 40*b*1 of the second guide rail 40*b*, and is nearly equal to the distance between the bottom end of the straight portion 40*b*2 of the second guide rail 40*b* and the hole 40*c*. The distance between the tip of the straight portion (straight groove hole) 50*b*2 of the cam hole 50*b* and the rotational shaft 50*a* is slightly greater than the radius of the arcuate portion 40*b*1 of the second guide rail 40*b*. The widths of the arcuate portion 50*b*1 of the cam hole 50*b* and straight groove hole 50*b* are slightly greater than the diameter of the second boss 41*c* of the moving guide 41.

At the leading end of the arcuate portion 50*b*1 of the cam hole 50*b*, with respect to the direction in which the opening/closing cover 15 is opened, an assembly facilitation portion 50*b*3 is provided, through which the claws 41*c*1 and 41*c*2 on the tip of the second boss 41*c* of the moving guide 41 are put during the apparatus assembly. The assembly facilitation portion 50*b*3 is shaped so that it extends from the end of the arcuate portion 50*b*1, both outward and inward of the cam hole 50*b*, with respect to the radius direction of the arcuate portion 50*b*1 of the cam hole 50*b*. One or both of these two extending portions of the assembly facilitation portion 50*b*3 are rendered narrower than the diameter of the second boss 41*c* of the moving guide 41, in order to prevent the second boss 41*c* of the moving guide 41 from entering the outward portion of the assembly facilitation portion 50*b*3, with respect to the arcuate portion 50*b*1, with respect to the radius direction of the cam hole 50*b*, during the apparatus assembly. Further, the cam plate 50 is provided with a temporarily holding rib 50*c*, which is on the surface opposite to the surface facing the inner plate 40, and in the adjacencies of the upstream end of the assembly facilitation portion 50*b*3 with respect to the direction in which the opening/closing cover 15 is closed.

The guide rails 40*a* and 40*b* of the inner plate 40 are such holes that have been formed by burring, and their lips slightly protrude toward the cam plate 50. Therefore, in order to accommodate the guide rails 40*a* and 40*b*, the cam plate 50 is tiered around the cam hole 50*b* by a height equal to the distance by which the lips of the guide rails 40*a* and 40*b* protrude toward the cam plate 50. The aforementioned temporary positioning rib 50*c* is located above this tiered portion of the cam plate 50, so that as the claw 41*c*1 of the moving guide 41 goes over this temporary positioning rib 50*c* during the apparatus assembly, the cam plate 50 is flexed by this tiered portion.

The cam plate 50 is also provided with a connecting boss 50*d*, which is in the adjacencies of the assembly facilitation portion 50*b*3, that is, the trailing end of the cam hole 50*b*, on the surface opposite to the surface on which the rotational shaft 50*a* is present. The end portion of the connecting boss 50*d* constitutes a claw 50*d*1. There is the aforementioned assembly facilitation claw 50*e* near the rotational shaft 50*a*. The assembly facilitation claw 50*e* is fitted into the arcuate hole 40*d* of the inner plate 40 to prevent the disengagement of the cam plate 50.

The descriptions given above regarding the configuration of the cam plate 50 are common to both the left and right cam plates.

Next, the cam plate 50 on the driving means side (which hereinafter will be referred to as the cam plate right) will be described. The right cam plate 50 is provided with a raised portion, which is on the same side as the side on which the connecting boss 50*d* is provided, and is on the inward side of the cam hole 50*b* with respect to the radius direction of the cam hole 50*b*. The top surface 50*f* of this raised portion is slightly outward of the surface in which the cam hole 50*b* is present. The top surface 50*f* is provided with a second boss 50*g*. The distance by which the surface 50*f* is raised is greater than the height of the connecting boss 50*d*. The end portion of the second boss 50*g* is provided with a pair of claws 50*g*1 and 50*g*2, which extend in the radius direction of the boss 50*g*.

The cam plate 50 on the side from which the process cartridge is not driven (which hereinafter will be referred to as the left cam plate) is provided with the second cam portion 50*h*, which is located near the straight portion (straight groove hole) 50*b*2 of the cam hole 50*b* and on the outward side of the cam hole 50*b* with respect to the radius direction of the cam hole 50*b*, and a contact surface 50*i*, which is on the upstream side of the cam plate 50 with respect to the rotational direction in which the opening/closing cover 15 closes. The second cam portion 50*h* is a portion of the cam plate 50, which is for driving the pushing arm 52 as the means for accurately positioning the left side of the process cartridge, and will be described later. It has a gently arcuated arm driving portion 50*h*1, which extends from the edge of the arcuate periphery of the main structure of the cam plate 50, approximately in the direction in which the opening/closing cover 15 closes, and a gently arcuated arm holding portion 50*h*2, the center of the curvature of which coincides with that of the axial line of the rotational shaft 50*a* of the cam plate 50. These portions 50*h*1 and 50*h*2 are in the form of a groove, the open side of which, with respect to the lengthwise direction of the process cartridge, faces the inner plate 40. The second cam portion 50*h* protrudes more inward of the apparatus main assembly than the inwardly tiered portion of the cam plate 50 for accommodating the inwardly protruding lips of the guide rail 40*b*. The pushing arm 52 fits in the gap created by the difference between the distances by which the second cam portion 50*h* and the tiered portion of the cam plate 50, protrude inward of the apparatus main assembly. The contact surface 50*i* extends in the radius direction of the rotational shaft 50*a*, and its height with respect to the thickness direction of the cam plate 50 is the same as that of the bottom wall of the second cam portion 50*h*.

(Connecting Plate)

The cam plate 50 and opening/closing cover 15 are connected by the connecting plate 51, together forming a four joint linkage. The connecting plate 51 has a hole 51*a*, which is located in one of the lengthwise end portions, and into which the connecting boss 50*d* of the cam plate 50 rotationally engages, and a shaft 51*b*, which is located at the other lengthwise end, and has a pair of snap fitting claws 51*b*1. The hole 51*a* is provided with a recess 51*a*1 for preventing the claw 50*d*1 of the connecting boss 50*d* of the cam plate 50 from hanging up on the connecting plate 51 when connecting the connecting plate 51 and cam plate 50. The recess 51*a*1 extends from one side of the connecting plate 51 to the other with respect to the axial direction of the shaft 51*b*. The pair of snap fitting claws 51*b*1 are symmetrically positioned with respect to the line connecting the centers of the hole 51*a* and shaft 51*b*. Further, the shaft 51*b* is provided with a pair of intermediate portions, which are symmetrically positioned with respect to the line perpendicular to the line connecting the centers of the hole 51*a* and shaft 51*b*, being therefore at the middles of the intervals between the pair of snap fitting claws 51*b*1 with respect to the circumferential direction of the shaft 51*b*, reinforcing the shaft 51*b* against the load which acts upon the shaft 51*b* in the direction of the line which connects the centers of the hole 51*a* and shaft 51*b* of the connecting plate 51.

(Cover and Cover Backing)

Figure 10:
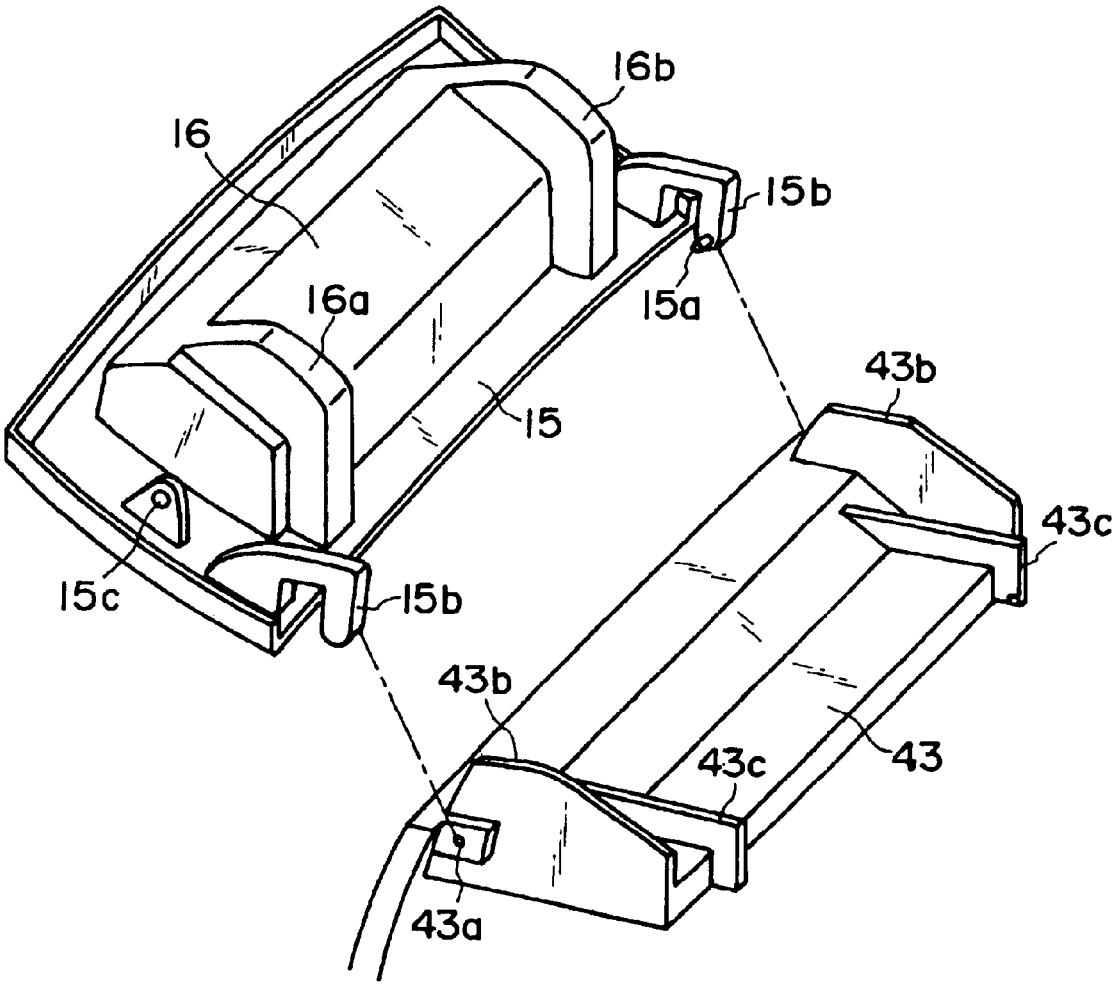
FIG. 10 is a perspective view of an opening and closing cover and a front guide.

Referring to FIG. 10, the opening/closing cover 15 is provided with a pair of hinges 15*b* having a center boss 15*a*, and a pair of plates having a connecting hole 15*c* into which the shaft 51*b* of the connecting plate 51 fits. The pair of hinges 15*b* and the pair of plates having a connecting hole 15*c* are on the back side of the opening/closing cover 15, near the lengthwise ends of the opening/closing cover 15, one for one. The opening/closing cover 15 is also provided with a backing 16, which is for increasing the rigidity of the opening/closing cover 15, and is fixed to the inward surface of the opening/closing cover 15. The backing 16 is provided with a pair of projections 16*a*, 16*b* which are located near the lengthwise end of the backing 16, and function as guides for approximately guiding the process cartridge B when mounting the process cartridge B into the image forming apparatus.

(Front Guide)

Also referring to FIG. 10, there are front guides 43 between the left and right inner plate 40, being fixed thereto. The front guide 43 is provided with a pair of supporting holes 43*a*, in which the pair of center bosses 15*a* of the opening/closing cover 15 are rotationally supported, one for one. The front guide 43 is also provided with a pair of side guide ribs 43*b* and a pair of contact ribs 43*c*, which are located near the lengthwise ends of the front guide 43, one for one.

Each side guide 43*b* is disposed so that the position of its inward surface coincides with the inward surface of the corresponding moving guide 41. Not only does it guide the positioning guide 18*a* of the process cartridge B and the process cartridge B itself, but also accurately positions the process cartridge B with respect to the lengthwise direction of the process cartridge B in coordination with the other side guide rib 43*b*. Each contact rib 43*c* is disposed on the inward side of the side guide rib 43*b* with respect to the lengthwise direction of the opening/closing cover 15, and contacts the downwardly facing surface 10*f*4 of the toner/developing means holding frame 10*f* of the process cartridge B.

(Driving Means)

Referring to FIGS. 7 and 11, the right and left inner plates 40 are provided with an inward bearing 84, which is located higher than the transfer roller 4. With the provision of this inward bearing 84, a large gear 83 having a large gear coupling 83*a* for transmitting the driving force to the photoconductive drum 7 is rotationally supported by the inner plate 40.

The opposite side of the large gear coupling 83*a* of the large gear 83 is rotationally supported by an outward bearing 86 fixed to a gear cover (unshown) attached to the inner plate 40.

The inward bearing 84 is provided with an arcuate cartridge catching/retaining portion 84*a* for holding the process cartridge B to a position in which the large coupling 83*a* of the process cartridge B is engageable (final process cartridge position in the apparatus main assembly: second location). The location of the arcuate cartridge catching/retaining portion 84*a* corresponds to the final process cartridge position in the apparatus main assembly, and the center of the curvature of the arcuate cartridge catching/retaining portion 84*a* coincides with the axial line of the large gear 83. The arcuate cartridge catching/retaining portion 84*a* catches the positioning guide 18*a* of the process cartridge B. The inward bearing 84 is also provided with a cylindrical portion 84*b* and a cam surface comprising cam surfaces 84*c*1 and 84*c*2, both of which are on the large gear 83 side. The cam surface of inward bearing 84 faces outward with respect to the radius direction of the cylindrical portion 84*b*.

On the cam surface side of the inward bearing 84, a cylindrical coupling cam 85 is provided. The coupling cam 85 rotationally fits around the cylindrical portion 84*b*, and has a cam surface comprising cam surfaces 85*a*1 and 85*a*2 which contacts the cam surface of the inward bearing 84. As the coupling cam 85 rotates, it allows the large gear 83 to move in its axial direction due to the function of the cam surfaces. Further, the coupling cam 85 is provided with a boss 85*b*, which is located on the outward edge of the cylindrical peripheral surface of the coupling cam 85 with respect to the radius direction of the coupling cam 85. More specifically, the coupling cam 85 is provided with a circumferential rib 85*c*, which is attached to the large gear 83 side of the cylindrical peripheral surface of the coupling cam 85, and projects in the radius direction of the coupling cam 85. The boss 85*b* is attached to this circumferential rib 85*c*, projecting in the axial direction of the coupling cam 85. The tip of the boss 85*b* is provided with a claw 85*b*1. Between the outward bearing 86 and large gear 83, there is a spring (not shown), which keeps the large gear 83 pressed toward the inward bearing 84.

(Thruster Rod)

Figure 12:
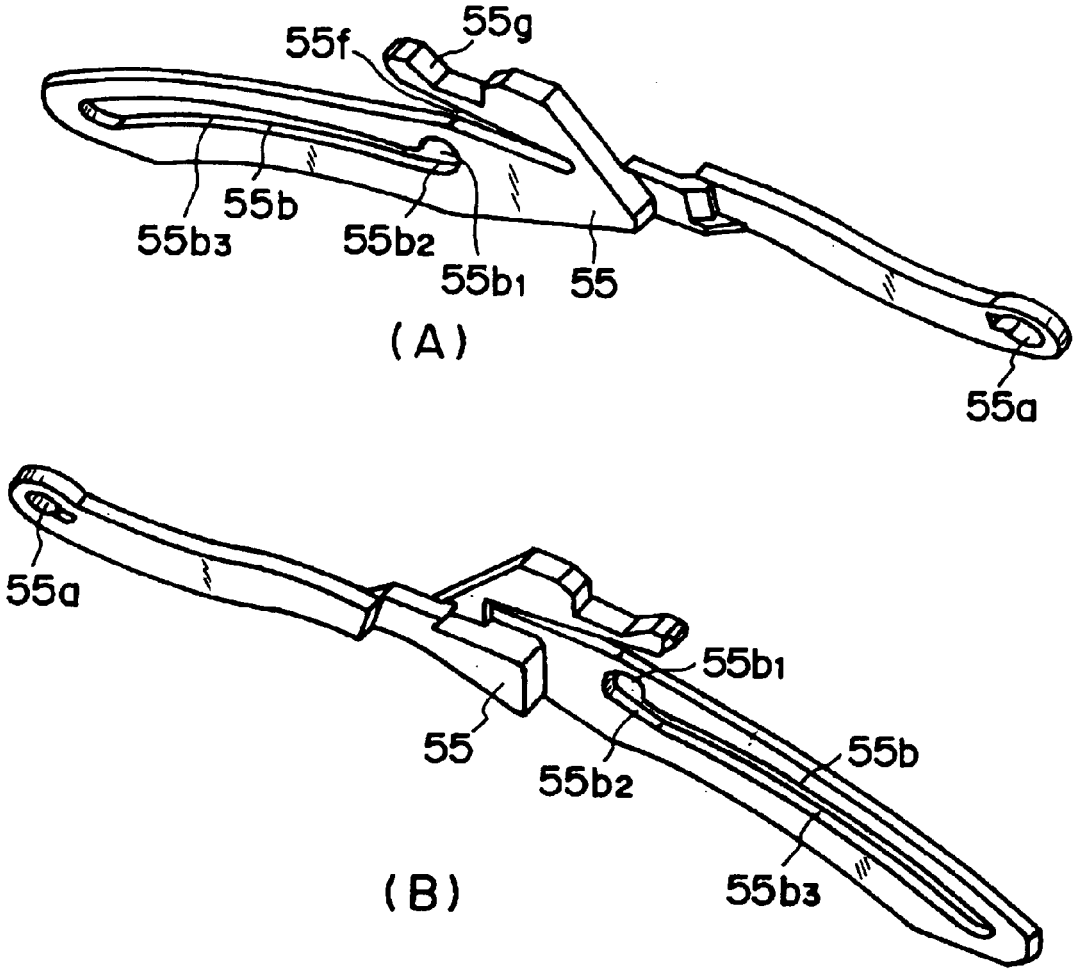
FIGS. 12(A) and 12(B) are perspective views of a thruster rod.

FIGS. 12(A) and 12(B) show a thruster rod 55. The thruster rod 55 constitutes a connecting rod which connects the second boss 50*g* to the right cam plate 50 and the boss 85*b* of the coupling cam 85. It is on the right inner plate 40, and forms the second four joint linkage. As shown in FIGS. 12(A) and 12(B), the thruster rod 55 is provided with two through holes: keyhole shaped hole 55*a* and an elongated hole 55*b*. The keyhole shaped hole 55*a* has a size and a configuration for the claw 85*b*1 of the coupling cam 85 to be put through, and the boss 85*b* is slidably fitted therein. The elongated hole 55*b* is a hole through which the second boss 50*g* of the cam plate 50 is slidably put. The elongated hole 55*b*has three sections: a straight portion 55*b*1, which extends downward approximately perpendicular to the line connecting the center of the end portion, on the keyhole shaped hole 55*a* side, and the center of the keyhole shaped hole 55*a*; an inclined portion 55*b*2, which extends diagonally downward from the bottom end of the straight portion 55*b*1; and an arcuate portion 55*b*3, which extends diagonally downward from the bottom end of the inclined portion 55*b*2. Below the arcuate portion 55*b*3, a boss is located, and the tip of the boss 55*c* is provided with a claw.

Above the straight portion 55*b*1 of the elongated hole 55*b*, a lifting surface 55*f* is provided, which is recessed in the lengthwise direction of the thruster rod 55, appearing like a U shaped groove which is laid on its side and opens toward the direction opposite to the keyhole shaped hole 55*a*. Further, above the lifting surface 55*f*, a backup portion 55*g* is provided, which is an upwardly open recess. These portions are integral parts of the thruster rod 55.

(Stationary Guide)

As is evident from FIG. 7, there is a stationary guide 44, which surrounds the inward bearing 84. The stationary guide 44 is approximately in the form of a letter E, being open toward the area, and extends beyond the cartridge catching/retaining portion 84*a* of the inward bearing 84, and inward end of the first guide rail 40*a* of the inner plate 40.

The stationary guide 44 is provided with: a butting portion 44*a*, which surrounds the cartridge catching/retaining portion 84*a*, and is enabled to come into contact with the butting surface 18*c* located on one of the lengthwise ends of the process cartridge B as the process cartridge B is mounted; a rotation controlling portion 44*b*, which is located higher than the butting portion 44*a*, and on the downstream side of the cartridge catching/retaining portion 84*a* with respect to the process cartridge mounting direction, and fixes the position of the process cartridge B with respect to the rotational direction of the process cartridge B, by being contacted by the butting surface 18*d* provided on the process cartridge frame to control the rotational movement of the process cartridge B, during an image forming operation; and a shutter guide portion 44*c*, which is located higher than the rotational controlling portion 44*b*, and constitutes one of the components of the mechanism for opening or closing the aforementioned drum shutter 12.

Figure 13:
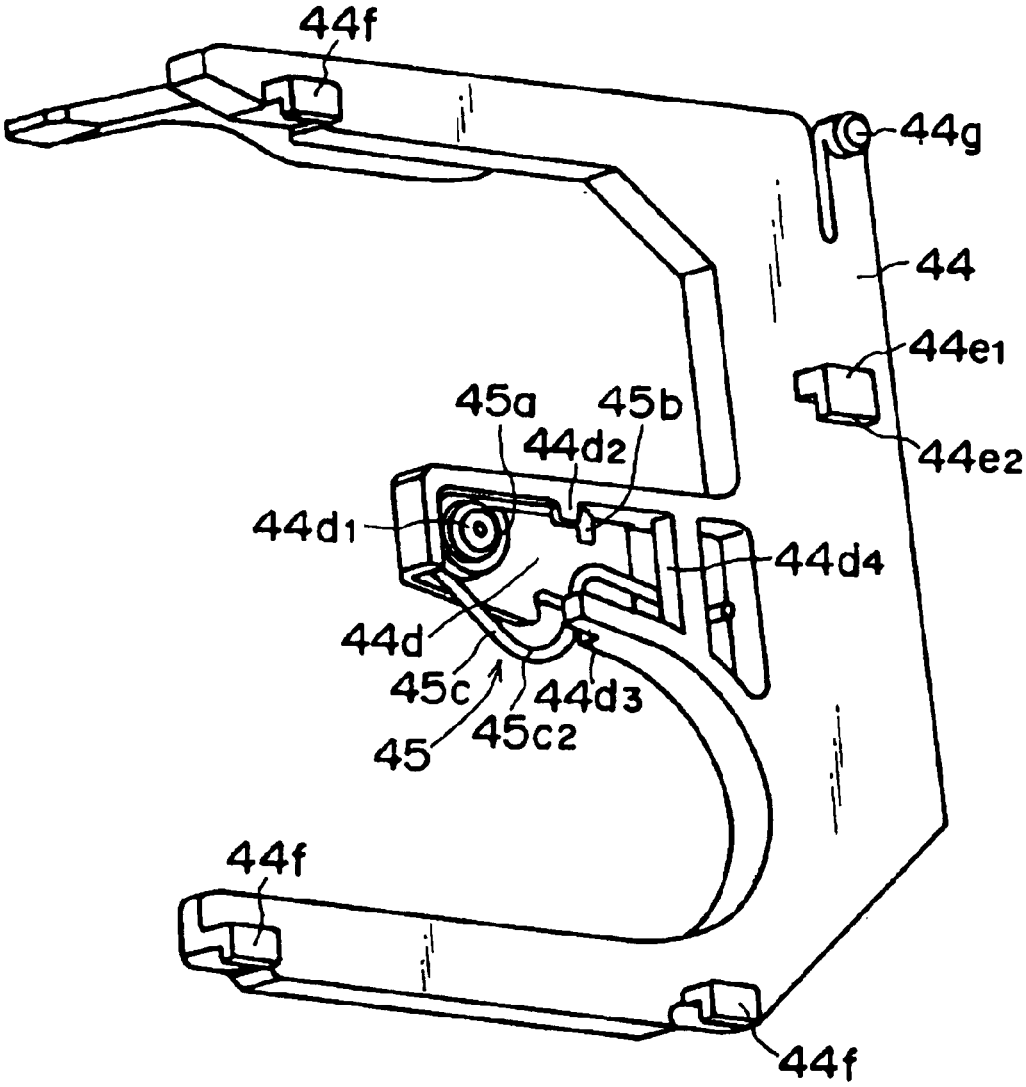
FIG. 13 is perspective views of a fixed guide and a screw coil spring.

Further, referring to FIG. 13, the stationary guide 44 is provided with a helical torsion coil spring 45, which is located in the middle portion among the three horizontal portions of the approximately E shaped stationary guide 44, and is for keeping the positioning guide 18*a* of the process cartridge B pressed upon the cartridge catching/retaining portion 84*a*, on the upstream side of the cartridge catching/retaining portion 84*a* with respect to the cartridge mounting direction. Thus, the surface of the stationary guide 44, which is placed in contact with the inner plate 40 is provided with a recess 44*d*, in which the helical torsion coil spring 45 is placed and is allowed to play its role. In the recess 44*d* are provided, a boss 44*d*1, around which the coiled portion of the helical torsion coil spring 45 is fitted, a claw 44*d*2 for preventing the stationary arm portion 45*b* of the helical torsion coil spring 45 from becoming dislodged, and a regulative claw 44*d*3 and a regulative rib 44*d*4 for regulating the position of the functional arm of 45*c* of the helical torsion coil spring 45, with respect to the lengthwise direction of the process cartridge B.

Also, the stationary guide 44 is provided with a positioning rib 44*e*1, which is for accurately positioning the stationary guide 44 relative to the right inner plate 40 and fixing it thereto, and is located on the surface opposite to the surface on which the rotation controlling portion 44*b* is located, in correspondence to the rotation controlling portion 44*b*. The positioning rib 44*e*1 accurately positions the stationary guide 44 relative to the right inner plate, with respect to the vertical direction, by being engaged into the positioning hole (unshown) of the right inner plate 40. The tip of the positioning rib 44*e*1 is provided with a claw 44*e*2, which prevents the stationary guide 44 from becoming dislodged from the right inner plate 40. Further, the stationary guide 44 is provided with three locking claws 44*f* for keeping the stationary guide 44 fixed to the right inner plate 40, and a projection 44*g* for preventing stationary guide 44 from horizontally sliding, ensuring that the stationary guide 44 remains firmly fixed to the right inner plate 40, maintaining the. proper attitude.

(Conveying Means Frame)

A bearing for rotationally supporting the transfer roller 4 is slidably attached to a conveying means frame 90 (FIG. 28), which provides a surface across which the recording medium is conveyed. The conveying means frame 90 is provided with a positioning portion 90*a*, which is located adjacent to, and above, the left end of the transfer roller 4, with respect to the axial direction of the roller 4, and the position of which corresponds to the position of the rotational axis of the large gear 83. The positioning portion 90*a* holds the positioning boss 18*a* of the process cartridge B to the position in which the process cartridge B is capable of carrying out an image forming operation. This positioning portion 90*a*, and the pushing arm 52, which will be described later, together constitute the means for accurately positioning the left side of the process cartridge B.

(Push Arm)

Figure 14:
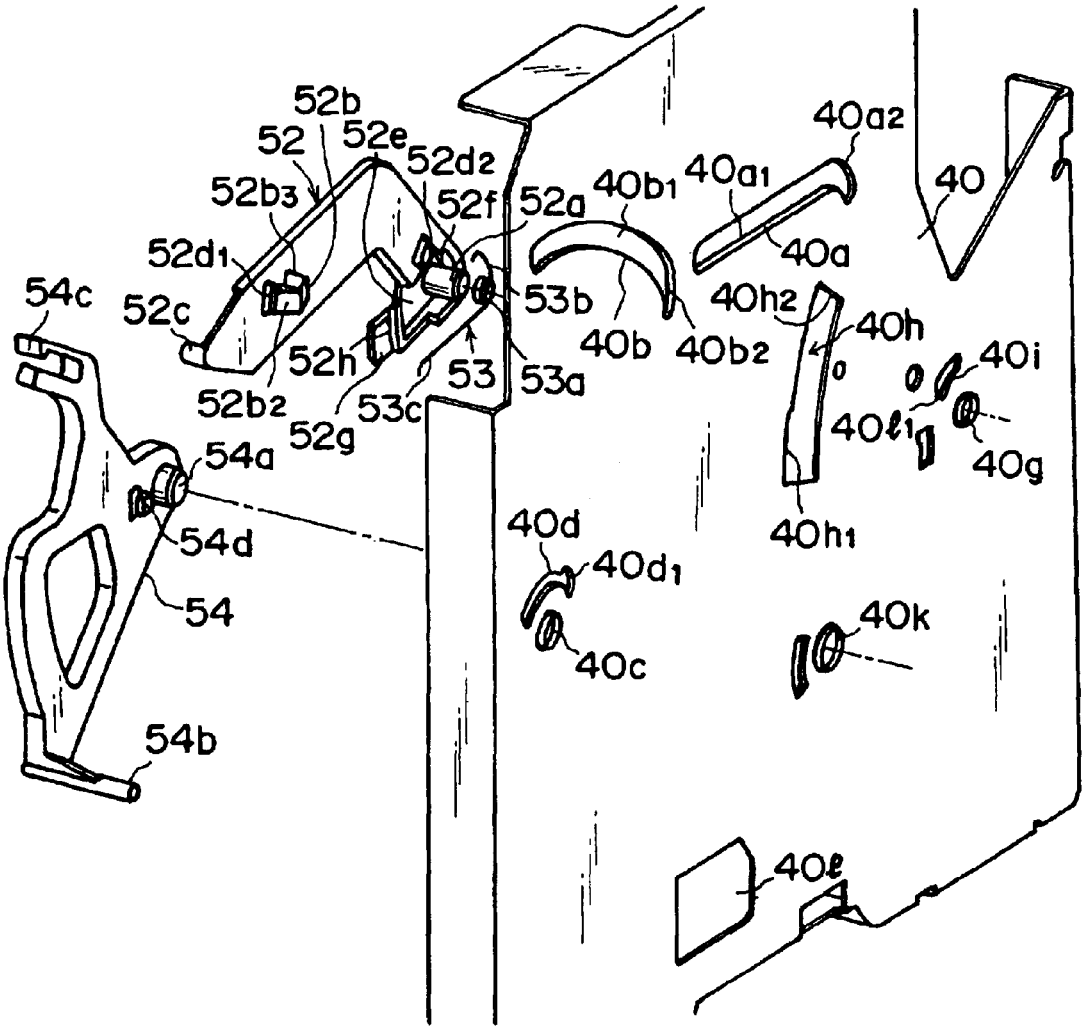
FIG. 14 is an exploded perspective view of a pushing arm and an inter-relating (interlocking) switch.
Figure 15:
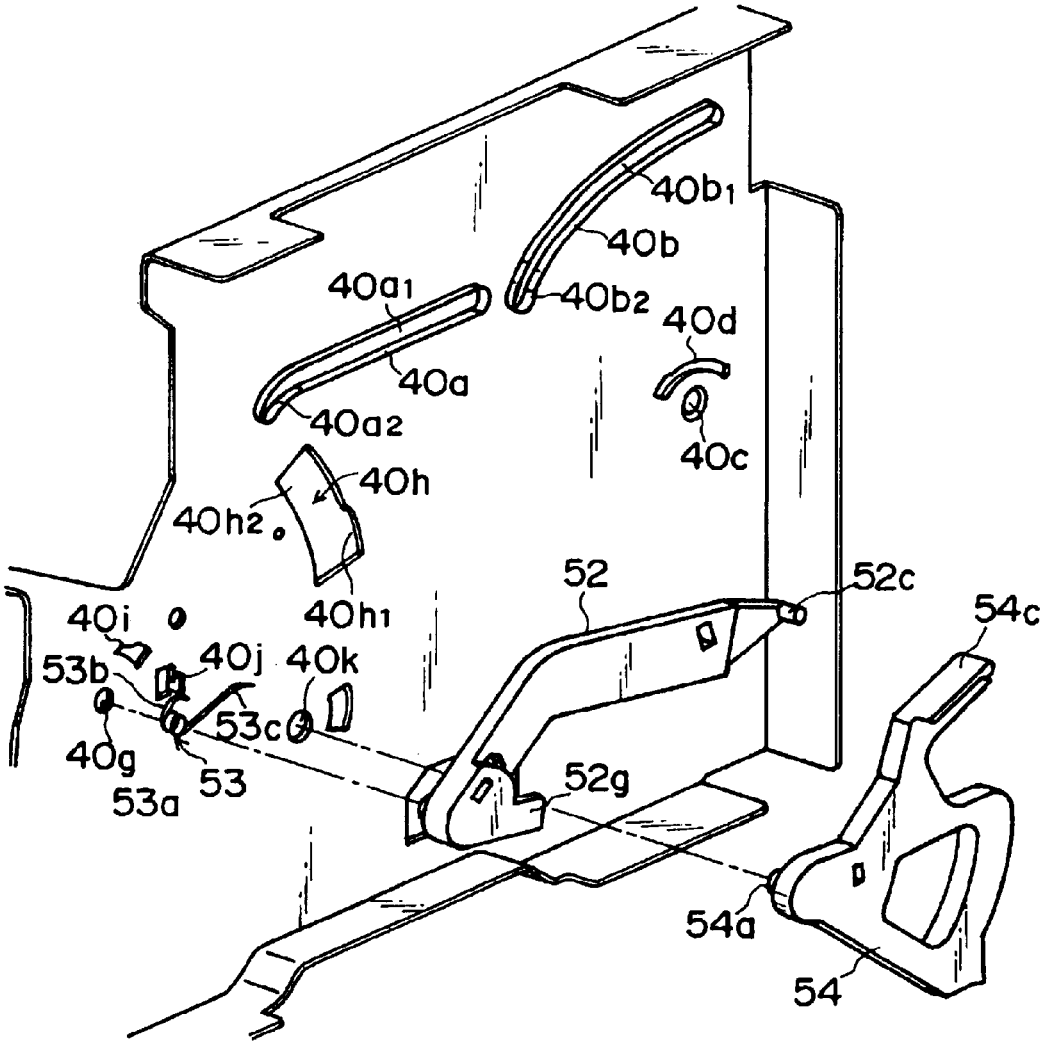
FIG. 15 is an exploded perspective view of a pushing arm and an inter-relating (interlocking) switch.

Referring to FIGS. 14 and 15, the left inner plate 40 is provided with a pushing arm 52, which has a function of holding the positioning boss 18*a* of the process cartridge B to the positioning portion 90*a*, after the process cartridge B is moved by the process cartridge mounting/dismounting mechanism, the movement of which is linked to the closing movement of the opening/closing cover 15.

The pushing arm 52 is rotationally supported by the left inner plate 40; the rotational shaft 52*a* of the pushing arm 52 is rotationally engaged in the hole 40*g* of the left inner plate 40. Further, the pushing arm 52 is provided with a resilient pressing portion 52*b*, which is pushed through a fan shaped hole 40*h* of the left inner plate 40.

The pushing arm 52 is provided with a helical torsion coil spring 53, which is fitted around the base portion of the rotational shaft 52*a*, and keeps the pushing arm 52 pressed upward to prevent the resilient pressing portion 52*b* from invading the path of the positioning guide 18*a* of the process cartridge B.

The tip of the resilient pressing portion 52*b* is provided with a boss 52*c*, which is for allowing the pushing arm 52 to oscillate, and engages in the second cam 50*h* of the cam plate 50. Further, the pushing arm 52 is provided with claws 52*d*1 and 52*d*2, which are for attaching the pushing arm 52 to the left inner plate 40, and are located adjacent to the base portion of the resilient pressing portion 52*b*, and the rotational shaft 52*a*, respectively. The claws 52*d*1 and 52*d*2 are put through the fan shaped hole 40*h* and key shaped hole 40*i* of the left inner plate 40, and latch on the back sides of the fan shaped hole 40*h*, and the key shaped hole 40*i* functioning as locking devices for preventing the pushing arm 52 from becoming disengaged from the left inner plate 40.

In addition, the pushing arm 52 is provided with: a recess 52*e* in which the aforementioned helical torsion coil spring 53 is disposed; a rib 52*f* as a means for preventing the functional arm 53*b* of the helical torsion coil spring 53 from dislodging; a protective rib 52*g*, which is large enough to keep the helical torsion coil spring 53 almost completely covered, within its rotational range, after the stationary arm 53*c* of the helical torsion coil spring 53 supported by the spring anchor portion 40*j* of the left inner plate 40 is fixed; and a temporarily holding rib 52*h*, which makes it possible to temporarily hold the stationary arm 53*c* of the helical torsion coil spring 53 to the pushing arm 52 before attaching it to the spring anchor portion 40*j*. They are near the base portion of the rotational shaft 52*a*.

(Interlocking Switch)

Referring to FIGS. 14 and 15, the left inner plate 40 is provided with an interlocking switch 54, which is rotationally supported by the plate 40. It presses a microswitch 91 (FIG. 58) provided on a circuit board, at the very end of the closing of the opening/closing cover 15. As the interlocking switch 54 presses the microswitch 91, current flows through various parts of the image forming apparatus main assembly, readying it for an image forming operation.

The interlocking switch 54 comprises: a rotational shaft 54*a* which functions as a pivot; a lever 54*b* which presses the microswitch 91; an elastic portion 54*c* which elastically bends as it presses on the contact surface 50*i* of the cam plate 50; and a claw 54*d* for attaching the interlocking switch 54 to the inner plate 40. The left inner plate 40 is provided with a hole 40*k*, the position of which corresponds to that of the rotational shaft 54*a*, and a hole 40*l* located outside the operational range of the lever 54*b*.

(Assembly Method)

Next, the method for assembling the above described various components will be described.

As will be understood from FIGS. 5, 7, and 15, and the like drawings, the moving guide 41 is attached to the inner plate 40 in the following manner. First, the claws 41*c*1 and 41*c*2 located at the tip of the second boss 41*c* are aligned with the arcuate portion 40*b*1 of the second guide rail 40*b*, and put though the arcuate portion 40*b*1. Then, the moving guide 41 is rotated. As the moving guide 41 is rotated, the claws 41*c*1 and 41*c*2 latch on the lips of the second guide rail 40*b*, preventing the second boss 41*c* from disengaging from the inner plate 40. Then, the first boss 41*b* of the moving guide 41 is put through the first guide rail 40*a*. Next, the moving guide 41 is moved toward the inclined portion 40*a*2 of the first guide rail 40*a*, and a guide stopper 46 as a disengagement prevention device is fitted in the through hole 41*b*2 of the first boss 41*b*.

Referring to FIG. 5, the guide stopper 46 comprises: a cylindrical portion 46*a*1 which is located in the center of the guide stopper 46, and fits in the through hole 41*b*2; a shaft 46*a*2, which is located also in the center of the guide stopper 46, and is smaller in diameter than the cylindrical portion 46*a*1; and a bottom portion 46*b*, to which the cylindrical portion 46*a*1 is connected, with the interposition of the shaft portion 46*a*2. The guide stopper 46 also comprises a pair of side walls 46*c*, which perpendicularly project from the lengthwise ends of the bottom portion 46*b*, one for one.

Thus, as the cylindrical portion 46*a*1 and shaft portion 46*a*2 of the guide stopper 46 are fitted into the through hole 41*b*2, the snap fitting claw 41*b*1 latches on the stepped portion between the cylindrical portion 46*a*1 and shaft portion 46*a*2, and the pair of side walls 46*c* is enabled to contact the inner plate 40, on the outward side of the lips of the guide rail 40*a* formed by burring. The first boss 41*b* is structured so that when the first boss 41*b* of the moving guide 41 is fitted through the inclined portion 40*a*2 of the guide rail 40*a*, the position of the snap fitting claw 41*b*1 with respect to the circumferential direction of the first boss 41*b* coincides with the direction in which the inclined portion 40*a*2 diagonally extends. Therefore, the presence of the snap fitting claws 41*b*1 does not adversely affect assembly efficiency. With the provision of the above described structural arrangement, even if the moving guide 41 is subjected to such force that might cause the moving guide 41 to fall into the inward side of the left or right inner plate, the snap fitting claw 41*b*1 remains latched on the cylindrical portion 46*a*1 of the guide stopper 46, and the pair of side walls 46*c* remain in contact with the inner plate 40, preventing the moving guide 41 from disengaging from the inner plate 40.

Each side wall 46*c* of the guide stopper 46 is rendered substantially taller than the lips of the first guide 40*a* formed by burring. Therefore, it does not occur that bottom portion 46*b* of the guide stopper 46 is shaved by coming into contact with the flush left on the lips of the first guide rail 40*a* when the first guide rail 40*a* was formed by burring.

After attaching the moving guide 41 to the inner plate 40, the cam plate 50 shown in FIG. 8 and the like are attached.

When the moving guide 41 is in the position at which the second boss 41*c* contacts the bottom end of the straight portion 40*b*2 of the guide rail 40*b*, the direction in which the claws 41*c*1 and 41*c*2 of the second boss 41*c* extends aligns with the hole 40*c*, the axial line of which coincides with the rotational axis of the cam plate 50.

Thus, the assembly facilitation hole 50*b*3 of the cam plate 50 is aligned with the second boss 41*c* of the moving guide 41, and the rotational shaft 50*a* is inserted into the hole 40*c*. As the rotational shaft 50*a* is inserted into the hole 40*c*, the cam plate 50 comes into contact with the inner plate 40, since the assembly facilitation claw 50*e* is positioned so that as the assembly facilitation hole 50*b*3 is aligned with the second boss 41*c*, the assembly facilitation claw 50*e* aligns with the assembly facilitation portion 40*d*1 of the arcuate hole 40*d*.

In this state, the cam plate 50 is rotated in the direction in which the opening/closing cover 15 is opened. As the cam plate 50 is rotated, the temporary holding rib 50*c* passes the back side of the claw 41*c*1 of the second boss 41*c* of the moving guide 41; the claws 41*c*1 and 41*c*2 come into contact with the edge of the cam hole 50*b*; and the assembly facilitation claw 50*e* latches on the edges of the arcuate hole 40*d*. As a result, the cam plate is properly fixed to inner plate 40.

In consideration of the variance in component size resulting from manufacturing errors, a gap is provided between the surface on which the temporary holding rib 50*c* is located and the claws 41*c*1 and 41*c*2 located at the top of the second boss 41*c* of the moving guide 41, and the height of the temporary holding rib 50*c* is rendered slightly greater than this gap. Therefore, the temporary holding rib 50*c* is caught by the claw 41*c*1 of the second boss 41*c* of the moving guide 41, preventing the cam plate 50 from rotating far enough to allow the assembly facilitation hole 50*b*3 of the cam plate 50 to align with the second boss 41*c* of the moving guide 41. Therefore, the boss 41*c* does not disengage from the assembly facilitation hole 50*b*3 of the cam plate 50.

The right cam plate 50 is attached to the right inner plate 40 in the following manner. First, the thruster rod 55 is connected to the coupling cam 85, and the elongated hole 55*b* of the thruster rod 55 is aligned with the claws 50*g*1 and 50*g*2 of the second boss 50*g*. Then, the right cam plate 50 is attached to the right inner plate 40. Thereafter, the thruster rod 55 is rotated to make the elongated hole 55*b* intersect with the direction in which the claws 50*g*1 and 50*g*2 extend. Then, the coupling cam 85 is fitted around the cylindrical portion 84*b* of the inward bearing 84, completing the four joint linkage comprising the cam plate 50, coupling cam 85, and thruster rod 55.

Thereafter, the cam plate 50 is rotated, as described above, to complete the process for attaching the moving guide 41 and cam plate 50 to the inner plate 40.

Referring to FIG. 13, after the helical torsion coil spring 45 is placed in the recess 44*d* of the stationary guide 44, the positioning rib 44*e*1 and locking claws 44*f* of the stationary guide 44 are aligned with the positioning hole (unshown) and connecting holes (unshown) of the right inner plate 40, and are fitted therein. Then, the stationary guide 44 is slid. As the stationary guide 44 is slid, the claw 44*e*2 of the positioning rib 44*e*1, and the locking claws 44*f*, latch on the edges of the positioning hole and connecting holes, by their back surfaces. Further, the slide regulating projection 44*g* fits in the corresponding connecting hole (unshown), fixing the position of the stationary guide 44 relative to the inner plate 40 with respect to the direction in which the stationary guide 44 is slid.

Referring to FIGS. 14 and 15, before the pushing arm 52 is attached to the left inner plate 40, the helical torsion coil spring 53 is attached to the pushing arm 52.

More specifically, the coiled portion 53*a* of the helical torsion coil spring 53 is fitted around the rotational shaft 52*a*, and the functional arm 53*b* is set under the rib 52*f*. Then, the stationary arm 53*c* is rested on the temporary stationary arm rest 52*h*, which is on the back side of the protective rib 52*g*.

The pushing arm 52 is structured so that as the resilient pressing portion 52*b* is aligned with the wider portion 40*h*, that is, the bottom end portion of the fan shaped hole 40*h*, the claw 52*d*2 aligns with the wider portion 40*i*1 of the key shaped hole 40*i*. When the pushing arm 52 is in the above described state, the spring anchor portion 40*j* of the left inner plate 40 can be seen above the protective rib 52*g*.

The pushing arm 52 being in the above described state, the stationary arm 53*c* of the helical torsion coil spring 53 is transferred from the temporary stationary arm rest 52*h* to the spring anchor portion 40*j* by being held by its tip. As a result, the resiliency stored in the helical torsion coil spring 53 is released, and pivots the pushing arm 52 upward, causing the claw 52*d*1 located at the base portion of the resilient pressing portion 52*b*, and the claw 52*d*2 located near the rotational shaft 52*a*, to latch on the edges of the fan shaped hole 40*h* and key shaped hole 40*i*, respectively, completing the process for attaching the pushing arm 52.

During this process, as the pushing arm 52 is rotated upward by the resiliency of the helical torsion coil spring 53, the butting portion 52*b*3, that is, the tip of the resilient pressing portion 52*b* comes into contact with the top end 40*h*2 of the fan shaped hole 40*h*, allowing the pulling surface 52*b*2 located at the base portion of the resilient pressing portion 52*b*, to escape upward above the path of the positioning guide 18*a* of the process cartridge B, and then, remains on standby. As the pushing arm 52 enters into the standby state, the stationary arm 53*c* of the helical torsion coil spring 53 moves to a position at which it is hidden behind the protective rib 52*g* of the pushing arm 52.

After the various components are attached to the left and right inner plates 40, various units, for example, the conveying means frame 90 unit, to which the conveying means, the transfer roller 4, the fixing means 5, and the like, have been attached, the optical system 1 unit, and the like units, are attached to the left and right inner plates 40. Thereafter, the external trims and shells inclusive of the opening/closing cover 15 are attached to complete an image forming apparatus.

During the above described final stage of the assembly, the wide portion 40*h*1 of the fan shaped hole 40*h* of the left inner plate 40 is plugged by the positioning portion 90*a* of the conveying means frame 90, so that the pushing arm 52 is prevented from becoming disengaged after the image forming apparatus is completely assembled.

In order to attach the opening/closing cover 15, the center boss 15*a* of each hinge 15*b* of the opening/closing cover 15 is fitted into the corresponding supporting hole 43*a* of the front guide 43, by elastically deforming the hinge 15*b* in the lengthwise direction of the process cartridge B. The front guide 43 is fixed to the left and right inner plates 40.

Next, the method for connecting the connecting plate 51 to the cam plate 50 and opening/closing cover 15 will be described.

Figure 27:
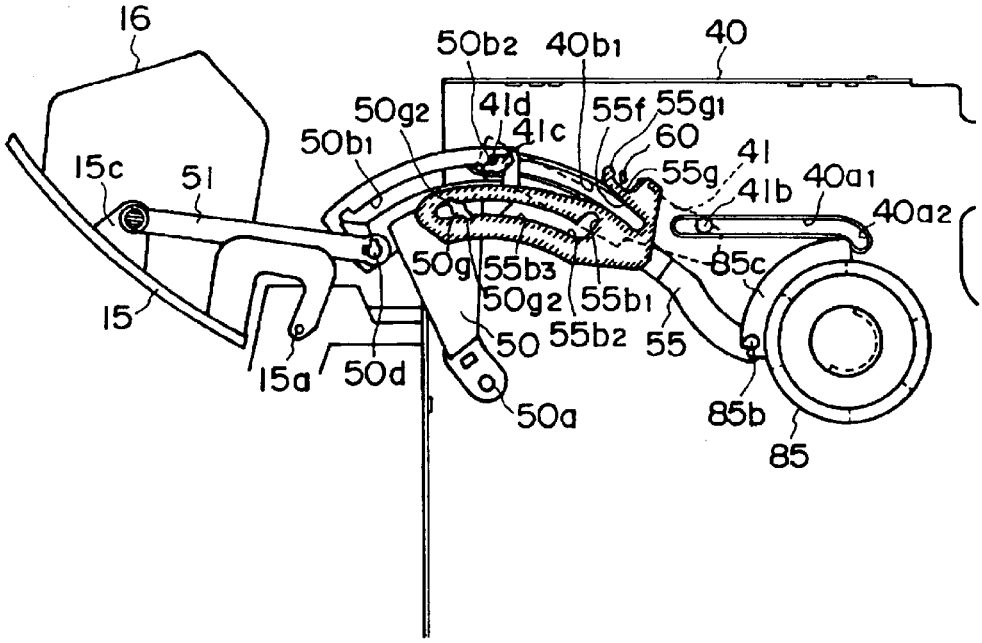
FIG. 27 is an illustration of a process cartridge inserting operation into the process cartridge mounting-and-demounting mechanism, at the righthand side inner plate in the image forming apparatus, as seen at the same timing as FIG. 26.

As will be understood referring to, for example, FIG. 27, rotating the opening/closing cover 15 and cam plate 50 in the opening direction of the opening/closing cover 15 exposes the connecting boss 50*d* and connecting hole 15*c*, by which the cam plate 50 and opening/closing cover 15 are connected to each other. The claw 50*d*1 of the connecting boss 50*d* points outward with respect to the radius direction of the cam plate 50. The recess 51*a*1 of the hole 51*a* of the connecting plate 51 extends toward the shaft 51*b*. Therefore, as the connecting plate 51 is pointed outward with respect to the radius direction of the cam plate 50, and the claw 50*d*1 and recess 51*a*1 engage with each other. As a result, the connecting plate 51 becomes attached to the cam plate 50.

Thereafter, the shaft 51*b* is put through the connecting hole 15*c* by rotating the connecting plate 51. As the shaft 51*b* is put through the connecting hole 15*c*, the snap fitting claw 51*b*1 latches on the edge of the connecting hole 15*c*, preventing the shaft 51*b* from disengaging.

As a result, the opening/closing cover 15 and cam plate 50 rotationally supported by the image forming apparatus main assembly 14 form the four joint linkage connected by the connecting plate 51. With the provision of this structural arrangement, the linking mechanism becomes such a mechanism that the moving guide 41 is moved by the cam plate 50 during the first half of the process for closing the opening/closing cover 15, and the latter half of the process for opening the opening/closing cover 15.

(Mounting of Process Cartridge into Apparatus Main Assembly and Dismounting of Process Cartridge from Apparatus Main Assembly)

Next, referring to FIGS. 16 25, the processes carried out by an operator to mount the process cartridge B into, or dismount the process cartridge B from the image forming apparatus A equipped with the process cartridge mounting/dismounting mechanism, will be described.

As the opening/closing cover 15 of the image forming apparatus main assembly A is fully opened (fully open state), an opening W, through which the process cartridge B is mounted or dismounted, is exposed. In this state, the moving guide 41 is tilted diagonally downward with respect to the process cartridge insertion direction, as shown in FIG. 16. On the upstream side, there are left and right auxiliary guides 42, which are symmetrically fixed to the left and right inner plate 40, one for one.

Figure 17:
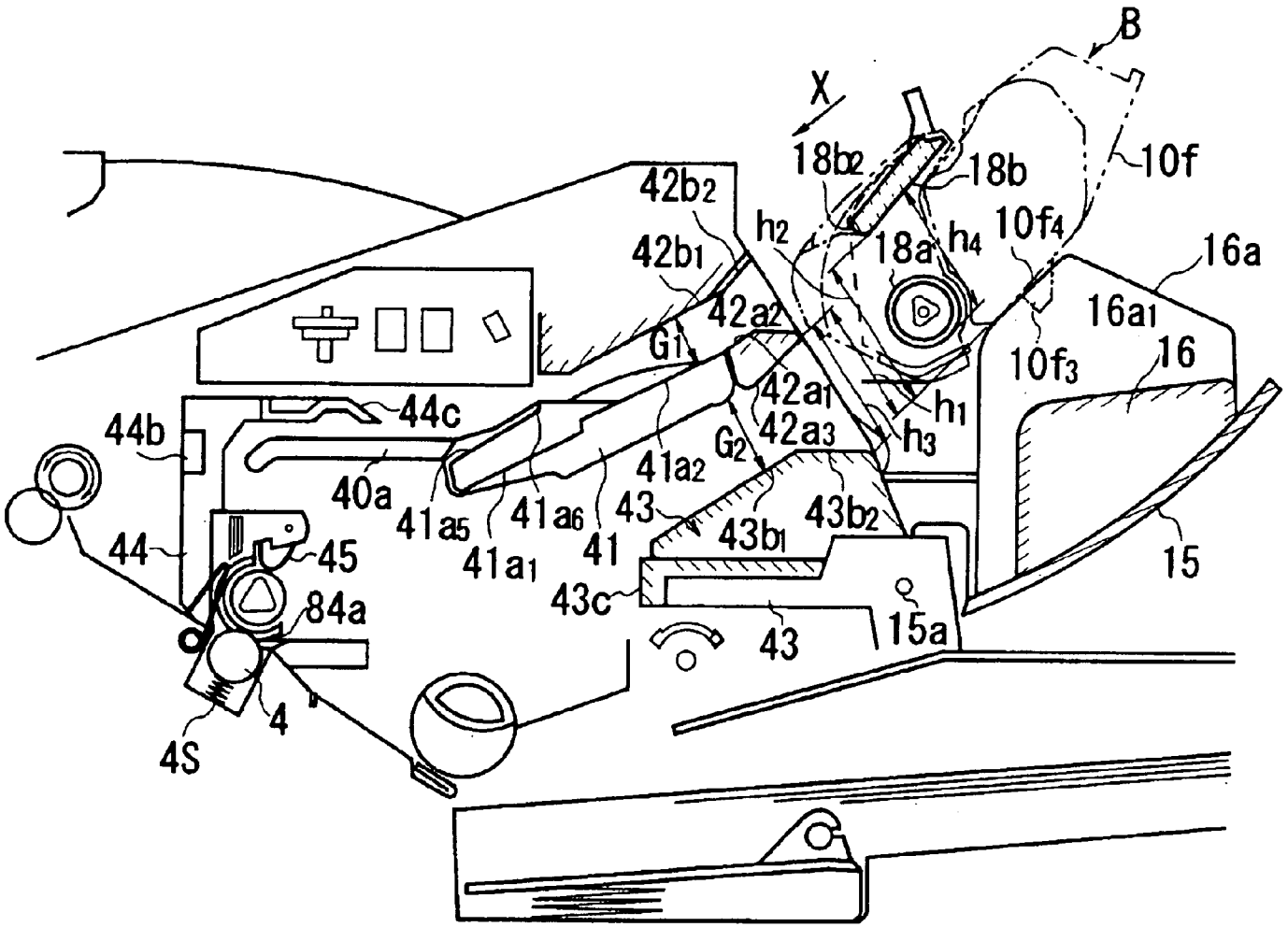
FIG. 17 is an illustration of an inserting operation of the process cartridge into a process cartridge mounting-and-demounting mechanism.

As will be more easily understood referring to FIG. 17, each auxiliary guide 42 has a mounting/dismounting assistance portion 42*a*, which is connected to the trailing end of the moving guide 41, and a top regulating portion 42*b*, which has such a surface that is virtually in contact with, and flush with, the top surface 41*a*6 of the moving guide 41.

The mounting/dismounting assistance portion 42*a* is provided with a front guiding surface 42*a*1 contiguous with the guiding surface 41*a*2, an entry guiding surface 42*a*2, which is contiguous with the front guiding surface 42*a*1, and is gentler in inclination than the front guiding surface 42*a*1, being virtually horizontal, and a bottom guide surface 42*a*3, which is located below the front guiding surface 42*a*1 and entry guiding surface 42*a*2, and extends toward the bottom surface of the moving guide 41, being steeper in inclination than the front guiding surface 42*a*1.

Further, the top regulating portion 42*b* is provided with a top regulating surface 42*b*1, which is virtually continuous and flush with the top surface 41*a*6 of the moving guide 41, and a top entry guiding surface 42*b*2, which is contiguous with the top regulating surface 42*b*1, being virtually parallel to the bottom guiding surface 42*a*3, and extends diagonally upward from the top regulating surface 42*b*1.

The side guide 43*b* of the above described front guide 43 is provided with an inclined surface 43*b*1, which is virtually parallel to the guiding surface 41*a*2 of the moving guide 41, being only slightly greater in inclination than the guiding surface 41*a*2 of the moving guide 41, and a horizontal surface 43*b*2 which is on the opening/closing cover 15 side and is contiguous with the inclined surface 43*b*1.

Thus, on the inward surface of each of the left and right inner plates 40 visible through an opening W which appears as the opening/closing cover 15 is opened, there are two guiding grooves: a top guide G1 and a bottom guide G2. The top guide G1 is wider on the entry side because of the configuration of the entry guiding surface 42*a*2 and top entry guiding surface 42*b*2, is formed by the top regulating portion 42*b*, mounting/dismounting assisting portion 42*a* of the auxiliary cover 42, and the moving guide 41, and extends diagonally downward with respect to the process cartridge insertion direction. The bottom guide G2 is wider on the entry side because of the configuration of the bottom guiding surface 42*a*3 and horizontal surface 43*b*2, is formed by the mounting/dismounting assisting portion 42*a*, moving guide 41, and side guide 43*b*, and extends diagonally downward with respect to the cartridge insertion direction.

Referring to FIG. 10, the center bosses 15*a* of the opening/closing cover 15 are on the bottom side of the opening/closing cover 15. Therefore, the opening/closing cover 15 opens downward, causing the backing 16 to face upward toward the opening W. Each of the projections 16*a* of the backing 16 is provided with a loosely guiding surface 16*a*1, which extends diagonally downward with respect to the process cartridge insertion direction.

As described above, the process cartridge B comprises: the pair of positioning guides 18*a*, which are on the both lateral walls of the cartridge frame CF, one for one, and the axial line of which coincides with the rotational axis of the photoconductive drum 7; and the pair of mounting guides 18*b*, which are in the form of a rib, and extend in the direction in which the process cartridge B is mounted or dismounted. The process cartridge B also comprises a pair of projections 10*f*3, which are located on the downwardly facing surface of the toner/developing means holding frame 10*f*, near the lengthwise ends thereof, one for one.

When inserting the process cartridge B through the opening W, the mounting guides 18*b* and positioning guides 18*a* of the process cartridge B are aligned with the top and bottom guides G1 and G2 on the side walls of the opening W, respectively, and the process cartridge B is inserted until the mounting guides 18*b* abut the deepest ends of the guiding grooves 41*a* of the moving guides 41. During this process, the projections 16*a* of the backing 16 regulate the position of the process cartridge B at the opening W, to a certain degree; in other words, they function as rough guides which make it easier for the mounting guides 18*b* and positioning guides 18*a* of the process cartridge B to be guided to the top and bottom guides G1 and G2, respectively. More specifically, as shown in FIG. 17, a structural arrangement is made so that the distance h1 from the loosely guiding surface 16*a*1 to the highest point of the entry guiding surface 42*a*2 on the opening/closing cover 15 side, and the distance h2 from the downwardly facing surface of the toner/developing means holding frame 10*f* to the intersection between the bottom surface 18*b*1 and end surface 18*b*2 of the mounting guide 18*b*, are set to satisfy the following inequality:

$$h1<h2.$$

Further, another structural arrangement is made so that the distance h3 from the highest point of the entry guiding surface 42*a*2 on the opening/closing cover side to the higher point of the horizontal surface 43*b* 2 of the side guide 43*b*, and the distance h4 from the intersection between the bottom surface 18*b*1 and end surface 18*b*2 of the mounting guide 18*b* to the bottom surface of the positioning guide 18*a*, are set to satisfy the following inequality:

$$h3>h4.$$

Figure 18:
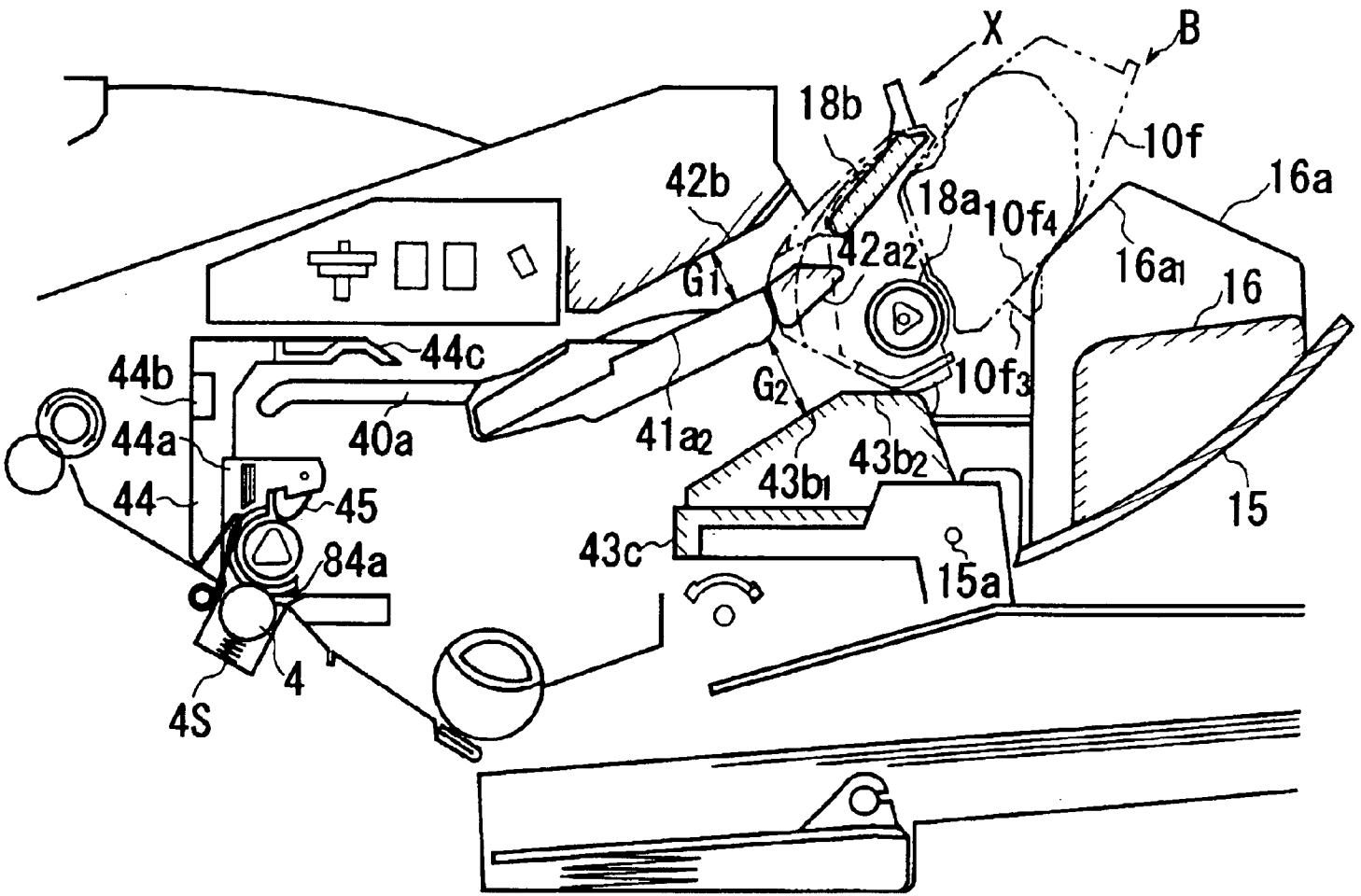
FIG. 18 is an illustration of an inserting operation of the process cartridge into a process cartridge mounting-and-demounting mechanism.

With the provision of these structural arrangements, as the process cartridge B is inserted while making the bottom wall of the toner/developing means holding frame 10*f* follow the loosely guiding surface 16*a*1, that is, the top surface of the projection 16*a*, the mounting guide 18*b* and positioning guide 18*a* are spontaneously guided to the entrances of the top and bottom guides G1 and G2, respectively, as shown in FIGS. 17 and 18. The position of the process cartridge B in this state is the position from which the process cartridge B is inserted into the apparatus main assembly 14 to mount the process cartridge B into the apparatus main assembly 14, or the position from which the process cartridge B can be picked up by an operator.

Figure 19:
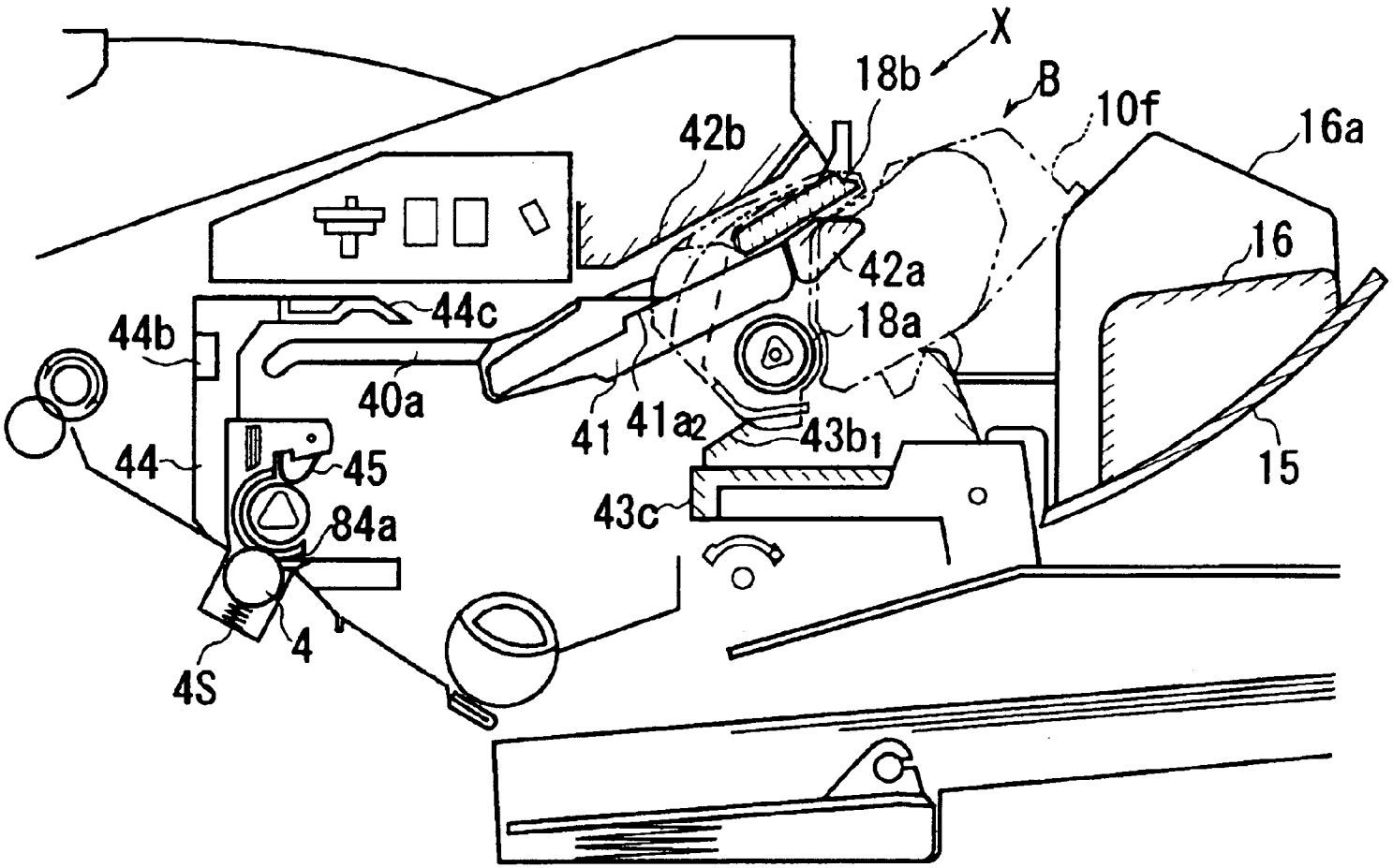
FIG. 19 is an illustration of a process cartridge inserting operation into the process cartridge mounting-and-demounting mechanism.

Referring to FIG. 19, until the mounting guide 18*b* begins to slide onto the guiding surface 41*a*2 of the moving guide 41, the projection 16*a* remains in contact with the trailing end of the toner/developing means holding frame 10*f*, and keeps the process cartridge B tilted downward with respect to the process cartridge insertion direction, making it easier for the process cartridge B to be moved inward of the guiding groove 41*a* of the moving guide 41, by the self weight of the process cartridge B.

The reason why the projections 16*a* are located near the lengthwise ends of the backing 16, and the center portion is kept low, is to secure a gap large enough for the hand of a user to be easily put through when mounting or dismounting, or when dealing with a paper jam. In other words, the configuration is made to make the opening W, which is exposed as the opening/closing cover 15 is opened, satisfy both the requirement for providing the region for the mounting of the process cartridge B and the requirement for providing the gap for a user to access the interior of the image forming apparatus.

Figure 22:
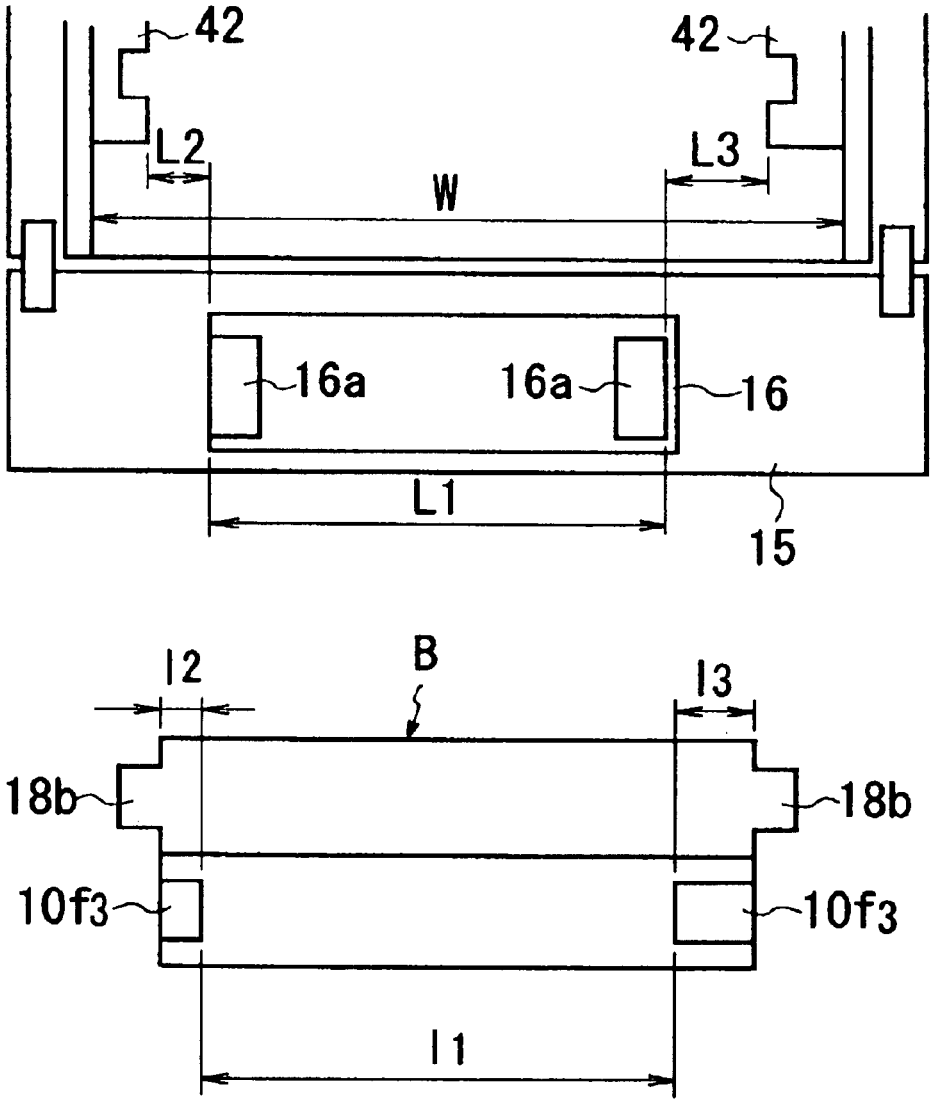
FIG. 22 is an illustration of a positional relation, in the longitudinal direction, of the back cap projection and a projection of the process cartridge at an opening W.

At this time, referring to FIG. 22, the relationship between the projection 16*a* and process cartridge B, at the opening W, with respect to the lengthwise direction of the process cartridge B, will be described.

When the gap between the outward sides of the two projections 16*a* of the backing 16 is L1; the gap between the outward surface of the left projection 16 and the inward surface of the left auxiliary guide, is L2; the gap between the outward surface of the right projection and inward surface of the right auxiliary guide, is L3; the gap between the inward sides of the two projections 10*f*3 of the process cartridge B,l1; the gap between the inward surface of the left projection and the left lateral wall of the cartridge frame CF, is l2; and the gap between the inward surface of the right projection and the lateral wall of the cartridge frame CF is l3, the following relations are satisfied:

$$L1<l1 \tag{1}$$

$$L2=l2+(l1L1)/2+((L1+L2+L3)-(l+l2+l3))/2 \tag{2}$$

$$L3=l3+(l1L1)/2+((L1+L2+L3)-(l1+l2+l3))/2 \tag{3}$$

Thus, since inequality (1) is satisfied, the pair of projections 16*a* located near the lengthwise end of the backing 16 fit between the projections 10*f*3 on the bottom wall of the toner developing means holding frame 10*f*, and from approximations (2) and (3), it is evident that by loosely aligning the projections 10*f*3 with the projections 16*a*, the process cartridge B can be aligned with the opening W with respect to the lengthwise direction of the process cartridge B.

As described above, the front guiding surface, which is the bottom surface of the top guide G1, and the guiding surface 41*a*2, are tilted downward with respect to the process cartridge mounting direction, and the trailing end of the mounting guide 18*b* is extended beyond a point corresponding to the center of the gravity of the process cartridge B. Therefore, as the mounting guides 18*b* and positioning guides 18*a* of the process cartridge B are guided to the top and bottom guides G1 and G2 with the use of projections 16*a* of the backing 16 constructed as described above, the process cartridge B is tilted downward with respect to the process cartridge mounting direction, being automatically guided inward of the moving guide 41 by its own weight.

As will be understood referring to FIG. 19, the inclined surface 43*b*1 of the side guide 43*b*, that is, the bottom surface of the bottom guide G2, is slightly greater in inclination than the guiding surface 41*a*2. Therefore, as the process cartridge B is inserted deeper, the positioning guide 18*a* leaves the inclined surface 43*b*1 of the side guide 43*b*.

For this reason, the process cartridge mounting/dismounting mechanism is structured so that as the process cartridge B is inserted through the opening WV, the mounting guide 18*b* is caught by the moving guide 41.

Figure 20:
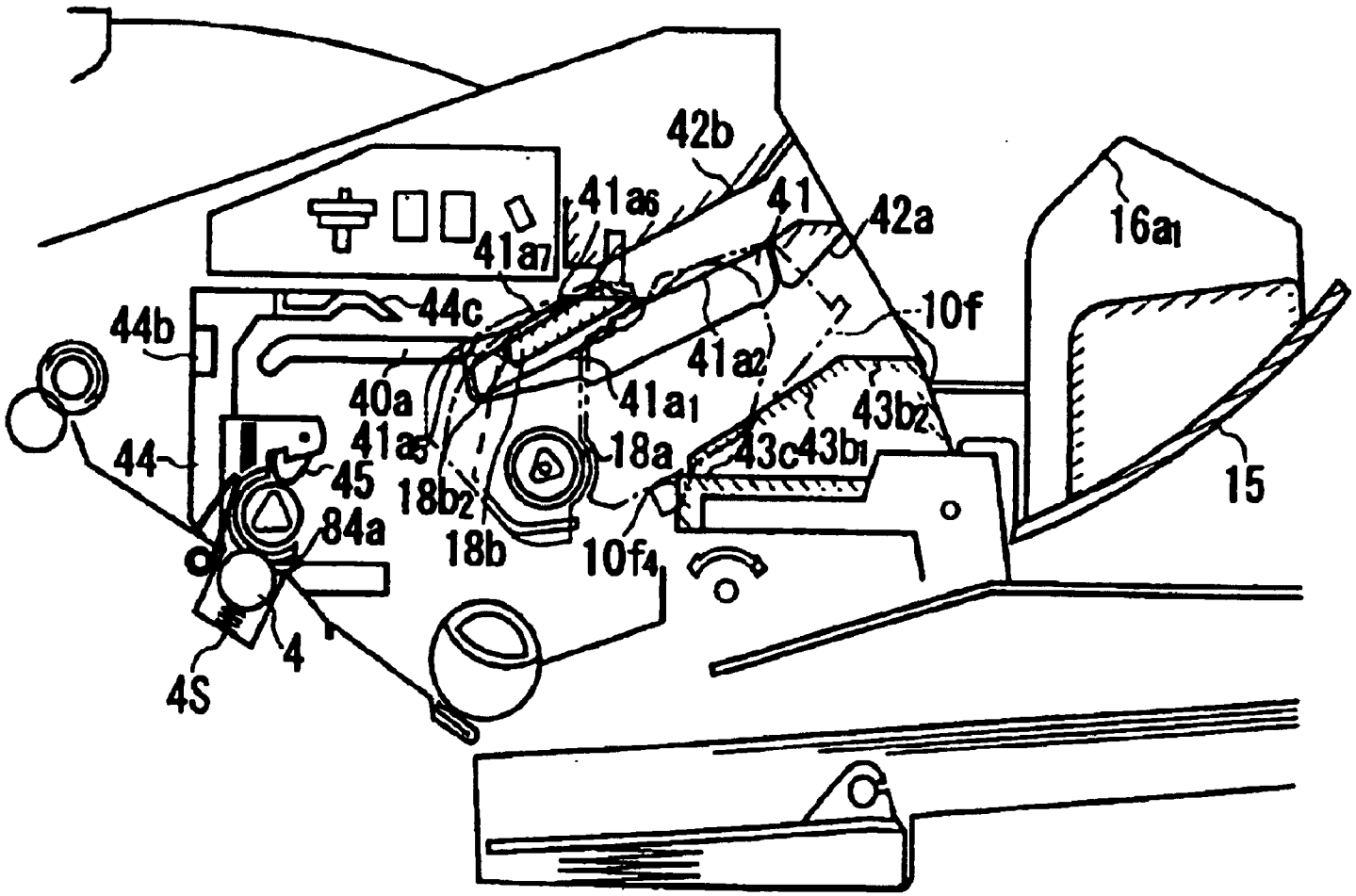
FIG. 20 is an illustration of a process cartridge inserting operation into the process cartridge mounting-and-demounting mechanism.
Figure 21:
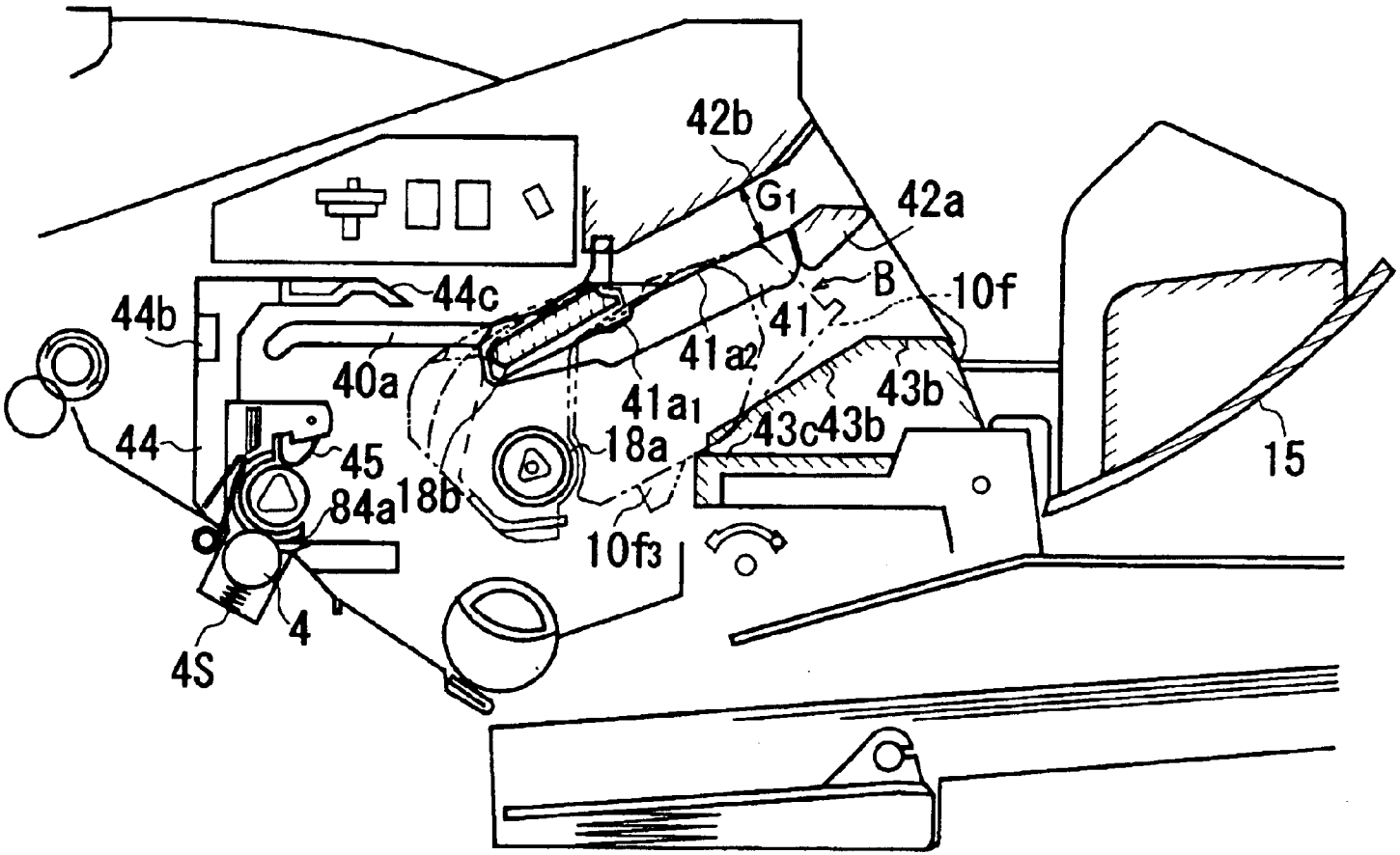
FIG. 21 is an illustration of a process cartridge inserting operation into the process cartridge mounting-and-demounting mechanism.

As the process cartridge B is inserted deeper after being caught by the guiding surface 41*a*2 of the moving guide 41, the end surface 18*b*2 of the mounting guide 18*b* comes into contact with the inclined top surface 41*a*7 of the moving guide 41 (FIG. 20). The end surface 18*b*2 of the mounting guide 18*b* is smooth and arcuate, and the bottom side of the inclined top surface 41*a*7 forms a retaining surface 41*a*1, which is lower than the guiding surface 41*a*2. Therefore, as the process cartridge B is inserted inward of the guiding groove 41*a*, its attitude is changed by the function of the inclined top surface 41*a*7, in the direction to increase its inclination. Consequently, the end surface 18*b*2 of the mounting guide 18*b* comes into contact with the deepest end of the retaining surface 41*a*1, ending the mounting of the process cartridge B into the moving guide 41, as shown in FIG. 21. As is evident from the descriptions given up to this point, when the process cartridge B is mounted into the moving guide 41 by an operator, the process cartridge B is inserted diagonally downward into the apparatus main assembly.

Referring to FIGS. 20 and 21, when the attitude of the process cartridge B is changed in the direction to increase the inclination of the process cartridge B, the end of the contact rib 43*c* of the front guide 43 comes into contact with the bottom surface 10*f*4 of the toner/developing means holding frame 10*f*, and the process cartridge B tilts downward with respect to the process cartridge mounting direction, with the contact rib 43*c* and bottom surface 10*f*4 remaining in contact with each other.

The process cartridge mounting/dismounting mechanism is structured so that after the completion of the insertion of the process cartridge B into the moving guide 41, the contact point between the bottom surface 10*f*4 of the toner/developing means holding frame 10*f* and the contact rib 43*c* will be on the trailing side with respect to the center of gravity of the process cartridge B with respect to the process cartridge mounting direction. Therefore, at the completion of the process cartridge B insertion into the moving guide 41, the process cartridge B assumes such an attitude that the toner/developing means holding frame 10*f* side of the process cartridge B, that is, the side which becomes the trailing side with respect to the process cartridge mounting direction, has been lifted. Thus, after being inserted through the opening W, the process cartridge is supported in such a manner that the bottom side of the end surface 18*b*2 of the mounting guide 18*b* is supported by the deeper end of the retaining surface 41*a*1 of the guiding groove 41*a*, and the bottom surface 10*f*4 of the toner/developing means holding frame 10*f* is supported by the contact rib 43*c* of the front guide 43, as shown in FIG. 21. For this reason, the bottom corner 18*b*3 of the trailing end of the mounting guide 18*b* has been lifted.

The contact rib 43*c* is structured so that the bottom corner 18*b*3 of the trailing end of the mounting guide 18*b* will become level with the guiding surface 41*a*2 of the moving guide 41.

At this time, the inclination of the guiding surface 41*a*2 will be described.

If the inclination of the guiding surface 41*a*2 is too gentle, it is impossible for the process cartridge B to be guided inward of the moving guide 41 by its own weight, and therefore, the process cartridge B must be pushed inward by a user. On the contrary, if the inclination of the guiding surface 41*a*2 is too steep, the process cartridge B slides down too fast into the apparatus main assembly as it is released by a user during the process cartridge B insertion. As a result, it is possible for the impact, to which the process cartridge B is subjected as it reaches the deepest end of the moving guide 41, to become large enough to damage the process cartridge B and/or image forming apparatus main assembly 14. Therefore, the inclination of the guiding surface 41*a*2 is desired to be in a range of 15 to 50 deg. relative to a horizontal direction. In this embodiment, the inclination of the guiding surface 41*a*2 is set to approximately 26 deg. relative to a horizontal direction.

As described previously, the process cartridge B is inserted into the moving guide 41, from the point (first location) at which the guiding surface 41*a*2 of the guiding groove 41*a* connects to the front guide surface 42*a*1 of the auxiliary guide 42. The moving guide 41 assumes such an attitude (first attitude) that it tilts downward with respect to the process cartridge mounting direction, that is, such an attitude that when the process cartridge B is at the point beyond which the process cartridge B is mounted into the moving guide 41, that is, the point at which the guiding surface 41*a*2 is contiguous with the front guiding surface 42*a*1, the direction X in which the process cartridge B is mounted into the guiding groove 41*a* intersects with the direction in which the recording medium 2 is conveyed by the conveying means 3. This is for the following reason. That is, as will be understood from FIG. 27, the process cartridge mounting/dismounting mechanism is structured so that when the opening/closing cover 15 is fully open, the second boss 41*c* of the moving guide 41 will be at the end of the straight portion (groove hole) 50*b*1 of the cam hole 50*b*, and the first boss 41*b* will be at the end of the first guide rail 40*a* on the opening/closing cover 15 side.

In this embodiment, the moving guide 41 of the process cartridge mounting/dismounting mechanism is structured so that its movement is linked to the opening or closing movement of the opening/closing cover 15. Thus, if the moving guide 41 is structured so that the trailing end (end on the cover side) of the moving guide 41 can be pushed by the process cartridge B, the moving guide 41 escapes into the interior of the image forming apparatus, making it impossible to engage the mounting guide 18*b* of the process cartridge B into the guiding groove 41*a* of the moving guide 41. Therefore, in this embodiment, the auxiliary guide 42 having the mounting/dismounting assisting portion 42*a* contiguous with the trailing end of the moving guide 41 is provided, being fixed to the inner guide 40, on the upstream side of the moving guide 41 with respect to the direction X in which the process cartridge B is mounted. The above described problem is solved by this auxiliary guide 42; which assures that the mounting guide 18*b* of the process cartridge B is guided to the guiding groove 41*a* of the moving guide 41.

Further, the process cartridge mounting/dismounting mechanism is structured so that the process cartridge B is mounted into the moving guide 41, the movement of which is linked to the opening or closing movement of the opening/closing cover 15. Therefore, when the opening/closing cover 15 has been partially closed, the moving guide 41 has moved inward of the image forming apparatus, and therefore, a gap has been created between the moving guide 41 and the mounting/dismounting assisting portion 42*a* of the auxiliary guide 42. When the opening/closing cover 15 has been only slightly closed, and therefore, the above described gap is small enough for the mounting guide 18*b* to easily slide over from the mounting/dismounting assisting portion 42*a* to the moving guide 41, the process cartridge B can be mounted. However, as this gap widens to a certain extent, it becomes impossible for the mounting guide 18*b* of the process cartridge B to be engaged into the guiding groove 41*a* of the moving guide 41. Further, as the gap becomes even wider, it is conceivable that the mounting guide 18*b* will slip into the wrong space in the image forming apparatus through this gap.

Thus, in this embodiment, the backing 16 is provided with the projections 16*a* to prevent the process cartridge B from being inserted when the opening/closing cover 15 has been partially closed.

Figure 23:
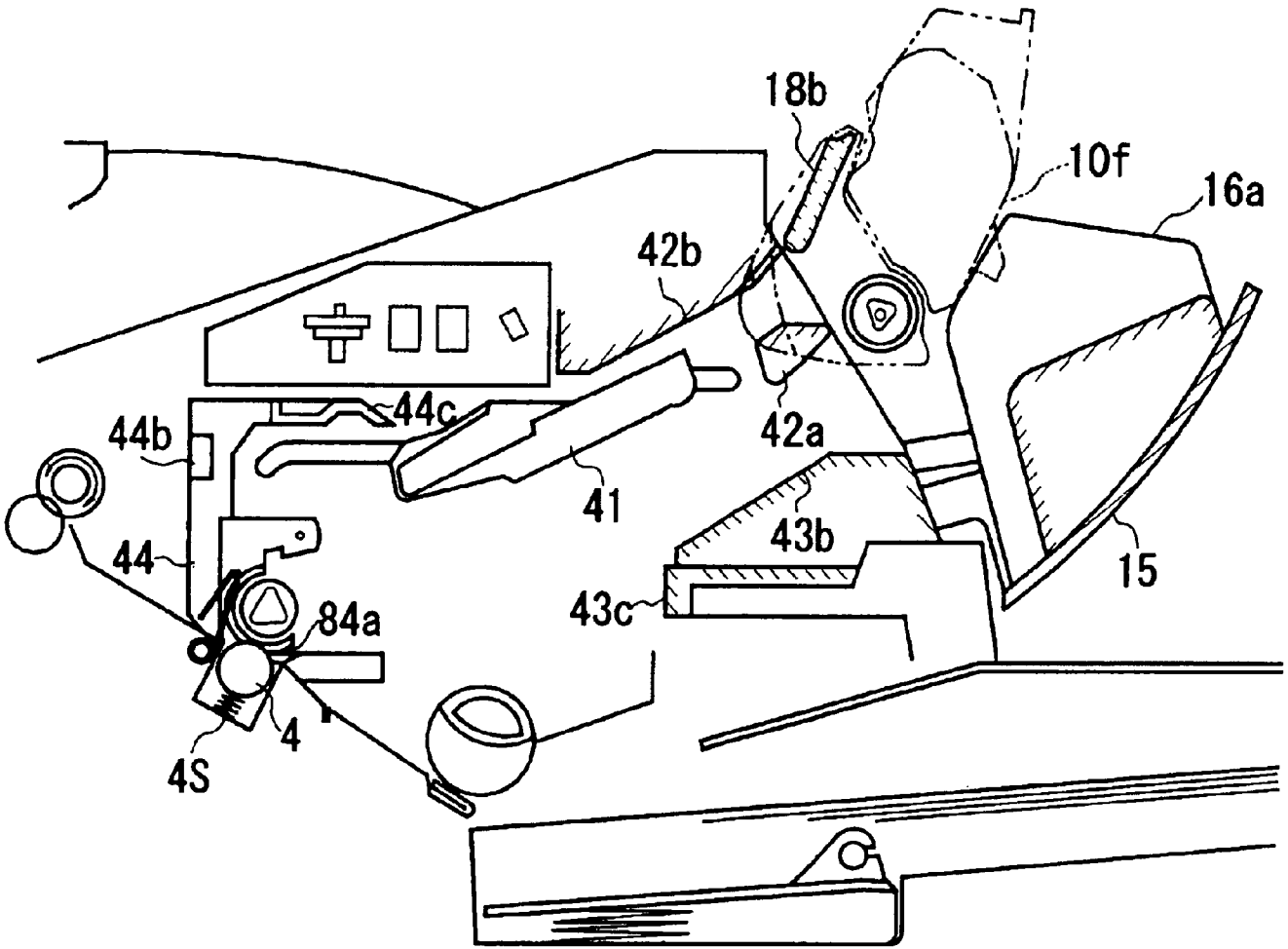
FIG. 23 is an illustration of an obstruction against insertion of the process cartridge into the process cartridge mounting-and-demounting mechanism in the process of opening and closing of the cover.

In other words, when the opening/closing cover 15 has been closed by a substantial angle, the projection 16*a* of the backing 16 has come closer to the top regulating portion 42*b*, making the space between the projection 16*a* and the top regulating portion 42*b* too small for the insertion of the process cartridge B, as shown in FIG. 23.

Figure 24:
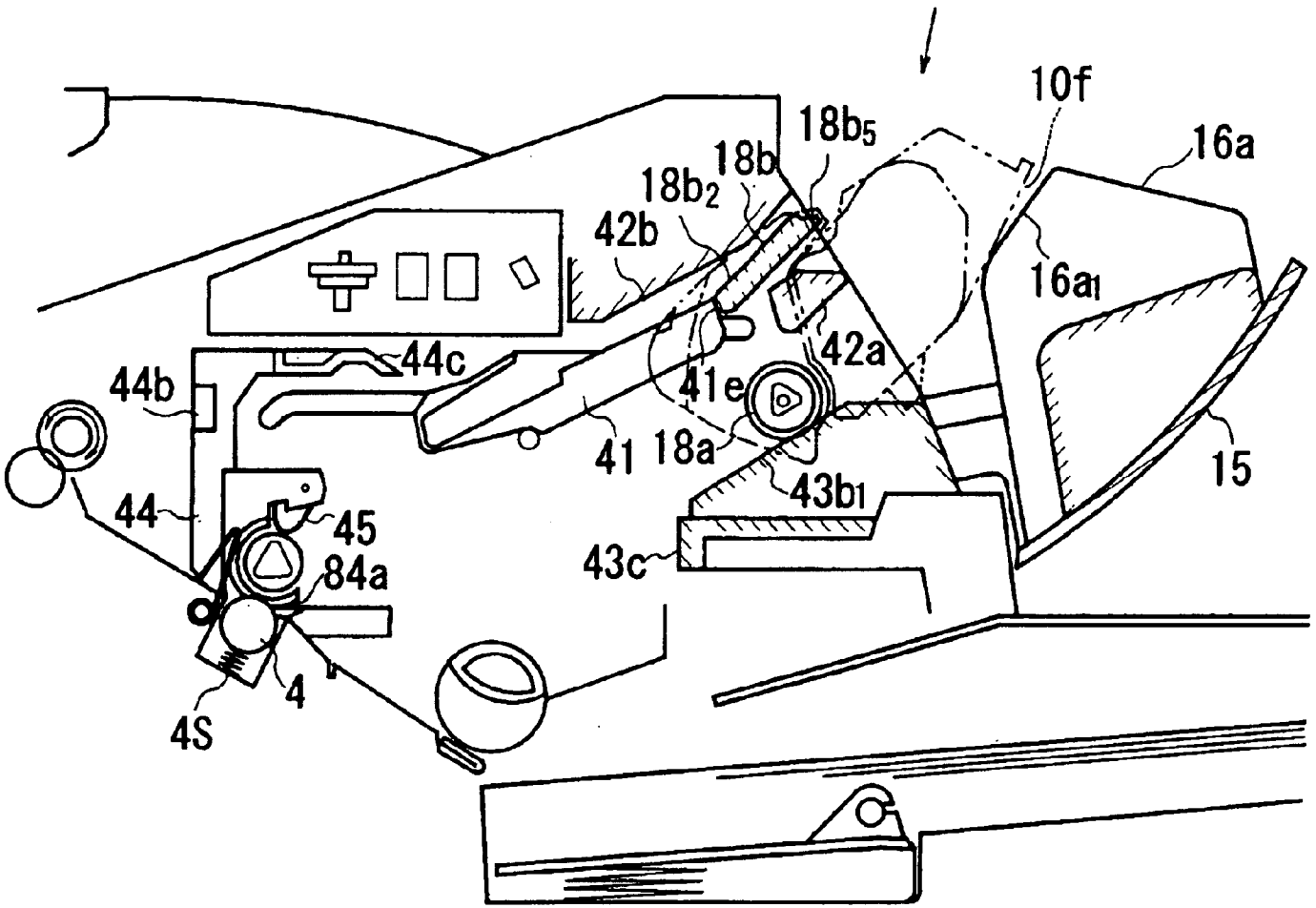
FIG. 24 is an illustration of an obstruction against insertion of the process cartridge into the process cartridge mounting-and-demounting mechanism in the process of opening and closing of the cover.

Referring to FIG. 24, when the opening/closing cover 15 has been partially closed, but the process cartridge B is still insertable, the projection 16 has been made to intrude into the normal path through which the process cartridge B is mounted or dismounted, and also the inclination of the loosely guiding surface 16*a*1 of the backing 16 relative to the horizontal direction has been increased, by the rotation of the opening/closing cover 15. Therefore, it has become impossible for the process cartridge B to be inserted, unless the process cartridge B is inserted at an angle steeper than the normal angle.

When the opening/closing cover 15 has been partially closed, the guiding surface 41*a*2 of the moving guide 41 is not contiguous with the front guiding surface 42*a*2 of the auxiliary cover 42. Thus, if the process cartridge B is inserted into the apparatus main assembly, in this condition, at a steeper angle than the normal angle, in a manner to make the bottom surface of the process cartridge B follow the loosely guiding surface 16*a*1 of the projection 16*a*, the leading end surface 18*b*2 of the mounting guide 18*b* comes into contact with the trailing end 41*e* of the moving guide 41. At this moment, the positioning guide 18*a* contacts the inclined surface 43*b*1 of the side guide 43*b*, and the bottom surface of the toner/developing means holding frame 10*f* contacts the projection 16*a* of the backing 16. As a result, the process cartridge B is regulated in its attitude.

As the opening/closing cover 15 is further closed from the position at which there are three (six) contacts, that is, the leading end 18*b*2 of the mounting guide 18*b* is in contact with the trailing end 41*e* of the moving guide 41; the positioning guide 18*a* is in contact with the inclined surface 43*b*1 of the side guide 43*b*; and the bottom surface of the toner/developing means holding frame 10*f* is in contact with the projection 16*a*, the moving guide 41 moves inward of the image forming apparatus, and the projection 16*a* of the backing 16 rotates upward. As a result, the process cartridge B is caused to rotate counterclockwise. Consequently, the corner of the mounting guide 18*b*, at which trailing end of the top surface of the mounting guide 18*b* connects to the perpendicular surface 18*b*5 of the mounting guide 18*b*, comes into contact with the top guiding surface 42*b*2 of the auxiliary guide 42, preventing the opening/closing cover 15 from being closed further (FIG. 25). In other words, when the process cartridge B is inserted into the apparatus main assembly, the opening/closing cover 15 which has been partially closed, cannot be closed, preventing the problem that the process cartridge B is improperly mounted into the apparatus main assembly.

Is Incidentally, even after the process cartridge B has been inserted into the apparatus main assembly, the opening/closing cover 15 has been partially closed, and the process cartridge B has become immovable, the process cartridge B can be pulled out of the apparatus main assembly, by rotating the opening/closing cover 15 in the opening direction. More specifically, as the opening/closing cover 15 is rotated in the opening direction, the moving guide 41 moves toward the opening W, and pushes the leading end 18*b*2 of the mounting guide 18*b*, forcing the process cartridge B outward. Then, as the opening/closing cover 15 is opened further, the aforementioned gap between the guiding surface 41*a*1 of the moving guide 41 and the front guiding surface 42*a*1 of the auxiliary guide 42 becomes smaller, and the mounting guide 18*b* moves across the gap, and settles in the guiding groove 41*a*, becoming ready for the mounting of the process cartridge B.

(Description of Movement of Process Cartridge Mounting/Dismounting Mechanism)

(Moving Guide Movement Linked to Opening/Closing Cover Movement)

Figure 26:
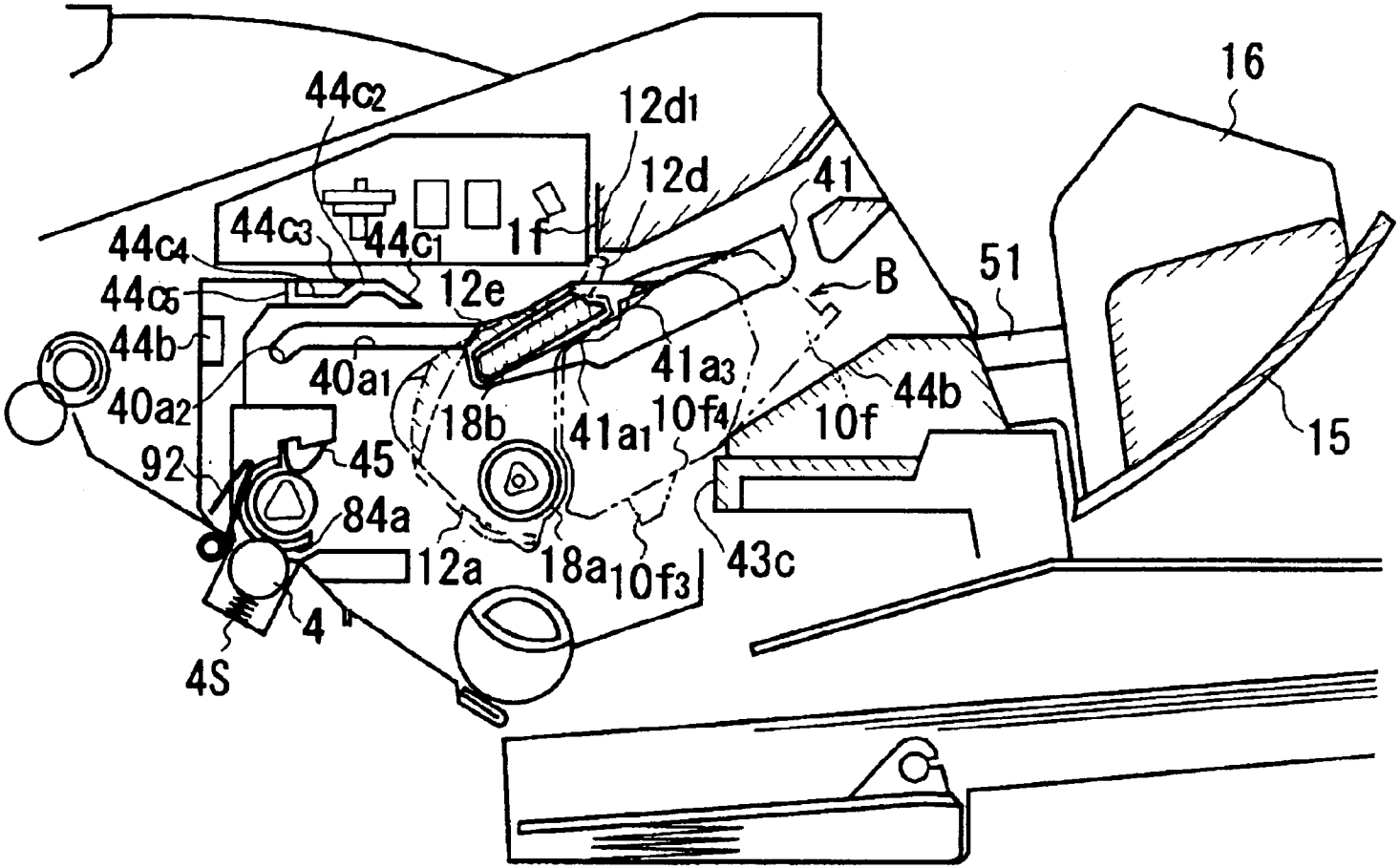
FIG. 26 is an illustration of a process cartridge inserting operation into the mounting-and-demounting mechanism of the process cartridge, and more particularly an illustration of the motion of the process cartridge, at the righthand side inner plate in the image forming apparatus.
Figure 28:
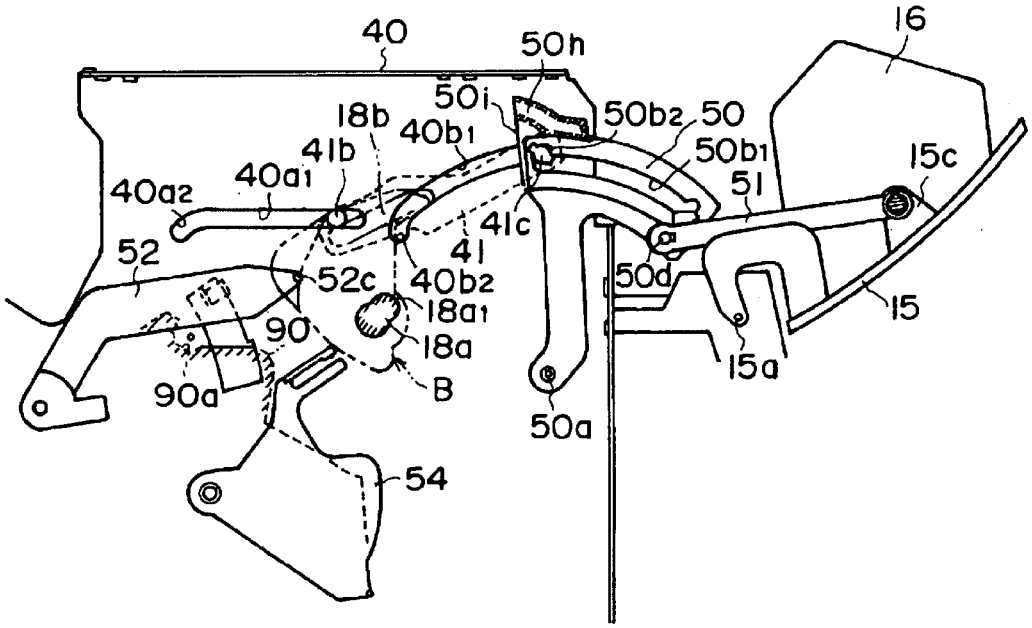
FIG. 28 is an illustration of a process cartridge inserting operation into the process cartridge mounting-and-demounting mechanism, at the left-hand side inner plate in the image forming apparatus, as seen at the same timing as FIG. 26.
Figure 32:
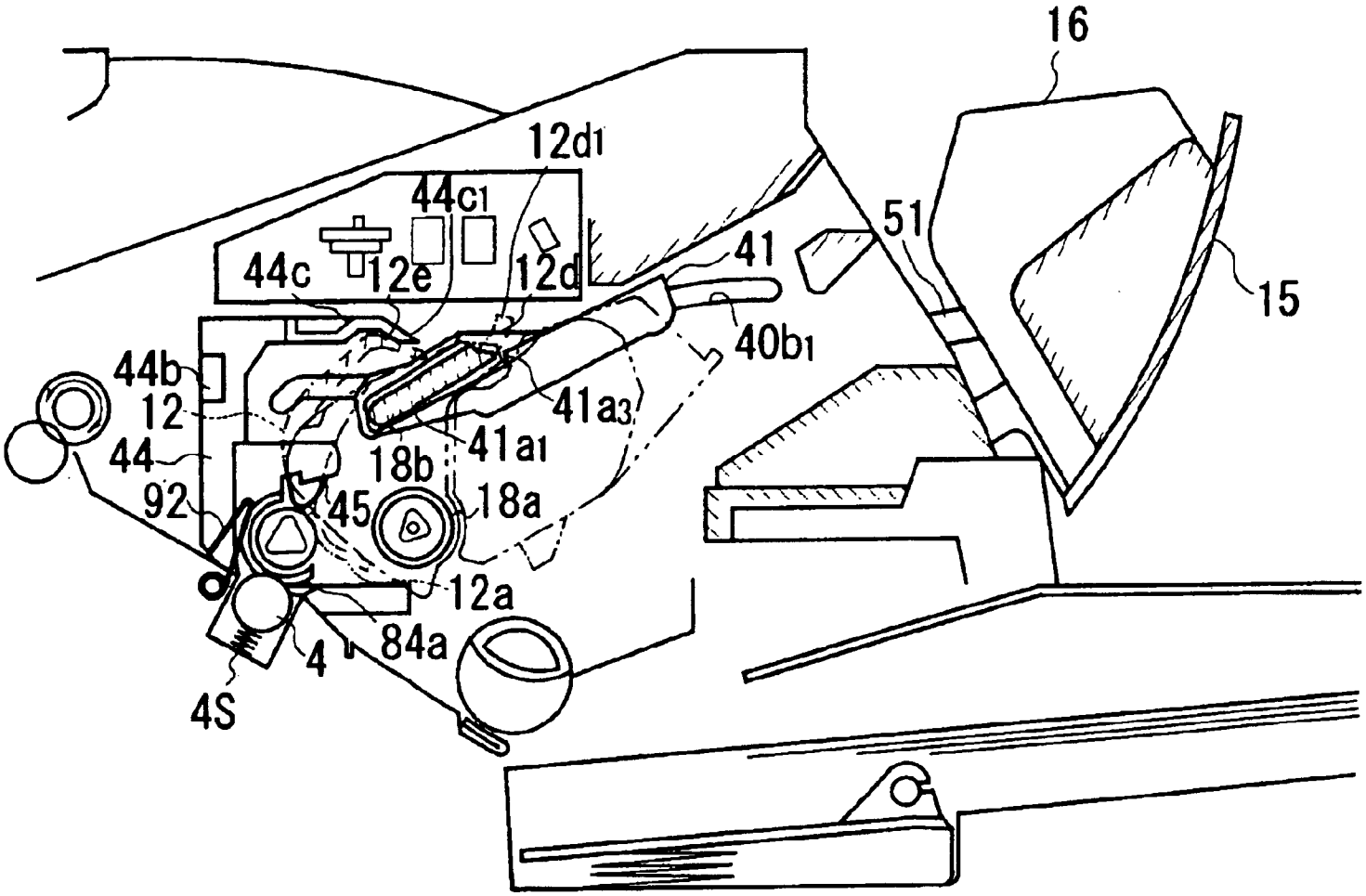
FIG. 32 is an illustration of a process cartridge inserting operation into the mounting-and-demounting mechanism of the process cartridge, and more particularly an illustration of the motion of the process cartridge, at the righthand side inner plate in the image forming apparatus.
Figure 33:
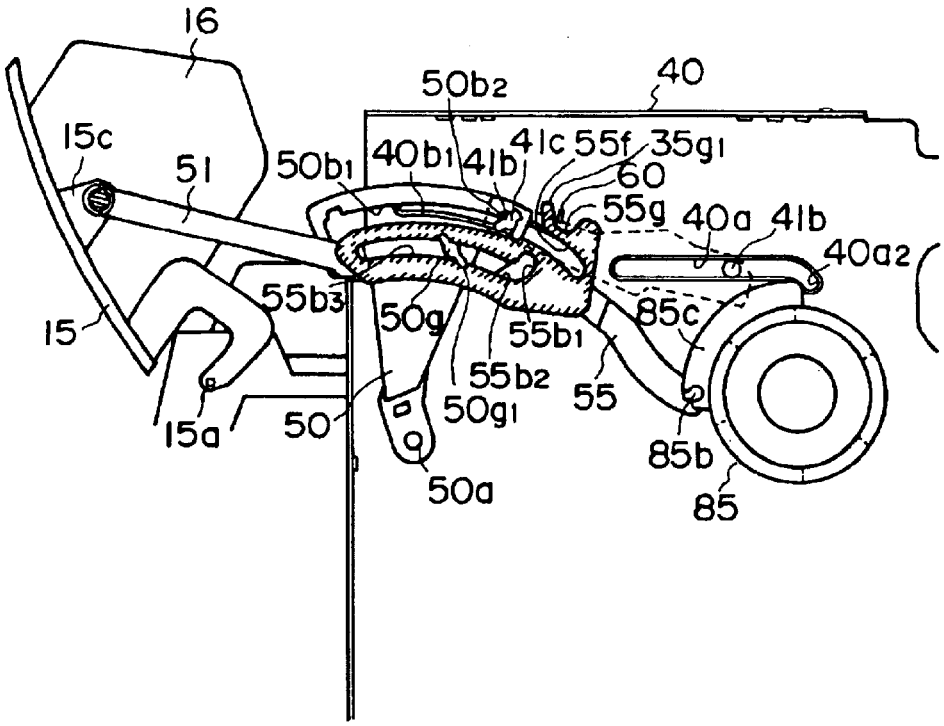
FIG. 33 is an illustration of a process cartridge inserting operation into the process cartridge mounting-and-demounting mechanism, at the righthand side inner plate in the image forming apparatus, as seen at the same timing as FIG. 32.
Figure 34:
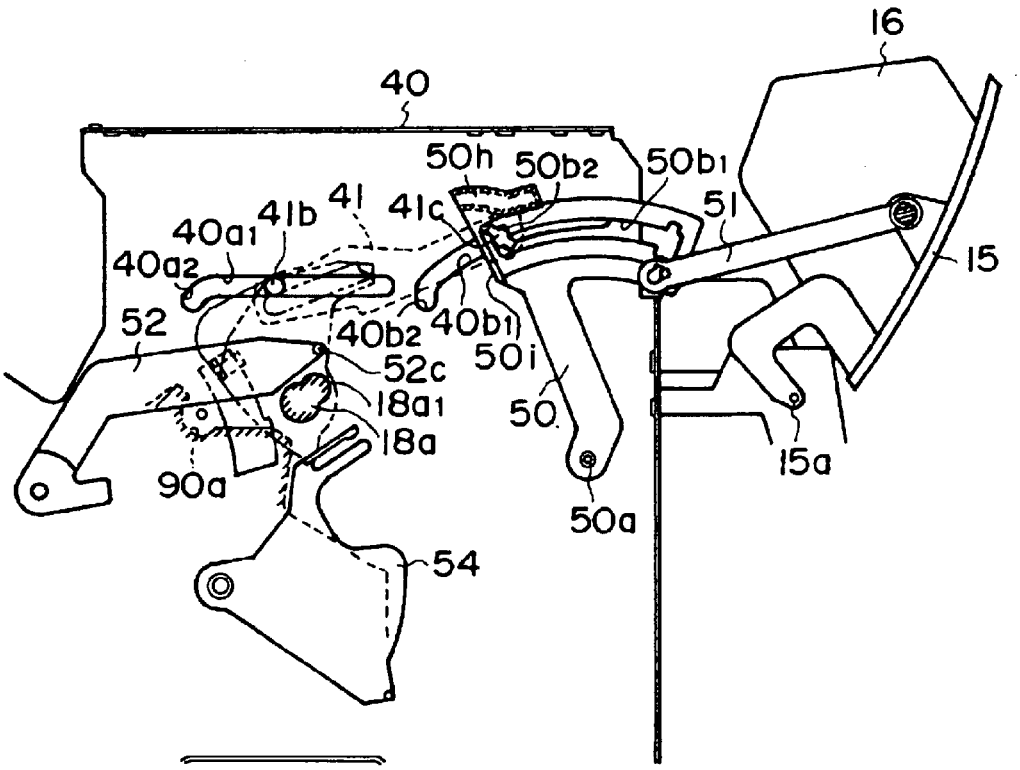
FIG. 34 is an illustration of a process cartridge inserting operation into the process cartridge mounting-and-demounting mechanism, at the left-hand side inner plate in the image forming apparatus, as seen at the same timing as FIG. 32.
Figure 35:
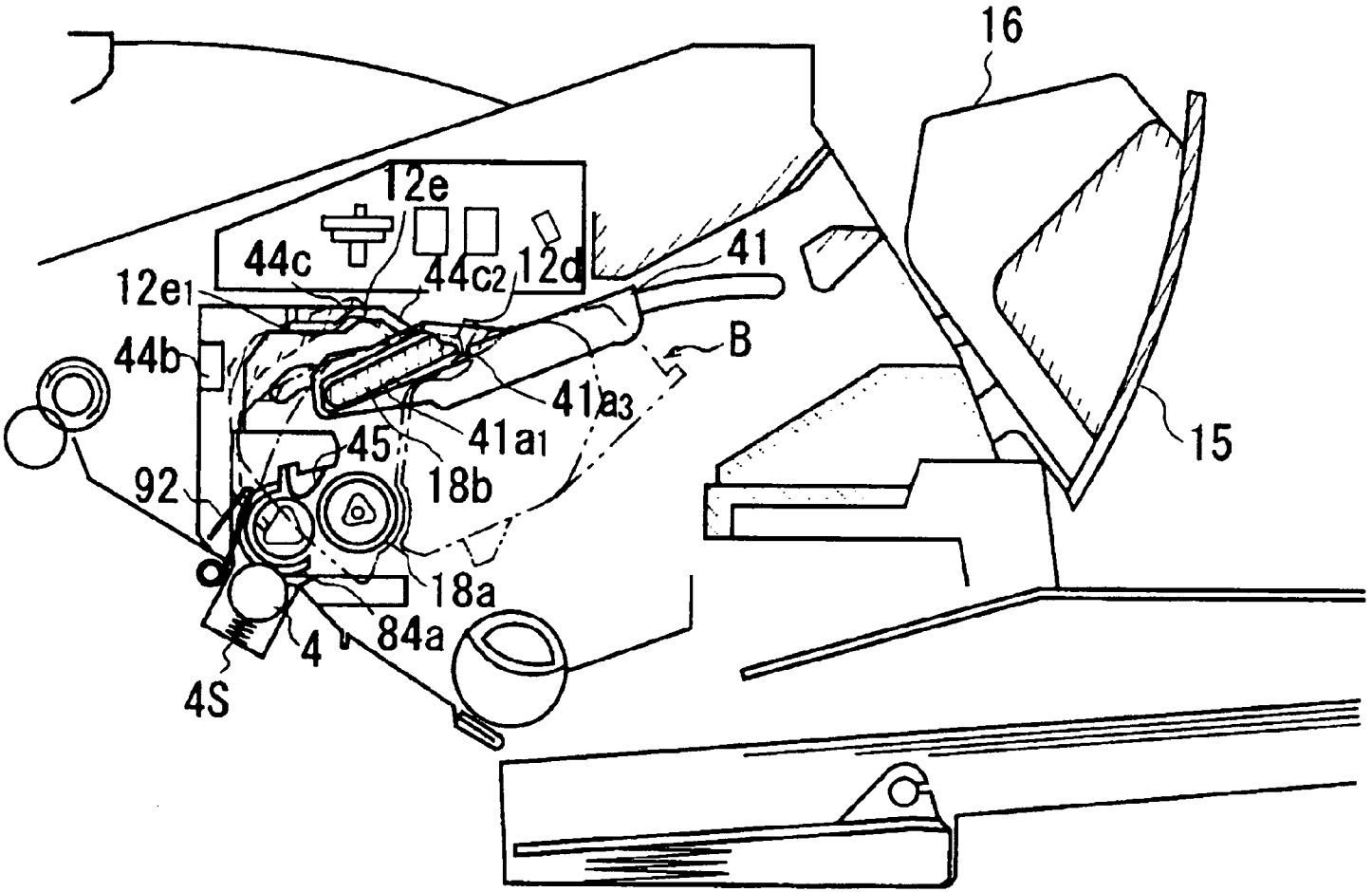
FIG. 35 is an illustration of a process cartridge inserting operation into the mounting-and-demounting mechanism of the process cartridge, and more particularly an illustration of the motion of the process cartridge, at the righthand side inner plate in the image forming apparatus.
Figure 36:
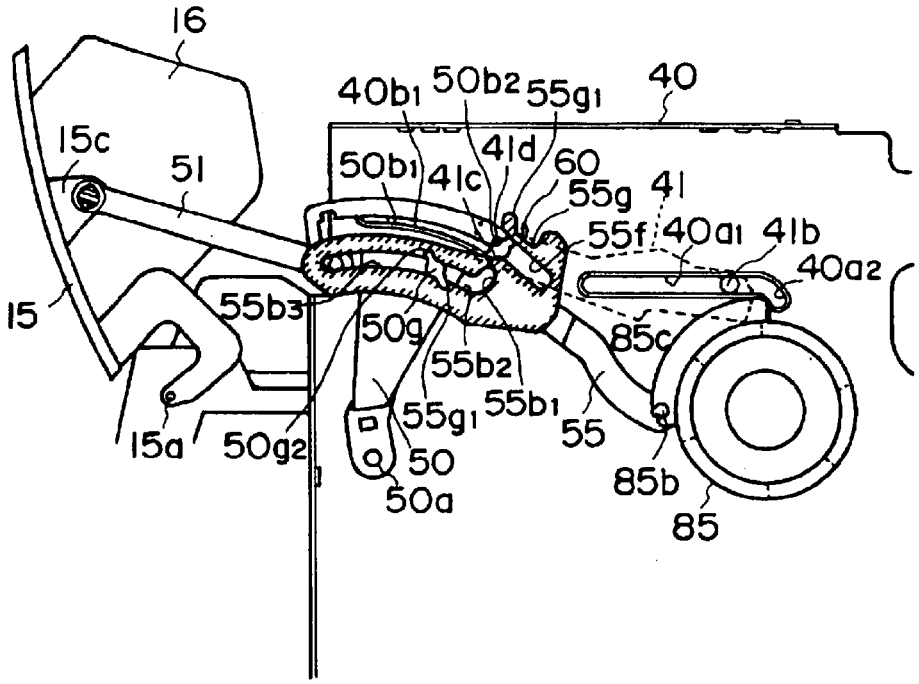
FIG. 36 is an illustration of a process cartridge inserting operation into the process cartridge mounting-and-demounting mechanism, at the righthand side inner plate in the image forming apparatus, as seen at the same timing as FIG. 35.
Figure 37:
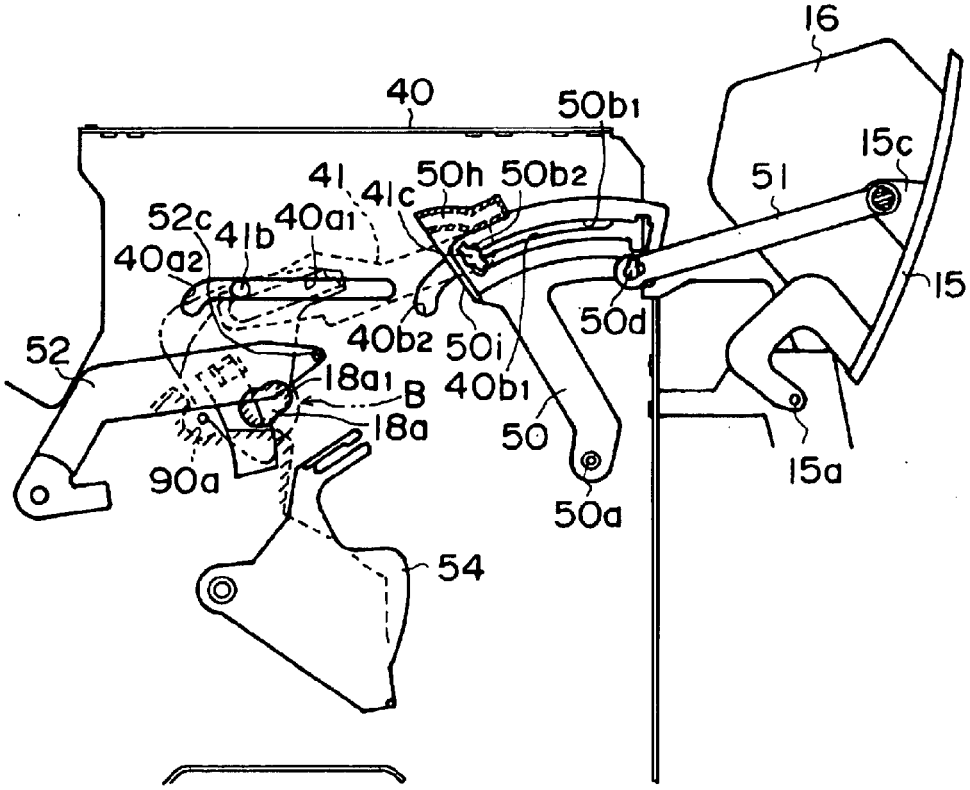
FIG. 37 is an illustration of a process cartridge inserting operation into the process cartridge mounting-and-demounting mechanism, at the left-hand side inner plate in the image forming apparatus, as seen at the same timing as FIG. 35.
Figure 38:
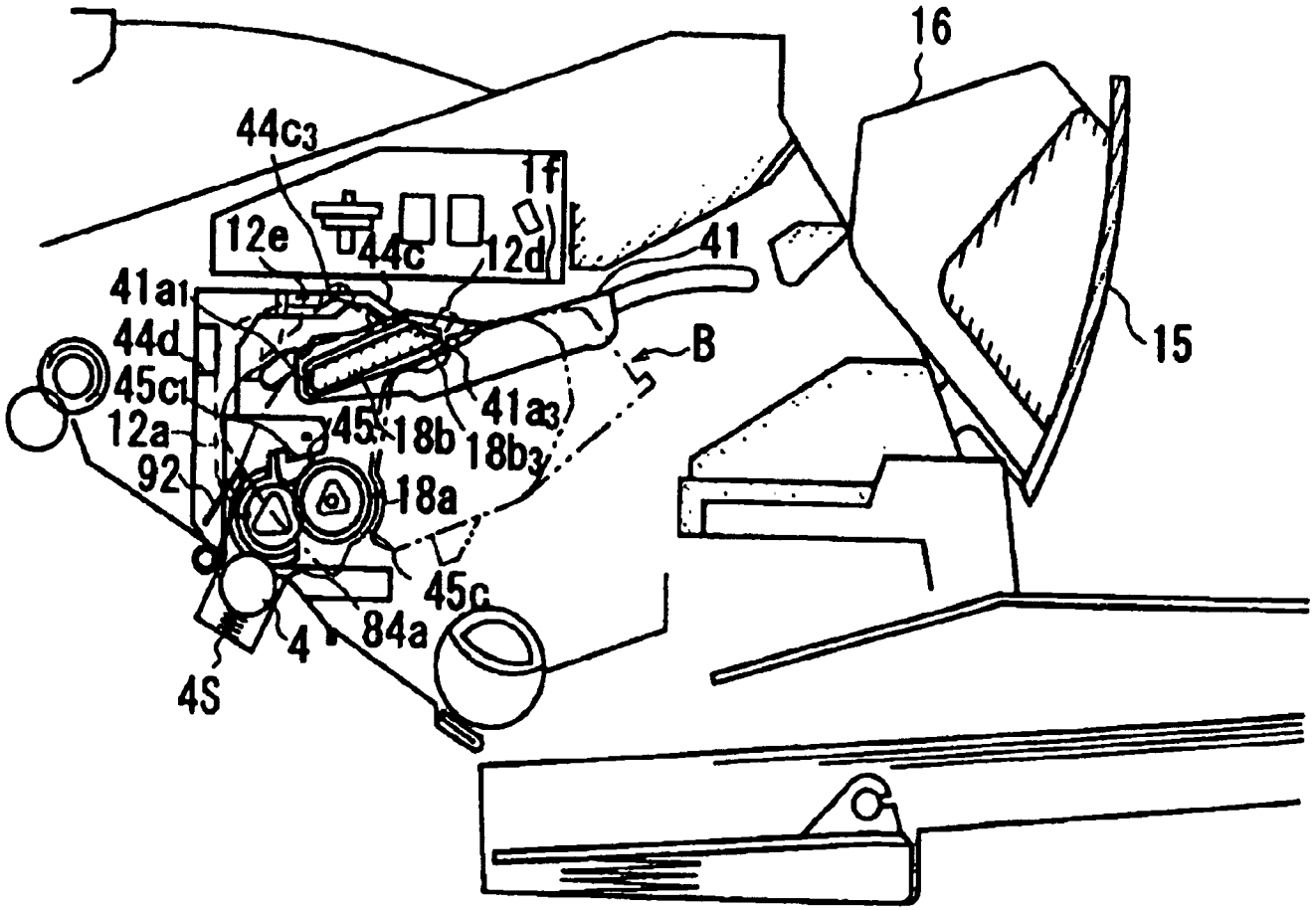
FIG. 38 is an illustration of a process cartridge inserting operation into the mounting-and-demounting mechanism of the process cartridge, and more particularly an illustration of the motion of the process cartridge, at the righthand side inner plate in the image forming apparatus.
Figure 39:
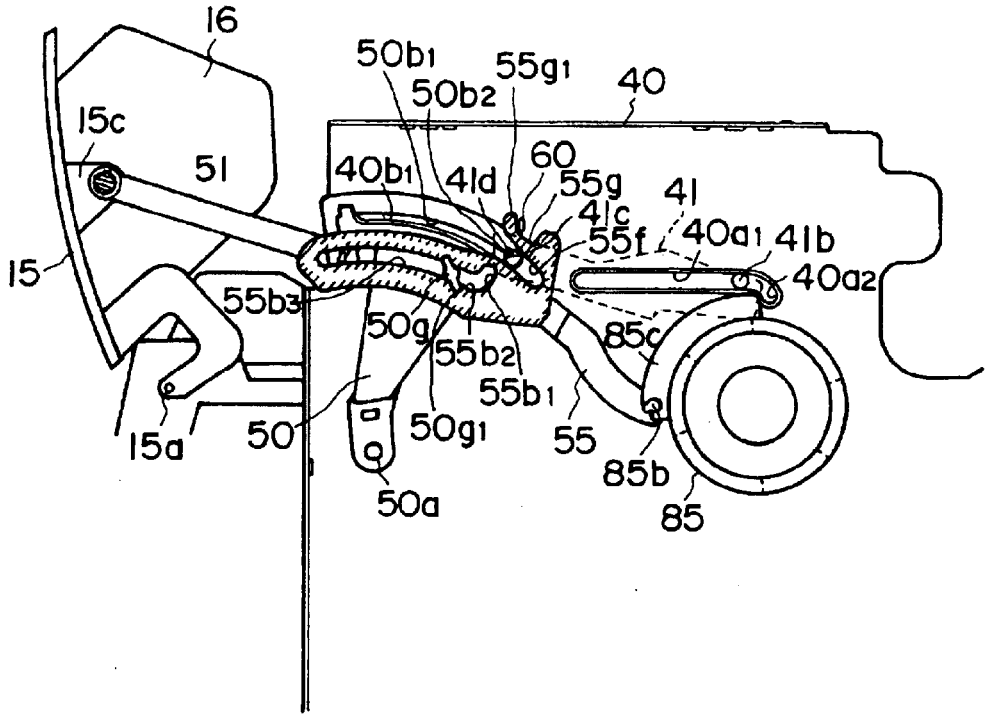
FIG. 39 is an illustration of a process cartridge inserting operation into the process cartridge mounting-and-demounting mechanism, at the righthand side inner plate in the image forming apparatus, as seen at the same timing as FIG. 38.
Figure 40:
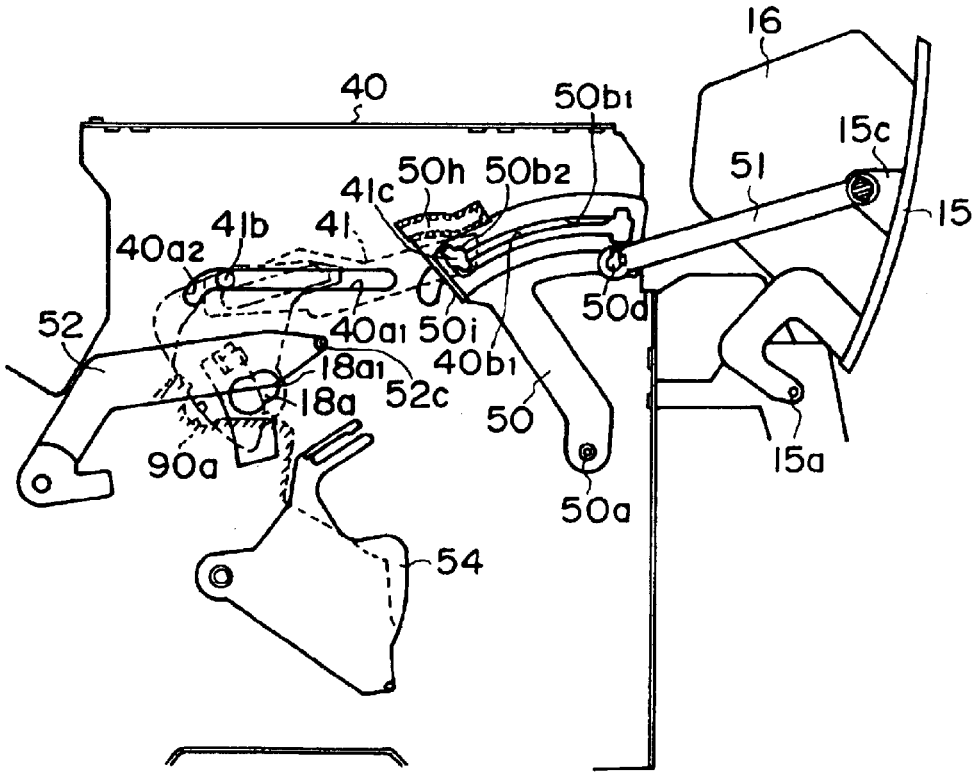
FIG. 40 is an illustration of a process cartridge inserting operation into the process cartridge mounting-and-demounting mechanism, at the left-hand side inner plate in the image forming apparatus, as seen at the same timing as FIG. 38.
Figure 41:
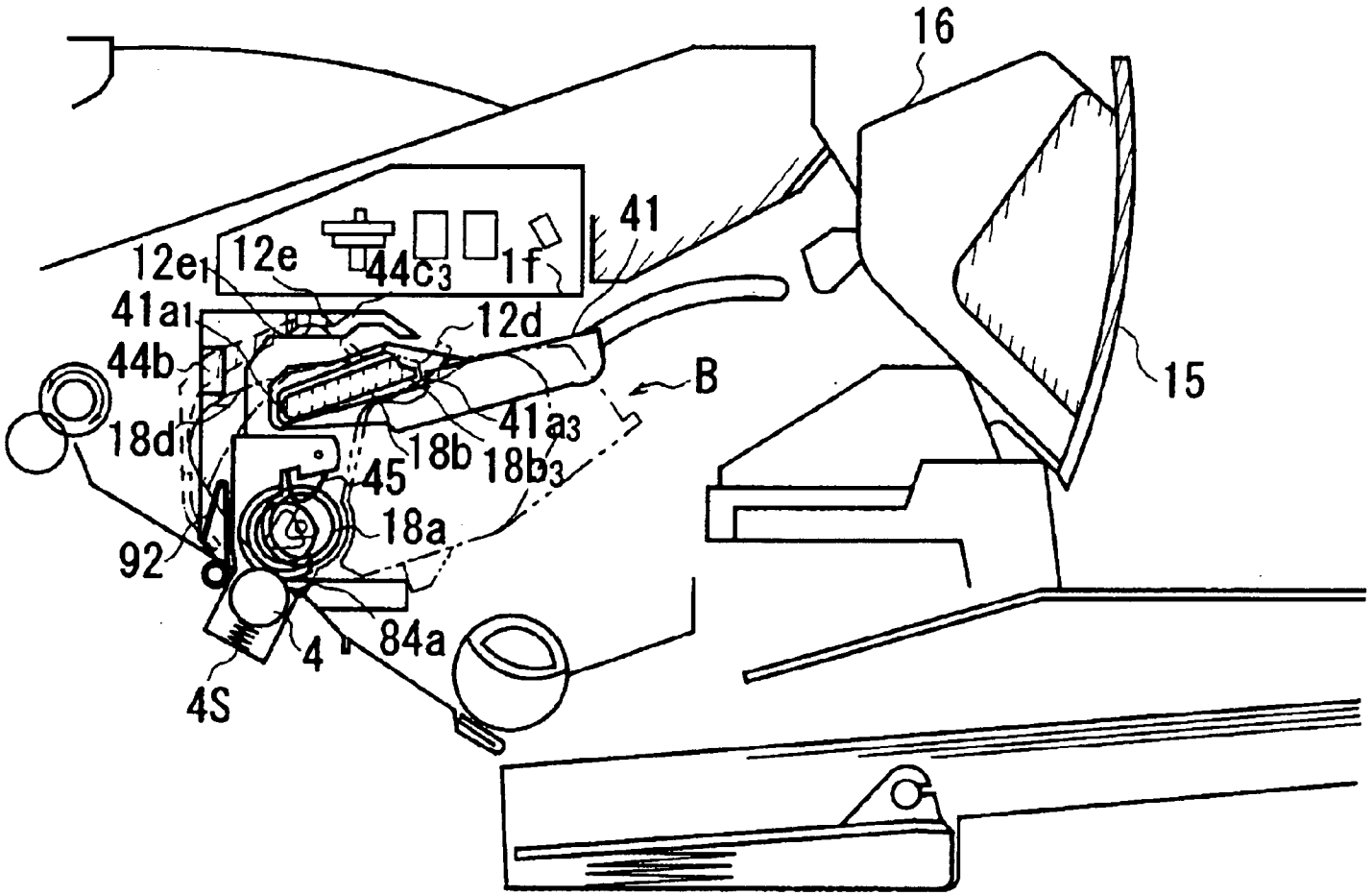
FIG. 41 is an illustration of a process cartridge inserting operation into the mounting-and-demounting mechanism of the process cartridge, and more particularly an illustration of the motion of the process cartridge, at the righthand side inner plate in the image forming apparatus.
Figure 42:
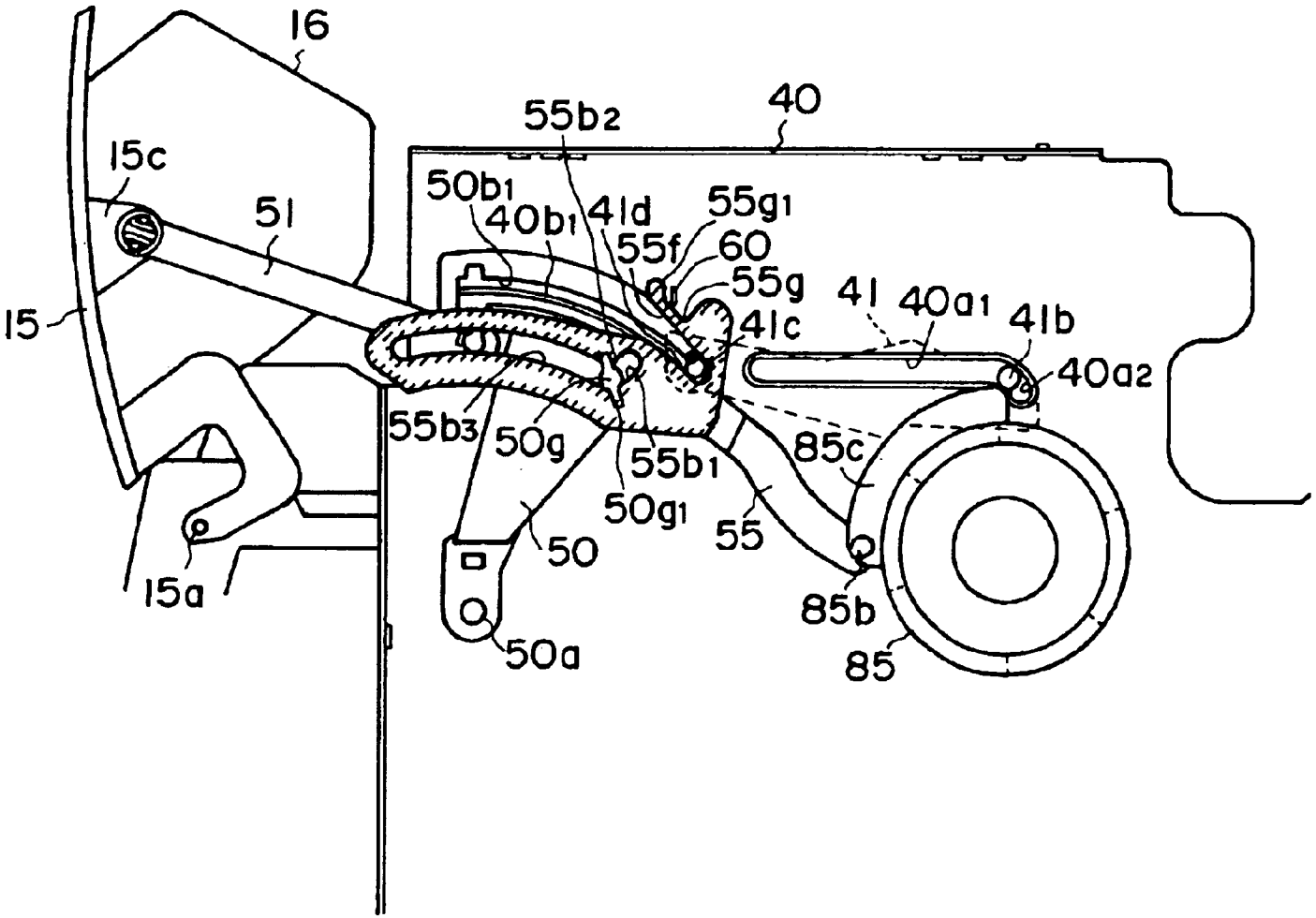
FIG. 42 is an illustration of a process cartridge inserting operation into the process cartridge mounting-and-demounting mechanism, at the righthand side inner plate in the image forming apparatus, as seen at the same timing as FIG. 41.
Figure 43:
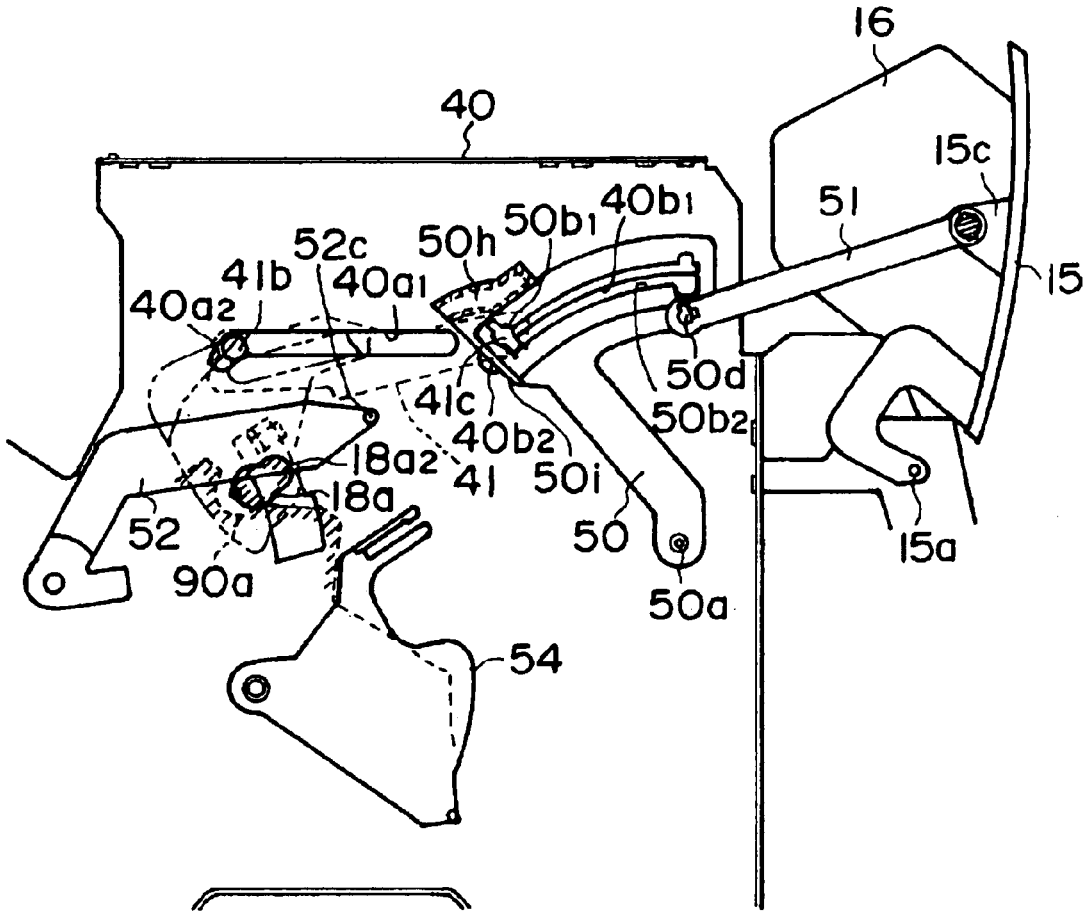
FIG. 43 is an illustration of a process cartridge inserting operation into the process cartridge mounting-and-demounting mechanism, at the left-hand side inner plate in the image forming apparatus, as seen at the same timing as FIG. 41.
Figure 44:
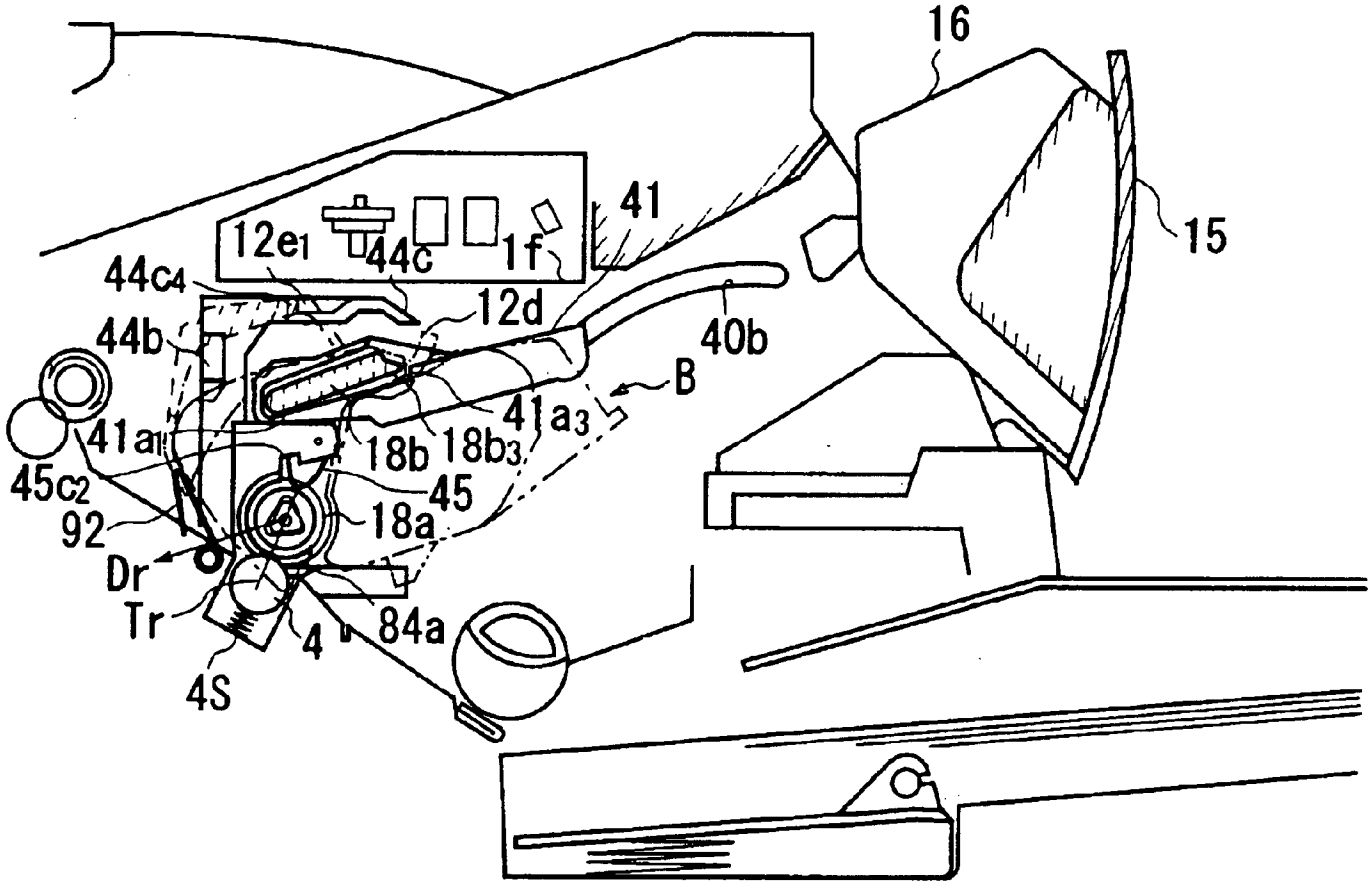
FIG. 44 is an illustration of a process cartridge inserting operation into the mounting-and-demounting mechanism of the process cartridge, and more particularly an illustration of the motion of the process cartridge, at the righthand side inner plate in the image forming apparatus.
Figure 45:
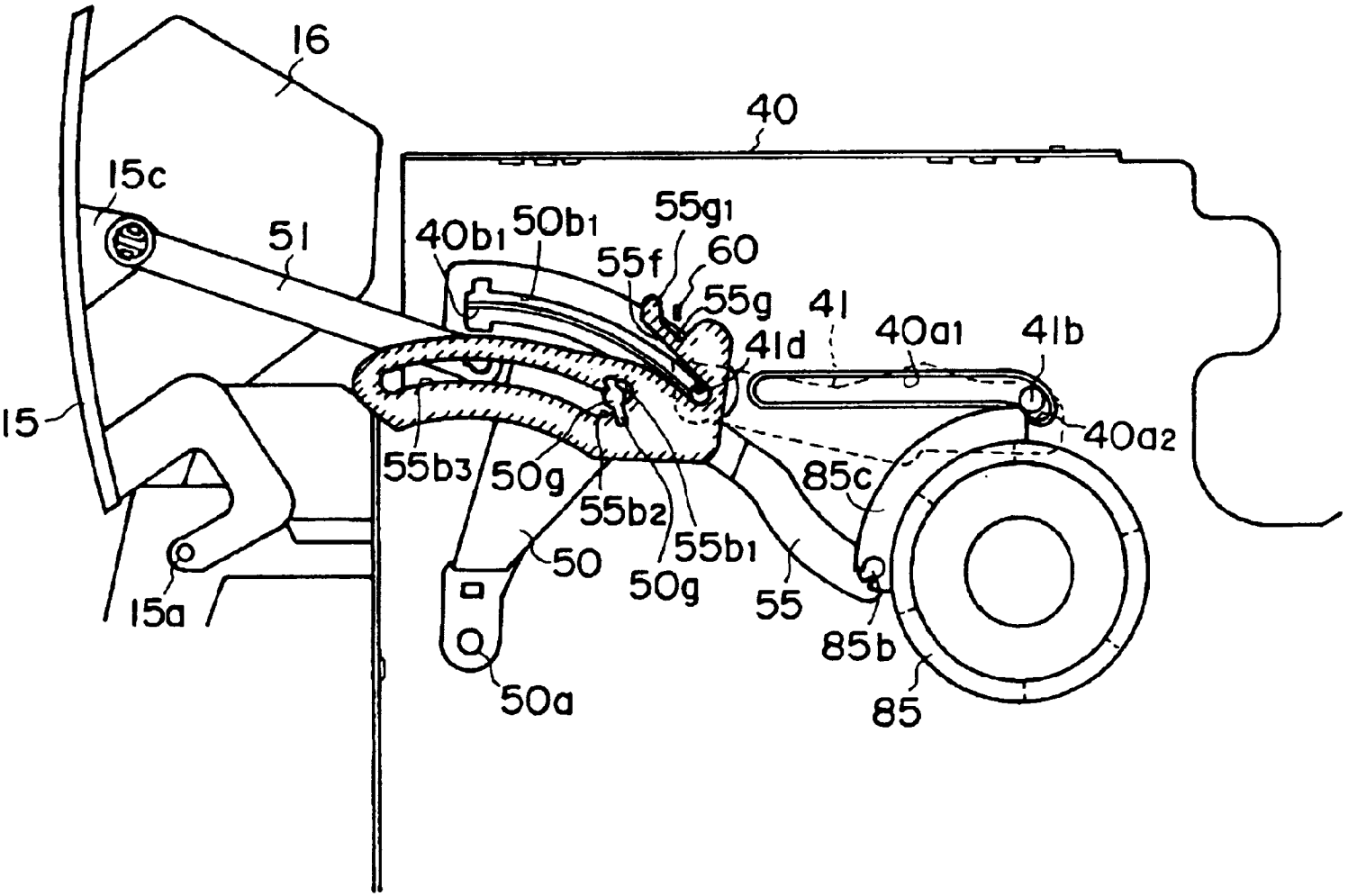
FIG. 45 is an illustration of a process cartridge inserting operation into the process cartridge mounting-and-demounting mechanism, at the righthand side inner plate in the image forming apparatus, as seen at the same timing as FIG. 44.
Figure 46:
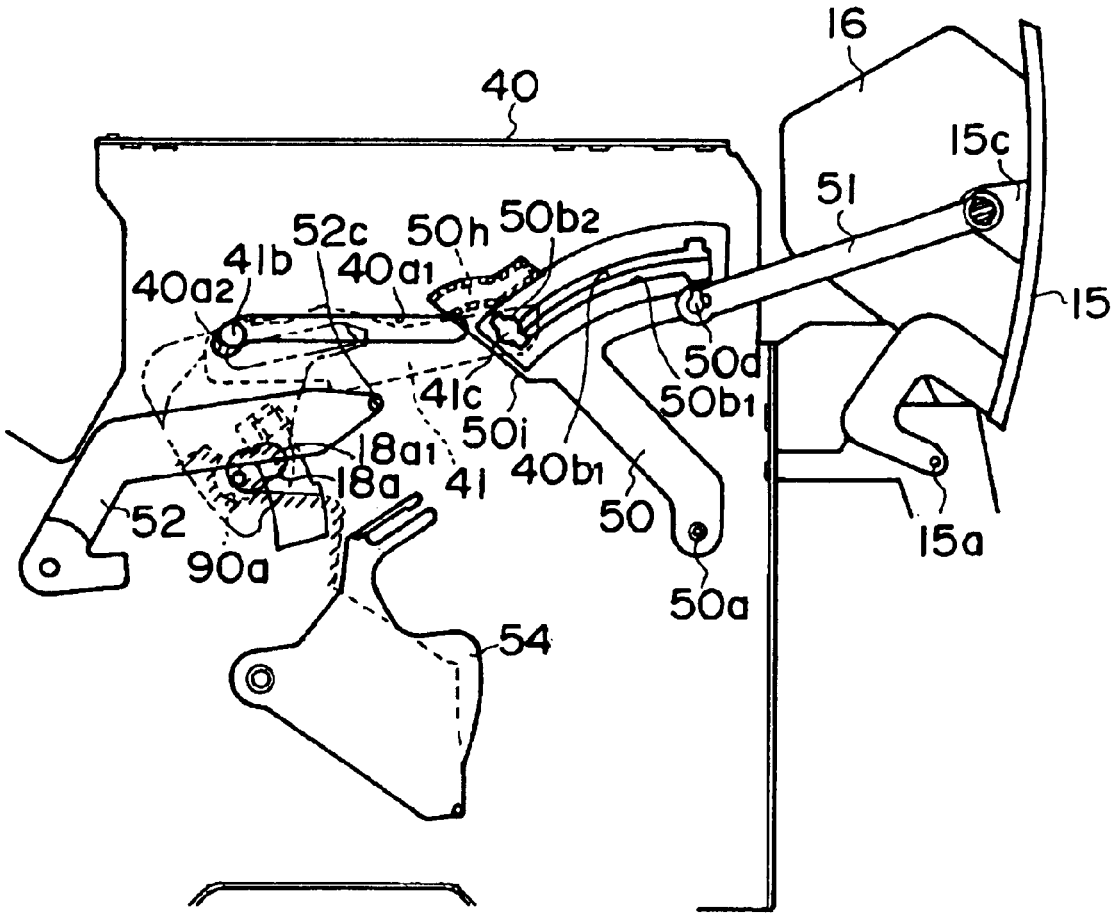
FIG. 46 is an illustration of a process cartridge inserting operation into the process cartridge mounting-and-demounting mechanism, at the left-hand side inner plate in the image forming apparatus, as seen at the same timing as FIG. 44.
Figure 48:
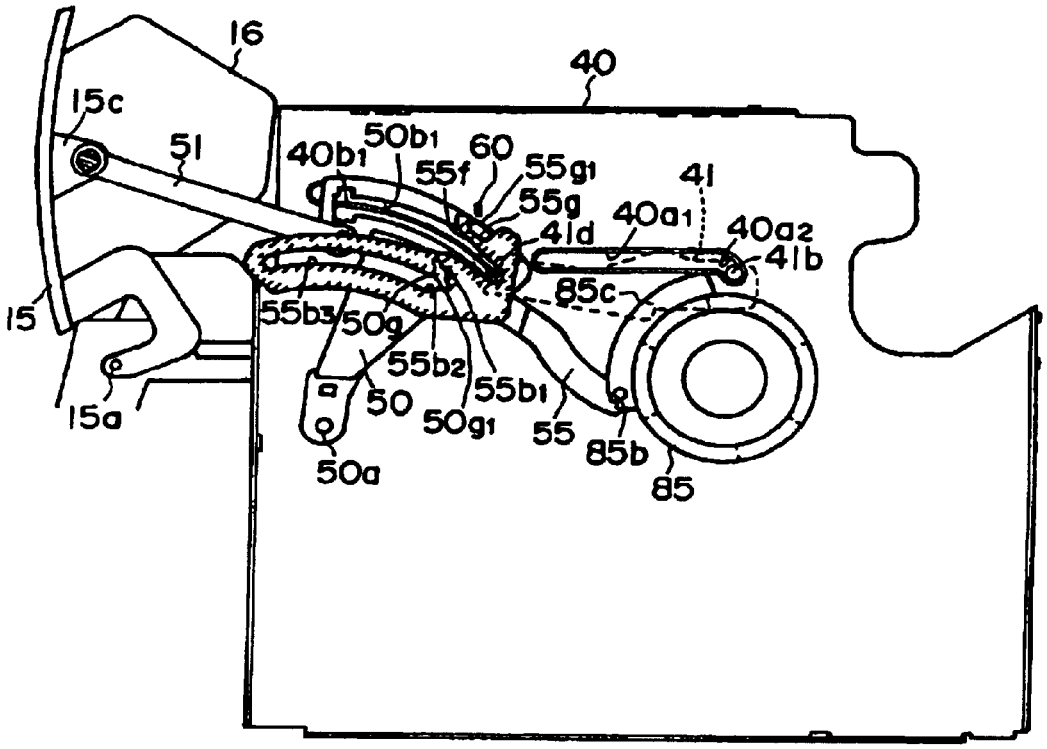
FIG. 48 is an illustration of a process cartridge inserting operation into the process cartridge mounting-and-demounting mechanism, at the righthand side inner plate in the image forming apparatus, as seen at the same timing as FIG. 47.
Figure 49:
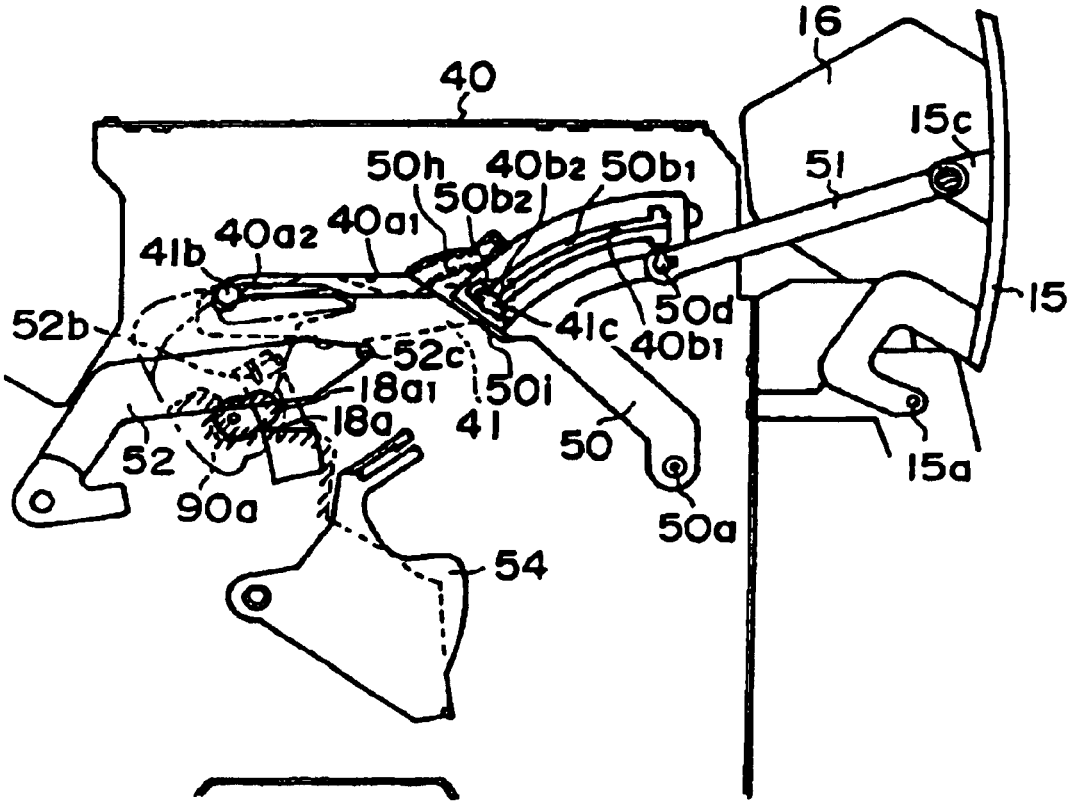
FIG. 49 is an illustration of a process cartridge inserting operation into the process cartridge mounting-and-demounting mechanism, at the left-hand side inner plate in the image forming apparatus, as seen at the same timing as FIG. 47.

Next, referring to FIGS. 26 49, the manner in which the moving guide 41, on which the process cartridge B has rested, moves during the first half of the closing movement of the opening/closing cover 15, will be described. FIGS. 26, 27, and 28 are the same with respect to the timing of the movement of the moving guide 41, and so are FIGS. 29, 30, and 31; FIGS. 32, 33, and 34; FIGS. 35, 36, and 37; FIGS. 38, 39, and 40; FIGS. 41, 42, and 43; FIGS. 44, 45, and 46; and FIGS. 47, 48, and 49. FIGS. 26, 29, 32, 35, 38, 41, 44, and 47 show the movement of the process cartridge B in relation to the right inner plate as seen from the inward side of the image forming apparatus. FIGS. 27, 30, 33, 36, 39, 42, 45, and 48 show the movement of the process cartridge B in relation to the right inner plate, as seen from the outward side of the image forming apparatus. FIGS. 28, 31, 34, 37, 40, 43, 46, and 49 show the movement of the process cartridge B in relation to the left inner plate, as seen from the outward side of the image forming apparatus.

As the opening/closing cover 15 is closed by rotating it about the center boss 15*a*, the cam plate 50, which is connected to the opening/closing cover 15 by the connecting plate 51, and constitutes the follower of the four joint linkage, also rotates, as shown in FIGS. 28 49. As a result, the second boss 41*c* of the moving guide 41 is moved by the top end of the straight portion (straight groove hole) 50*b*2 of the cam hole 50*b* of the cam plate 50, along the first arcuate portion 40*b*1 of the second guide rail 40*b*.

As described before, the center of the curvature of the first arcuate portion 40*b*1 coincides with the rotational axis 50*a* of the cam plate 50, and the radius of the first arcuate portion 40*b*1 is slightly smaller than the distance from the rotational axis 50*a* of the cam plate 50 to the top of the straight portion (straight groove hole) 50*b*2 of the cam hole 50*b* of the cam plate 50. Therefore, the second boss 41*c* of the moving guide 41 is retained in the space surrounded by the first arcuate portion 40*b*1 of the second guide rail 40*b* and the straight portion (straight groove hole) 50*b*2 of the cam hole 50*b*, and is moved by the rotation of the cam plate 50. Consequently, the first boss 41*b* of the moving guide 41 also moves inward, with respect to the direction X in which the process cartridge B is mounted, along the horizontal portion 40*a*1 of the first guide rail 40*a*.

The process cartridge B is in the apparatus main assembly, with its mounting guide 18*b* being in contact with the deeper end of the guiding groove 41*a* of the moving guide 41, and the bottom surface of the toner/developing means holding frame 10*f* being in contact with the contact rib 43*c* of the front guide 43 (FIG. 21).

As the moving guide 41 is moved further inward of the image forming apparatus, the process cartridge B moves inward of the image forming apparatus, along with the moving guide 41. As a result, the bottom surface 10*f*4 of the toner/developing means holding frame 10*f* becomes separated from the contact rib 43*c*, and the process cartridge B begins to be supported by the retaining surface 41*a*1 of the moving guide 41, by the bottom surface 18*b*1 of the mounting guide 18*b* (FIG. 29).

Figure 29:
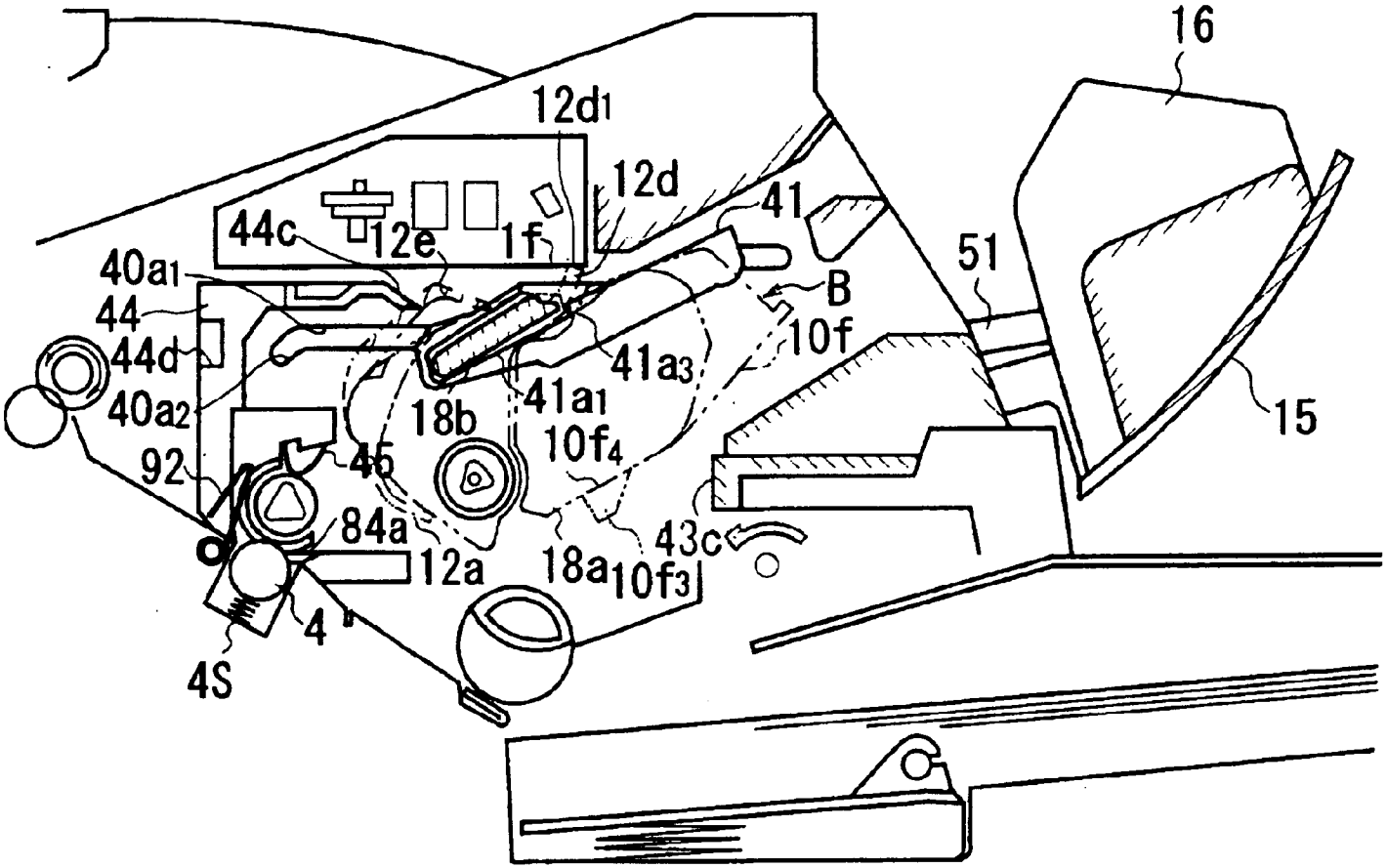
FIG. 29 is an illustration of a process cartridge inserting operation into the mounting-and-demounting mechanism of the process cartridge, and more particularly an illustration of the motion of the process cartridge, at the righthand side inner plate in the image forming apparatus.
Figure 30:
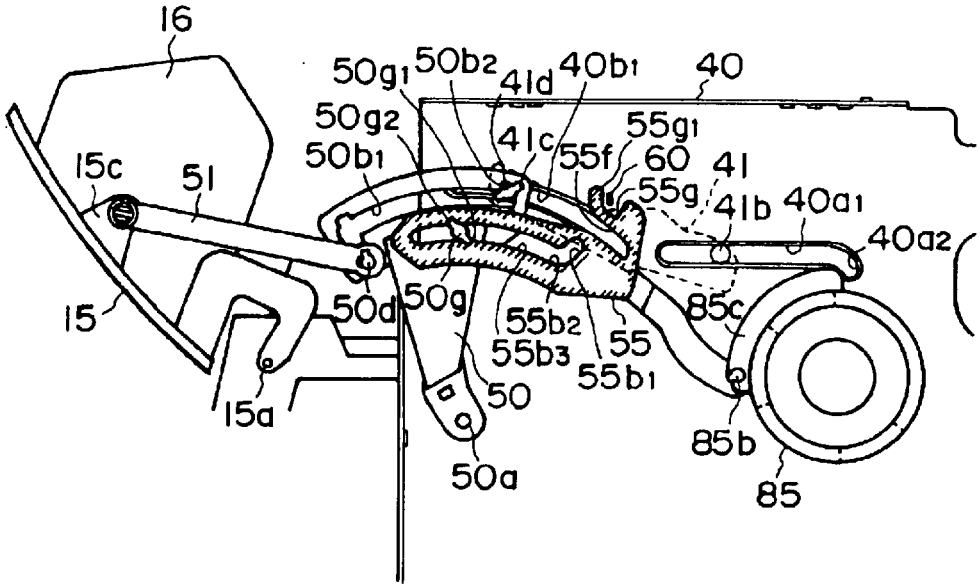
FIG. 30 is an illustration of a process cartridge inserting operation into the process cartridge mounting-and-demounting mechanism, at the righthand side inner plate in the image forming apparatus, as seen at the same timing as FIG. 29.
Figure 31:
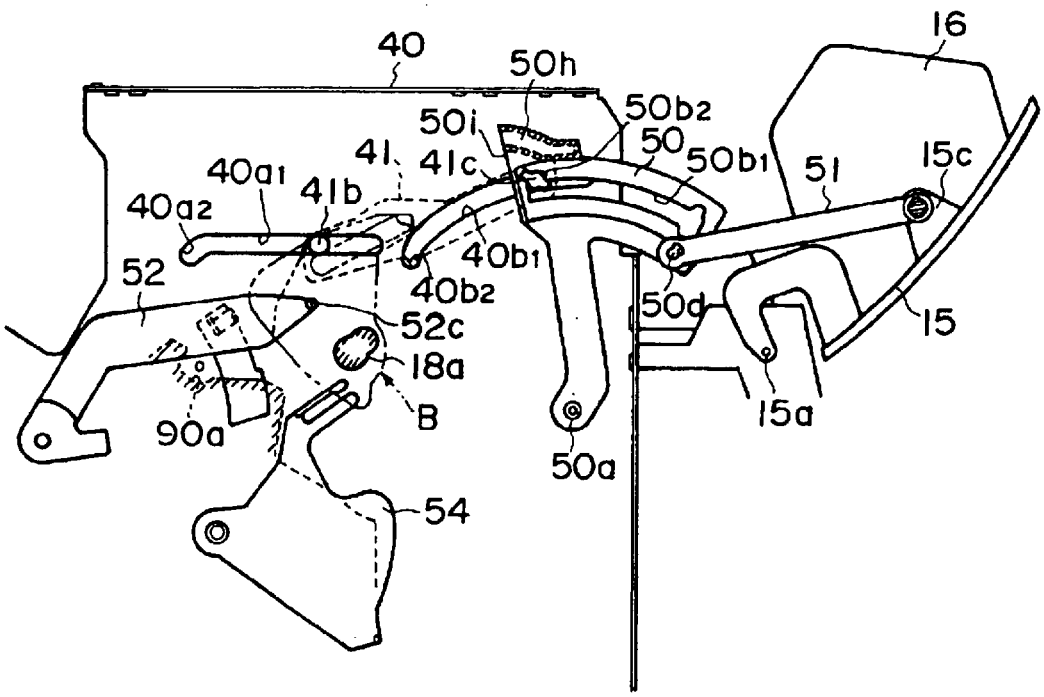
FIG. 31 is an illustration of a process cartridge inserting operation into the process cartridge mounting-and-demounting mechanism, at the left-hand side inner plate in the image forming apparatus, as seen at the same timing as FIG. 29.
Figure 47:
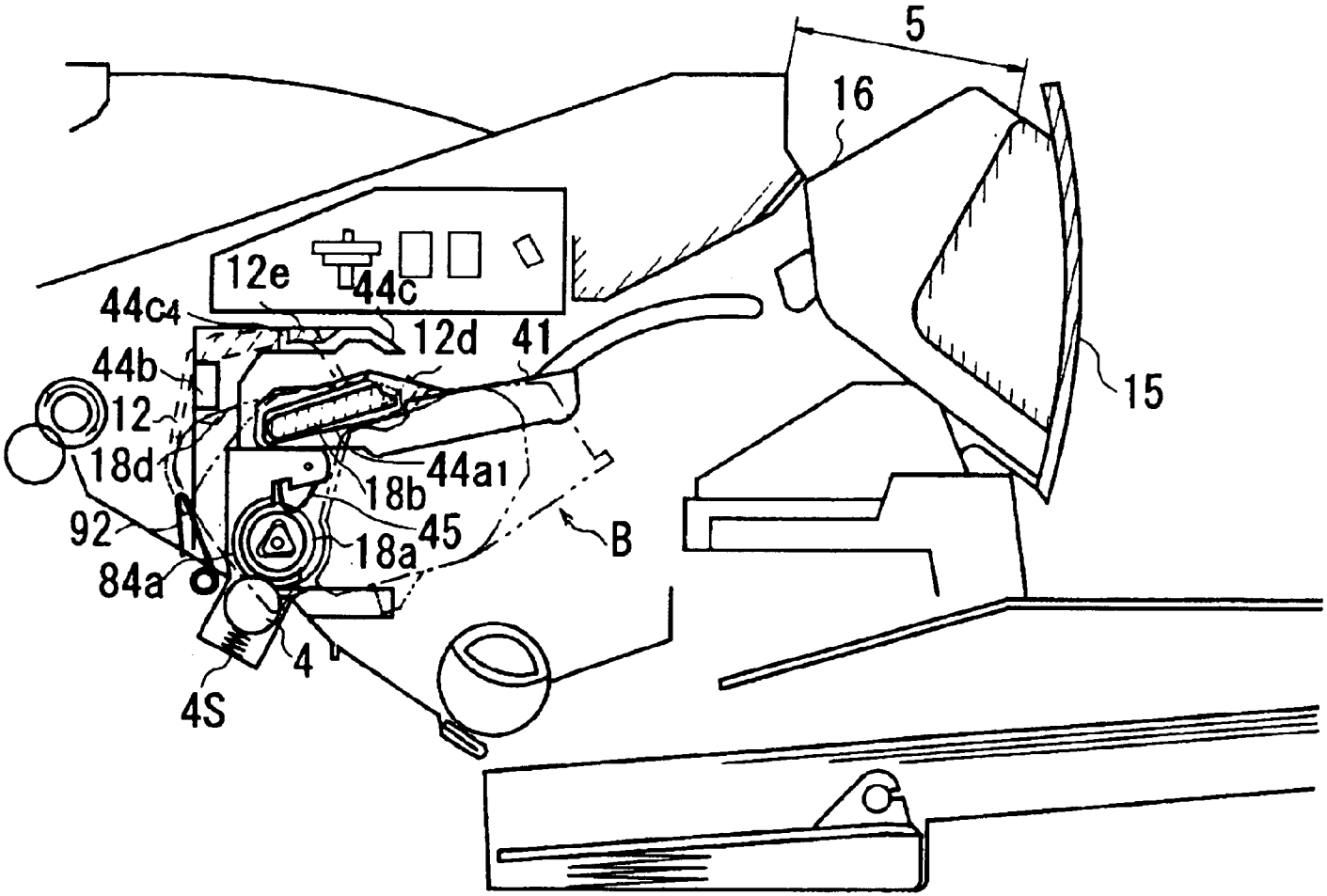
FIG. 47 is an illustration of a process cartridge inserting operation into the mounting-and-demounting mechanism of the process cartridge, and more particularly an illustration of the motion of the process cartridge, at the righthand side inner plate in the image forming apparatus.

The moving guide 41 supports the mounting guide 18*b* by the retaining surface 41*a*1, and moves inward while changing its attitude in the clockwise direction as shown in FIGS. 29 47. During this movement of the moving guide 41, the process cartridge B is conveyed in the image forming apparatus while changing its attitude in the clockwise direction, with the photoconductive drum 7 moving virtually horizontally. As the moving guide 41 moves while changing its attitude, the guide stopper 46 fitted around the first boss 41*b* follows the moving guide 41 while rotating, with the inward surface of the side wall 46*c* remaining in contact with the outward side of the lip of the first guide rail 40*a* formed by burring.

On the right side where the driving means is located, the helical torsion coil spring 45 for holding the process cartridge B in the position at which the driving force receiving portion of the process cartridge B can be connected to the driving force transmission mechanism of the apparatus main assembly, by the aforementioned coupling means, is disposed. This helical torsion coil spring 45 keeps the positioning guide 18*a* pressed upon the cartridge catching/retaining portion 84*a*, by its resiliency, to prevent the positioning guide 18*a* of the process cartridge B from being dislodged from the position, in which the driving force receiving portion of the process cartridge B can be engaged with the corresponding portion of the apparatus main assembly by the coupling portion, by the pressure generated by the spring 4*s* to keep the transfer roller 4 pressed upon the photoconductive drum 7.

Thus, as the opening/closing cover 15 is further closed, the process cartridge B moves closer to the image formation location located further inward of the image forming apparatus main assembly 14, while gradually becoming horizontal, as shown in FIG. 38. On the right side of the apparatus, the peripheral surface of the positioning guide 18*a* comes into contact with the contact portion 45*c*1 of the functional arm 45*c* of the helical torsion coil spring 45 disposed in the recess 44*d* of the stationary guide 44, in such a manner as to intrude into the upstream side of the path of the process cartridge B to the image formation location.

As described previously, the length of the retaining surface 41*a*1 of the moving guide 41 is greater than that of the bottom surface 18*b*1 of the mounting guide 18*b*. Thus, when the opening/closing cover 15 is further closed from the above described position, the process cartridge B is prevented by the resiliency of the helical torsion coil spring 45, from moving further inward, as shown in FIG. 38. As a result, the mounting guide 18*b* slides on the retaining surface 41*a*1, within the guiding groove of the moving guide 41, and the bottom corner 18*b*3 of the mounting guide 18*b*, on the trailing side, comes into contact with the perpendicular surface 41*a*3 of the guiding groove 41*a*.

Thereafter, as the opening/closing cover 15 is further closed, the bottom corner 18*b*3 of the trailing end of the mounting guide 18*b* is pressed by the perpendicular surface 41*a*3 of the guiding groove 41*a*. As a result, the functional arm 45*c* of the helical torsion coil spring 45 is bent upward, being forced out of the path of the positioning guide 18*a*, against the resiliency of the helical torsion coil spring 45. Consequently, it becomes possible for the process cartridge B to be pushed further into the apparatus main assembly (FIG. 41).

Then, as soon as the positioning guide 18*a* passes the bend portion 45*c*2 of the helical torsion coil spring 45, the latent resiliency of the helical torsion coil spring 45 acts upon the positioning guide 18*a* in the direction to push the positioning guide 18*a* into the cartridge catching/retaining portion 84*a* of the inward bearing 84 (FIG. 44).

Referring to FIG. 44, the helical torsion coil spring 45 in this embodiment contacts the peripheral surface of the positioning guide 18*a* by the bend portion 45*c*2 of the functional arm 45*c*. In order to prevent this bend portion 45*c*2 from deforming in a manner to become permanently bent when the peripheral surface of the positioning guide 18*a* passes the bend portion 45*c*2 during the mounting or dismounting of the process cartridge B, the radius of curvature of the bend portion 45*c*2 is rendered relatively large (approximately 3 mm 4 mm).

Further, in order to prevent the functional arm 45*c* from dislodging from the intended position, with respect to the lengthwise direction of the process cartridge B, when the functional arm 45*c* of the helical torsion coil spring 45 is bent upward by the positioning guide 18*a*, the recess 44*d* of the stationary guide 44 is provided with a regulating claw 44*d*3 and a regulating rib 44*d*4, which regulate the movement of the functional arm 45*c*, with respect to the lengthwise direction of the process cartridge B, by the portion of the functional arm 46*c* beyond the bend portion 46*c*2. With this arrangement, the functional arm 45*c* deforms within the gap defined by the bottom surface of the recess 44*d*, regulating claw 44*d*3, and regulating rib 44*d*4, being regulated in its position with respect to the lengthwise direction of the process cartridge B. The functional arm 45*c* of the helical torsion coil spring 45 keeps the positioning boss 18*a* pressed upon the cartridge catching/retaining portion 84*a* with the application of a predetermined pressure (approximately 0.98 N to 4.9 N).

Near the point which the positioning guide 18*a* passes while deforming the helical torsion coil spring 45, the first boss 41*b* of the moving guide 41 moves from the horizontal portion 40*a*1 of the first guide rail 40*a* to the inclined portion 40*a*2 of the first guide rail 40*a* (FIGS. 38 44).

While the first boss 41*b* moves along the horizontal portion 40*a*1 of the first guide rail 40*a*, the photoconductive drum 7 moves nearly horizontally. Then, as the first boss 41*b* transfers to the inclined portion 40*a*2 of the first guide rail 40*a*, the photoconductive drum 7 is moved to the Dr portion (FIG. 44) of its path, where the path points diagonally downward with respect to the process cartridge mounting direction. Therefore, the photoconductive drum 7 moves toward the transfer roller 4.

With the above described structural arrangement, such a component of the force applied in the direction to move the process cartridge B inward of the apparatus main assembly that acts in the direction to press the transfer roller 4 can be increased by increasing the angle between the direction Tr (FIG. 44) in which the transfer roller 4 is pressed by the spring 4*s*, and the direction of the path of the photoconductive drum 7 after the photoconductive drum 7 comes into contact with the transfer roller 4 and begins to press the transfer roller 4 downward.

As is evident from the above description, constructing the first guide rail 40*a* so that its front end, with respect to the process cartridge mounting direction, tilts downward as described above makes it possible to efficiently press down the transfer roller 4 by the movement of the process cartridge linked to the rotation of the opening/closing cover 15.

At this time, the relationship between the guiding groove 41*a* of the moving guide 41 and the mounting guide 18*b* when the photoconductive drum 7 of the process cartridge B presses down the transfer roller 4 will be described.

As described previously, while the process cartridge B is moved by the rotation of the opening/closing cover 15, the mounting guide 18*b* is supported by the retaining surface 41*a*1 of the guiding groove 41*a* of the moving guide 41. During this movement of the process cartridge B, as the process cartridge B is subjected to the forces (resistance) generated by the helical torsion coil spring 45, as well as an electrical contact 92, in the direction to push back the process cartridge B, the perpendicular surface 41*a*3 of the moving guide 41 moves the process cartridge B by coming into contact with the bottom corner 18*b*3 of the trailing end of the mounting guide 18*b*.

Toward the end of the conveyance of the process cartridge B, the photoconductive drum 7 comes into contact with the transfer roller 4 and presses down the transfer roller 4 against the spring 4*s*. The pressure which the spring 4*s* applies to the transfer roller 4 acts on the photoconductive drum 7 in the direction to lift the mounting guide 18*b* of the process cartridge B from the retaining surface 41*a*1 of the moving guide 41. Being subjected to such a pressure, the mounting guide 18*b* tends to go over the stepped portion between the retaining surface 41*a*1 and guiding surface 41*a*2. If the mounting guide 18*b* goes over the stepped portion between the retaining surface 41*a*1 and guiding surface 41*a*2, it becomes impossible for the moving guide 41 to insert the process cartridge B against the resistive load with respect to the process cartridge insertion direction; in other words, it becomes impossible to send the process cartridge B to the location at which image formation is possible.

As has been described with reference to FIG. 6, in this embodiment, the guiding groove 41*a* of the moving guide 41 is provided with the perpendicular surface 41*a*3, which is located at the trailing end of the retaining surface 41*a*1 and is perpendicular to the retaining surface 41*a*1, and the inclined portion 41*a*4, which extends diagonally upward from the top end of the perpendicular surface 41*a*3 and connects to the guiding surface 41*a*2 in a manner to form an acute angle relative to the guiding surface 41*a*2. Thus, as the process cartridge B is resisted by the force generated by the helical torsion coil spring 45 and electrical contact 92 in the direction opposite to the process cartridge mounting direction, during the inward conveyance of the process cartridge B, the perpendicular surface 41*a*3 of the moving guide 41 moves the process cartridge B by coming into contact with the bottom corner 18*b*3 of the trailing end of the mounting guide 18*b*. Then, the photoconductive drum 7 comes into contact with the transfer roller 4 due to the movement of the process cartridge B caused by the perpendicular surface 41*a*3 of the moving guide 41, and is subjected to the force reactive to the force applied to the transfer roller 4 by the photoconductive drum 7. As a result, the mounting guide 18*b* tends to go over the stepped portion of the guiding groove 41*a*. In this embodiment, however, the inclined surface portion 18*b*4 of the mounting guide 18*b*, which connects to the bottom corner 18*b*3 of the trailing end of the mounting guide 18*b* and forms an acute angle relative to the bottom surface 18*b*1, comes into contact with the inclined portion 41*a*4, which extends diagonally upward from the top end of the perpendicular surface 41*a*3, as shown in FIG. 6(B). Therefore, even if the mounting guide 18*b* is moved in the direction to go over the stepped portion of the guiding groove 41*a*, the inclined portion 41*a*4 catches the inclined surface portion 18*b*4, making it possible for the moving guide 41 to push the process cartridge B inward against the force applied to the transfer roller 4 by the spring 4*s*.

In the descriptions given above regarding the conveyance of the process cartridge B by the movement of the moving guide 41 linked to the rotation of the opening/closing cover 15, it was stated that the right positioning guide 18*a* is kept pressed upon the cartridge catching/retaining portion 84*a* by the helical torsion coil spring 45.

However, on the left side of the apparatus, a resilient pressing means which intrudes into the path of the positioning guide 18*a* is not provided. Further, a certain amount of play is provided between the mounting guide 18*b* and the retaining surface 41*a*1 of the moving guide 41. Therefore, even after the left positioning guide 18*a* reaches near the positioning portion 90*a* of the conveying means frame 90, it is not immediately caught by the positioning portion 90*a* due to the presence of the contact pressure between the transfer roller 4 and photoconductive drum 7, and the contact pressure generated by various electrical contacts (FIG. 49).

The left positioning guide 18*a* is guided to the positioning portion 90*a* of the frame 90, being thereby accurately positioned, by the movement of the pushing arm 52, which will be described later.

Although the right positioning guide 18*a* is kept pressed upon the cartridge catching/retaining portion 84*a* by the helical torsion coil spring 45, it eventually is separated from the cartridge catching/retaining portion 84*a* against the resiliency of the helical torsion coil spring 45, and as the rotational axes of the large gear coupling 83*a* and drum coupling 7*a*1 are made to coincide with each other by the engagement between the two couplings caused by the coupling means, the position of the process cartridge B relative to the image forming apparatus, within the image forming apparatus, on the right side, becomes fixed.

After the right positioning guide 18*a* passes by the helical torsion coil spring 45, the first boss 41*b* of the moving guide 41 transfers to the inclined portion 40*a*2 of the first guide rail 40*a*, and causes the photoconductive drum 7 to press down the transfer roller 4. This virtually concludes the process cartridge conveyance.

Next, the movements of the cam plate 50 and moving guide 41 linked to the rotation of the opening/closing cover 15, which occur during above described process cartridge conveyance, will be described.

Near the area where the distance by which the positioning guide 18*a* pushes up the helical torsion coil spring 45 becomes maximum, the second boss 41*c* of the moving guide 41 is at the portion of the second guide rail 40*b* where the first arcuate portion 40*b*1 and second arcuate portion 40*b*2 of the second guide rail 40*b* of the inner plate 40 connect to each other in a smooth curvature, and the first boss 41*b* of the moving guide 41 is at the point where it is about to move into the inclined portion of the first guide rail 40*a* of the inner plate 40 (FIGS. 41, 42, and 43).

As the opening/closing cover 15 is further closed from the above described point, the range of the area surrounded by the cam hole 50*b* of the cam plate 50 and the second guide rail 40*b* of the inner plate 40 changes to the area between the inward side of the straight portion (straight groove hole) 50*b*2 of the cam hole 50*b* of the cam plate 50, with respect to the radius direction of the cam hole 50*b*, and the straight portion 40*b*2 of the second guide rail 40*b*, and the second boss 41*c* of the moving guide 41 are moved within this area.

Therefore, the first boss 41*b* of the moving guide 41 is moved downward along the inclined portion 40*a*2 while the second boss 41*c* of the moving guide 41 is moved to the bottom end of the straight portion 40*b*2. Then, as the second boss 41 comes into contact with the bottom end of the straight portion 40*b*2, the movement of the moving guide 41 concludes (FIGS. 47, 48, and 49).

As a result, the moving guide 41 becomes virtually horizontal as the process cartridge B reaches the image formation location. In other words, at the second location, the moving guide 41 assumes an attitude different from the attitude it assumes at the first location. The first guide rail 40*a* is slightly longer than the moving distance of the first boss 41*b* of the moving guide 41 as described before. Therefore, at the completion of the movement of the moving guide 41, there is a gap between the first boss 41*b* and the end of the inclined portion 40*a*2 of the first guide rail 40*a*. Thus, the compression deformation to the moving guide 41 does not occur due to the contact between the first boss 41*b* and the end of the inclined portion 40*a*2.

(Mechanism for Opening or Closing Drum Shutter)

Up to this point, the manner in which the process cartridge moves in connection with the rotation of the opening/closing cover 15 has been described. Next, the opening and closing movements of a drum shutter 12 linked to the movement of the process cartridge B will be described.

According to the present invention, the drum shutter 12 is not opened or closed during the stage in which the process cartridge B is mounted onto the moving guide 41 (FIGS. 17 21). Instead, it is opened or closed during the stage in which the process cartridge B is moved within the apparatus main assembly by the rotation of the opening/closing cover 15 (FIGS. 26–47).

This arrangement is made to prevent a problem that as the drum shutter 12 is opened in the stage in which the process cartridge B is mounted onto the apparatus main assembly (moving guide 41), the resistance generated by the opening of the drum shutter 12 adds to the load to which the process cartridge B is subjected when the process cartridge B is mounted onto the moving guide 41, and therefore, the inward movement of the process cartridge B is stopped before the mounting guide 18*b* is caught by the retaining portion 41*a*1 in the inward portion of the guiding groove 41*a*. For this reason, the structural design that caused a conventional apparatus to generate a negative load with respect to the process cartridge inserting direction when the process cartridge B is mounted onto the apparatus main assembly by a user has been eliminated; in other words, the drum shutter 12 is opened or closed during the stage in which the process cartridge B is moved within the apparatus, by the closing movement of the opening/closing cover 15.

As the process cartridge B is moved by the closing movement of the opening/closing cover 15, the drum shutter 12 which is rotationally supported by the process cartridge B is rotated and exposes the transfer opening 9*a* and exposure opening 9*b* for the photoconductive drum 7, readying the process cartridge B for image formation.

Referring to FIG. 3, the rib 12*e* which keeps the drum shutter 12 open is on top of the cleaning means holding frame 11*d*. However, when it is seen from the direction parallel to the lengthwise direction of the process cartridge B, it is within the contour of the cleaning means holding frame 11*d*, and when it is seen from the direction perpendicular to the lengthwise direction of the process cartridge B, it is on the inward side of the contour of the surface of the cleaning means holding frame 11*d* facing the moving guide 41.

The surface of the rib 12*e*, which contacts the shutter guide 44*c* (second contact portion) of the stationary guide 44, faces the cleaning means holding frame 11*d*, and is exposed as the drum shutter 12 is opened.

As is evident from the above description, when the process cartridge B is outside the apparatus main assembly, that is, when the drum shutter 12 is closed, the rib 12*e* (second projection) for controlling the attitude of the drum shutter 12, which is open when the process cartridge B is within the image forming apparatus main assembly, is within the contour of the cleaning means holding frame 11*d* as seen from either the lengthwise direction of the process cartridge B or the direction perpendicular thereto. Therefore, the rib 12*e* is not damaged by the impacts which occur while the process cartridge B is transported, or the manner in which the process cartridge B is handled while the process cartridge B is mounted or dismounted.

Referring to FIG. 26, as the process cartridge B is moved by the closing movement of the opening/closing cover 15, the cam portion 12*d* (first projection) of the drum shutter 12 comes into contact with an optical system plate 1*f* (first contact portion), which is between the left and right inner plates within the image forming apparatus main assembly, and supports an optical system 1. As a result, the drum shutter 12 is rotated in the clockwise direction, while resisting the resiliency of a shutter spring, by the movement of the process cartridge B, and begins to expose the transfer opening 9*a* and exposure opening 9*b*.

As the drum shutter 12 is rotated in the clockwise direction, the rib 12*e*, which is attached to the connecting portion 12*c* (supporting portion), is moved away from the top surface of the cleaning means holding frame 11*d*, and therefore, the surface of the rib 12*e* which was in contact with the shutter guide 44*c* is exposed. As the process cartridge B is moved deeper into the apparatus main assembly, the cam portion 12*d* of the drum shutter 12, which has come into contact with the corner of the optical system plate 1*f*, keeps moving, with the highest point 12*d*1 located at the end of the cam portion 12*d* remaining in contact with the bottom surface of the optical system plate 1*f*, as shown in FIG. 29. Thus, as the process cartridge B is moved inward, the rib 12*e* comes into contact with the shutter guide 44*c* of the stationary guide 44, causing the drum shutter 12 to be opened further. As a result, the highest point 12*d*1 (contact point) of the cam portion 12*d* is moved away from the bottom surface of the optical system plate 1*f* (FIG. 32).

The shutter guide 44*c* is disposed above the cleaning means holding frame 11*d*, overlapping therewith, and is wide enough to catch the rib 12*e*. Referring to FIG. 26, listing from the upstream side with respect to the direction in which the process cartridge B is inserted, the shutter guide 44*c* has a first inclined surface 44*c*1, which is higher on the downstream side, a raised surface 44*c*2, a second inclined surface 44*c*3, which is lower on the downstream side, a horizontal surface 44*c*4, and a vertical surface 44*c*5, which is the most downstream surface with respect to the process cartridge mounting direction.

As described above, the shutter guide 44*c* rotates the drum shutter 12 by keeping the cam portion 12*d* in contact with the optical system plate 1*f*, and catches the rib 12*e*, which has moved away from the cleaning means holding frame 11*d*. For this purpose, the shutter guide 44*c* is located on the downstream side of the stationary guide 44 outside the path through which the rib 12*e* comes up. Referring to FIG. 32, the shutter guide 44*c* catches the first inclined surface 44*c*1, which is positioned lower on the upstream side so that it can easily scoop up the rib 12*e* as the rib 12*e* is moved toward the shutter guide 44*c* by the movement of the process cartridge B. After being caught by the first inclined surface 44*c*1, the rib is slid up the first inclined surface 44*c*1 by the movement of the process cartridge B, increasing the angle at which the drum shutter 12 is open.

As the opening/closing cover 15 is closed further, and the process cartridge B is moved thereby further inward of the image forming apparatus main assembly 14, the rib 12*e* of the drum shutter 12 comes into contact with the raised portion 44*c*2, or the highest portion, of the shutter guide 44*c*, opening the drum shutter 12 wider. During this movement of the drum shutter 12, the presence of a square notch 12*f* (FIG. 4) at the left front corner of the drum shutter 12 prevents the drum shutter 12 from colliding with the electrical contact 92 of the image forming apparatus (FIG. 35).

Thereafter, the rib 12*e* is moved onto the second inclined surface 44*c*3 of the shutter guide 44*c*, which is lower on the downstream side with respect to the process cartridge mounting direction, and therefore, the drum shutter 12 temporarily moves a short distance in the closing direction. This second slanted surface 44*c*3 connects the raised surface 44*c*2, which is rendered long to enable the drum shutter 12 to avoid the electrical contact 92, and the horizontal surface 44*c*4, which is lower than the raised surface 44*c*2, and onto which the rib 12*e* finally moves.

Thereafter, as the first boss 41*b* of the moving guide 41 moves onto the inclined portion 40*a*2 of the first guide rail 40*a*, the rib 12*e* of the drum shutter 12 is supported by the horizontal portion 44*c*4, remaining therefore at the same level, as shown in FIG. 41. However, the process cartridge B moves downward toward the transfer roller 4, increasing the angle at which the drum shutter 12 is open.

Eventually, the movement of the moving guide 41 linked to the rotation of the opening/closing cover 15 stops, ending the conveyance of the process cartridge B. In this stage, the rib 12*e* of the drum shutter 12 is supported by the horizontal surface 44*c*4 of the shutter guide 44*c*, keeping the drum shutter 12 open at a predetermined angle, and the transfer opening 9*a* and exposure opening 9*b* are exposed, with the process cartridge B being properly positioned in the image forming apparatus and ready for image formation, as shown in FIG. 44.

Immediately after the movement of moving guide 41 linked to the closing movement of the opening/closing cover 15 ends in the first half of the entirety of the closing movement of the opening/closing cover 15, the second boss 41*c* of the moving guide 41 is at the bottom end of the straight portion 40*b*2 of the second guide rail 40*b* of the inner plate 40, and then, it moves to the arcuate portion 50*b*1 of the cam hole 50*b* of the cam plate 50 (FIG. 49). As described above, the arcuate portion 50*b*1 of the cam hole 50*b* is such a portion of the cam hole 50*b* that the center of its curvature coincides with the rotational axis of the rotational shaft 50*a*; the radius of its outward edge is equal to the distance from the rotational shaft 50*a* to the bottom end of the straight portion 40*b*2 of the second guide rail 40*b*; and its width (dimension with respect to its radius direction) is slightly greater than the external diameter of the second boss 41*c* of the moving guide 41. Therefore, as the opening/closing cover 15 is further closed after the completion of the movement of the moving guide 41, the cam plate 50 is allowed to rotate, with the edge of the arcuate portion 50*b*1 of the cam hole 50*b* of the cam plate 50 being guided by the second boss 41*c* of the moving guide 41, and therefore, the opening/closing cover 15 can be completely closed.

Hereinafter, various mechanisms, the movements of which are linked to the latter half of the entire closing movement of the opening/closing cover 15, will be described.

(Movement of Means for Connecting Driving Force Transmitting Means, Linked to Opening/closing Cover Movement)

As described previously, the right inner plate 40 is provided with a driving means, which comprises a coupling means for transmitting driving force to the process cartridge B, and a coupling means control for engaging or disengaging the coupling means. Also as described above, the coupling means becomes engaged or disengaged as it is moved by the coupling means control in the lengthwise direction of the process cartridge B, which is approximately perpendicular to the direction in which the process cartridge B is mounted into the apparatus main assembly.

The coupling means has the inward bearing 84, outward bearing 86, and large gear 83. The inward bearing 84 rotationally supports the large gear 83 by the large gear coupling 83*a*, and is fixed to the inner plate 40. The outward bearing 86 is attached to a gear cover (not shown) fixed to the inner plate 40, and rotationally supports the other end of the large gear. The large gear 83 is rotationally supported by the inward and outward bearings 84 and 86 (FIG. 11).

The large gear coupling 83*a* is provided with a twisted hole, the cross section of which is in the form of a substantially equilateral triangle. The rotational axis of the large gear coupling 83*a* coincides with that of the large gear 83. A gear flange (unshown) fixed to one of the lengthwise ends of the photoconductive drum 7 of the process cartridge B is provided with a drum coupling 7*a*1, the rotational axis of which coincides with that of the photoconductive drum 7, and is in the form of a twisted equilateral triangular pillar. The drum coupling 7*a*1 is within the hollow of the right positioning guide 18*a*, and the rotational axis of the drum coupling 7*a*1 also coincides with the axial line of the right positioning guide 18*a* (FIG. 3).

Referring to FIGS. 11, 50(A), 50(B), and 50(C), the coupling means controlling means comprises: the cam surface 84*c* (84*c*1 and 84*c*2) of the inward bearing 84; a coupling cam 85 positioned between the inward bearing 84 and large gear 83; and a spring, which is disposed between the large gear 83 and outward bearing 86, and keeps the large gear 83 pressed toward the inward bearing 84.

The coupling cam 85 is rotatably supported by the cylindrical portion 84*b* of the inward bearing 84, and is provided with the cam surface 85*a* (85*a*1, 85*a*2, and 85*a*3). The cam surface 84*c* of the inward bearing 84 has two portions symmetrically positioned with respect to the axial line of the cylindrical portion 84*b*: portion 84*c*1 and portion 84*c*2 which are contiguous with each other. The portion 84*c*1 of the cam surface 84*c* is parallel to the inward surface of the inner plate 40, and is raised a predetermined height toward coupling cam 85 in the direction parallel to the rotational axis of the large gear 83, from the inward surface of the inner plate 40 (inward surface of inward bearing 84). The portion 84*c*2 of the cam surface 84*c* is an inclined surface, which connects a predetermined point on the peripheral surface of the cylindrical portion 84*b* to the raised parallel portion 84*c*1. The cam surface 85*a* of the coupling cam 85 also has two portions: portion 85*a*1 and 85*a*2 .

The portion 85*a*1 of the cam surface 85*a* is parallel to the inward surface of the inner plate 40, and is raised toward the inward surface of the inner plate 40, from the base portion 85*a*3, by the height equal to the height of the raised parallel portion 84*c*1 of the cam surface 84*c* from the inward surface of the inner plate 40. The portion 85*a*2 of the cam surface 85*a* is an inclined surface that connects the raised parallel portion 85*a*1 and the base portion 85*a*3 of the cam surface 85*a*.

Figure 50:
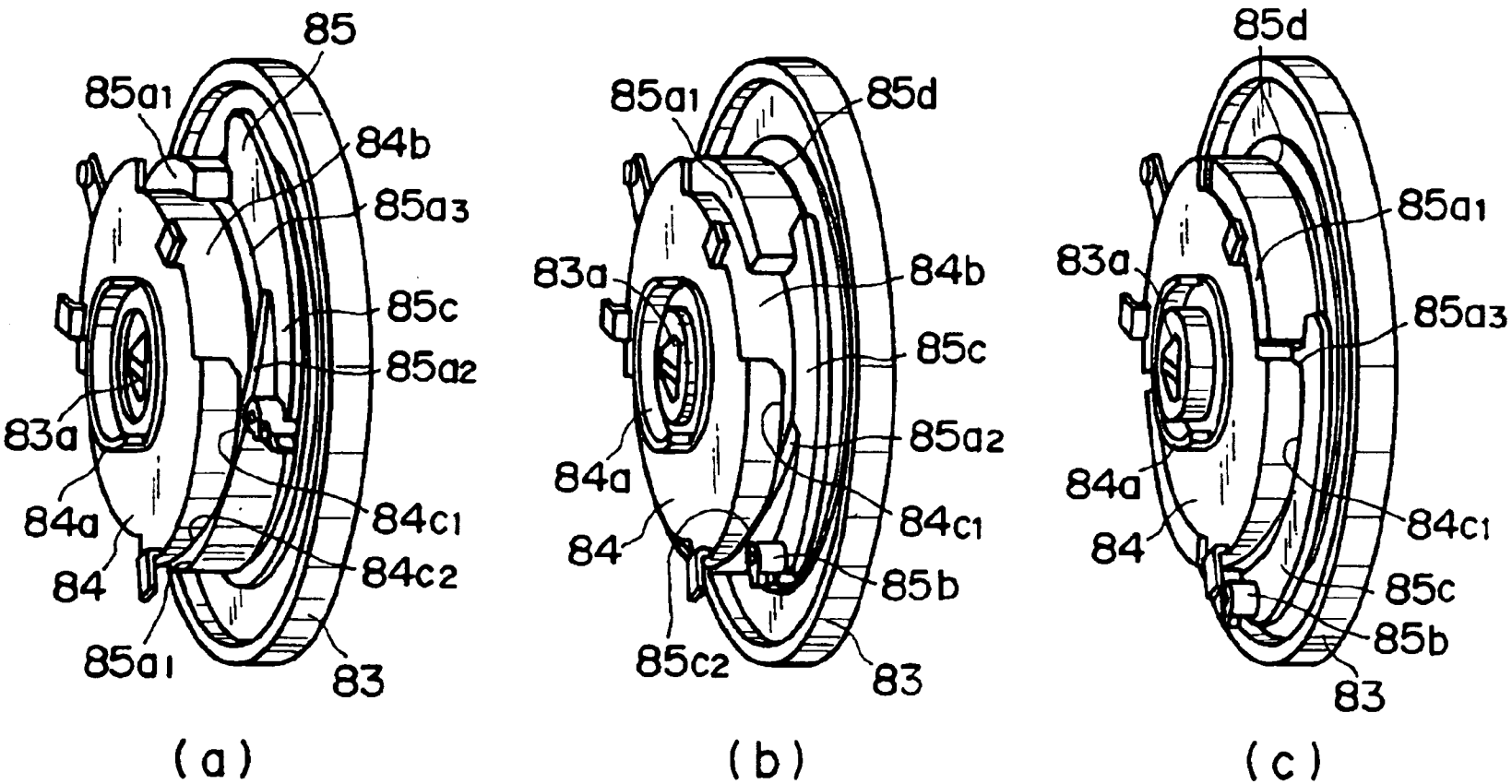
FIGS. 50(*a*)–50(*c*) are perspective views illustrating advancement and retraction of a large gear by rotation of a coupling can.

Referring to FIG. 50(C), as the coupling cam 85 is fitted around the cylindrical portion 84*b* of the inward bearing 84 in such a manner than the raised surface 84*c*1 contacts the bottom portion 85*a*3, it approaches the inner plate 40, with a small amount of play relative to the inward bearing 84 with respect to their rotational direction, and the coupling 83*a* of the large gear 83 is made to intrude into the image forming apparatus by the resiliency of the spring between bearing 86 and large gear 83, becoming ready to be engaged with the drum coupling 7*a*1 of the process cartridge B.

Referring to FIG. 50(B), as the coupling cam 85 is rotated, the inclined surfaces 84*c*2 and 85*a*2 come into contact with each other, and begin to slide against each other. As a result, the coupling cam 85 begins to be moved in the direction to move away from the inner plate 40. Consequently, the back surface 85*d* of the coupling cam 85 begins to push out the large gear 83 in the direction to move away from the inner plate 40 against the resiliency of the spring between bearing 86 and large gear 83, making the large gear coupling 83*a* begin to disengage from the drum coupling 7*a*1. Further, as the raised surface 85*a*1 of the coupling cam 85 comes into contact with the raised surface 84*c*1 as the result of the rotation of the coupling cam 85, the coupling cam 85 moves away from the inner plate 40 by a distance equal to the height of the raised portion 85*a*1 and base portion 85*a*3, which in turn moves the large gear 83 into a position where the coupling 83*a* of the large gear 83 is completely free from the drum coupling 7*a*1. When the large gear 83 is at this position, the end surface of the large gear coupling 83*a* is recessed from the inward surface of the inner plate 40, and also has retracted from the moving path of the positioning guide 18*a* of the process cartridge B.

As has been described up to this point, the coupling means of the image forming apparatus in this embodiment is engaged or disengaged, that is, enabled or disabled to transmit driving force, by being moved in the direction parallel to the rotational axis of the photoconductive drum 7, that is, the direction perpendicular to the direction in which the process cartridge B is moved, by the coupling means controller. Thus, each step of the movements of the process cartridge B and coupling means controller must be always carried out in the proper sequence. As the coupling means is ready to be engaged, the large gear coupling 83*a* is partially in the path of the positioning guide 18*a*, within the hollow of which the drum coupling 7*a*1, which engages with the large gear coupling 83*a*. Therefore, if the large gear coupling 83*a* becomes ready for engagement prior to the mounting of the process cartridge B, the positioning guide 18*a* collides with the large gear coupling 83*a* during the mounting of the process cartridge B, preventing the process cartridge B from being inserted further.

Incidentally, when an attempt is made to take the process cartridge B out of the apparatus main assembly before the disengagement of the coupling means, the driven side of the process cartridge B cannot be moved because of the engagement between the coupling on the process cartridge B side and the coupling on the apparatus main assembly side.

In a case that the two processes of conveying the process cartridge B and driving the coupling means controller are carried out by the rotational movement of the opening/closing cover 15, it is necessary to provide a mechanism which guarantees that during the closing movement of the opening/closing cover 15, the coupling means is readied for engagement by the coupling means controller, after the completion of the movement of the process cartridge B, whereas during the opening of the opening/closing cover 15, the process cartridge B becomes ready for removal, after the disengagement of the coupling means by the coupling means controlling means.

Next, the mechanism for guaranteeing that the above described two processes will be carried out in the proper sequence, will be described.

When the opening/closing cover 15 is completely open (FIG. 27), the cam surfaces of the coupling cam 85 and inward bearing 84 are in contact with each other by the raised surface 84*c*1 and raised surface 85*a*1 . The large gear 83 is in the retracted position away from the inner plate 40. The contact surfaces of the raised surfaces of the coupling cam 85 and inward bearing 84 are inclined at a predetermined angle, and in order for the two raised surfaces to come into contact with each other, it is necessary for the coupling cam 85 to rotate a certain angle. The thruster rod 55 is engaged with the boss 85*b* of the coupling cam 85, the boss 85*b* being fitted in the keyhole like hole 55*a* of the thruster rod 55, and is in contact with the second boss 50*g* of the right cam plate 50 near the end of the arcuate portion 55*b*3 of the elongated hole 55*b*. A stopper rib 60 extending in the lengthwise direction of the process cartridge B from the surface of the inner plate 40 is within the recess of the backup portion 55*g*. The arcuate portion 55*b*3 of the elongated hole 55*b* is configured so that when the thruster rod 55 is in the above described state, the center of the curvature of the arcuate portion 55*b*3 virtually coincides with the axial line of the rotational shaft 50*a*. The claws 50*g*1 and 50*g*2 located at the end of the second boss 50*g* of the cam plate 50 remain outside the elongated hole 55*b*, always functioning to prevent the disengagement between the second boss 50*g* and thruster rod 55 during the movement of the thruster rod 55. A tension spring 5 is stretched between the boss 55*c* located below the arcuate portion 55*b*3 of the elongated hole 55*b*, and the inner plate 40. The second boss 50*g* is kept in contact with the top wall of the arcuate portion 55*b*3 of the elongated hole 55*b*.

Up to this point, the process, in which the moving guide 41 is moved by the rotational closing movement of the opening/closing cover 15, and the process cartridge B is moved by the movement of the moving guide 41, has been described. Next, the structure which prevents the coupling cam 85 as the coupling means controller from rotating will be described.

While the second boss 41*c* of the moving guide 41 is moving in the arcuate portion 40*b*1 of the second guide rail 40*b*, the second boss 50*g* of the cam plate 50 moves in the arcuate portion 55*b*3 of the elongated hole 55*b* of the thruster rod 55. The center of the curvature of the arcuate portion 55*b*3 practically coincides with the axial line of the rotational shaft 50*a*. Therefore, during this movement of the second boss 50*g*, the thruster rod 55 maintains the attitude which it assumes when the opening/closing cover 15 is completely open. Thus, the coupling cam 85 is not rotated to move the large gear 83 (FIGS. 27 42).

Figure 51:
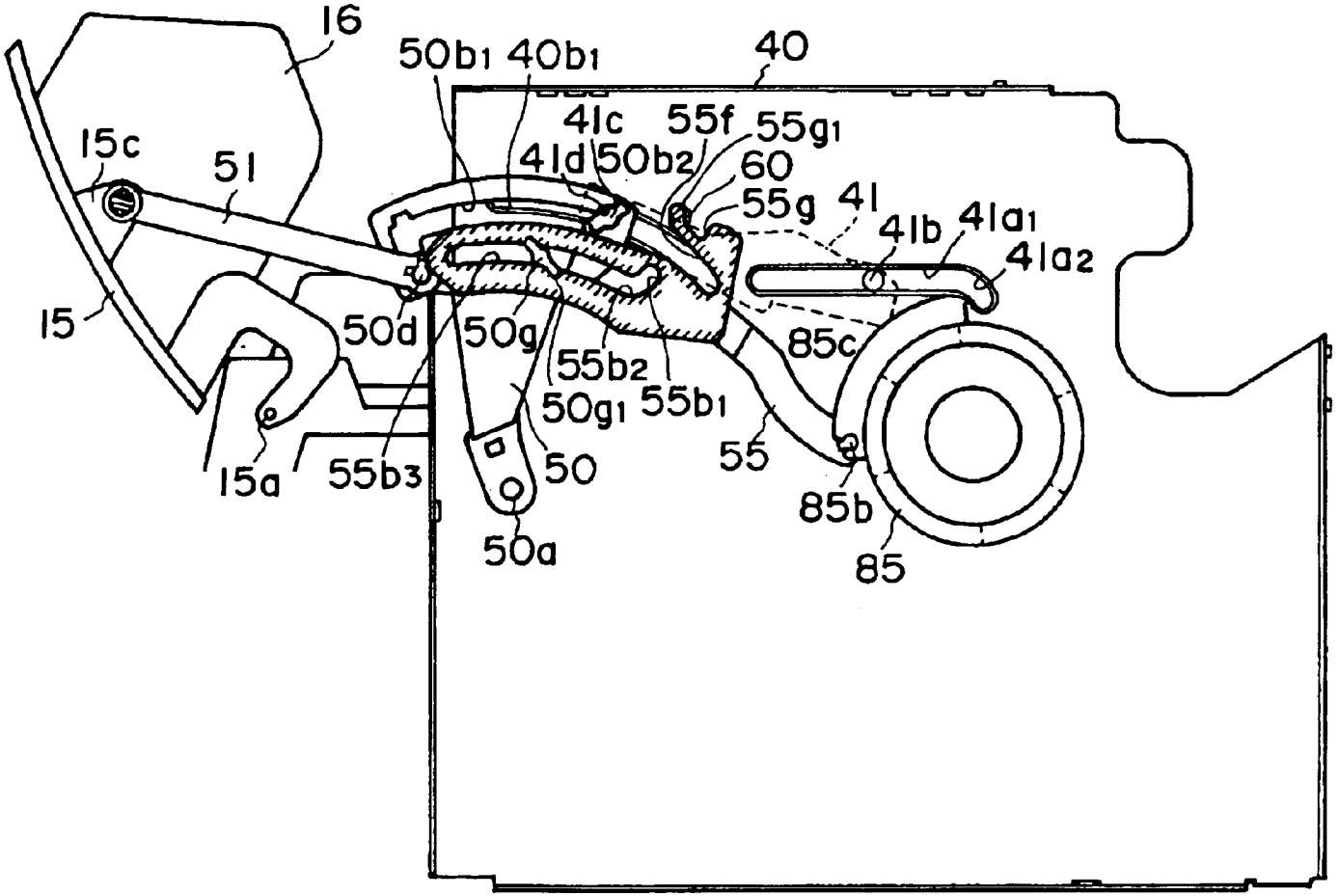
FIG. 51 is an illustration of the obstruction against the thruster rod during transportation of the process cartridge.

Even if an unexpected external force acts upon the thruster rod 55 in the direction to make the thruster rod 55 advance, while the second boss 50*g* is moving in the arcuate portion 55*b*3 of the elongated hole 53*b*, the backup surface 55*g*1 of the backup portion 55*g* comes into contact with the stopper rib 60, as shown in FIG. 51, ensuring that the thruster rod 55 is prevented from advancing, in order to prevent the coupling cam 85 from being rotated. In order for the backup surface 55*g*1 of the backup portion 55*g* to pass the stopper rib 60, the thruster rod 55, which is in the position shown in FIG. 27, must rotate about the axial line of the keyhole like hole 55*a*, in which the boss 85*b* of the coupling cam 85 is fitted to connect the thruster rod 55 and coupling cam 85, so that the top end of the backup surface 55*g*1 moves below the bottom end of the stopper rib 60. However, such rotation of the thruster rod 55 is impossible while the second boss 50*g* of the cam plate 50 is in the arcuate portion 55*b*3 or inclined portion 55*b*2 of the elongated hole 55*b*. Therefore, the backup surface 55*g*1 and stopper rib 60 are made to remain in contact with each other, preventing the coupling cam 85 from beginning to rotate while the moving guide 41 is moving.

Referring to FIG. 36, as the second boss 41*c* of the moving guide 41 comes close to the border between the arcuate portion 40*b*1 and straight portion of the second guide rail 40*b*, a timing boss 41*d*, with which only the right moving guide 41 is provided, enters the U shaped groove, which is located under the lifting portion 55*f* and is open toward the opening/closing cover 15, and then, the second boss 50*g* of the cam plate 50 moves into the inclined portion 55*b*2 of the elongated hole 55*b* (FIG. 42). While the second boss 50*g* of the cam plate 50 is in the inclined portion 55*b*2 of the elongated hole 55*b*, the thruster rod 55 is prevented by the stopper rib 60 from advancing. Therefore, the rotation of the coupling cam 85 has yet to begin.

As the second boss 50*g* of the cam plate 50 reaches the border between the inclined portion 55*b*2 and straight portion 55*b*1 of the thruster rod 55, the thruster rod 55 is rotated by the resiliency of the tension spring 56 about the axial line of the keyhole like hole 55*a* in the counterclockwise direction, guiding the second boss 50*g* of the cam plate 50 into the straight portion 55*b*1 of the elongated hole 55*b*. As a result, the thruster rod 55 begins to move in the direction to allow the backup portion 55*g* to pass the stopper rib 60. However, when the second boss 41*c* of the moving guide 41 is above the straight portion 40*b*2 of the second guide rail 40*b* as shown in FIG. 45, the timing boss 41*d* located at the end of the second boss 41*c* of the moving guide 41 is in contact with the lifting surface 55*f* of thruster rod 55. Therefore, it is impossible for the backup portion 55*g* of the thruster rod 55 to pass the stopper rib 60.

Referring to FIG. 48, the cam plate 50 is rotated by the closing movement of the opening/closing cover 15 until the second boss 41*c* of the moving guide 41 moves downward in the straight portion 40*b*2 of the second guide rail 40*b*, and the timing boss 41*d* at the end of second boss 41*c* of the moving guide 41 also moves down and separates from the lifting portion 55*f*. As a result, the backup portion 55*g* of the thruster rod 55 is allowed to pass the stopper rib 60, and is pulled down by the resiliency of the tension spring 56 about hole 55*a* until the top end of the straight portion 50*b*1 of the thruster rod 55 butts against the second boss 50*g* of the cam plate 50.

During the period between when the timing boss 50*d* comes into contact with the lifting surface 55*f* and when they separate from each other, the thruster rod 55 begins to rotate the coupling cam 85. However, the angle by which the coupling cam 85 is rotated during this period is set in a range in which the coupling cam 85 and inward bearing 84 remain in contact with each other by their raised surfaces 85*a*1 and 84*c*1, respectively. Therefore, the large gear coupling 83*a* does not begin to move.

As has been described above, while the moving guide 41 is moved by the rotation of the opening/closing cover 15, the second boss 50*g* of the cam plate 50, which drives the thruster rod 55, moves in the arcuate portion 55*b*3 and inclined portion 55*b*2 of the elongated hole 55*b* of the thruster rod 55. Therefore, the thruster rod 55 does not move. In addition, the movement of the thruster rod 55 is regulated by the condition that the stopper rib 60 is in the backup portion 55*g*. Thus, while the process cartridge B is conveyed by the movement of the moving guide 41 linked to the rotation of the opening/closing cover 15, the large gear 83 as the coupling means does not become ready to be engaged for driving force transmission, and therefore, does not interfere with the process cartridge conveyance.

Figure 52:
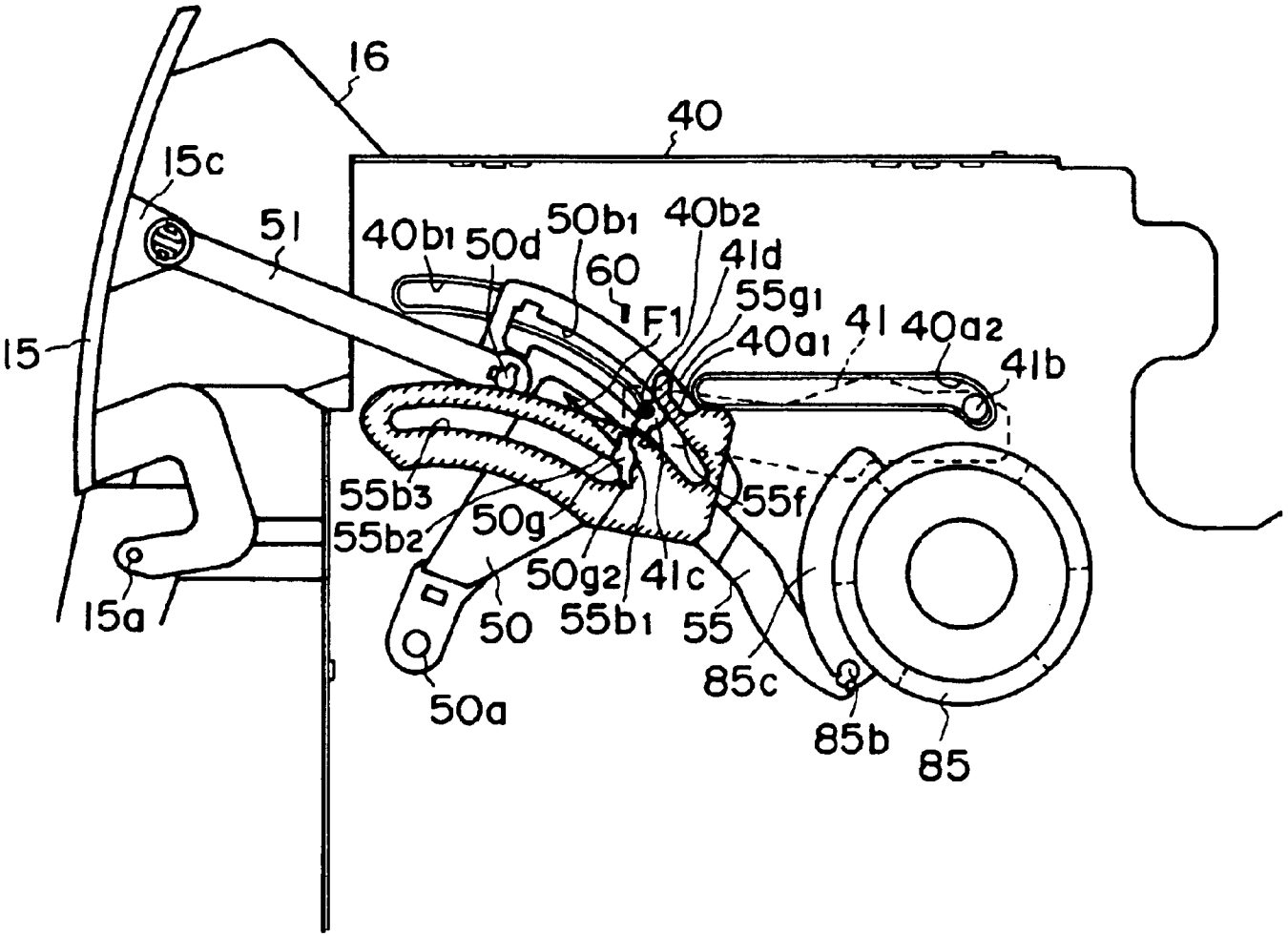
FIG. 52 is an illustration of the rotation of the coupling cam by the process cartridge mounting-and-demounting mechanism.

Referring to FIG. 52, as the opening/closing cover 15 is further closed after the completion of the movement of the moving guide 41, the arcuate portion 50*b*1 of the cam hole 50*b* of the elongated hole 50*b* (cam groove) of the cam plate 50 rotates along the second boss 41*c* of the moving guide 41. Thus, the moving guide 41 remains in the second location in the image forming apparatus, and the end of the straight portion 55*b*1 of the elongated hole 55*b* of the thruster rod 55 is made to contact the second boss 50*g* of the cam plate 50, by the resiliency of the tension spring 56 about hole 55*a*, establishing the four joint linkage comprising the thruster rod 55 and coupling cam 85.

As a result, after the completion of the movement of the moving guide 41, the coupling cam 85 is rotationally driven by the rotation of the cam plate 50, causing the boss 85*b* of the coupling cam 85, by which the coupling cam 85 is connected to the thruster rod 55, to move downward.

Then, as the opening/closing cover 15 is further rotated, the state of the contact between the coupling cam 85 and inward bearing 84 shifts to the contact between their inclined surfaces 85*a*2 and 84*c*2, and the large gear 83 comes under the pressure from the spring 87 between the large gear 83 and outward bearing 86. As a result, the large gear coupling 83*a* is forced to intrude into the hole of the inner plate 40. When the twisted hole at the intruding end of the large gear coupling 83*a* is not coincidental in rotational phase with the twisted projection located at the end of the drum coupling 7*a*1 located in the hollow of the positioning guide 18*a* and coaxial with the positioning guide 18*a*, the intrusion of the large gear coupling 83*a* into the hole of the inner plate 40 stops as the intruding end of the large gear coupling 83*a* comes into contact with the end of the drum coupling 7*a*1.

Figure 53:
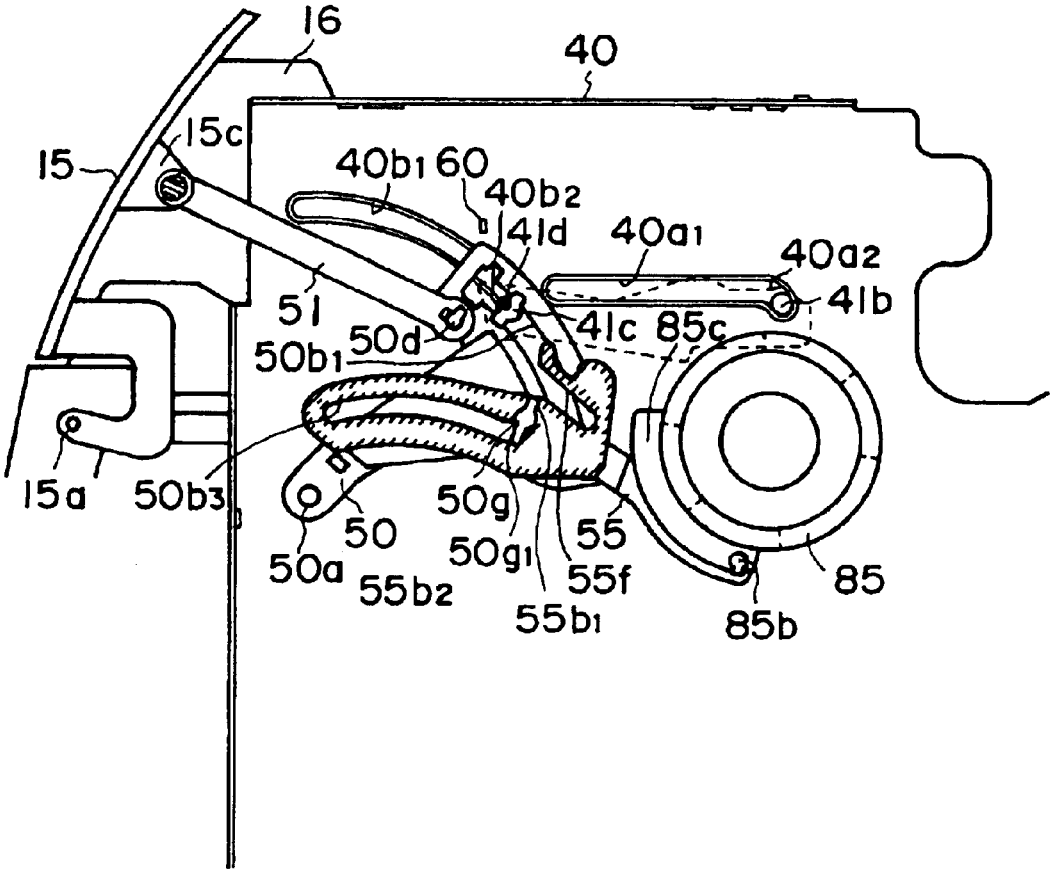
FIG. 53 is an illustration of the rotation of the coupling cam by the process cartridge mounting-and-demounting mechanism.

Then, before the opening/closing cover 15 completely closes, the coupling cam 85 rotates a certain angle until it becomes possible for the base portion 85*a*3 of the cam surface 85*a* of the coupling cam 85 to contact the raised surface 84*c*1 of the cam surface 84*c* of the inward bearing 84. By the time the opening/closing cover 15 completely closes, the inclined surfaces 84*c*2 and 85*a*2 of the inward bearing 84 and coupling cam 85 separate from each other, and remain separated, as shown in FIG. 53.

In the preceding description of the present invention, it was stated that the end of large gear coupling 83*a* stops intruding into the hole of the inner plate 40 as it comes into contact with the end of the drum coupling 7*a*1. However, when the opening/closing cover 15 is closed without mounting the process cartridge B, the large gear 83 moves until it comes into contact with the inward bearing 84. Therefore, the large gear coupling 83*a* protrudes a substantial distance into the inward side of the inner plate 40.

This concludes the description of the mechanism for ensuring that the process of conveying the process cartridge B by the movement of the moving guide 41 during the first half of the closing movement of the opening/closing cover 15, and the process of readying the coupling means by the coupling means controller to be engaged for driving force transmission during the latter half of the closing movement of the opening/closing cover 15, are carried out in the correct order.

(Driving of Process Cartridge Positioning Means on Left Side)

As described before, during the process cartridge conveyance by the movement of the moving guide 41 linked by the rotation of the opening/closing cover 15, the left positioning guide 18*a* is not in the positioning portion 90*a* of the conveyance frame 90. This is for the following reason. For the purpose of reducing the load which acts upon the process cartridge B during its conveyance, the left positioning guide 18*a* is not provided with a spring for keeping the left positioning guide 18*a* pressed upon the positioning portion 90*a*. Therefore, the process cartridge conveyance by the moving guide 41 alone cannot engage the left positioning guide 18*a* into the positioning portion 90*a* against the contact pressure generated by the transfer roller 4 and various electrical contacts 92.

On the outward side of the left inner plate 40, the pushing arm 52 is provided, which functions as a process cartridge positioning means, and is driven by the cam plate 50. The pushing arm 52 is provided with the resilient pressing portion 52*b*, which protrudes into the inward side of the inner plate 40 through the fan shaped hole 40*h* of the left inner plate 40, and is supported at a position away from the positioning portion 90*a*, that allows it to oscillate.

On the other hand, the left positioning guide 18*a* of the process cartridge B is provided with a mounting assistance auxiliary guide 18*a*1, which extends backward with respect to the process cartridge mounting direction. The rear end of this mounting assistance guide 18*a*1 constitutes a contact portion 18*a*2, which comes into contact with the resilient pressing portion 52*b* of the pushing arm 52. In this embodiment, the contact portion 18*a*2 is made arcuate so that the center of its curvature coincides with the axial line of the positioning guide 18*a*. With this structural arrangement, the variance in the positional relationship of the portion 18*a*2 relative to the resilient pressing portion 52*b* is minimized, when the positioning guide 18*a* settles into the positioning portion 90*a*.

During the conveyance of the process cartridge B, the pushing arm 52 remains in the retracted position, in which the resilient pressing portion 52*b* of the pushing arm 52 is outside the paths of the positioning guide 18*a* and portion 18*a*1. In this state, as the pushing arm 52 is driven by the cam plate 50, the resilient pressing portion 52*b* pushes the positioning guide 18*a* into the positioning portion 90*a* after the completion of the cartridge conveyance, and comes to a retaining position because the positioning guide 18*a* must be prevented from being moved out of the positioning portion 90*a* by the external force which acts on the process cartridge B, for example, the force generated by the recording medium in the direction to lift the photoconductive drum 7 during image formation, in addition to the contact pressure from the transfer roller 4 and electrical contacts 92.

In order to minimize the angle which the pushing arm 52 must rotate to move the resilient pressing portion 52*b* from the retaining portion to the retracted position, the mounting assistance auxiliary guide 18*a*1, which is behind the positioning guide 18*a* with respect to the process cartridge mounting direction, is provided with the pressure catching portion 18*a*2, which is located on the peripheral surface, keeping the resilient pressing portion 52*b* of the pushing arm 52 away from the rotational shaft 52*a*. If the angle, by which the pushing arm 52 must rotate to place the resilient pressing portion 52*b* of the pushing arm 52 in contact with the peripheral surface of the positioning guide 18*a*, is increased to keep the resilient pressing portion 52*b* away from the paths of the positioning guide 18*a* and mounting assistance auxiliary guide 18*a*1, the distance between the retracted position of the boss 52*c*, which is driven by the cam plate 50 located ahead of the resilient pressing portion 52*b* with respect to the process cartridge mounting direction, and the rotational shaft 50*a* of the cam plate 50, increases. Consequently, the end of the arm driving portion 50*h*1 must be extended in the outward direction with respect to the radius direction of the cam plate 50, requiring a larger space for the rotation of the cam plate 50, which is a problem.

The top surface of the mounting assistance auxiliary guide 18*a*1 is an inclined surface, tilting toward the peripheral surface of the positioning guide 18*a*. This inclined surface assures that the pressure catching surface 18*a*2 contacts the resilient pressing portion 52*b* to minimize the protrusion of the mounting assistance auxiliary guide 18*a*1 from the path of the positioning guide 18*a*, within the area on the inward side of the rotational radius of the resilient pressing portion 52*b*. With this arrangement, the clearance between the resilient pressing portion 52*b* in its retracted position, and the path of the mounting assistance auxiliary guide 18*a*1, is secured.

In other words, the pressure catching portion 18*a*2 is such that it is located on the upstream side of the cartridge positioning portion 18*a*, with respect to the direction in which the process cartridge B is mounted into the apparatus main assembly 14, and also is located away from the cartridge positioning portion 18*a*. It comes under the pressure from resilient pressing portion 52*b* of the apparatus main assembly 14, as the process cartridge B is moved into the proper cartridge position in the apparatus main assembly 14. Further, the pressure catching portion 18*a*2 is in the form of an arc, the center of which coincides with the axial line of the photoconductive drum 7. The cartridge frame, cartridge positioning portion 18*a*, and pressure catching portion 18*a*2, are integrally formed of plastic.

The pressure catching portion 18*a*2 is located on the upstream side of the cartridge positioning portion 18*a*, with respect to the direction in which the process cartridge B is mounted into the apparatus main assembly 14, and also is located away from the cartridge positioning portion 18*a*. It comes under the pressure from the resilient pressing portion 52*b* of the apparatus main assembly 14, as the opening/closing cover 15 is closed.

The movement of the pushing arm 52 is similar to that of the coupling means controller in that it must be carried out in the proper order. In other words, it is necessary that during the closing movement of the opening/closing cover 15, the pushing arm 52 begins to rotate after the completion of the conveyance of the process cartridge B, and during the opening movement of the opening/closing cover 15, the process cartridge B begins to move after the completion of the rotation of the pushing arm 52. More specifically, during the closing movement of the opening/closing cover 15, the pushing arm 52 rotates, moving the process cartridge B to a predetermined location, after the completion of the movement of the moving guide 41, and then, it retains the process cartridge B in the positioning portion. These functions of the pushing arm 52 will be described next.

When the pushing arm 52 is in the retracted position, in which it is holding up the resilient pressing portion 52*b*, by being pressured by the resiliency of the helical torsion coil spring 53, the boss 52*c* is at a point at which it is about to cross the path of the open end of the arm driving portion 50*h*1 of the second cam 50*h*, after the cam plate 50 has moved the moving guide 41 to the second location.

Thus, as the opening/closing cover 15 is closed further after the completion of the movement of the moving guide 41, the arm driving portion 50*h*1 of the second cam 50*h* of the cam plate 50 takes in the boss 52*c* of the pushing arm 52. During the closing movement of the opening/closing cover 15, the boss 52*c* contacts the outward wall of the second cam 50*h*, and rotates the pushing arm 52 in the clockwise direction about the arm driving portion 50*h*1 of the second cam 50*h* against the resiliency of the helical torsion coil spring 53. Therefore, as the cam plate 50 rotates, the boss 52*c* moves deeper into the arm driving portion 52*h*1. By this rotation of the pushing arm 52, the resilient pressing portion 52*b* of the pushing arm 52 is moved closer to the mounting assistance guide 18*a*1 of the process cartridge B.

At this point, the positioning guide 18*a* of the process cartridge B has yet to fit into the positioning portion 90*a* of the conveyance frame 90. Therefore, the mounting assistance auxiliary guide 18*a*1 on the peripheral surface of the positioning guide 18*a* is outside the rotational path of the pressure application surface 52*b*1 of the resilient portion 52*b* of the pushing arm 52.

Figure 55:
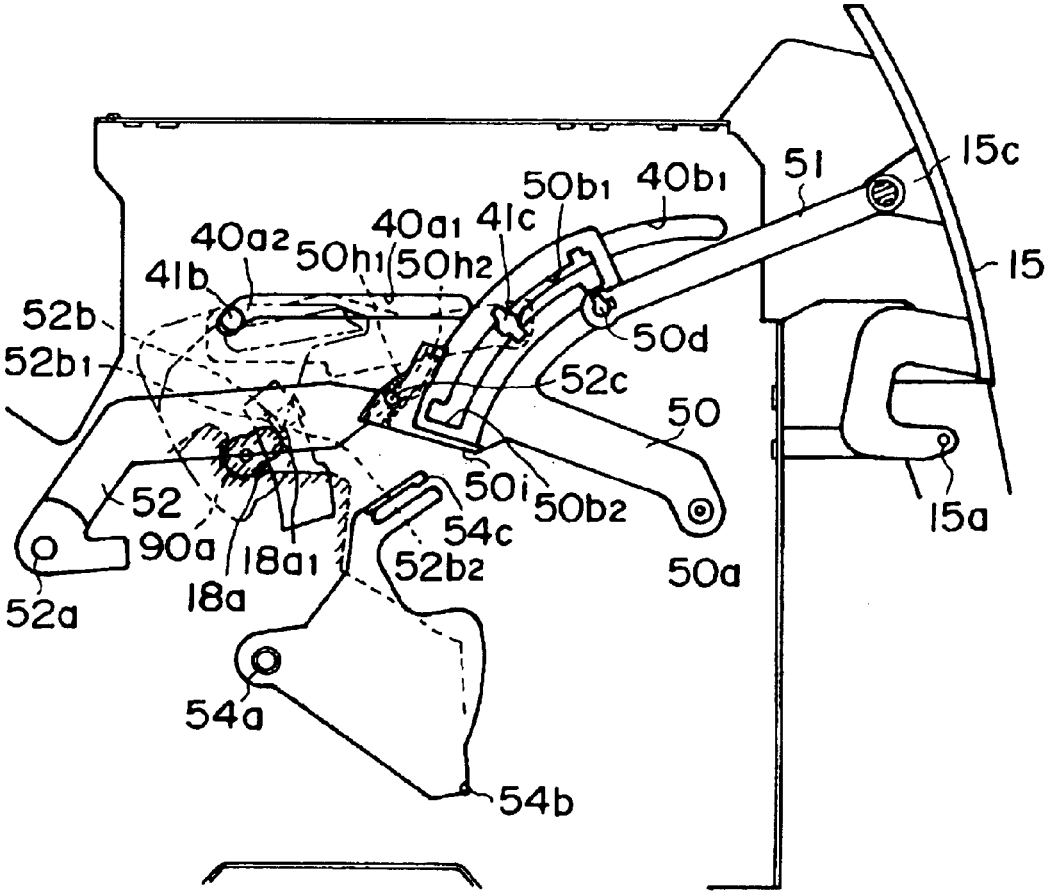
FIG. 55 is an illustration of an operation of an interrelating switch and a swing action of a pushing arm by the process cartridge mounting-and-demounting mechanism.

As the pushing arm 52 rotates about the rotational shaft 52*a* due to further rotation of the cam plate 50, the pulling surface 52*b*2, which is on the upstream side of the resilient pressing portion 52*b* with respect to the rotational direction of the pushing arm 52 and is tilted more in the outward direction, with respect to the radius direction of the rotation of the pushing arm 52, comes into contact with the mounting assistance auxiliary guide 18*a*1 on the upstream side of the peripheral surface of the positioning guide 18*a*, with respect to the process cartridge mounting direction with respect to a predetermined position (FIG. 55).

Figure 56:
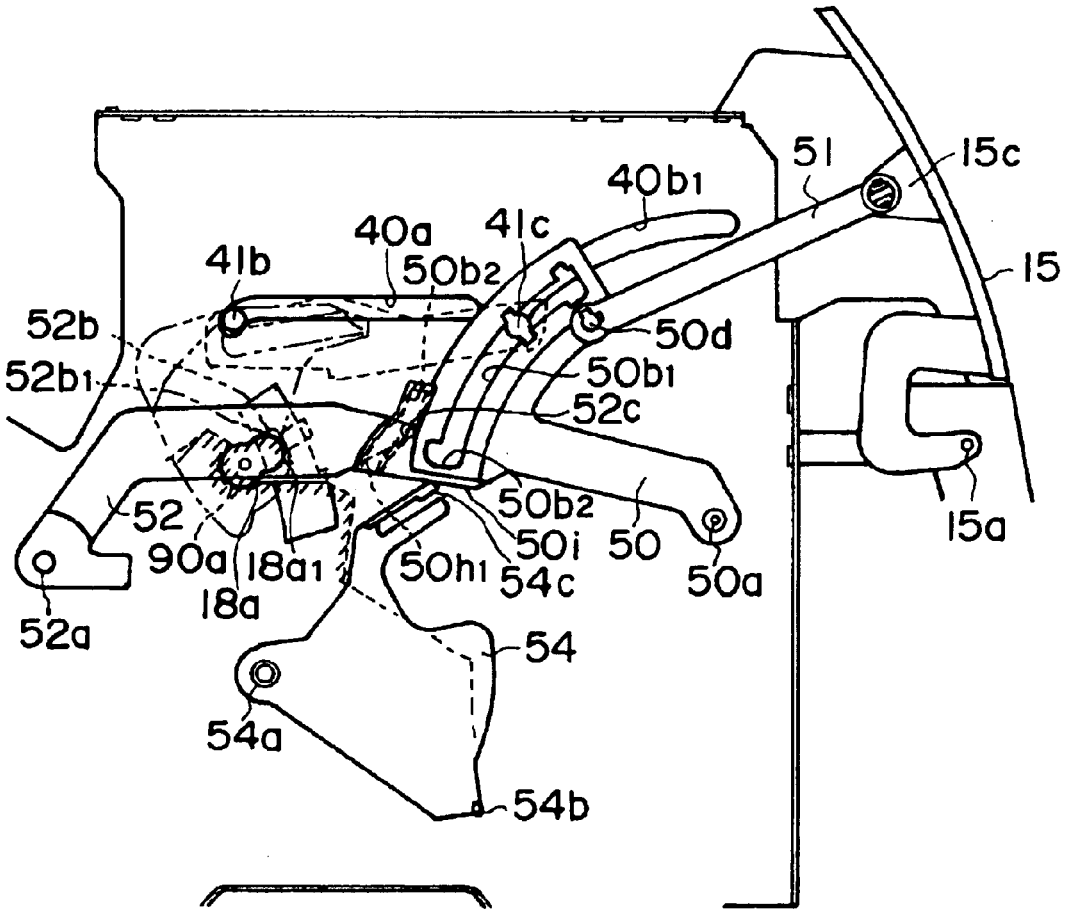
FIG. 56 is an illustration of an operation of an interrelating switch and a swing action of a pushing arm by the process cartridge mounting-and-demounting mechanism.

As the resilient pressing portion 52*b* is further rotated after the pulling surface 52*b*2 comes into contact with the round corner of the mounting assistance auxiliary guide 18*a*1, which connects the inclined surface and pressure catching portion 18*a*2 of the mounting assistance auxiliary guide 18*a*1, the process cartridge B begins to be pressured by the slanted pulling surface 52*b*2 in the direction to fit the positioning guide 18*a* into the positioning portion 90*a*, and the round corner of the mounting assistance auxiliary guide 18*a*1 comes into contact with the contact surface 52*b*1 of the resilient pressing portion 52*b*, on the rotational shaft 52*a* side. Then, as this contact surface 52*b*1 comes into contact with the pressure catching portion 18*a*2, which is on the peripheral surface of the mounting assistance auxiliary guide 18*a*1, the positioning guide 18*a* fits into the positioning portion 90*a*, as shown in FIG. 56, ending the positioning of the process cartridge B in the apparatus main assembly.

Figure 57:
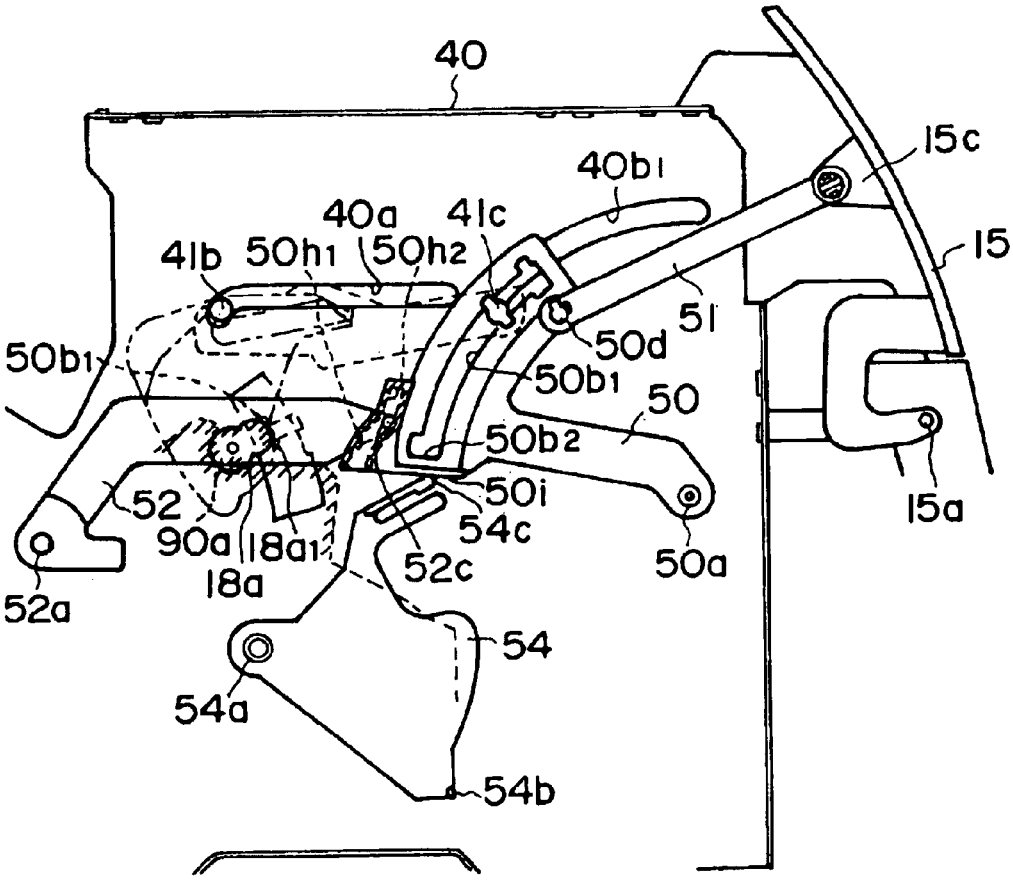
FIG. 57 is an illustration of an operation of an interrelating switch and a swing action of a pushing arm by the process cartridge mounting-and-demounting mechanism.

Even after pushing the positioning guide 18*a* into the positioning portion 90*a* by the resilient pressing portion 52*b*, the pushing arm 52 continues to rotate until the resilient pressing portion 52*b* entirely enters the path of the pressure catching portion 18*a*2 to begin to properly support and retain the process cartridge B (FIG. 57).

Thereafter, as the cam plate 50 rotates further, the boss 52*c* moves past the arm driving portion 50*h*1 and moves into the arm retaining portion 50*h*2, the center of the curvature of which coincides with the rotational axis of the cam plate 50. As the result, the rotation of the pushing arm 52 stops.

Figure 58:
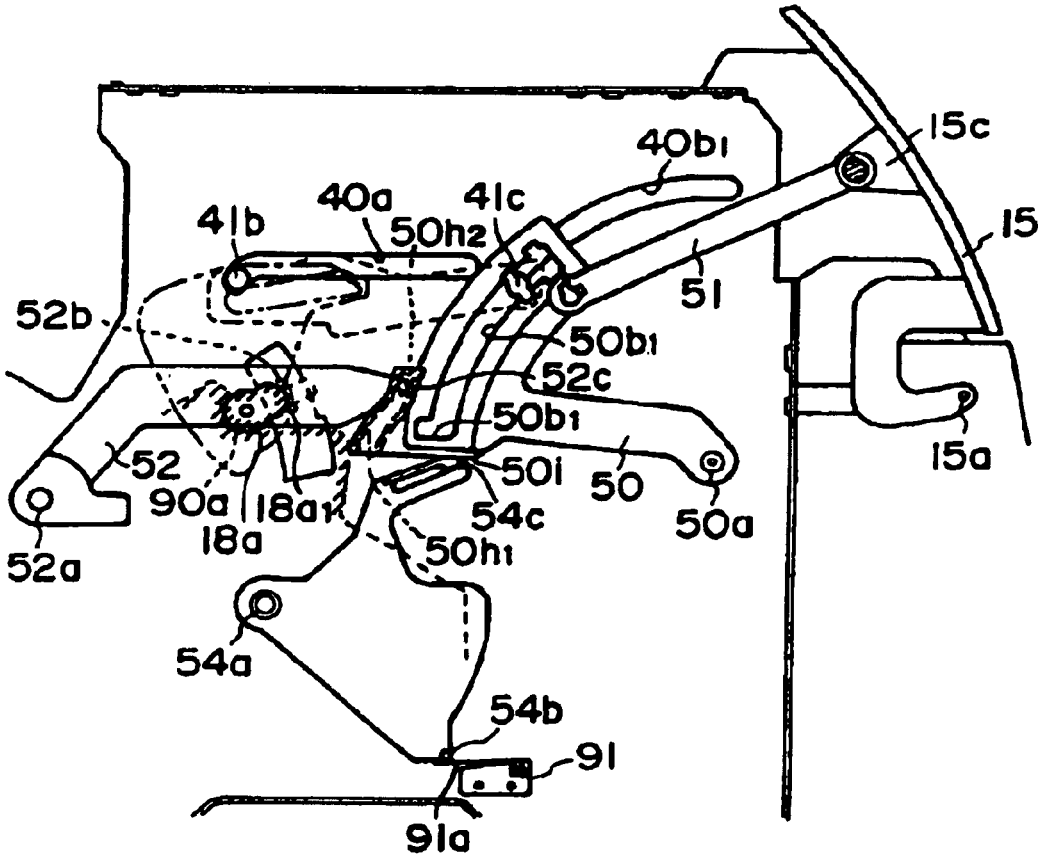
FIG. 58 is an illustration of an operation of an interrelating switch and a swing action of a pushing arm by the process cartridge mounting-and-demounting mechanism.

Thereafter, the cam plate 50 rotates further to a point at which it will ensure that the boss 52*c* of the pushing arm 52 has come into contact with the cam surface of the arm retaining portion 50*h*2, and which point corresponds to the completely closed position of the opening/closing cover 15 (FIG. 58).

At this point, the resilient pressing portion 52*b* of the pushing arm 52 is in contact with the pressure catching portion 18*a*2 of the process cartridge B, and also, is completely in the path of the positioning guide 18*a*. Therefore, the process cartridge B is regulated in movement; in other words, it is retained in the positioning portion 90*a*.

In this state, the only direction in which the positioning guide 18*a* is allowed to move is the direction of the line connecting the resilient pressing portion 52*b* and rotational shaft 52*a*. Therefore, as an attempt is made to dislodge the process cartridge B from the positioning portion 90*a*, the reactive force which acts on the resilient pressing portion 52*b* is directed approximately toward the rotational shaft 52*a*, failing to rotate the pushing arm 52. Without the rotation of the pushing arm 52, the resilient pressing portion 52*b* does not unlatch from the pressure catching portion 18*a*2. Therefore, the process cartridge B remains retained in the positioning portion 90*a*, being properly positioned.

Regarding the relationship between the boss 52*c* of the pushing arm 52 and the second cam 50*h* of the cam plate 50 while they are in contact with each other, when the image forming apparatus is ready for image formation, that is, after the complete closing of the opening/closing cover 15, the boss 52*c* is in the arm retaining portion 50*h*2 of the second cam 50*h*, the center of the curvature of which coincides with the axial line of the rotational shaft 50*a* of the cam plate 50, being supported thereby. Therefore, even if an attempt is made to rotate the pushing arm 52, it is impossible for the pushing arm 52 to rotate the cam plate 50. Thus, neither does the opening/closing cover 15 open, nor is the image forming apparatus adversely affected.

(Activation of Interlocking Switch)

Up to this point, the placement of the process cartridge B in the apparatus main assembly linked to the closing movement of the opening/closing cover 15, the readying of the coupling means by the movement of the coupling means controlling means, for engagement, and the positioning and retaining of the left positioning guide of the process cartridge B by the pushing arm 52, in the positioning portion, have been described.

Figure 54:
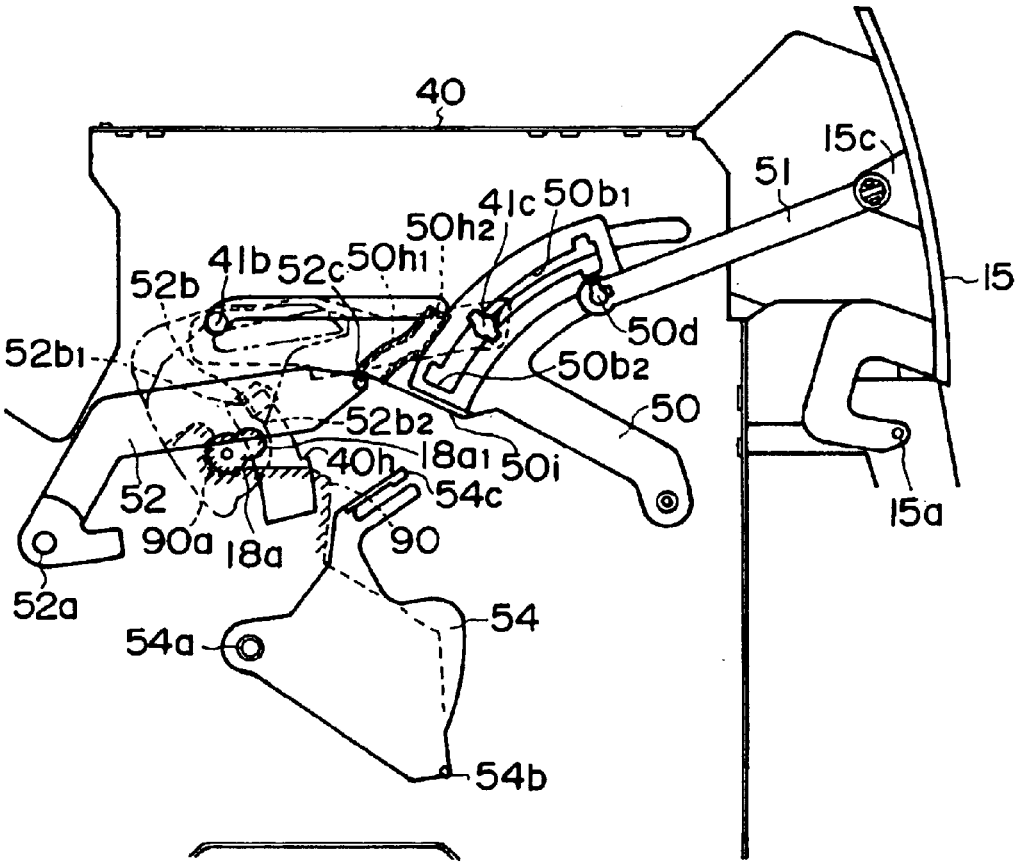
FIG. 54 is an illustration of an operation of an interrelating switch and a swing action of a pushing arm by the process cartridge mounting-and-demounting mechanism.

These processes completely end before the opening/closing cover 15 is completely closed. Thus, as the opening/closing cover 15 is completely closed, the interlocking switch 54 is activated, allowing electrical current to flow to ready the image forming apparatus for image formation. More specifically, as the microswitch 91 (FIG. 58) on the power source circuit board is pressed by an oscillatory lever 91*a*, the image forming apparatus is turned on. Referring to FIGS. 54 58, the interlocking switch 54 is rotationally attached to the left inner plate 40. It makes contact with the oscillatory lever 91*a* of the microswitch 91 (unshown in FIGS. 54 57), by the lever 54*b*, and is kept pressed upward by the resiliency of the microswitch 91.

The left cam plate 50 is provided with a contact surface 50*i*, which is located on the inward side, with respect to the radius direction of the curvature of the second cam 50*h*, of the second cam 50*h* located at the leading end of the left cam plate 50 with respect to the rotational direction of the cam plate 50. The contact surface 50*i* contacts the elastic portion 54*c* of the interlocking switch 54.

As the opening/closing cover 15 is closed, and the left cam plate 50 guides the boss 52*c* of the pushing arm 52 to the arm retaining portion 50*h*2 of the second cam 50*h*, the contact surface 50*i* comes into contact with the elastic portion 54*c* of the interlocking switch 54. Thereafter, while the cam plate 50 is moving the boss 52*c* of the pushing arm 52 to the outward wall of the arm retaining portion 50*h*2, the interlocking switch 54 rotates about the shaft 54*a* against the resiliency of the microswitch 91, causing the lever 54*b* to press the lever 91*a* downward to engage the microswitch 91. As a result, the image forming apparatus is turned on.

In order to ensure that the interlocking switch 54 is activated during the last stage of the rotational movement of the cam plate 50, the contact surface 50*i* of the cam plate 50 must be positioned as if it is partially in the contact portion of the interlocking switch 54 (FIG. 58), in consideration of the variance in the angle by which the cam plate 50 is rotated by the closing of the opening/closing cover 15. Therefore, the contact portion 54*c* of the interlocking switch 54 is rendered elastic so that the contact portion 54, or elastic portion, elastically deforms to tolerate the intrusion of cam plate 50.

(Method for Positioning Process Cartridge)

The turning on of the image forming apparatus concludes the last movement of the various mechanisms linked to the closing of the opening/closing cover 15; in other words, the complete closing of the opening/closing cover 15 readies the image forming apparatus for image formation. Thereafter, as the motor of the driving means rotates, the driving force is transmitted to the large gear 83, rotating the large gear 83. As the large gear 83 rotates, the twisted hole of the large gear coupling 83*a* becomes coincidental in rotational phase with the twisted projection of the drum coupling 7*a*1. As the twisted hole and projection coincide in rotational phase, the large gear coupling 83*a* is advanced by the spring located between the large gear 83 and outward bearing 86. Then, force is generated by the twist of both the couplings in the direction to cause the two couplings to pull each other. As a result, the end of the twisted projection of the drum coupling 7*a*1 comes into contact with the bottom surface of the twisted hole of the large gear coupling 83*a*, and is kept in contact therewith, by the force which is acting upon both the couplings in the direction to cause the couplings to pull each other, fixing thereby the positions of both couplings with respect to the lengthwise direction of the process cartridge B. Since the cross section of the twisted hole of the large gear coupling 83*a* and the cross section of the twisted projection of the drum coupling 7*a*1 are both in the form of a virtually equilateral triangle, and the axial lines of the twisted hole and twisted projection coincide with the large gear coupling 83*a* and drum coupling 7*a*1, respectively, the rotational axes of the large gear coupling 83*a* and drum coupling 7*a*1 become aligned with each other as the three lateral walls of the twisted hole come into contact with the corresponding three lateral edges of the twisted projection, allowing driving force to be smoothly transmitted.

Figure 59:
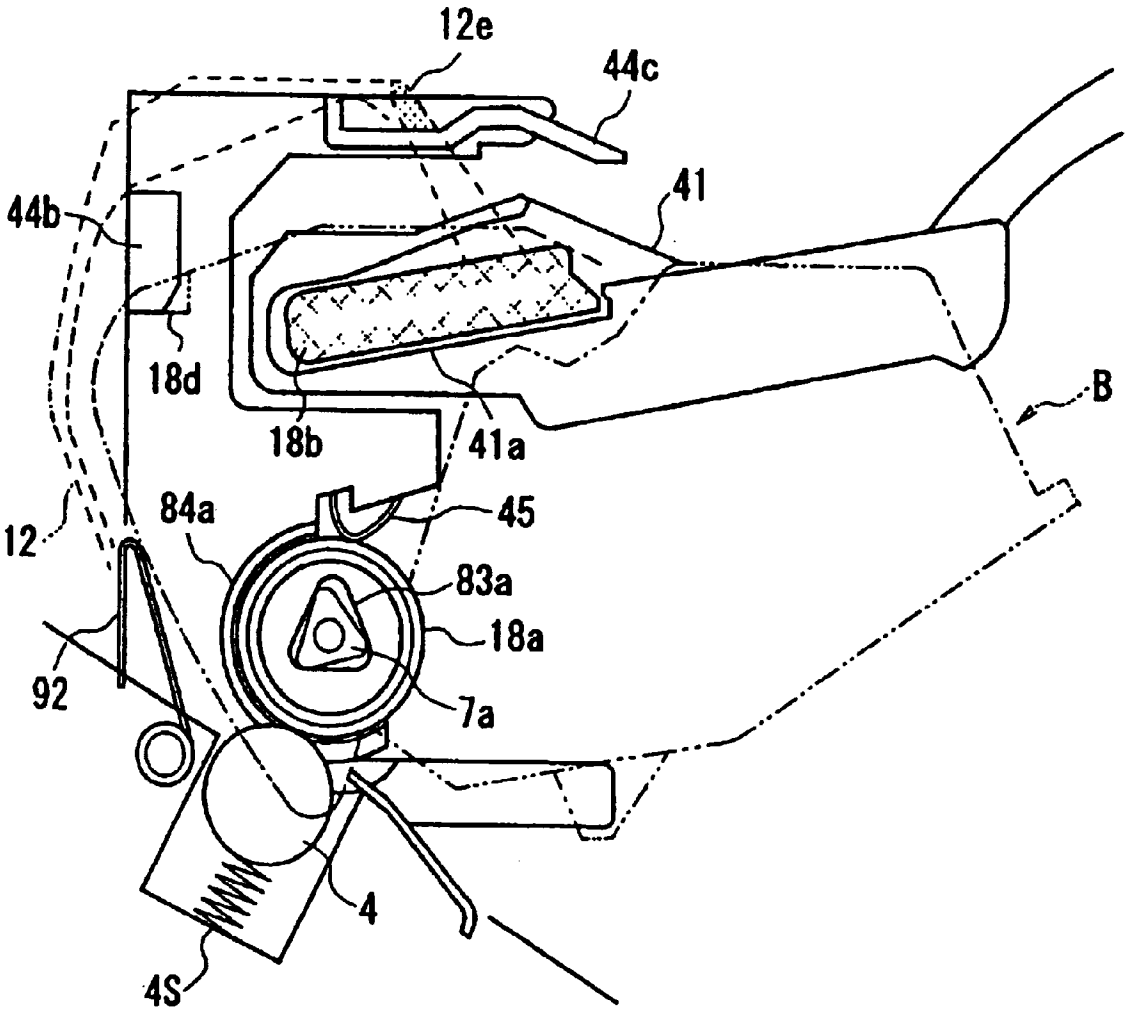
FIG. 59 is an illustration of supporting of the process cartridge in an operative state with the cover closed.
Figure 60:
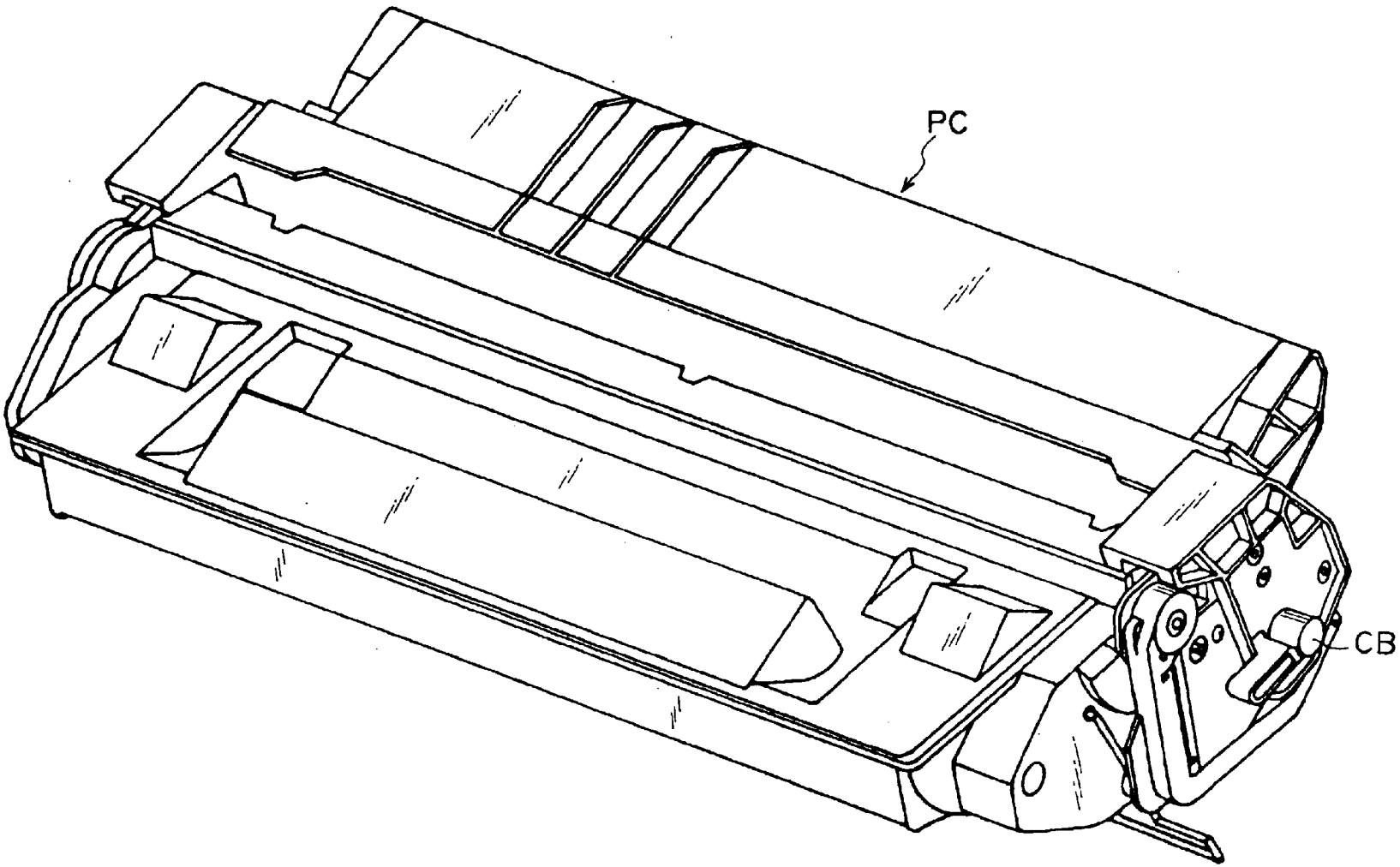
FIG. 60 is a perspective view of a process cartridge which is detachably mountable to a cartridge mounting guide provided in the main assembly of a conventional electrophotographic image forming apparatus.
Figure 61:
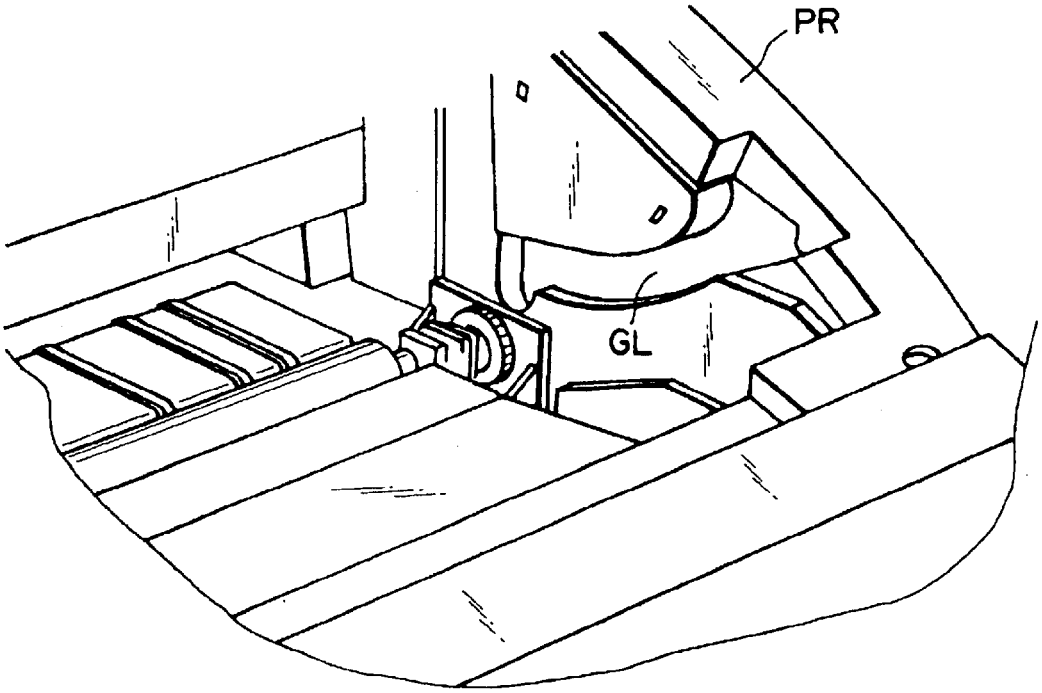
FIG. 61 is an illustration of a cartridge mounting guide provided in the main assembly of the conventional electrophotographic image forming apparatus.
Figure 62:
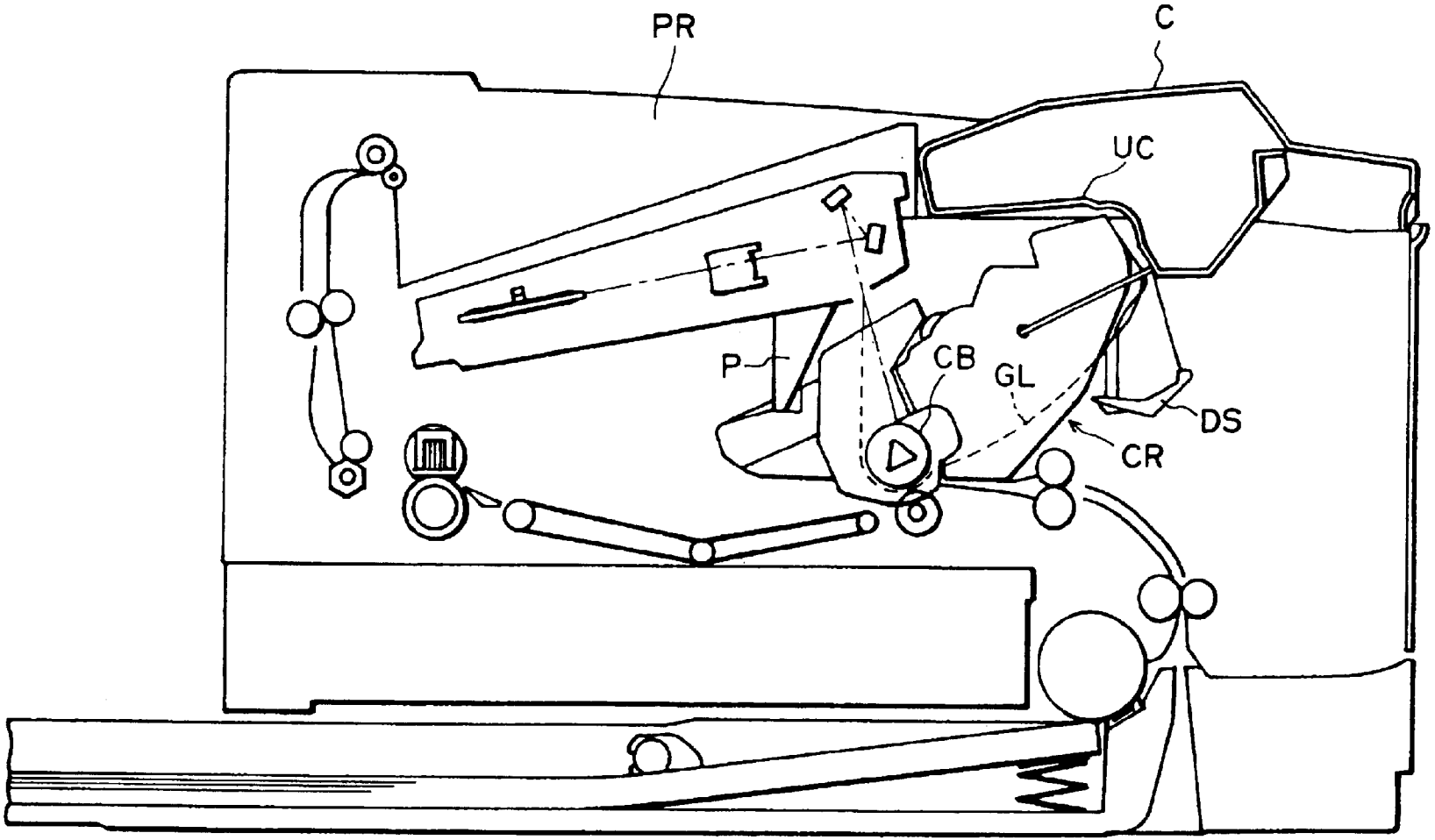
FIG. 62 is a drawing for depicting the cartridge mounting guide and under cover of the main assembly of an example of an electrophotographic image forming apparatus in accordance with the prior arts.

After driving force begins to be transmitted by the engagement of the coupling means, and the rotational axes of the large gear coupling 83*a* and drum coupling 7*a*1 are aligned, the position of the right end of the process cartridge B, where the coupling means controlling means is located, is fixed by the coupling means. Referring to FIG. 59, the positioning guide 18*a*, which has been supported by the cartridge catching/retaining portion 84*a* until the coupling means is engaged, is separated from the cartridge catching/retaining portion 84*a* against the resiliency of the helical torsion coil spring 4S, and also, the mounting guide 18*b* is separated from the guiding groove 41*a* of the moving guide 41. Further, as the process cartridge B begins to be driven as the result of the engagement of the coupling means, in other words, as the process cartridge B begins to be subjected to rotational force, the butting surface 18*d*, which is on the right end of the cartridge frame, as seen from the trailing side with respect to the process cartridge mounting direction, and on the leading end of the cartridge frame with respect to the process cartridge mounting direction, and faces forward with respect to the rotational direction of the process cartridge B, comes into contact with the rotation controlling portion 44*b* of the stationary guide 44.

As described above, in this embodiment, the image forming apparatus is structured so that the position of the process cartridge B within the image forming apparatus is fixed only after driving force begins to be transmitted to the process cartridge B by the engagement of the coupling means.

After driving force begins to be transmitted to the process cartridge B, the process cartridge B is retained in the proper position by the drum coupling 7*a*1, which is coaxially attached to the right end of the photoconductive drum 7, and the large gear coupling 83*a* rotationally supported by the right inner plate 40 of the image forming apparatus. The left end of the process cartridge B is properly positioned as the positioning guide 18*a* of the cartridge frame, the axial line of which coincides with the rotational axis of the photoconductive drum 7, is fitted in the positioning portion 90*a* of the conveyance frame 90, and is retained therein as the pressure catching portion 18*a*2 on the peripheral surface of the positioning guide 18*a* is kept pressed by the resilient pressing portion 52*b* of the pushing arm 52. Further, the butting surface 18*d* of the cartridge frame, which is at the leading end, with respect to the process cartridge mounting direction, and at the right end, as seen from the trailing side with respect to the process cartridge mounting direction, remains in contact with the rotation controlling portion 44*b* of the stationary guide 44. In other words, the process cartridge B is properly retained in the proper position in the image forming apparatus, by three points.

In order to place the process cartridge B in the above described proper position, the mounting guide 18*b* of the process cartridge B, which has been supported by the moving guide 41 while being conveyed by the movement of moving guide 41, leaves the retaining surface 41*a*1 of the moving guide 41, as the positioning portions (positioning guide 18*a*, and drum coupling 7*a*1), which are coaxial with the photoconductive drum 7 begin to be supported by the positioning means (positioning portion 90*a* of the conveyance frame, and large gear coupling 83*a*) on the image forming apparatus side.

As is evident from the above description, by supporting the positioning portions on the process cartridge B side, which are coaxial with the photoconductive drum 7, by the positioning means of the image forming apparatus main assembly, the process cartridge B is placed and retained in the proper position in the image forming apparatus, and therefore, the process cartridge B is highly accurately positioned relative to such components as the optical system 1 and transfer roller 4, the positional relationship of which relative to the photoconductive drum 7 must be guaranteed in accuracy.

(Movements of Process Cartridge Mounting/Dismounting Mechanism During Opening of Opening/Closing Cover 15)

Next, the sequence of turning off the image forming apparatus by deactivating interlocking switch 54 by opening the opening/closing cover 15; disengaging the pushing arm 52 and coupling means by further opening the opening/closing cover 15; moving the moving guide 41 by further opening the opening/closing cover 15; and taking out the process cartridge B from the moving guide 41, will be described. In this sequence, the steps described above are carried out in the reverse order.

The opening/closing cover 15, which is in the position shown in FIGS. 53, 58, and 59, is opened. On the left side of the image forming apparatus, as the opening/closing cover 15 is opened, the cam plate 50 rotates in the direction to move away from the interlocking switch 54. As a result, the interlocking switch 54 is lifted by the resiliency of the microswitch 91, and therefore, the current to various operational units of the image forming apparatus is cut off. Further, the elastic portion 54*c* is disengaged from the contact portion 50*i* of the cam plate 50 (FIGS. 55 58).

Next, the pushing arm 52 is disengaged from the coupling means. First, the disengagement of the left pushing arm 52 will be described.

As the cam plate 50 is rotated until the elastic portion 54*c* of the interlocking switch 54 becomes disengaged from the contact portion 50*i*, the boss 52*c* of the pushing arm 52 becomes disengaged from the arcuate surface of the arm retaining portion 50*h*2 of the second cam 50*h* (FIG. 55). Since the resiliency of the helical torsion coil spring 53 attached to the base of the pushing arm 52 is not strong enough to disengage the pushing arm 52 by lifting the pushing arm 52 and overcoming the friction between the resilient pressing portion 52*b* and pressure catching portion 18*a*2, the cam plate 50 simply contacts the boss 52*c* by the inward wall of the arm driving portion 50*h*1 of the second cam 50*h*, with respect to the radius direction. Then, the pushing arm 52 is forced by the rotation of the cam plate 50 to move upward.

After this disengagement of the boss 52*c* and the inward wall of the arm driving portion 50*h*1 of the second cam 50*h*, the resilient pressing portion 52*b* of the pushing arm 52 is disengaged from the pressure catching portion 18*a*2 of the process cartridge B. The pushing arm 52 is placed in contact with the top end 40*h*2 of the fan shaped hole 40*h* of the inner plate 40, by the helical torsion coil spring 53, by the butting portion 52*b*3 at the top end of the resilient pressing portion 52*b*, and the resilient pressing portion 52*b* is moved to its retracted position where it will be out of the paths of the positioning guide 18*d* and pressure catching portion 18*a*2 of the process cartridge B (FIGS. 54 55).

As a result, the left positioning guide 18*a* of the process cartridge B is moved out of the positioning portion 90*a* by the contact pressure between the photoconductive drum 7 and transfer roller 4, which acts in the direction to lift the photoconductive drum 7.

At the same time as the disengagement of the pushing arm 52 on the left side, the coupling means is disengaged.

As the opening/closing cover 15 is opened, the coupling cam 85 connected to the right cam plate 50 by the thrust rod 55 rotates (FIG. 52) in the direction to cause the large gear coupling 83*a* to move away from the process cartridge B with respect to the direction of the rotational axis of the photoconductive drum 7.

As described before, one end of the thruster rod 55 is connected to the second boss 50*g* of the right cam plate 50, by the end of the elongated arcuate hole 55*b*, and the other end is connected to the boss 85*b* of the coupling cam 85, by the keyhole like hole 55*a*. The end of the elongated hole 55*b* is kept pressed upon the second boss 50*g* by the tension spring about hole 55*a*. It is as described above that the direction of the straight portion 55*b*1 of the elongated hole 55*b* of the thruster rod 55 is virtually perpendicular to the line connecting the top end of the straight portion 55*b*1 and keyhole like hole 55*a*.

The coupling means is constituted of a combination of the twisted projection and twisted hole, the cross sections of which are in the form of a virtual equilateral triangle. Therefore, in order to disengage the coupling means by moving the large gear coupling 83*a* in its axial direction, either the drum coupling 7*a*1 with the twisted projection or the large gear coupling 83*a* with the twisted hole must be rotated by such an angle that is necessary to release the engagement between the twisted edges of the twisted projection and the twisted walls of the twisted hole. Therefore, a relatively large amount of force is necessary for the disengagement.

The thruster rod 55 transmits driving force of the cam plate 50 to the coupling cam 85, rotating the coupling cam 85, and the rotation of the coupling cam 85 disengages the coupling means. Therefore, as driving force is transmitted from the cam plate 50 to the coupling cam 85 to disengage the coupling means, the thruster rod 55 is subjected to a coupling means disengagement load F1 which acts in the direction of the line connecting the keyhole like hole 55*a*, in which the boss 85*b* of the coupling cam 85 is fitted, and the top end of the straight portion 55*b*1 of the elongated hole 55*b*, which is in contact with the second boss 50*g* of the cam plate 50, as shown in FIG. 52. In order to prevent the second boss 50*g* from dislodging from the end of the elongated hole 55*b* when this coupling means disengagement load F1 is caught by the end of the elongated hole 55*b*, the wall surface of the end of the elongated hole 50*b* must be rendered either perpendicular to the direction of the coupling means disengagement load, or inclined in such a manner that the coupling means disengagement load, the major component of which is caught by the straight portion 55*b*1 of the elongated hole 55*b*, and directed toward the top end of the straight portion 55*b*1. In this embodiment, the straight portion 50*b*1, which constitutes the end portion of the elongated hole 50*b* is rendered virtually perpendicular to the line connecting the top end of the straight portion 50*b*1 and the keyhole like hole 55*a*, and the tension spring about hole 55*a* is mounted so that the end of the straight portion 50*b*1 is kept pressed upon the second boss 50*g*.

As the cam surfaces of the inward bearing 84 and the corresponding inclined surfaces 85*a*2 and 84*c*2 are placed in contact with each other by the rotation of the coupling cam 85, the coupling cam 85 is moved by the function of the inclined surfaces, outward of the apparatus with respect to its axial direction, dissolving the engagement between the large gear coupling 83*a* and drum coupling 7*a*1. Thereafter, the further rotation of the coupling cam 85 causes the raised surfaces 85*a*1 and 84*c*1 of the cam surfaces of the coupling cam 85 and inward bearing 84, respectively, to contact each other. As the raised surfaces 85*a*1 and 84*c*1 contact each other, the inward end of the large gear coupling 83*a* is moved outward of the apparatus beyond the inward surface of the inner plate 40, ending the disengagement of the coupling means.

In the description given above regarding the internal movements of the image forming apparatus linked to the opening of the opening/closing cover 15, it was stated that the movement of the cam plate 50 was linked to the movement of the opening/closing cover 15, and the various mechanisms were driven by the rotation of the cam plate 50. However, the moving guide 41, which had conveyed the process cartridge B, remains stationary during the opening of the opening/closing cover 15 to the above described point. This is due to that fact that during the rotation of the cam plate 50 up to the above described point, all that happens is that the top and bottom walls of the arcuate portion 50*b*1 of the elongated hole 50*b* passes by the peripheral surface of the second boss 41*c* of the moving guide 41 located below the bottom end of the straight portion 40*b*2 of the second guide rail 40*b* of the inner plate 40. In other words, until the pushing arm 52 and coupling means, which are the means for properly positioning and supporting the process cartridge B within the image forming apparatus, are completely disengaged, the process cartridge B is not conveyed by the moving guide 41.

Thus, as the opening/closing cover 15 is further opened from the point corresponding to the end of the above described cover opening stage, the moving guide 41 begins to be moved by the cam plate 50.

As the rotation of the cam plate continues, the moving guide 41 comes into contact with the second boss 41*c* at the intersection of the arcuate portion 50*b*1 and straight portion (straight groove hole) 50*b*2 of the elongated hole 50*b* of the cam plate 50. As a result, the further rotation of the cam plate 50 begins to cause the straight portion (straight groove hole) 50*b*2 to make the second boss 41*c* of the moving guide 41 move upward into the straight portion 40*b*2 of the second guide rail 40*b* of the inner plate 40. At this point, the moving guide 41 begins to be moved by the opening movement of the opening/closing cover 15, for the first time.

At this time, the aforementioned disengagement of the thruster rod 55 will be described.

Referring to FIG. 52, while the coupling means is disengaged by the rotation of the cam plate 50, the timing boss 41*d* of the moving guide 41 enters the space under the lifting surface 55*f* of the thruster rod 55. The cam plate 50 begins to lift the moving guide 41 as the coupling cam 85 further rotates from the point at which the raised surface 85*a*1 and 84*c*1 of the cam surfaces of the coupling cam 85 and inward bearing 84, respectively, come into contact with each other. At this point, the stopper rib 60, which perpendicularly extends from the surface of the inner plate 40 has arrived above the recessed backup portion 55*g*, which is above the lifting surface 55*f*, and is open upward (FIG. 48).

As the timing boss 41*d* at the end of the second boss 41*c* of the moving guide 41 moves upward on the lifting surface 55*f* of the thruster rod 55, the thruster rod 55 rotates about the axial line of the keyhole like hole 55*a*. This rotation causes the corner of the elongated hole 55*b* of the thruster rod 55, where the straight portion 55*b*1 and inclined portion 55*b*2 of the elongated hole 55*b* meet, to move beyond the second boss 50*g* of the cam plate 50, ending the driving of the thruster rod 55 by the cam plate 50. Also, this rotation of the thruster rod 55 causes the stopper rib 60 to settle in the recessed backup portion 55*g*, beginning to regulate the movement of the thruster rod 55 (FIG. 45).

Then, the second boss 41*c* of the moving guide 41 is lifted by the cam plate 50, and the first boss 41*b* of the moving guide 41 begins to move along the inclined portion 40*a*2 of the first guide rail 40*a*. As a result, the moving guide 41 is moved upward. Therefore, the bottom surface 18*b*1 of the mounting guide 18*b* of the process cartridge B, which was not in contact with the moving guide 41 up to this point, comes into contact with the retaining surface 41*a*1 of the moving guide 41.

Consequently, the process cartridge B will be supported by the moving guide 41 instead of the positioning means of the image forming apparatus main assembly.

The moving guide 41 makes contact with the end 18*b*2 of the mounting guide 18*b*, by the inward end of the catching surface 41*a*2, and begins to pull the process cartridge B outward of the apparatus main assembly. During this movement of the moving guide 41, on the right side of the apparatus main assembly, the process cartridge B is pulled outward of the apparatus main assembly in the diagonally upward direction, while the right positioning guide 18*a* pushes up the helical torsion coil spring 45 attached to the right stationary guide 44 (FIG. 44).

As the opening/closing cover 15 is further opened, the second boss 41*c* of the moving guide 41 is sandwiched by the first arcuate portion 40*b*1 of the second guide rail 40*b* of the inner plate 40, and the leading end of the straight portion (straight groove hole) 50*b*2 of the elongated hole 50*b* (cam groove) of the cam plate 50, and is moved toward the opening W, through which the process cartridge B is mounted or dismounted. At the same time, the first boss 41*b* is moved outward from the inclined portion 40*a*2 of the first guide rail 40*a* along the horizontal portion 40*a*1. Consequently, the process cartridge B is conveyed to the location (cartridge removal location) at which the process cartridge B can be grasped by a user, with the photoconductive drum 7 being horizontally conveyed (FIGS. 26 44).

At the time of this conveyance of the process cartridge B, the drum shutter 12, rotationally supported by the cartridge frame of the process cartridge B, is moved following in reverse the steps it follows during the mounting of the process cartridge B.

As the first boss 41*b* of the moving guide 41 is made to climb the inclined portion 40*a*2 of the first guide rail 40*a* while moving the process cartridge B upward, the angle, at which the drum shutter 12 is open, temporarily narrows slightly. Then, as the process cartridge B begins to be conveyed toward the opening W, the rib 12*e* comes into contact with the second inclined surface 44*c*3 of the shutter guide 44*d* of the stationary guide 44, increasing the angle at which the drum shutter is open. Then, the rib 12*e* is moved onto the raised surface 44*c*2, and the drum shutter 12 avoids the electrical contact 92. Then, the rib 12*e* is moved onto the first inclined surface 44*c*1, and is conveyed on the first inclined surface 44*c*1 toward the opening W, together with the process cartridge B, while allowing the angle, at which the drum shutter 12 is open, to be reduced by the force of the shutter spring (unshown). As the angle, at which the drum shutter 12 is open, reduces, the highest point 12*d*1 of the cam portion 12*d* comes into contact with the bottom surface of the optical system plate 1*f*, and the rib 12*e* leaves the first inclined surface 44*c*1. Then, as the highest point 12*d*1 of the cam portion 12*d* comes out of the bend portion of the optical system plate 1*f*, the cam portion 12*d* is rotated by a large angle by the force of the torsional coil spring. The drum shutter 12 continues to close until the cam portion 12*d*leaves the optical system plate 1*f*, when the transfer opening 9*a* and exposure opening 9*b* are completely covered by the drum shutter 12.

When the highest portion 12*d*1 of the cam portion 12*d* of the drum shutter 12 is made to pass the bend portion of the optical system plate 1*f*, by the conveyance of the process cartridge B carried out by the movement of the moving guide 41 linked to the rotation of the opening/closing cover 15, the bottom surface 10*f*4 of the toner/developing means holding frame 10*f* of the process cartridge B comes into contact with the contact rib 43*c* of the front guide 43 which constitutes the bottom wall of the opening W (FIG. 26).

When the process cartridge B assumes such an attitude that it contacts the contact rib 43*c*, the center of gravity of the process cartridge B is at the photoconductive drum 7 side with respect to the contact surface between the process cartridge B and contact rib 43*c*. Therefore, as the opening/closing cover 15 is further opened when the process cartridge B assumes the above described attitude, the moving guide 41 moves closer to the opening W, moving the process cartridge B toward the opening W, or toward an operator. While the process cartridge B is moved toward the opening W, it is rotated by the inclination of the contact rib 43*c* and bottom surface 10*f*4 of the toner/developing means holding frame 10*f*, in such a manner that the toner/developing means holding frame 10*f* side of the process cartridge B is lifted as if the inward end 18*b*2 of the mounting guide 18*b* is functioning as a fulcrum. The contact rib 43*c* is shaped so that as the opening/closing cover 15 continues to be opened until it becomes fully open as shown in FIG. 21, the process cartridge B is rotated until the outward bottom corner 18*b*3 of the mounting guide 18*b* moves beyond the inclined surface 41*a*4 located at the stepped portion of the guiding groove 41*a* of the moving guide 41.

Therefore, as the guiding surface 41*a*2 of the guiding groove 41*a* of the moving guide 41 is made contiguous and level with the front guiding surface 42*a*1 of the auxiliary guide 42 (first location) by the final stage of the rotational movement of the opening/closing cover 15 before it becomes fully open, the process cartridge is enabled to be smoothly taken out of the apparatus main assembly, through the opening W, without such an occurrence that the outward bottom corner 18*b*3 of the mounting guide 18*b* hangs up on the inclined surface 41*a*1, by being simply pulled toward the operator.

When the opening/closing cover 15 is in the fully open position, the second boss 41*c* of the moving guide 41 is placed in contact with the inward wall of the straight portion (straight groove hole) 50*b*2 (straight groove hole) of the elongated hole 50*b* of the cam plate 50, and the end of the arcuate portion 40*b*1 of the second guide rail 40*b*, on the opening W side, being used as a stopper for preventing the opening/closing cover 15 from being further rotated.

As described above, during the first half of the entire rotational range of the opening/closing cover 15 for completely closing the fully open opening/closing cover 15, the process cartridge mounting/dismounting mechanism in this embodiment moves the moving guide 41 from the first location, at which the process cartridge B can be mounted into, or dismounted from, the apparatus main assembly, to the second location, from which the process cartridge B is conveyed close to the location at which the process cartridge B functions for image formation. Then, the drum shutter 12 is opened by the conveyance of the process cartridge B and the movement of the moving guide 41. Next, the process cartridge B is readied for an image forming operation, and is kept on standby near the location at which process cartridge B functions for image formation. During the latter half of the entire rotational range of the opening/closing cover 15 for closing the fully open opening/closing cover 15, the process cartridge mounting/dismounting mechanism readies the coupling means for transmitting driving force to the process cartridge B for engagement, and activates the positioning means for placing and supporting the process cartridge B in the location at which the process cartridge B can function for image formation. Then, it turns on the image forming apparatus. On the other hand, during the first half of the entire rotational range of the opening/closing cover 15 for fully opening the completely closed opening/closing cover 15, first, the image forming apparatus is turned off by the initial opening movement of the opening/closing cover 15. Then, the positioning means which has been retaining the process cartridge B in the position at which the process cartridge B can function for image formation, and the coupling means, are disengaged. Then, during the latter half of the entire rotational range of the opening/closing cover 15 for fully opening the completely closed opening/closing cover 15, the process cartridge B is conveyed by moving the moving guide 41 from the aforementioned second location to the first location, while closing the drum shutter 12 by the conveyance of the process cartridge B.

With the provision of the above described mechanism, it becomes possible to move the process cartridge B by the opening or closing movement of the opening/closing cover 15. Therefore, even if the design of an image forming apparatus is such that the process cartridge B is mounted into the deeper end of the image forming apparatus main assembly 14, the operation for mounting or dismounting the process cartridge B can be easily carried out.

The description given above regarding one of the embodiments of the present invention can be summarized as follows.

The process cartridge B removably mountable in the electrophotographic image forming apparatus main assembly 14 having the process cartridge entrance opening/closing cover 15, which can be opened or closed, and the first and second guides 41, the movements of which are linked to the opening and closing movement of the opening/closing cover 15, comprises:

the electrophotographic photoconductive drum 7;

processing means (charging means 8, developing means 10, and cleaning means 11) which act on the photoconductive drum 7, the first cartridge frame CF, which is located at one end of the process cartridge B with respect to the axial direction of the photoconductive drum 7, and extends in the direction parallel to the direction in which the process cartridge B is mounted into the apparatus main assembly 14;

the first cartridge guide 18*b* which projects from the first cartridge frame CF, and rests on the first guide 41 of the apparatus main assembly so that the process cartridge B is conveyed toward the designated process cartridge position in the apparatus main assembly 14 by the movement of the first guide 41, when the process cartridge B is mounted into the apparatus main assembly 14;

the second cartridge frame CF, which is located at the other end of the process cartridge B with respect to the axial direction of the photoconductive drum 7, and extends in the direction parallel to the direction in which the process cartridge B is mounted into the apparatus main assembly 14;

the second cartridge guide 18*b* which projects from the second cartridge frame CF, and rests on the second guide 41 of the apparatus main assembly so that the process cartridge B is conveyed toward the designated process cartridge position in the apparatus main assembly 14 by the movement of the second guide 41, when the process cartridge B is mounted into the apparatus main assembly 14;

the first cartridge positioning portion 18*a*, which is on one end of the process cartridge B with respect to the axial direction of the photoconductive drum 7, projects outward from the first cartridge frame CF, and is coaxial with the photoconductive drum 7, and which engages with the first positioning portion 44*a* of the apparatus main assembly 14, in order to properly position the process cartridge B relative to the apparatus main assembly 14, toward the end of the mounting of the process cartridge B into the apparatus main assembly 14; and the second cartridge positioning portion 18*a*, which is on the other end of the process cartridge B with respect to the axial direction of the photoconductive drum 7, projects outward from the second cartridge frame CF, and is coaxial with the photoconductive drum 7, and which engages with the second positioning portion 90*a* of the apparatus main assembly 14, in order to properly position the process cartridge B relative to the apparatus main assembly 14, toward the end of the mounting of the process cartridge B into the apparatus main assembly 14.

One end of the photoconductive drum 7 with respect to the axial direction of the photoconductive drum 7 is provided with the driving force receiving portion 7*a*1, which receives the driving force for rotating the photoconductive drum 7, from the apparatus main assembly 14 after the process cartridge B is mounted into the apparatus main assembly 14.

Further, the aforementioned driving force receiving portion 7*a*1 is a projection approximately in the form of a twisted triangular pillar. In order to receive driving force, it engages into the hole in the form of a twisted pillar, the cross section of which perpendicular to its axial line is approximately an equilateral triangle.

As seen in the lengthwise direction of the photoconductive drum 7 and also with respect to the process cartridge mounting direction, the rear end of the first cartridge guide 18*b* and the rear end of the second cartridge guide 18*b* are on the upstream side with respect to the center of gravity of the process cartridge B. Further, the front end of the first cartridge guide 18*b* and the front end of the second cartridge guide 18*b* are on the downstream side of the center of gravity of the process cartridge B.

When the process cartridge B is in the position, at which it is to function for image formation, in the apparatus main assembly 14, the front end of the first cartridge guide 18*b* and the front end of the second cartridge guide 18*b* are on the downstream side with respect to the vertical line intersecting the axial line of the photoconductive drum 7.

The rear end of the first cartridge guide 18*b* has a flat portion 18*b*1 by which the rear end of the first cartridge guide 18*b* rests on the first guide 41 of the apparatus main assembly 14, and an inclined surface 18*b*4, which extends upstream with respect to the process cartridge mounting direction, tilting diagonally downward. It is pressed by the first guide 41 of the apparatus main assembly 14 in the process cartridge mounting direction, by the point of the first cartridge guide 18*b*, at which the portion 18*b*1 and inclined portion 18*b*4 meet.

Further, the rear end of the second cartridge guide 18*b* has a flat portion by which the second cartridge guide 18*b* rests on the second guide 41 of the apparatus main assembly 14, and an inclined portion 18*b*4, which extends upstream with respect to the process cartridge mounting direction, tilting diagonally downward, and is pressed by the second guide 41 of the apparatus main assembly 14 in the process cartridge mounting direction by the point of the second cartridge guide 18*b*, at which the portion 18*b*1 and inclined portion 18*b*4 meet.

The first cartridge guide 18*b* and second cartridge guide 18*b* are moved in the process cartridge mounting direction, resting on the first and second guides 41 of the apparatus main assembly 14. Then, they are subjected to the resistance generated by the spring 45 as the process cartridge B is further inserted. As they are subjected to the resistance, the rear end of the first cartridge guide 18*b* is pressed by the first guide 41 of the apparatus main assembly 14, and the rear end of the second cartridge guide 18*b* is pressed by the second guide 41 of the apparatus main assembly 14. When the process cartridge B is placed in the image formation position in the apparatus main assembly 14, the first cartridge guide 18*b* and second cartridge guide 18*b* are apart from the first guide 41 and second guide 41, respectively, of the apparatus main assembly 14.

Further, the process cartridge B is provided with the regulating portion 18*d* (butting surface), which comes into contact with the rotation controlling portion 44*b* of the stationary guide 44 of the apparatus main assembly 14, and prevents the process cartridge B from being rotated about the first and second cartridge positioning portions 18*a* by the force, which is generated as the driving force receiving portion 7*a*1 receives driving force from the apparatus main assembly 14, and which acts in the direction to rotate the process cartridge B about the first cartridge positioning portion 18*a* and second cartridge positioning portion 18*a*. The regulating portion 18*d* is on the external surface of the cartridge frame CF of the process cartridge B, which faces upward when the process cartridge B is in the image formation position in the apparatus main assembly 14. The first cartridge positioning portion 18*a* of the process cartridge B engages into the first positioning portion 44*a* of the apparatus main assembly 14, and the second cartridge positioning portion 18*a* engages into the second positioning portion 90*a* of the apparatus main assembly 14. When the regulating portion 18*d* is in contact with the rotation controlling portion 44*b* of the stationary guide 44 of the apparatus main assembly 14, the process cartridge B is in the position in which it is to perform image formation.

The first cartridge positioning portion 18*a* and second cartridge positioning portion 18*a* are cylindrical, and the former is greater in diameter than the latter.

The process cartridge B is conveyed by the opening movement of the opening/closing cover 15 to the location from which it can be taken out of the apparatus main assembly 14, with the first cartridge guide 18*b* and second cartridge guide 18*b* resting on the first and second guides 41, respectively, of the apparatus main assembly 14. While the process cartridge B is conveyed to the location from which it can be taken out of the apparatus main assembly 14, the bottom surface of the process cartridge B comes into contact with the projection 16*a* of the apparatus main assembly 14. As a result, the downstream side of the process cartridge B with respect to the direction in which the process cartridge B is taken out of the apparatus main assembly 14, lifts.

Further, the aforementioned cartridge B comprises: a shutter, which protects the portion of the photoconductive drum 7 exposed from the cartridge frame CF, and is movable between the protective position in which it protects the photoconductive drum 7 and the position into which it is retracted from the protective position; a first projection 12*d* which projects upward from the portion of the external surface of the cartridge, which faces upward while the cartridge B is conveyed, and comes into contact with a first contact portion 1*f* of the apparatus main assembly 14 in order to move the shutter 12 from the protective position to the retraction position as the cartridge B is conveyed to the designated protective cartridge position by the first and second guides 41 of the apparatus main assembly; and a second projection 12*e* which projects in the lengthwise direction of the cartridge frame CF, and comes into contact with the second contact portion 44*c* of the apparatus main assembly 14 in order to retain the shutter 12 at the retraction position, while the cartridge B is conveyed, with respect to the lengthwise direction of the cartridge frame CF, the first guide 18*b*, second projection 12*e*, and first projection 12 are disposed in the listed order.

The shutter 12 is formed of plastic. The first and second projections 12*d* and 12*e* are integral parts of the shutter 12.

The shutter 12 comprises a cover portion 12*a* for covering the aforementioned exposed portion of the photoconductive drum 7, and a supporting portion 12*c* for supporting the cover portion 12*c* in such a manner that the cover portion 12*a* can be rotated around the cartridge frame CF. The aforementioned second projection 12*e* is a part of the supporting portion 12*c*.

With the use of the above described structural arrangement, the image forming apparatus main assembly 14 can have improved usability and maintenance requirements, without increasing the size of the main assembly.

Further, the image forming apparatus main assembly 14 can be afforded more latitude in the arrangement of the process cartridge and the other functional units of the electrophotographic image forming apparatus A. For example, the process cartridge B can be mounted into the deeper end of the image forming apparatus main assembly 14 with respect to the cartridge insertion direction.

Further, the latter half of the closing movement of the opening/closing cover 15 can be used to drive the driving means connecting means that makes engageable the push arm 52 and coupling means which constitute the means for properly positioning the process cartridge B in the image forming apparatus main assembly 14. Thus, the increase in component count of the image forming apparatus main assembly can minimized by the multi-functionality and integration of the components necessary for the process cartridge mounting/dismounting mechanism.

Further, the mounting guide 18*b* of the process cartridge B supported by the moving guide 41 and the positioning boss 18*a* of the process cartridge B supported by the positioning portion 90*a* and cartridge catching portion 84*a*, are made independent from each other. Therefore, the moving guide 41, positioning portion 90*a*, and cartridge catching portion 84*a* can be positioned in the same plane with respect to the direction perpendicular to the lengthwise direction of the process cartridge B. Therefore, the employment of the above described structural arrangement does not increase the dimension of the process cartridge B with respect to the lengthwise direction of the photoconductive drum.

In the foregoing embodiments, the process cartridge is for forming monochromatic images, but the process cartridge according to this invention is applicable to a cartridge having a plurality of developing means for forming multicolor images, for example two color images, three color images and full color images or the like.

The electrophotographic photosensitive member is not limited to the photosensitive drum. For example, the photosensitive member may be a photoconductor such as amorphous silicon, amorphous selenium, zinc oxide, oxide titanium, organic photoconductor (OPC) or the like. The photosensitive member may be in the form of a drum or belt. In the case of the drum type photosensitive member, the photoconductor is applied or evaporated on a cylinder made of aluminum alloy or the like.

Also, the present invention is preferably usable with various known developing methods such as the magnetic brush developing method using two component toner, the cascade developing method, the touch down developing method, the cloud developing method.

The structure of the charging means described in the foregoing is of a so called contact type charging means, but a known charging means comprising a tungsten wire which is enclosed width metal shield of aluminum or the like at three sides, wherein positive or negative ions generated by application of a high voltage to said tungsten wire are directed to the surface of the photosensitive drum to uniformly charge the surface, is usable.

The charging means may be a roller type as described in the foregoing, a blade type (charging blade), a pad type, a block type, a rod type, a wire type or the like.

The process cartridge, for example, comprises an electrophotographic photosensitive member and at least one process means. The process cartridge is detachably mountable as a unit to the main assembly of apparatus, wherein the process cartridge contains an electrophotographic photosensitive member and charging means; contains an electrophotographic photosensitive member and developing means; contains electrophotographic photosensitive member and cleaning means; or contains an electrophotographic photosensitive member and two or more process means.

In other words, the process cartridge contains an electrophotographic photosensitive member and charging means, developing means or cleaning means, the cartridge being detachably mountable as a unit to the main assembly of the apparatus. The process cartridge may contain an electrophotographic photosensitive member and at least one of a charging means, a developing means and a cleaning means in the form of a cartridge which is detachably mountable to a main assembly of an image forming apparatus, or it may be a cartridge containing integrally at least developing means and an electrophotographic photosensitive member, the cartridge being the detachably mountable to a main assembly of an image forming apparatus. The process cartridge is mounted to or demounted from the main assembly of the apparatus by the user. This means that maintenance of the apparatus is carried out, in effect, by the user.

In the foregoing embodiments, a laser beam printer has been taken as an exemplary embodiment of an electrophotographic image forming apparatus, but the present invention is not limited to this, and is applicable to another electrophotographic image forming apparatus such as an electrophotographic copying machine, a facsimile machine, a word processor or the like.

Modification 1

A modified version of the above described push arm 52, as an auxiliary means to the positioning boss 18*b* of the process cartridge, will be described.

In the preceding embodiment, in order to ensure that the positioning boss 18*a* comes into contact with the positioning portion 90*a* of the conveying means frame 90, the push arm 52 itself is formed of resinous material, so that the pressure applied to the pressing portion 52*b* of the push arm 52 by the mounting assistance auxiliary guide 18*a*1 as the pressing portion 52*b* makes contact with the mounting assistance auxiliary guide 18*a*1 can be absorbed by the elastic deformation of the push arm 52 itself.

Figure 63:
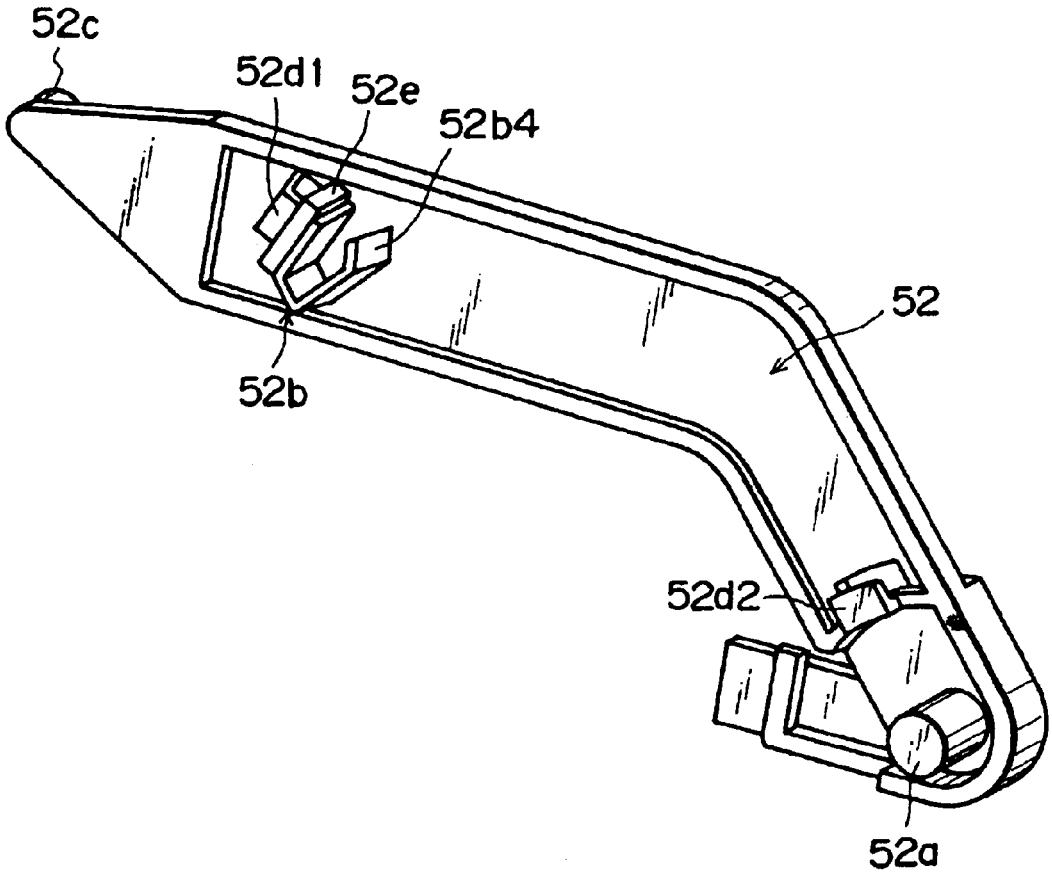
FIG. 63 is a perspective view of a modified version of the push arm.

If more pressure is necessary, or if the design specifications cannot be satisfied by the elastic deformation alone of the push arm 52 due to the decline in the pressure resulting from the creeping of the resinous material, the push arm 52 may be provided with a backup rib 52*b*, instead of the resilient pressing portion 52*b* in the preceding embodiment, as shown in FIG. 63.

To the surface of the backup rib 52*b*, a pressing spring 52*b*4 formed of plate of elastic metallic material such as stainless steel is attached to make the main portion of the push arm 52 strong enough to easily withstand the pressure generated by the pressing spring 53*b*4. With this arrangement, pressure is generated mainly by the elastic deformation of the pressing spring, making it possible to generate greater pressure. Further, the addition of metallic material reduces the creeping of the push arm 52, which in turn reduces the decline in the pressure generated by the push arm 52. As a means for increasing the pressure applied by the push arm 52 while using only resinous material, it is possible to increase the rigidity of the push arm 52 itself. However, increasing the rigidity of the push arm 52 itself results in increase in the creeping of the push arm 52. In other words, using the resinous material alone to increase the rigidity of the push arm 52 virtually guarantees that the pressure generated by the push arm 52 drastically decreases with the elapse of time. It may be the pressing spring alone that is elastically deformed. Therefore, when the pressing spring 52*b*4 is provided, the rigidity of the push arm may be further increased.

According to the preceding paragraph, the material for the pressing member 52*b*4 is a plate of elastic metallic substance. However, as long as the same effects as those provided by the pressing member 52b4 in the preceding paragraph can be provided, a torsion coil spring, for example, formed of linear material may be used in place of the pressing member 52b4 formed of plate of elastic metallic substance; the material for the pressing member 52b4 does not need to be limited to plate of the elastic metallic substance.

Although FIG. 63 shows the push arm 52 formed of resinous material and provided with the pressing spring 52b4 formed of the elastic metallic substance, the push arm 52 may be formed of elastic metallic substance alone, as long as the same effects as those provided by the push arm 52 in FIG. 63 can be provided. The structure and material of the push arm 52 is not limited to those shown in FIG. 63.

Modification 2

Next, the second modification of the push arm 52 will be described.

In the push arms 52 described thus far, the rotational center was apart from the positioning portion 90a. In other words, the structural arrangement was such that the resilient pressing portion 52b made contact with the positioning boss 18a of the process cartridge B.

In this modification, the structural arrangement is such that the push arm 52 makes contact with the positioning boss 18a of the process cartridge B. The configuration of each component in this modification will be described with reference to FIGS. 64–66.

Figure 65:
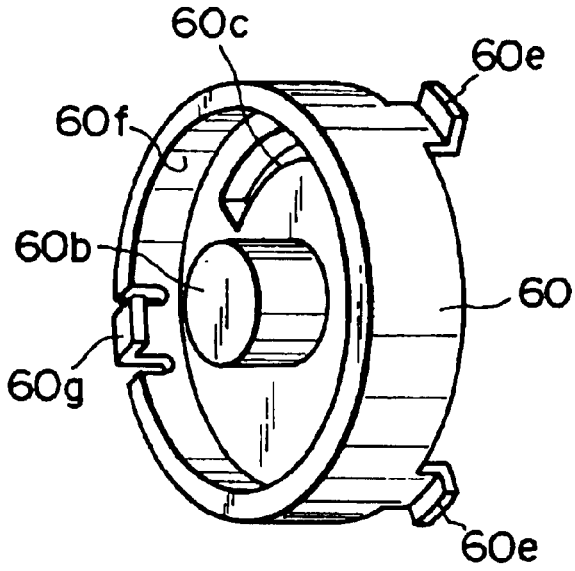
FIG. 65 is a perspective view of the positioning portion.

The positioning guide 60 is provided with a process cartridge positioning portion 60a, which is put through the inner plate 40, and extends into the inward side of the image forming apparatus. Referring to FIG. 65, the positioning guide 60 is also provided with a supporting shaft 60b, which is for rotationally supporting the push arm 61 and is located on the side opposite to where the process cartridge positioning portion 60a is located, with respect to the lengthwise direction of the process cartridge B. The axial line of the supporting shaft 60b coincides with that of the process cartridge positioning portion 60a.

The positioning guide 60 has a fan shaped hole 60c, an engaging portion 60d, a plurality of claws 60e, a cylindrical portion 6f, and a locking claw 60g. The fan shaped hole 60 is a through hole. The axial line of the fan shaped hole 60c coincides with that of the positioning portion 60a. The length of the fan shaped hole 60c with respect to its circumferential direction is greater than the length of the opening, or missing portion, of the positioning portion 60a with respect to its circumferential direction. The engaging portion 60d fits in the through hole (unshown) in the aforementioned inner plate 40. Its axial line coincides with that of the positioning portion 60a. The claws 60e attach the positioning guide 60 to the inner plate 40. The locking claw 60g is an integral part of the cylindrical portion 60f. It extends inward of the cylindrical portion 60f in the radius direction of the cylindrical portion 60f.

The push arm 61 has a center hole 61a, a contact portion 61b, a cam groove 61c, a locking claw catching surface 61d, and a spring anchoring portion 61e. The center hole 61a is the hole through which the supporting shaft 60b of the positioning guide 60 is put. Its axial line coincides with the rotational axis of the supporting shaft 60b. The contact portion 61b guides the process cartridge B to a predetermined location by coming into contact with the positioning boss 18a of the process cartridge B. The cam groove 61c is the groove into which the driving boss of a cam plate 50 fits to rotate the push arm 62. The cam plate 50 will be described later. The locking claw catching surface 61d, is the surface on which the locking claw 60g latches. The spring anchoring portion 61e is where one end of the tension spring 62 is anchored.

Figure 67:
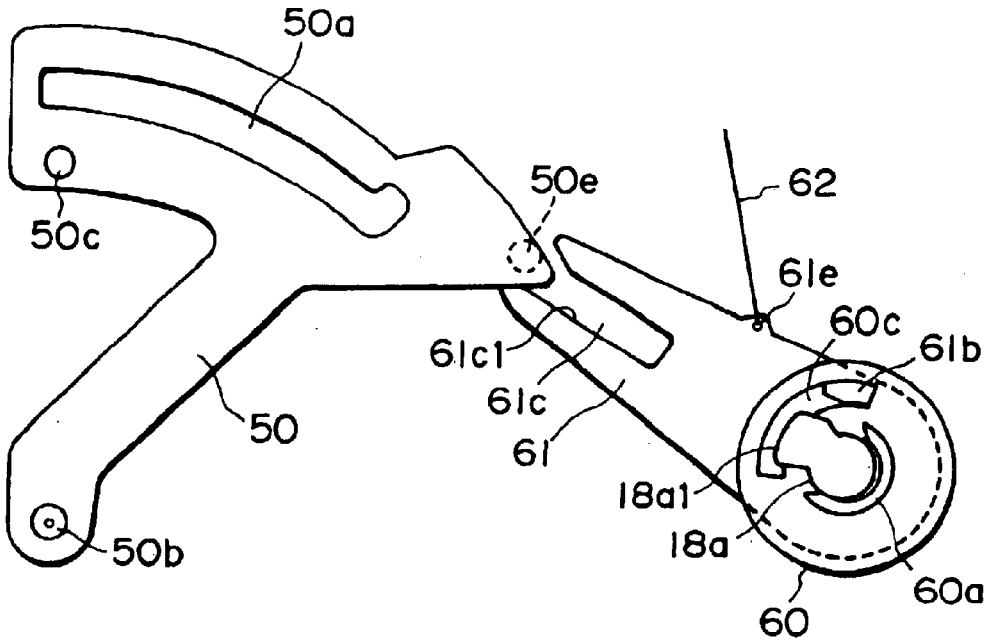
FIG. 67 is a drawing for describing the operations of the cam plate and push arm.
Figure 68:
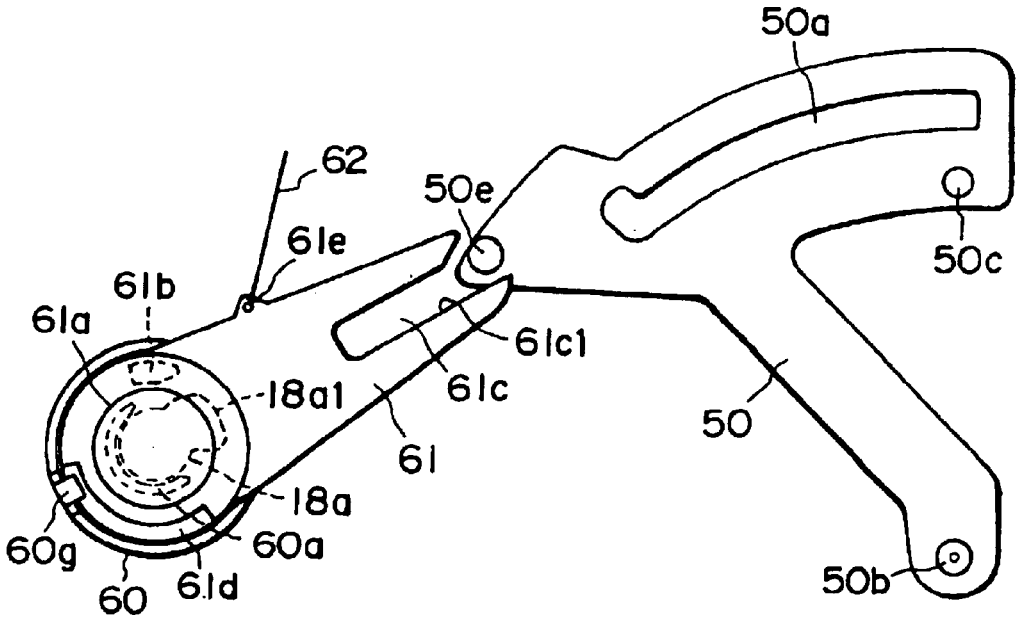
FIG. 68 is a drawing for describing the operations of the cam plate and push arm.

Referring to FIGS. 67 and 68, the cam plate 50 is provided with a driving boss 50e, instead of the second cam 50h in the preceding embodiment, which projects in the outward direction. Otherwise, the cam plate 50 in this embodiment is the same in structure as the cam plate in the preceding embodiment.

Figure 64:
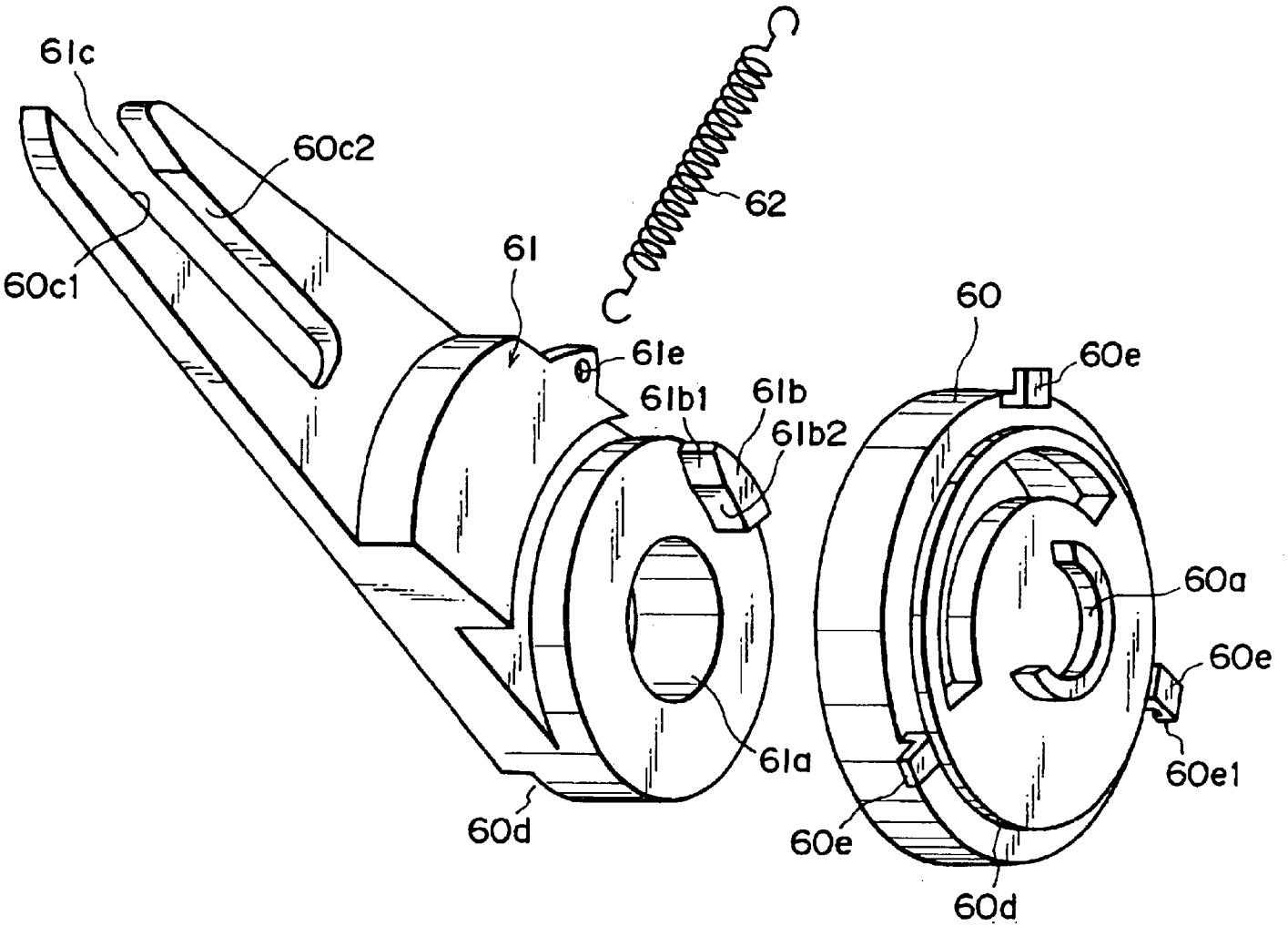
FIG. 64 is a perspective view of another modified version of the combination of the push arm and positioning portion.

Referring to FIG. 64, as the positioning guide 60 is rotated after the engaging portion 60d is put through the through hole of the inner plate 40, with the claws 60e aligned with the corresponding positioning guide attachment holes (unshown) of the inner plate 40, the claws 60e latch onto the inner plate 40, preventing the positioning guide 60 from becoming disengaged from the inner plate 40; a projection 60e1 with which one of the claws 60e is provided fits into a rotation control hole (unshown) located near the corresponding positioning guide attachment hole, locking the positioning guide 60 to the inner plate 40.

Figure 66:
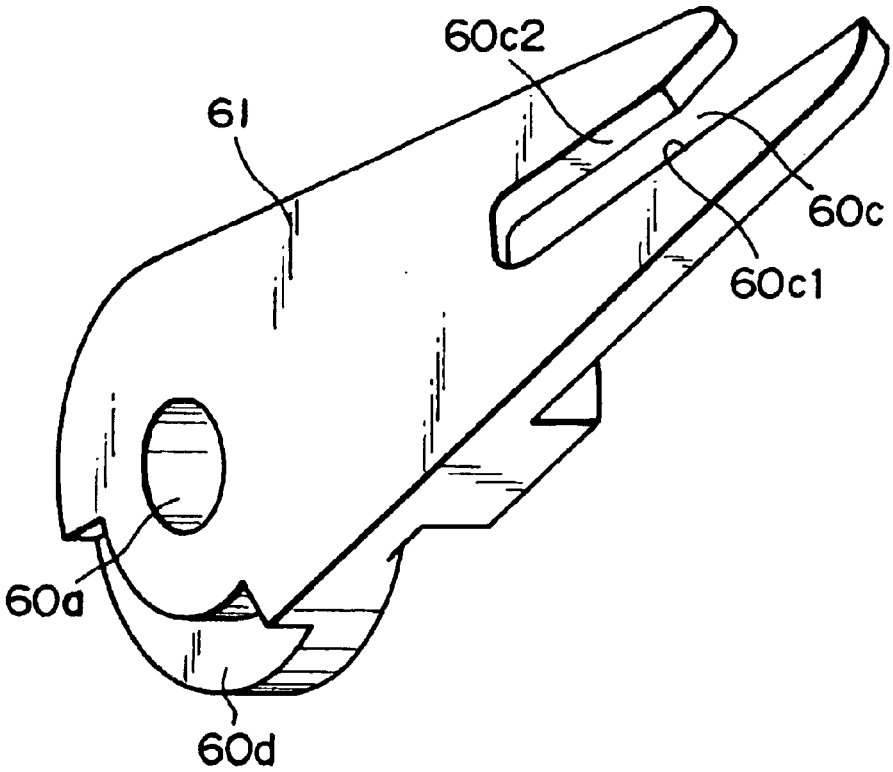
FIG. 66 is a perspective view of the push arm.

Next, referring to FIGS. 64 66, the contact portion 61b of the push arm 61 is aligned with the fan shaped through hole 60c of the positioning guide 60, and the center hole 61a is aligned with the supporting shaft 60b. Then, the push arm 61 is moved in the direction parallel to the supporting shaft 60b. As the push arm 61 is moved, the locking claw 60g latches onto the locking claw catching surface 61d, of the push arm 61, preventing the push arm 61 from becoming disengaged from the positioning portion 60. As a result, the push arm 61 is rotationally supported by the positioning guide 60.

The tension spring 62 is stretched between the spring anchoring portion 61e of the push arm 61 and the inner plate 40, keeping the push arm 61 pressured upward. The spring pressure of the tension spring 62 has only to be strong enough to push up the push arm 61. Being kept lifted by the tension spring 62, the push arm 61 is kept in the position in which its contact portion 61bis in contact with the wall of the fan shaped hole 60C.

Next, referring to FIGS. 64–68, the movements of the various components caused by the rotation of the opening/closing cover 15 will be described. In the drawings, the process cartridge B is not shown except for its positioning boss 18a.

FIGS. 67 and 68 show the cam plate 50, positioning portion 60, push arm 61, and positioning boss 18a, at the end of the first half of the closing movement of the opening/closing cover 15, in other words, at the end of the movement of the moving guide 41.

As has been already described, in this state, because of the presence of the resistance from the transfer roller 4, electrical contacts, and the like, the positioning boss 18a of the process cartridge B has not completely fitted into the positioning portion 60a. The push arm 61 is kept lifted by the pressure from the tension spring 62, with its contact portion 61b positioned so that it does not intersect the path of the positioning boss 18a.

As the opening/closing cover 15 is further closed from this position, the driving boss 50e of the cam plate 50 comes into contact with the bottom surface 61c1 of the cam groove 61c, and begins to rotate the push arm 61. The reason the driving boss 50e comes into contact with the bottom surface 61c1 of the cam groove 61c is that the bottom prong of the push arm 61 having the bottom surface 61c1 of the cam groove 61c is longer than the top prong having the top surface 61c2 of the cam groove 61c, and is long enough to intrude into the circular sweeping range of the cam plate 50.

Figure 69:
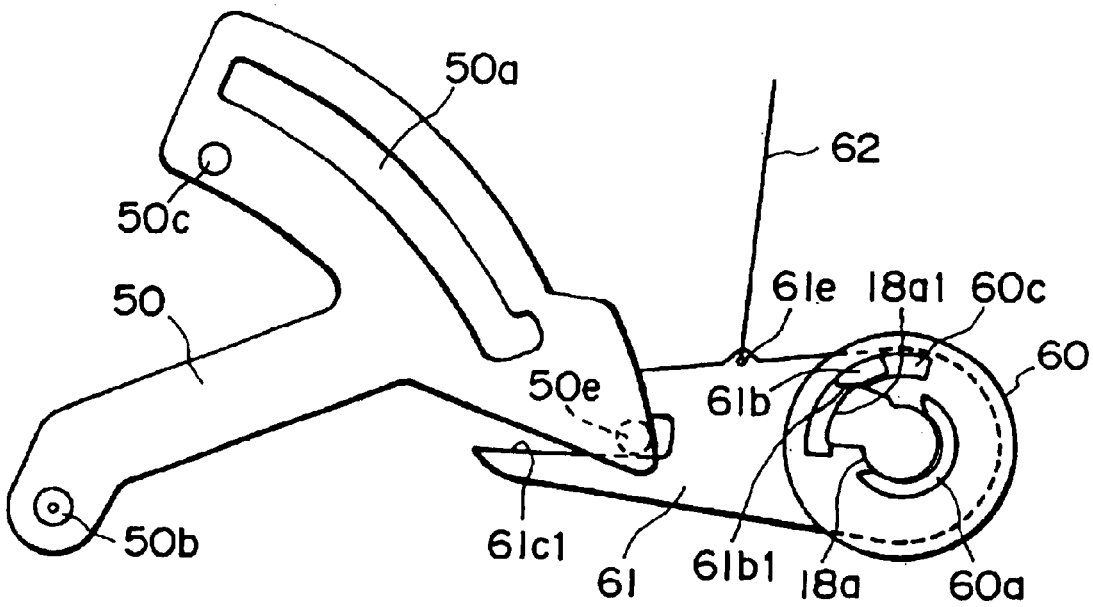
FIG. 69 is a drawing for describing the operations of the cam plate and push arm.
Figure 70:
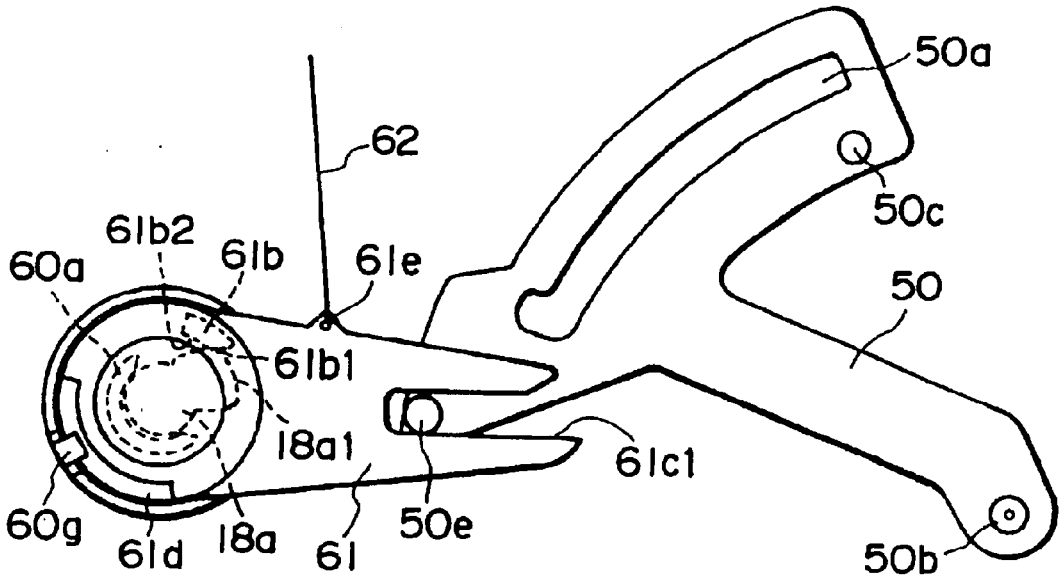
FIG. 70 is a drawing for describing the operations of the cam plate and push arm.

As the rotation of the opening/closing cover 15 continues, the cam plate 50 keeps on rotating the push arm 61, eventually causing the contact portion 61*b* of the push arm 61 to contact the mounting assistance auxiliary guide 18*a*1 of the positioning boss 18*a*, as shown in FIGS. 69 and 70. The inward side of the contact portion 61*b*, with respect to the radius direction of the center hole 61*a*, has an inclined surface 61*b*1 and an arcuate surface 61*b*2. The inclined surface 61*b*1 is on the upstream side with respect to the closing direction, and is inclined so that its distance from the axial line of the center hole 61*a* gradually decreases from the upstream toward the downstream, with respect to the direction in which the push arm 61 is rotated by the closing movement of the cam plate 50. The inclined surface 61*b*2 is on the downstream side, with respect to the closing direction, and its axial line coincides with that of the center hole 60*a*.

The difference between the distances from the upstream and downstream ends of the inclined surface 61*b*1 to the axial line of the center hole 60*a*, is set within the tolerance in the actual position of process cartridge B relative to the second position, ensuring that the rotation of the push arm 61 causes the inclined surface 61*b*1 to come into contact with the mounting assistance auxiliary guide 18*a*1, and pushes the positioning boss 18*a*, which has not completely fitted into the positioning portion 60*a*, all the way into the positioning portion 60*a*.

Figure 71:
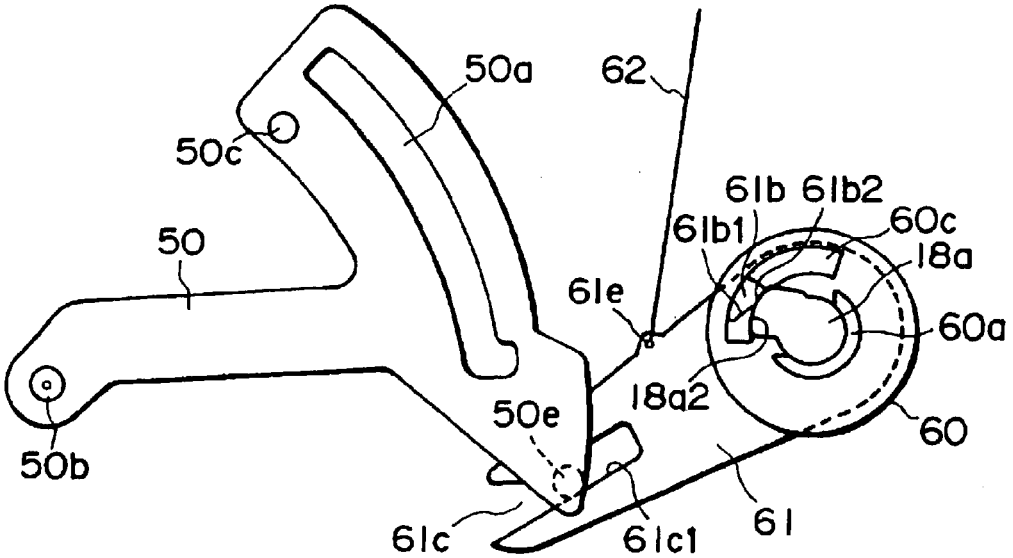
FIG. 71 is a drawing for describing the operations of the cam plate and push arm.
Figure 72:
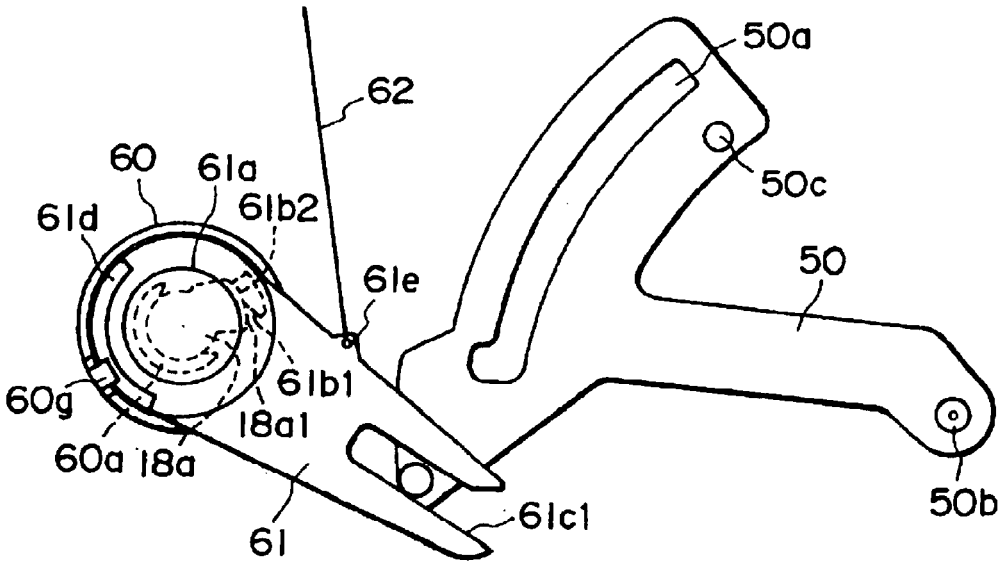
FIG. 72 is a drawing for describing the operations of the cam plate and push arm.

As the opening/closing cover 15 is further closed from this position, the step in which the process cartridge B is pulled into the apparatus main assembly by the inclined surface 61*b*1 of the contact portion 61*b*, ends, and then, the arcuate surface 61*b*2 comes into contact with the mounting assistance auxiliary guide 18*a*1 (FIGS. 71 and 72).

The axial line of the arcuate surface 61*b*2 coincides with that of the center hole 60*a*, and its radius is made equal to that of the mounting assistance auxiliary guide 18*a*1 of the process cartridge B, for the following reason. This arrangement allows the positioning guide 60 to support both the positioning boss 18*a* and push arm 61 in a manner to keep the axial lines of the boss 18*a* and arm 61 aligned, without using additional components, minimizing the error in the process cartridge B position resulting from the aggregate error in component dimension, and also, making it unnecessary to make the arcuate surface 61*b*2 theoretically intersect the mounting assistance auxiliary guide 18*a*1. Therefore, the force necessary to move the push arm 61 can be reduced, further improving the opening/closing cover 15 in operativity. Further, this structural arrangement does not require the push arm 61 to be elastic, allowing the contact portion 61*b* to be increased in rigidity. The increase in rigidity eliminates the problems concerning creeping, improving reliability.

In this modification, the push arm 61 is kept pressured upward by the pressure from the tension spring 62, and this pressure acts in a manner to move the cam plate 50 in the direction to open the opening/closing cover 15. Therefore, in this embodiment, in order to prevent the push arm 61 from pushing up the cam plate 50, the change in the pressure generated by the tension spring 62, which occurs as the push arm 61 is moved, is minimized by reducing the spring constant of the tension spring 62.

Next, the operation for opening the opening/closing cover 15 will be described. This operation follows in reverse the operation for closing the opening/closing cover 15.

As the opening/closing cover 15 is opened from the position shown in FIG. 72, the cam plate 50 begins to be rotated clockwise by the rotation of the opening/closing cover 15.

At this stage, the arcuate surface 61*b*2 of the push arm 61 and the mounting assistance auxiliary guide 18*a*1 are kept in contact with each other, by the force which is acting in the direction to make the process cartridge B separate from the positioning guide 60. Thus, when the frictional resistance is greater than the pressure generated by the tension spring 62, the driving boss 50*e* of the cam plate 50 comes into contact with the top surface 60*c*2 of the cam groove 61*c*, and rotates the push arm 61 in the counterclockwise direction.

When the frictional resistance is smaller than the pressure generated by the tension spring 62, the driving boss 50*e* follows the bottom surface 60*c*1 of the cam groove 61*c*, and the push arm 61 rotates in the counterclockwise direction also in this case. As the opening/closing cover 15 is further opened, the contact portion 61*b* of the push arm 61 becomes separated from the mounting assistance auxiliary guide 18*a*1. After the separation, the only pressure which acts on the push arm 61 is the pressure from the tension spring 62. Therefore, the driving boss 50*e* comes into contact with the top surface 61*c*2 of the cam groove 61*c*.

As the rotation of the opening/closing cover 15 continues, the driving boss 50*e* moves past the outward end of the top surface 61*c*2 of the cam groove 61*c*, coming out of the cam groove 61*c*; in other words, the cam plate becomes disengaged from the push arm 61. As a result, the push arm 61 is pulled further upward by the force of the tension spring 62, causing the trailing end of the arcuate surface 61*b*2 of the contact portion 61*b* to come into contact with the wall of the fan shaped hole 60*c* of the positioning guide 60. In this state, the contact portion 61*b* of the push arm 61 has moved out of the path of the positioning boss 18*a*, no longer interfering with the movement of the process cartridge.

Modification 3

In the second modification, the push arm 61 was kept under the pressure from the tension spring 62. In this modification, however, the tension spring 62 is not used. In the following description of this modification, the components, portions, and the like, which are identical to those found in the preceding embodiments, are given referential codes identical to those given to the counterparts in the preceding embodiments, and their descriptions will not be given.

Figure 73:
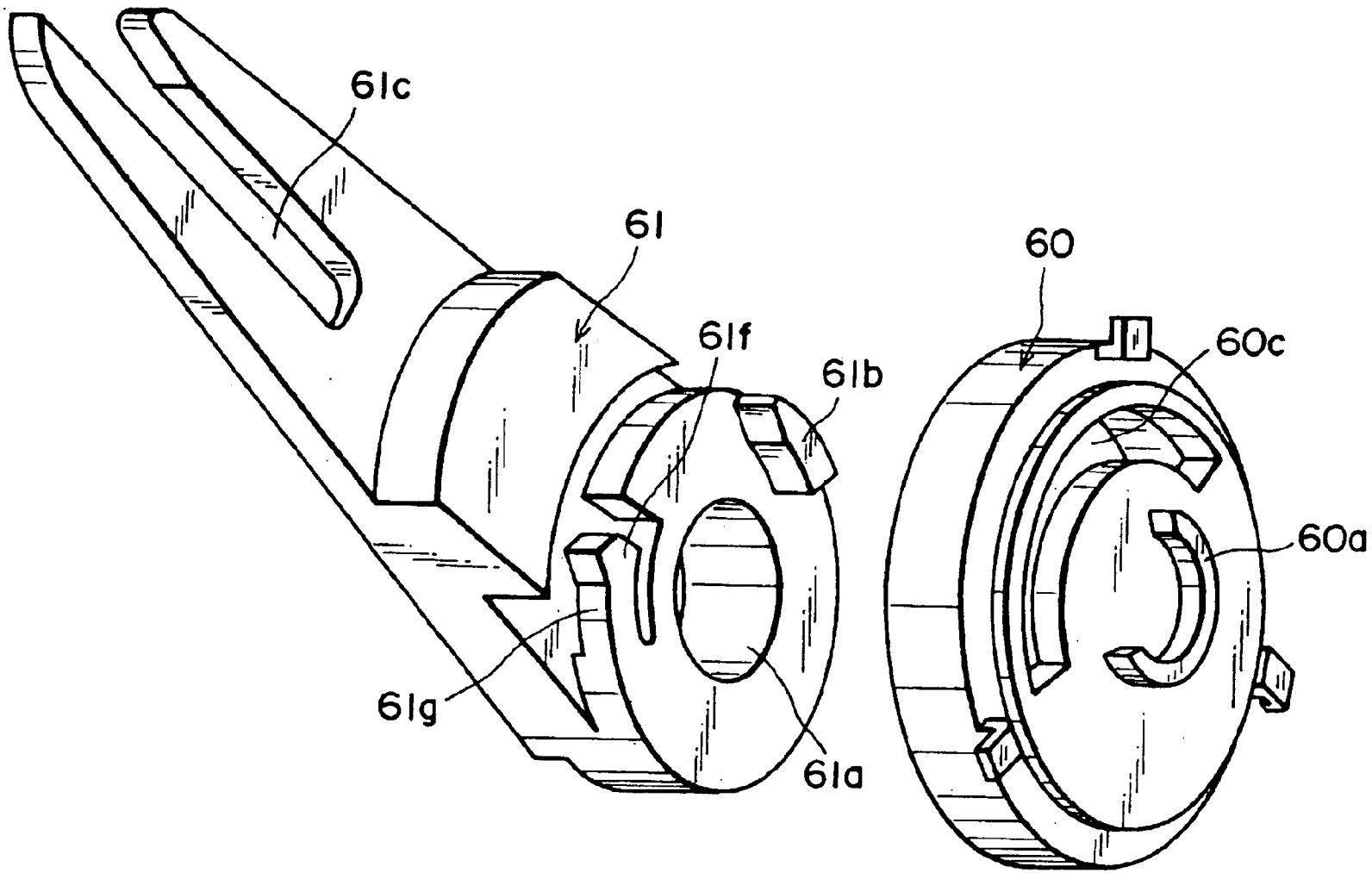
FIG. 73 is a perspective view of another modified version of the combination of the push arm and positioning portion.
Figure 74:
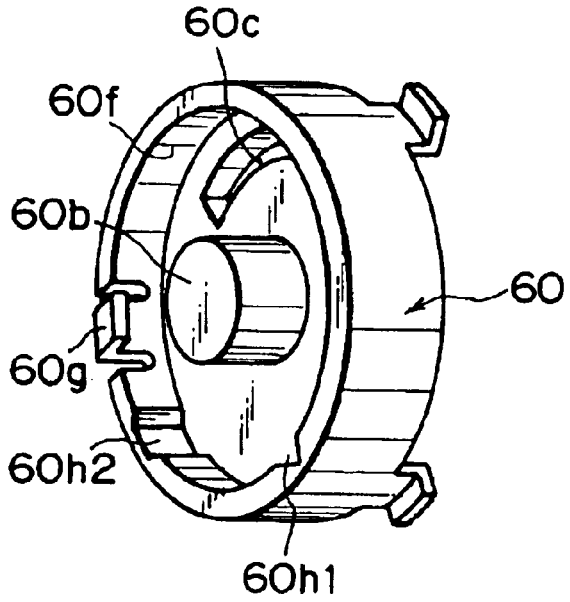
FIG. 74 is a perspective view of the positioning portion.
Figure 75:
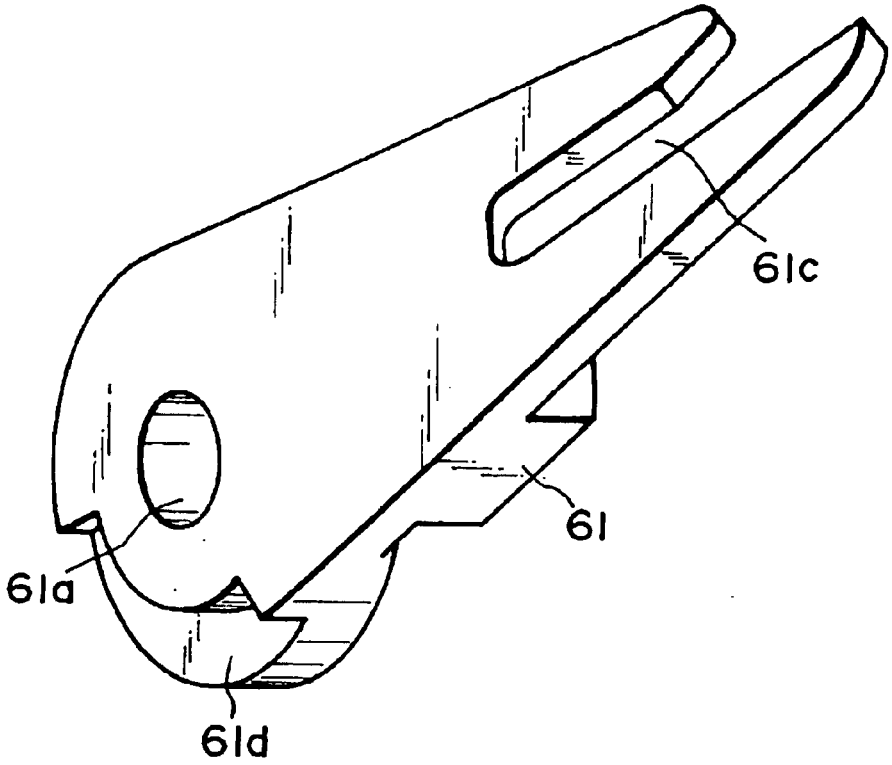
FIG. 75 is a perspective view of the push arm.

Referring to FIG. 73, the portion of the push arm 61, which fits in the cylindrical portion 60*f* (FIG. 74) of the positioning guide 60, is provided with a projection 61*f*, and an elastic arm 61*g* continuous with the projection 61*f*. Referring to FIGS. 74 and 75, the internal surface of the cylindrical portion 60*f* of the positioning guide 60 is provided with grooves 60*h*1 and 60*h*2.

Figure 76:
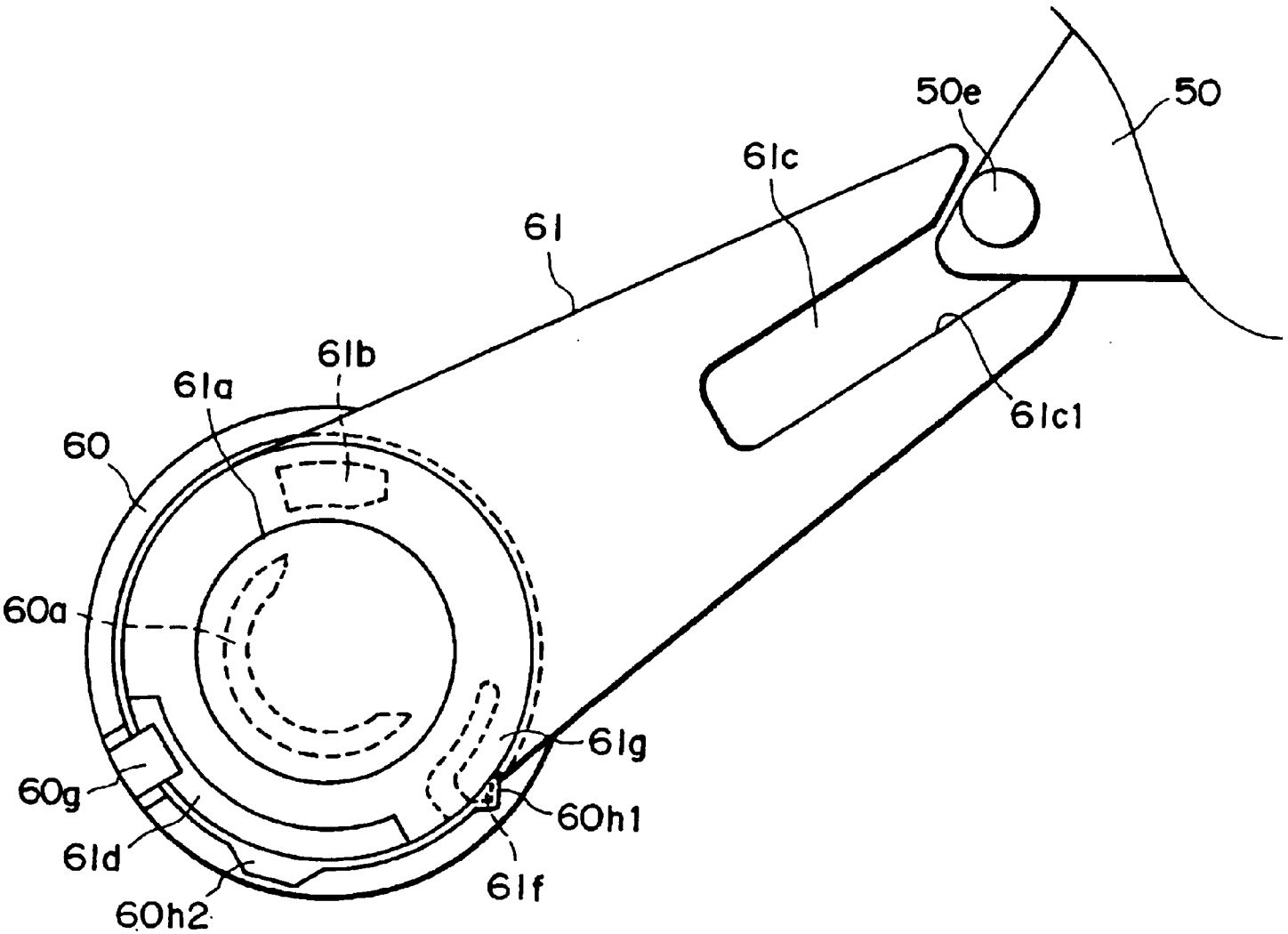
FIG. 76 is a drawing for describing the operations of the cam plate and push arm.

The distance from the rotational axis of the push arm 61 to the outermost tip of the projection 61*f*, with respect to the radius direction of the center hole 61*a*, is greater than the radius of the internal surface of the cylindrical portion 60*f*. The position of the groove 60*h*1 with respect to the circumferential direction of the cylindrical portion 60*f*, aligns with the position of the projection 61*f* of the push arm 61 immediately before the contact between the push arm 61 and cam plate 50 (FIG. 76). The position of the groove 60*h*2 aligns with the position of the projection 61*f* of the push arm 61 after the completion of the rotation of the push arm 61 caused by the cam plate 50, in other words, the completion of the closing of the opening/closing cover 15 (FIGS. 74 and 75).

Immediately before the push arm 61 is caused to come into contact with the cam plate 50, by the opening movement of the opening/closing cover 15, the projection 61*f* is in the groove 60*h*1. The resiliency of the elastic arm 61*g* is set at a value greater than that of the push arm 61 itself. Therefore, the push arm 61 does not start rotating.

Figure 77:
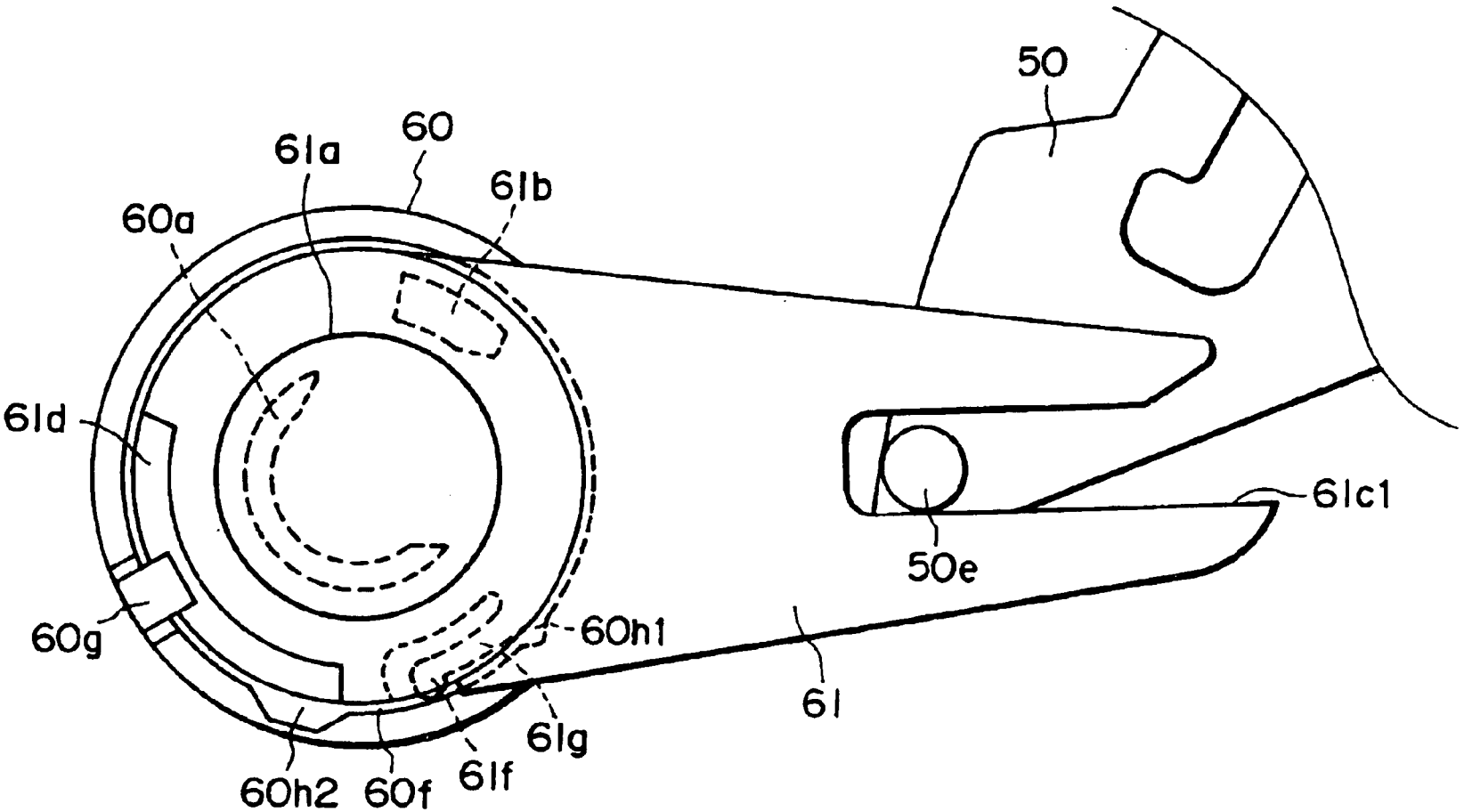
FIG. 77 is a drawing for describing the operations of the cam plate and push arm.
Figure 78:
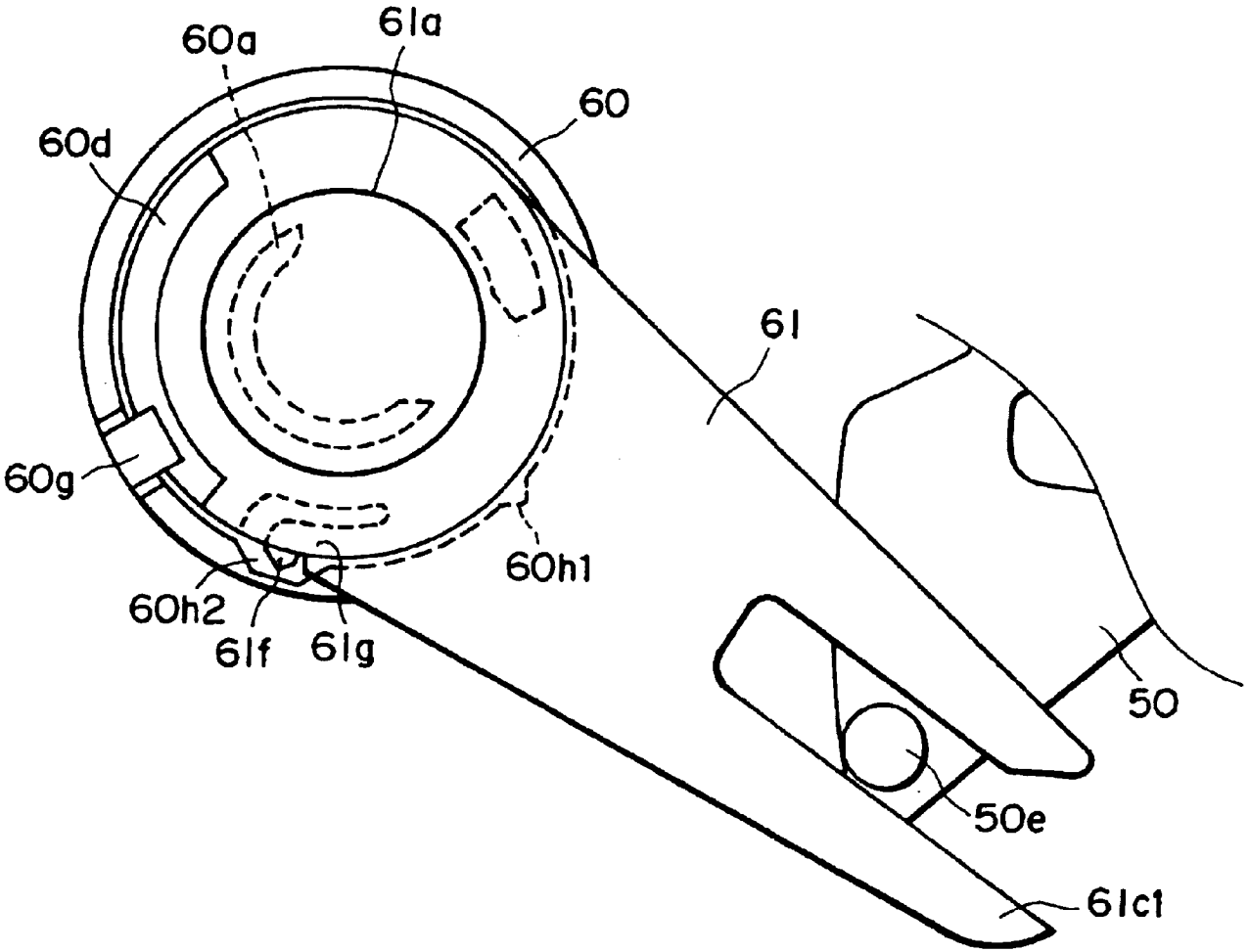
FIG. 78 is a drawing for describing the operations of the cam plate and push arm.

Referring to FIG. 77, as the push arm 61 begins to be rotated by the closing movement of the opening/closing cover 15, the elastic arm 61*g* is elastically flexed, allowing the projection 61*f* to come out of the groove 60*h*1.

Immediately before the opening/closing cover 15 is completely closed after the above described processes, the projection 61*f* engages into the groove 60*h*2, allowing the elastic arm 61*g* to regain the form prior to flexing. The state of the image forming apparatus, in which the opening/closing cover 15 is in the closed state, is the normal state of the image forming apparatus. Therefore, allowing the elastic arm 61*g* to regain its unflexed state immediately before the opening/closing cover 15 is completely closed prevents the elastic arm 61*g* from creeping.

The groove 60*h*2 is wider than the groove 60*h*1, with respect to the circumferential direction of the cylindrical portion 60*f*, for the following reason. There is always a certain amount of error in component dimension, therefore, it is possible that the position of the push arm 61 after the completion of the closing of the opening/closing cover 15 will be slightly off from the designated one. In consideration of this fact, the groove 60*h*2 was made wider than the groove 60*h*1. The groove 60*h*1 is given such a shape that is proper to keep the push arm 61 in the position in which it is ensured that the push arm 61 comes into contact with the cam plate 50. In other words, the width of the groove 60*h*1 is matched with the configuration of the projection 61*f* to prevent the unintentional dislodging of the push arm 61.

With the provision of the above described structural arrangement, it is unnecessary to employ a spring or the like to apply pressure upon the push arm 61. Thus, it is possible to achieve cost reduction by reducing the component count, which is obvious. In addition, there is merit in that when the opening/closing cover 15 is in the closed state, force such as the force in the second modification that acts in the direction to open the opening/closing cover 15 is not present in the case of this embodiment.

Effects similar to those obtained by the preceding embodiments can also obtained by the above described modifications of the embodiments.

As described above, according to the present invention, a process cartridge can be mounted into the main assembly of an image forming apparatus, with the use of the closing movement of the opening/closing cover of the image forming apparatus. Further, a process cartridge and an electrophotographic image forming apparatus are improved in the operation in the mounting of the process cartridge into the main assembly of the electrophotographic image forming apparatus. To sum up, the combination of a process cartridge mounting/dismounting mechanism, a process cartridge, and an electrophotographic image forming apparatus, which are in accordance with the present invention, makes it possible:

(1) to mount or dismount the process cartridge with the use of the closing or opening movement of the opening/closing member of the image forming apparatus; and (2) to ensure that the process cartridge is accurately and securely retained in the image forming position.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge mounting and demounting mechanism for detachably mounting a process cartridge to a main assembly of an electrophotographic image forming apparatus, said process cartridge including an electrophotographic photosensitive member and process means actable on said electrophotographic photosensitive member, said mechanism comprising:

an opening through which said process cartridge is inserted into the main assembly of the apparatus and is removed from the main assembly of the apparatus;

an opening and closing member configured and positioned to open and close said opening;

a cartridge mounting member configured and positioned to demountably mount said process cartridge;

mounting member holding means for movably holding said cartridge mounting member in interrelation with an operation of said opening and closing member at a first position in which said process cartridge is detachably mountable with said opening and closing member being in an open state and at a second position in which said process cartridge is capable of performing an operation for image formation with said opening and closing member being in a closing state;

a process cartridge supporting means for supporting said process cartridge at the second position;

a guide to be positioned, and wherein said process cartridge supporting means is positioning means engageable with said guide to be positioned; and assisting means for urging a portion to be urged of said process cartridge to position said guide to be positioned relative to said positioning means which is positioned at the second position, wherein said guide to be positioned and said portion to be urged are provided at one end of said process cartridge with respect to a longitudinal direction of said photosensitive member;

wherein said assisting means functions to urge said portion to be urged in a closing operation of said opening and closing member, and said assisting means releases said portion to be urged in an opening operation of said opening and closing member.

2. A mechanism according to claim 1, wherein said electrophotographic photosensitive member is in the form of a cylindrical photosensitive drum, and said guide to be positioned is disposed coaxially with said electrophotographic photosensitive member.

3. A mechanism according to claim 1, wherein a portion to be positioned of said guide is generally arcuate, and the portion to be urged is generally arcuate and coaxial with the portion to be positioned.

4. A mechanism according to claim 3, wherein the portion to be positioned and the portion to be urged are substantially coaxial with a rotational axis of said electrophotographic photosensitive member.

5. A mechanism according to claim 1, wherein said assisting means is provided with a pivotal shaft configured and positioned to rotatably support said assisting means, and a vector of an urging force urging said guide to be positioned to said positioning means passes substantially through a center of said pivotal shaft.

6. An electrophotographic image forming apparatus to which a process cartridge is detachably mountable, the process cartridge including an electrophotographic photosensitive member, a guide to be positioned, and process means actable on the electrophotographic photosensitive member, said apparatus comprising:

an opening through which the process cartridge is inserted into a main assembly of said apparatus and is removed from said main assembly of said apparatus;

an opening and closing member configured and positioned to open and close said opening;

a cartridge mounting member configured and positioned to demountably mount the process cartridge;

mounting member holding means for movably holding said cartridge mounting member in interrelation with an operation of said opening and closing member at a first position in which the process cartridge is detachably mountable with said opening and closing member being in an open state and at a second position in which the process cartridge is capable of performing an operation for image formation with said opening and closing member being in a closing state;

process cartridge supporting means for supporting the process cartridge at the second position;

wherein said process cartridge supporting means is positioning means engageable with said guide to be positioned; and assisting means for urging a portion to be urged of the process cartridge to position the guide to be positioned relative to said positioning means which is positioned at the second position, wherein the guide to be positioned and the portion to be urged are provided at one end of the process cartridge with respect to a longitudinal direction of the electrophotographic photosensitive member;

wherein said assisting means functions to urge the portion to be urged in a closing operation of said opening and closing member, and said assisting means releases the portion to be urged in an opening operation of said opening and closing member.

7. An apparatus according to claim 6, wherein said assisting means is provided with a pivotal shaft configured and positioned to rotatably support said assisting means, and a vector of an urging force urging the guide to be positioned to said positioning means passes substantially through a center of said pivotal shaft.

8. A process cartridge detachably mountable to a main assembly of an electrophotographic image forming apparatus, comprising:

a cartridge frame;

an electrophotographic photosensitive drum;

process means actable on said electrophotographic photosensitive drum;

a cartridge frame portion provided at one axial end of said electrophotographic photosensitive drum;

a cartridge positioning portion configured and positioned to position said process cartridge to the main assembly of the apparatus when said process cartridge is mounted to the main assembly of the apparatus, said cartridge positioning portion being projected outwardly from said cartridge frame portion coaxially with said electrophotographic photosensitive drum at one axial end of said electrophotographic photosensitive drum and being engageable with a main assembly positioning portion provided in the main assembly of the apparatus; and a portion to be urged, provided on said cartridge frame portion at a position away from said cartridge positioning portion upstream of said cartridge positioning portion with respect to a mounting direction in which said process cartridge is mounted to the main assembly of the apparatus, said portion to be urged being urged by an urging portion provided in the main assembly of the apparatus to engage said cartridge positioning portion with the main assembly positioning portion when said process cartridge is mounted to a mounting position in the main assembly of the apparatus.

9. A process cartridge according to claim 8, wherein said portion to be urged is arcuate coaxially with said photosensitive drum.

10. A process cartridge according to claim 8 or 9, wherein said cartridge frame portion, said cartridge positioning portion and said portion to be urged are integrally molded from plastic resin material.

11. A process cartridge detachably mountable to a main assembly of an electrophotographic image forming apparatus, the apparatus including an opening and closing member, and a first main assembly guide and a second main assembly guide which are movable in interrelation with opening and closing operations of the opening and closing member, said process cartridge comprising:

an electrophotographic photosensitive drum;

process means actable on said electrophotographic photosensitive drum;

a first cartridge frame portion provided at one axial end of said electrophotographic photosensitive drum;

a first cartridge guide provided to project from said first cartridge frame portion, said first cartridge guide guiding said process cartridge in a mounting direction by movement of the first main assembly guide when said first cartridge guide is placed on the first main assembly guide;

a second cartridge frame portion provided at the other axial end of said electrophotographic photosensitive drum;

a second cartridge guide provided to project from said second cartridge frame portion, said second cartridge guide guiding said process cartridge in the mounting direction by movement of the second main assembly guide when said second cartridge guide is placed on the second main assembly guide;

a first cartridge positioning portion configured and positioned to position said process cartridge to the main assembly of the apparatus when said process cartridge is mounted to the main assembly of the apparatus, said first cartridge positioning portion being projected outwardly from said first cartridge frame portion coaxially with said electrophotographic photosensitive drum at one axial end of said electrophotographic photosensitive drum and being engageable with a main assembly positioning portion provided in the main assembly of the apparatus;

a second cartridge positioning portion configured and positioned to position said process cartridge to the main assembly of the apparatus when said process cartridge is mounted to the main assembly of the apparatus, said second cartridge positioning portion being projected outwardly from said second cartridge frame portion coaxially with said electrophotographic photosensitive drum at the other axial end of said electrophotographic photosensitive drum and being engageable with the main assembly positioning portion provided in the main assembly of the apparatus; and a portion to be urged, provided on said first cartridge frame portion at a position away from said first cartridge positioning portion upstream of said first cartridge positioning portion with respect to the mounting direction, said portion to be urged being urged by an urging portion provided in the main assembly of the apparatus to engage said first cartridge positioning portion with the main assembly positioning portion when said process cartridge is mounted to a mounting position in the main assembly of the apparatus.

12. A process cartridge according to claim 11, wherein said portion to be urged is arcuate coaxially with said electrophotographic photosensitive drum.

13. A process cartridge according to claim 11 or 12, wherein said first and second cartridge frame portions, said first and second cartridge positioning portions, and said portion to be urged are integrally molded from plastic resin material.

14. A process cartridge according to claim 13, further comprising at the other axial end of said electrophotographic photosensitive drum a driving force receiving portion configured and positioned to receive a driving force for rotating said electrophotographic photosensitive drum from the main assembly of the apparatus when said process cartridge is mounted to the main assembly.

15. A process cartridge according to claim 14, wherein said driving force receiving portion is in the form of a substantially triangular twisted prism which is engageable with a twisted hole provided in the main assembly of the apparatus and has a substantially triangular section taken along plane crossing with an axis thereof to receive the driving force.

16. A process cartridge according to claim 11 or 12, wherein a trailing edge of said first cartridge guide and a trailing edge of said second cartridge guide as seen in a longitudinal direction of said electrophotographic photosensitive drum, are disposed upstream of a center of gravity of said process cartridge with respect to the mounting direction, and wherein a leading end of said first cartridge guide and a leading end of said second cartridge guide are disposed downstream of the center of gravity of said process cartridge.

17. A process cartridge according to claim 11 or 12, wherein when said process cartridge is at a position in the main assembly of the apparatus in which an image forming operation is capable of being performed, the leading end of said first cartridge guide and the leading end of said second cartridge guide are disposed downstream of a vertical plane passing through an axis of said electrophotographic photosensitive drum with respect to the mounting direction.

18. A process cartridge according to claim 17, wherein the trailing edge of said first cartridge guide comprises a flat portion to be supported on the first main assembly guide, and an inclined surface portion inclined downwardly toward an upstream direction with respect to the mounting direction, and wherein a portion thereof where said flat portion to be supported and said inclined surface portion cross each other, is urged by the first main assembly guide in the mounting direction.

19. A process cartridge according to claim 11 or 12, wherein the trailing edge of said second cartridge guide comprises a flat portion to be supported on the second main assembly guide, and an inclined surface portion inclined downwardly toward an upstream direction with respect to the mounting direction, and wherein a portion thereof where said flat portion to be supported and said inclined surface portion cross each other, is urged by the second main assembly guide in the mounting direction.

20. A process cartridge according to claim 11 or 12, wherein said first cartridge guide is moved in the mounting direction while being placed on the first main assembly guide, and said second cartridge guide is moved in the mounting direction while being placed on the second main assembly guide, and wherein the movement of said first and second cartridge guides is resisted by a spring provided in the main assembly of the apparatus, and the trailing edge of said first cartridge guide is pressed by the first main assembly guide, and the trailing edge of said second cartridge guide is pressed by the second main assembly guide, and wherein when said process cartridge is positioned at the mounting position, said first cartridge guide and the first main assembly guide are spaced from each other, and said second cartridge guide and the second main assembly guide are spaced from each other.

21. A process cartridge according to claim 20, wherein said process cartridge is conveyed to a removing position by an opening operation of said opening and closing member while said first cartridge guide is placed on the first main assembly guide, and said second cartridge guide is placed on the second main assembly guide, and wherein when said process cartridge is conveyed to the removing position, a lower surface thereof abuts a projection provided in the main assembly of the apparatus, such that a downstream portion with respect to the removing direction is raised upwardly.

22. A process cartridge according to claim 11 or 12, wherein said process means further includes at least one of developing means for developing an electrostatic latent image formed on said electrophotographic photosensitive drum, charging means for electrically charging said electrophotographic photosensitive drum, and cleaning means for removing developer remaining on said electrophotographic photosensitive drum.

23. An electrophotographic image forming apparatus comprising:

a main assembly; and a process cartridge detachably mountable to said main assembly, (i) said main assembly comprising:

a main assembly positioning portion; and an urging portion;

(ii) said process cartridge comprising:

a cartridge frame;

an electrophotographic photosensitive drum;

a process means actable on said electrophotographic photosensitive drum;

a cartridge frame portion provided at one axial end of said electrophotographic photosensitive drum;

a cartridge positioning portion configured and positioned to position said process cartridge to said main assembly of said electrophotographic image forming apparatus when said process cartridge is mounted to said main assembly of said electrophotographic image forming apparatus, said cartridge positioning portion being projected outwardly from said cartridge frame portion coaxially with said electrophotographic photosensitive drum at one axial end of said electrophotographic photosensitive drum and being engageable with said main assembly positioning portion provided in said main assembly of said electrophotographic image forming apparatus; and a portion to be urged, provided on said cartridge frame portion at a position away from said cartridge positioning portion upstream of said cartridge positioning portion with respect to a mounting direction in which said process cartridge is mounted to said main assembly of said electrophotographic image forming apparatus, said portion to be urged being urged by said urging portion provided in said main assembly of said electrophotographic image forming apparatus to engage said cartridge positioning portion with said main assembly positioning portion when said process cartridge is mounted to a mounting position in said main assembly of said electrophotographic image forming apparatus.

24. An electrophotographic image forming apparatus comprising:

a main assembly; and a process cartridge detachably mountable to said main assembly, (i) said main assembly comprising:

an opening and closing member; and a first main assembly guide and a second main assembly guide which are movable in interrelation with an opening and closing operation of said opening and closing member;

(ii) said process cartridge comprising:

an electrophotographic photosensitive drum;

process means actable on said electrophotographic photosensitive drum;

a first cartridge frame portion provided at one axial end of said electrophotographic photosensitive drum;

a first cartridge guide provided to project from said first cartridge frame portion, said first cartridge guide guiding said process cartridge in a mounting direction by movement of said first main assembly guide when said first cartridge guide is placed on said first main assembly guide;

a second cartridge frame portion provided at the other axial end of said electrophotographic photosensitive drum;

a second cartridge guide provided to project from said second cartridge frame portion, said second cartridge guide guiding said process cartridge in the mounting direction by movement of said second main assembly guide when said second cartridge guide is placed on said second main assembly guide;

a first cartridge positioning portion configured and positioned to position said process cartridge to said main assembly of said electrophotographic image forming apparatus when said process cartridge is mounted to said main assembly of said electrophotographic image forming apparatus, said first cartridge positioning portion being projected outwardly from said first cartridge frame portion coaxially with said electrophotographic photosensitive drum at one axial end of said electrophotographic photosensitive drum and being engageable with a main assembly positioning portion provided in said main assembly of said electrophotographic image forming apparatus;

a second cartridge positioning portion configured and positioned to position said process cartridge to said main assembly of said electrophotographic image forming apparatus when said process cartridge is mounted to said main assembly of said electrophotographic image forming apparatus, said second cartridge positioning portion being projected outwardly from said second cartridge frame portion coaxially with said electrophotographic photosensitive drum at the other axial end of said electrophotographic photosensitive drum and being engageable with the main assembly positioning portion provided in said main assembly of said electrophotographic image forming apparatus; and a portion to be urged, provided on one of said first and second cartridge frame portions at a position away from one of said first and second cartridge positioning portions upstream of one of said first and second cartridge positioning portions with respect to the mounting direction, said portion to be urged being urged by an urging portion provided in said main assembly of said electrophotographic image forming apparatus to engage one of said first and second cartridge positioning portions with the main assembly positioning portion when said process cartridge is mounted to a mounting position in said main assembly of said electrophotographic image forming apparatus.

25. An electrophotgraphic image forming apparatus to which a process cartridge is detachably mountable, the process cartridge including an electrophotographic photosensitive drum, process means actable on the electrophotographic photosensitive drum, a cartridge frame supporting the electrophotographic photosensitive drum and the process means, a cartridge guide provided to project from the cartridge frame, and a cartridge coupling member provided at one end portion of the electrophotographic photosensitive drum, said electrophotographic image forming apparatus comprising:

an opening through which the process cartridge is inserted into a main assembly of said apparatus and is removed from the main assembly of said apparatus;

an opening and closing member configured and positioned to open and close said opening;

a side plate constituting a side surface of said opening;

a guide rail provided on said side plate;

a main assembly guide movable in interrelation with opening and closing operations of the opening and closing member and movable when the process cartridge is placed in engagement therewith, said main assembly guide being provided on a surface which is opposite from a surface where the cartridge guide is engaged with said main assembly with respect to a direction of an axis of the electrophotographic photosensitive drum, said main assembly guide including a boss slidable on said guide rail, and said main assembly guide being capable of taking a first position for permitting mounting and demounting of the process cartridge and a second position for permitting the performance of an image forming operation of the process cartridge;

a main assembly coupling member positioned and configured to engage the cartridge coupling member to transmit a driving force from a driving source of said electrophotographic image forming apparatus to the cartridge coupling member, said main assembly coupling member being movable in a direction substantially perpendicular to a mounting direction in which the process cartridge is mounted to said electrophotographic image forming apparatus;

drive connecting means for performing engagement and disengagement between said main assembly coupling member and the cartridge coupling member by moving said main assembly coupling member in a direction substantially perpendicular to the mounting direction in interrelation with an opening and closing operation of said opening and closing member;

a cam plate rotatably supported on such a surface of said side plate as is provided with said main assembly guide with respect to the axial direction, said cam plate having a cam groove with which said boss is engageable; and a connecting member configured and positioned to connect said opening and closing member with said cam plate and to cooperate with said opening and closing member and said cam plate to constitute a quadric link, wherein said main assembly guide is moved and stopped by operations of said cam groove and said guide rail in accordance with opening and closing operations of said opening and closing member, and when said opening and closing member is closed, said main assembly guide on which the process cartridge is placed is moved from the first position to the second position by said drive connecting means, and then, said main assembly coupling member is contacted to the cartridge coupling member, and when said opening and closing member is opened, the engagement between said main assembly coupling member and the cartridge coupling member is released by said drive connecting means, and then, said main assembly guide on which the process cartridge is placed is moved from the second position to the first position.

26. An apparatus according to claim 25, further comprising holding means for preventing an operation of said drive connecting means during movement of said main assembly guide in interrelation with said opening and closing member.

27. An apparatus according to claim 25, wherein said drive connecting means includes:

an inner bearing member fixed on said side plate and rotatably supporting one end of said main assembly coupling member, said inner bearing member being provided with a cam surface at a side opposed to said main assembly coupling member;

an outer bearing member rotatably supporting the other end of said main assembly coupling member;

a coupling cam rotatably disposed between said inner bearing member and said main assembly coupling member and having a cam portion moving said main assembly coupling member in a direction of a rotational axis of said main assembly coupling member by engagement with said cam surface by rotation thereof; and a spring urging said main assembly coupling member toward said inner bearing member between said outer bearing member and said main assembly coupling member.

28. An apparatus according to claim 27, further comprising a timing member including:

an engaging portion configured and positioned to rotatably engage said coupling cam; and an elongated hole having:

a linear portion provided at an end portion adjacent to said engaging portion and slidably connecting with a boss provided on said cam plate;

an arcuate portion having a radius of curvature which is substantially equal to the turning radius of said boss on said cam plate; and an inclined portion connecting said linear portion and said arcuate portion, wherein when said cam plate is rotated, said boss on said cam plate moves in said elongated hole during movement of said main assembly guide, and said boss on said cam plate is in contact with an end of said linear portion of said elongated hole during rest of said main assembly guide and said coupling cam.

29. An apparatus according to claim 28, wherein said linear portion is substantially perpendicular to a line connecting said engaging portion and an end of said linear portion, and said inclined portion continues to a lower portion of said linear portion and is inclined downwardly, and said arcuate portion has a center substantially at a position of a rotational center of said cam plate when said boss on said cam plate is at said arcuate portion.

30. An apparatus according to claim 29, wherein said main assembly guide includes a projection projected from a free end of said boss of said main assembly guide, wherein said timing member is provided with an abutment surface abuttable to said projection of said main assembly guide, wherein said main assembly guide moves such that said projection moves upwardly in an initial stage of the opening movement of said opening and closing member, and rotates said timing member by abutment to the abutment surface to move said boss of said cam plate from the linear portion of said elongated hole to the inclined portion thereof.

31. An apparatus according to claim 30, wherein said timing member is provided with a recess contactable to a rib extending in a direction substantially perpendicular to said side plate, said recess and the rib constituting said holding means, wherein while the boss on said cam plate is at the arcuate portion or the inclined portion, a surface of said recess contacts said rib to prevent movement of said timing member.

* * * * *

UNITED STATES PATENT AND TRADEMARK OFFICE

CERTIFICATE OF CORRECTION

PATENT NO. : 6,917,774 B2
APPLICATION NO. : 10/098289
DATED : July 12, 2005
INVENTOR(S) : Ichiro Terada et al.

It is certified that error appears in the above-identified patent and that said Letters Patent is hereby corrected as shown below:

ON THE COVER PAGE
Item (54), Title, "PROCESS CARTRIDGE MOUNTING AND DEMOUNTING MECHANISM INCLUDING A GUIDE TO BE POSITIONED, A PROCESS CARTRIDGE DETACHABLY MOUNTABLE TO ELECTROPHOTOGRAPHIC IMAGE FORMING APPARATUS INCLUDING A GUIDE TO BE POSITIONED OR A CARTRIDGE POSITIONING PORTION, AND THE ELECTROPHOTOGRAPHIC IMAGE FORMING APPARATUS" should read --PROCESS CARTRIDGE MOUNTING AND DEMOUNTING MECHANISM, PROCESS CARTRIDGE AND ELECTROPHOTOGRAPHIC IMAGE FORMING APPARATUS--.

COLUMN 1
Line 1, "PROCESS CARTRIDGE MOUNTING AND DEMOUNTING MECHANISM INCLUDING A GUIDE TO BE POSITIONED, A PROCESS CARTRIDGE DETACHABLY MOUNTABLE TO ELECTROPHOTOGRAPHIC IMAGE FORMING APPARATUS INCLUDING A GUIDE TO BE POSITIONED OR A CARTRIDGE POSITIONING PORTION, AND THE ELECTROPHOTOGRAPHIC IMAGE FORMING APPARATUS" should read --PROCESS CARTRIDGE MOUNTING AND DEMOUNTING MECHANISM, PROCESS CARTRIDGE AND ELECTROPHOTOGRAPHIC IMAGE FORMING APPARATUS--.

COLUMN 9
Line 39, "recesses" should read --recess--.

COLUMN 14

Line 40, "is" should be deleted.

COLUMN 21
Line 41, "the." should read --the--.

Figure 16:
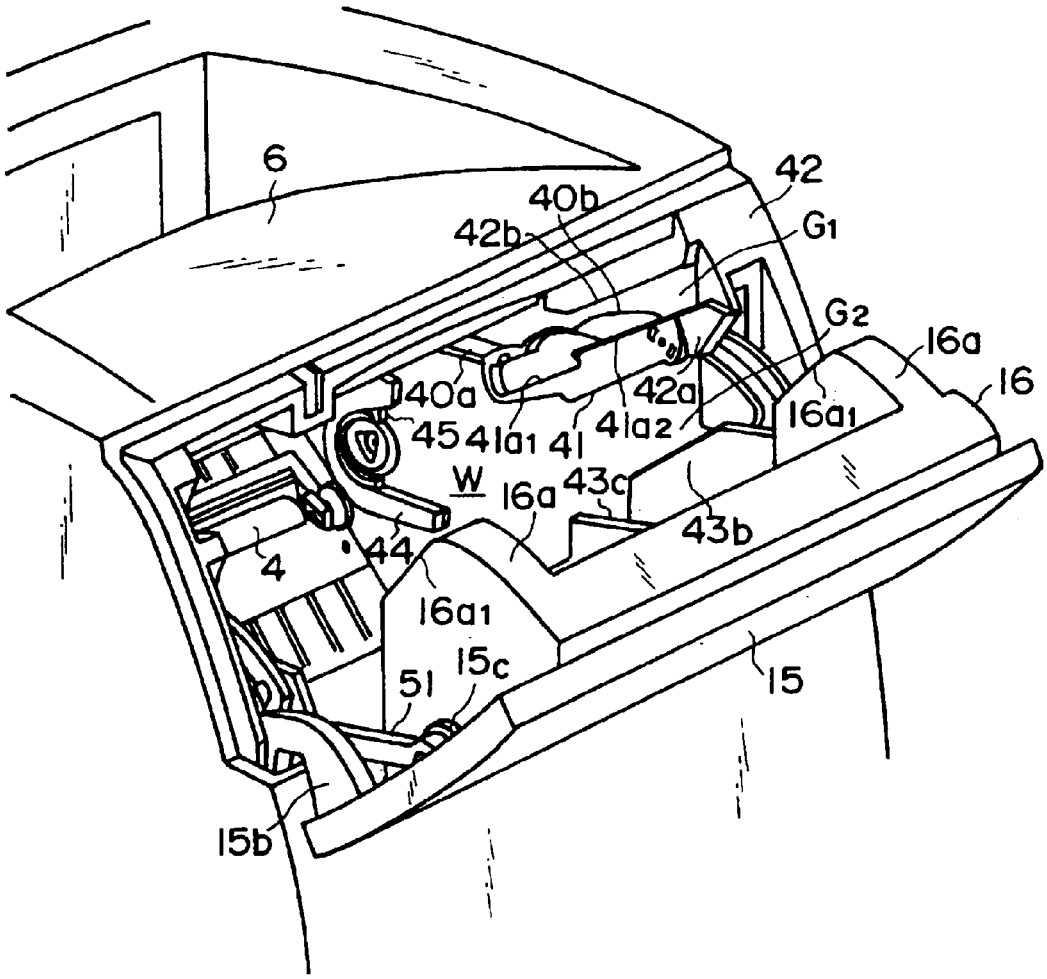
FIG. 16 is a perspective view of a process cartridge mounting-and-demounting mechanism.
Figure 25:
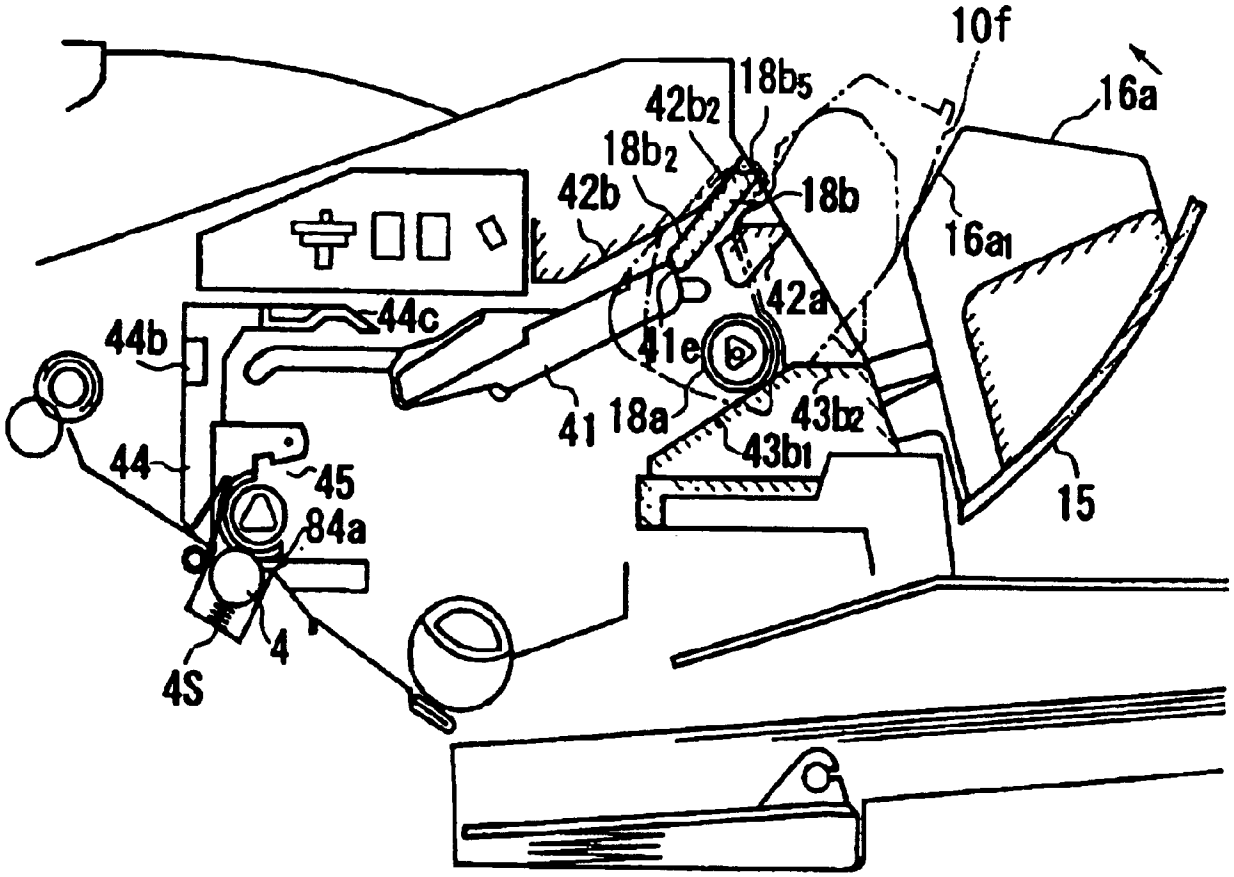
FIG. 25 is an illustration of an obstruction against insertion of the process cartridge into the process cartridge mounting-and-demounting mechanism in the process of opening and closing of the cover.

COLUMN 26
Line 7, "FIGS. 16 25" should read --FIGS. 16-25--.

COLUMN 28
Line 26, "guide," should read --guide--.
Line 28, "guide," should read --guide--.
Line 31, "CF," should read --CF--.

UNITED STATES PATENT AND TRADEMARK OFFICE

CERTIFICATE OF CORRECTION

PATENT NO. : 6,917,774 B2
APPLICATION NO. : 10/098289
DATED : July 12, 2005
INVENTOR(S) : Ichiro Terada et al.

It is certified that error appears in the above-identified patent and that said Letters Patent is hereby corrected as shown below:

COLUMN 31
Line 47, "41;" should read --41,--.
Line 49, "43b;" should read --43b,--.
Line 66, "Is" should be deleted.

COLUMN 32
Line 20, "FIGS. 26 49" should read --FIGS. 26-49--.

COLUMN 33
Line 13, "29 47." should read --29-47.--.

COLUMN 34
Line 44, "(FIGS. 38 44)." should read --FIGS. 38-44).--.

COLUMN 42
Line 54, "(FIGS. 27 42)." should read --(FIGS. 27-42).--.

COLUMN 48
Line 48, "FIGS. 54 57)," should read --FIGS. 54-57),--.

COLUMN 51
Line 33, "(FIGS. 54 55)." should read --(FIGS. 54-55).--.

UNITED STATES PATENT AND TRADEMARK OFFICE

CERTIFICATE OF CORRECTION

PATENT NO. : 6,917,774 B2
APPLICATION NO. : 10/098289
DATED : July 12, 2005
INVENTOR(S) : Ichiro Terada et al.

It is certified that error appears in the above-identified patent and that said Letters Patent is hereby corrected as shown below:

COLUMN 59
Line 13, "minimized" should read --be minimized--.
Lines 36-37, "oxide titanium," should read --titanium oxide,--.
Line 50, "width" should read --with a--.

COLUMN 62
Line 20, "FIGS 64 66," should read --FIGS. 64-66--.

Signed and Sealed this

Fifth Day of September, 2006

JON W. DUDAS
*Director of the United States Patent and Trademark Office*